US009202680B2

(12) United States Patent
Trimpin

(10) Patent No.: US 9,202,680 B2
(45) Date of Patent: Dec. 1, 2015

(54) MASS SPECTOMETRY USING LASERSPRAY IONIZATION

(75) Inventor: Sarah Trimpin, Detroit, MI (US)

(73) Assignee: Wayne State University, Detroit, MI (US)

( * ) Notice: Subject to any disclaimer, the term of this patent is extended or adjusted under 35 U.S.C. 154(b) by 24 days.

(21) Appl. No.: 13/376,132

(22) PCT Filed: Jun. 3, 2010

(86) PCT No.: PCT/US2010/037311
§ 371 (c)(1),
(2), (4) Date: Dec. 2, 2011

(87) PCT Pub. No.: WO2010/141763
PCT Pub. Date: Dec. 9, 2010

(65) Prior Publication Data

US 2012/0085903 A1 Apr. 12, 2012

Related U.S. Application Data

(60) Provisional application No. 61/348,676, filed on May 26, 2010, provisional application No. 61/307,352, filed on Feb. 23, 2010, provisional application No. 61/252,580, filed on Oct. 16, 2009, provisional application No. 61/251,247, filed on Oct. 13, 2009, provisional application No. 61/183,899, filed on Jun. 3, 2009.

(51) Int. Cl.
*H01J 49/00* (2006.01)
*H01J 49/16* (2006.01)
*H01J 49/04* (2006.01)

(52) U.S. Cl.
CPC ..... *H01J 49/164* (2013.01); *H01J 49/044* (2013.01); *H01J 49/0468* (2013.01)

(58) Field of Classification Search
None
See application file for complete search history.

(56) References Cited

U.S. PATENT DOCUMENTS 6,558,902 B1 * 5/2003 Hillenkamp ..... 506/6
6,646,253 B1 * 11/2003 Rohwer et al. ..... 250/288
7,034,292 B1 * 4/2006 Whitehouse et al. ..... 250/289
7,135,689 B2 * 11/2006 Truche et al. ..... 250/425

(Continued)

FOREIGN PATENT DOCUMENTS

CN 1695055 A 11/2005
CN 1695055 A * 11/2005

(Continued)

OTHER PUBLICATIONS

Frankevich, et al., "Probing the mechanisms of ambient ionization by laser-induced fluorescence spectroscopy," Rapid Commun. Mass Spectrom. 2012, 26, 1567-1572.

(Continued)

*Primary Examiner* — Andrew Smyth
(74) *Attorney, Agent, or Firm* — Lee & Hayes, PLLC; C. Rachal Winger

(57) ABSTRACT

Disclosed herein are systems and methods for mass spectrometry using laserspray ionization (LSI). LSI can create multiply-charged ions at atmospheric pressure for analysis and allows for analysis of high molecular weight molecules including molecules over 4000 Daltons. The analysis can be solvent-based or solvent-free. Solvent-free analysis following LSI allows for improved spatial resolution beneficial in surface and/or tissue imaging.

28 Claims, 159 Drawing Sheets

(56) References Cited

U.S. PATENT DOCUMENTS

| | | | | |
|---|---|---|---|---|
| 7,838,826 | B1 * | 11/2010 | Park | 250/288 |
| 7,858,926 | B1 * | 12/2010 | Whitehouse et al. | 250/281 |
| 2003/0148528 | A1 * | 8/2003 | Hillenkamp | 436/43 |
| 2003/0155498 | A1 * | 8/2003 | Kato | 250/281 |
| 2004/0023410 | A1 * | 2/2004 | Stacey | 436/173 |
| 2004/0026615 | A1 * | 2/2004 | Ellson et al. | 250/288 |
| 2004/0096820 | A1 * | 5/2004 | Rich et al. | 435/5 |
| 2005/0035287 | A1 * | 2/2005 | Jolliffe et al. | 250/288 |
| 2005/0077464 | A1 | 4/2005 | Truche | |
| 2005/0121537 | A1 * | 6/2005 | Ellson et al. | 239/102.2 |
| 2005/0139779 | A1 * | 6/2005 | Overney et al. | 250/423 P |
| 2005/0161613 | A1 * | 7/2005 | Truche et al. | 250/425 |
| 2005/0196786 | A1 * | 9/2005 | Levy | 435/6 |
| 2005/0199823 | A1 * | 9/2005 | Franzen | 250/425 |
| 2006/0057554 | A1 * | 3/2006 | Watling et al. | 435/4 |
| 2006/0118715 | A1 * | 6/2006 | Schneider et al. | 250/290 |
| 2006/0186334 | A1 * | 8/2006 | Jolliffe et al. | 250/288 |
| 2006/0223194 | A1 * | 10/2006 | Lopez-Avila et al. | 436/514 |
| 2008/0054176 | A1 | 3/2008 | Hiraoka | |
| 2008/0067345 | A1 * | 3/2008 | Fenn | 250/282 |
| 2008/0203289 | A1 * | 8/2008 | Lemaire et al. | 250/282 |
| 2008/0258052 | A1 * | 10/2008 | Jolliffe et al. | 250/282 |
| 2009/0078865 | A1 * | 3/2009 | Zapata et al. | 250/288 |
| 2009/0194687 | A1 * | 8/2009 | Jolliffe et al. | 250/288 |
| 2009/0289182 | A1 * | 11/2009 | Pevsner | 250/282 |
| 2010/0108879 | A1 * | 5/2010 | Bateman et al. | 250/283 |
| 2010/0267576 | A1 * | 10/2010 | Zhang et al. | 506/9 |

FOREIGN PATENT DOCUMENTS

| | | | | |
|---|---|---|---|---|
| CN | 1933092 | A | | 3/2007 |
| CN | 1933092 | A | * | 3/2007 |
| JP | 2003502803 | | | 1/2003 |
| JP | 2003315313 | | | 11/2003 |
| JP | 2004526161 | | | 8/2004 |

OTHER PUBLICATIONS

Baluya et al., "Automated MALDI Matrix Deposition Method With Inkjet Printing for Imaging Mass Spectrometry," *Anal. Chem.* 79:6862-6967, 2007.

Bedair et al., "Current and Emerging Mass-Spectrometry Technologies for Metabolomics," *Trends Anal. Chem.* 27:238-250, 2008.

Black, "Development of an Atmospheric Pressure Matrix-Assisted Laser Desorption/Ionisation Source for Mass Spectrometry," [online] May 2003, retrieved on Jul. 22, 2010]. Retrieved from the Internet: <http://swan.ac.uklnmsscJIMS/PhD%20Theses%20AGBIBlackClaudie%20thesis.pdf.>.

Boher et al., "Biomolecule Analysis by Ion Mobility Spectrometry," *Ann. Rev. Anal. Chem.* 1:293-327, 2008.

Chaurand et al., "Assessing Protein Patterns in Disease Using Imaging Mass Spectrometry," *J. Proteome Res.* 3, 245-252, 2004.

Chaurand et al., "Imaging Mass Spectrometry: A New Tool to Investigate the Spatial Organization of Peptides and Proteins in Mammalian Tissue Sections," *Curr. Opin. Chem. Biol.* 6:676-681, 2002.

Chaurand et al., "Molecular Imaging of Thin Mammalian Tissue Sections by Mass Spectrometry," *Curr. Opin. Biotechnol.* 17:431-436, 2006.

Chaurand et al., "New Developments in Profiling and Imaging of Proteins From Tissue Sections by MALDI Mass Spectrometry," *J. Proteome Res.* 5:2889-2900, 2006.

Chaurand et al., "Profiling and Imaging Proteins in Tissue Sections by MS," *Anal. Chem.* 76, 86A-93A, 2004.

Cooper et al., "The Role of Electron Capture Dissociation in Biomolecular Analysis," *Mass Spec. Rev.* 24:201-222, 2005.

Crecelius et al., "Three-Dimensional Visualization of Protein Expression in Mouse Brain Structures Using Imaging Mass Spectrometry," *J. Am. Soc. Mass Spec.* 16:1093-1099, 2005.

Crossman et al., "Investigation of the Profiling Depth in Matrix-Assisted Laser Desorption/Ionization Imaging Mass Spectrometry," *Rapid Commun. Mass Spec.* 20:284-290, 2006.

Deininger et al., "MALDI-Tissue Imaging At High Resolution and Speed: Essential Steps Towards Its Applications in Histology" Proceedings of the 57th ASMS Conf. on Mass Spec.and Allied Topics, Philadelphia, PA, Session: Developments in Imaging Instrumentation, Wednesday, Jun. 3, 2009, 4:10 pm.

Fournier et al., "Tissue Imaging Using MALDI-MS: A New Frontier of Histopathology Proteomics," *Expert Rev. Proteomics* 5:413-424, 2008.

Galicia et al., "Atmospheric Pressure Matrix-Assisted Laser Desorption/Ionization in Transmission Geometry," *Anal. Chem.* 74:1891-1895, 2002.

He et al., "Theoretical and Experimental Prospects for Protein Identification Based Solely on Accurate Mass Measurement," *J. Proteome Res.* 3:61-67, 2004.

http://www.vpglass.com/optical_glass/sodalime_glass.html.

Inutan and Trimpin "Laserspray Ionization-Ion Mobility Spectrometry-Mass Spectrometry: Baseline Separation of Isomeric Amyloids Without the Use of Solvents Desorbed and Ionized Directly From a Surface," *J. Proeome Res.* 9:6077-6081, 2010.

Jackson et al., "MALDI-Ion Mobility-TOFMS Imaging of Lipids in Rat Brain Tissue," *J. Mass Spec.* 42:1093-1098, 2007.

Jones et al., "Depth Profiling Brain Tissue Sections With a 40 Key C-60(+) Primary Ion Beam," *Anal. Chem.* 80:2125-2132, 2008.

Kaletas et al., "Sample Preparation Issues for Tissue Imaging by Imaging MS," *Proteomics* 9:2622-2633, 2009.

Karas and Hillenkamp "Laser Desorption Ionization of Proteins With Molecular Masses Exceeding 10 000 Daltons," *Anal. Chem.* 60:2299-2301, 1988.

Khatib-Shahidi et al., "Direct Molecular Analysis of Whole-Body Animal Tissue Sections by Imaging MALDI Mass Spectrometry," *Anal. Chem.* 78:6448-6456, 2006.

Koeniger et al., "Transfer of Structural Elements From Compact to Extended States in Unsolvated Ubiquitin," *J. Am. Chem. Soc.* 128(35):11713-9, 2006.

Laiko et al., "Atmospheric Pressure MALDI/Ion Trap Mass Spectrometry," *Anal. Chem.* 72:5239-5243, 2000.

Landgraf et al., "Imaging of Lipids in Spinal Cord Using Intermediate Pressure Matrix-Assisted Laser Desorption—Linear Ion Trap/Orbitrap," *MS. Anal. Chem.* 81:8488-8405, 2009.

Li et al., "Influence of Solvent Composition and Capillary Temperature on the Conformations of Electrosprayed Ions: Unfolding of Compact Ubiquitin Conformers From Pseudonative and Denatured Solutions," *Int. J. Mass Spec.* 185-187:37-37, 1999.

Liu et al., "Mapping the Human Plasma Proteome by SCX-LC-IMS-MS," *J. Am. Soc. Mass Spec.* 18:1249-1264, 2007.

Mackie, "Cannabinoid Receptors: Where They Are and What They Do" *J. Neuroendocrinol* 20(Suppl. 1):10-14, 2008.

McDonnell et al., "Imaging Mass Spectrometry" *Mass Spec. Reviews* 26:606-643, 2007.

McEwen et al., "Laserspray Ionization on a Commercial Atmospheric Pressure-MALDI Mass Spectrometer Ion Source: Selecting Singly or Multiply Charged Ions" *Anal. Chem.* 82:4988-5001, 2010.

Nemes et al., "Ambient Molecular Imaging and Depth Profiling of Live Tissue by Infrared Laser Ablation Electrospray Ionization Mass Spectrometry," *Anal. Chem.* 80:4575-4582, 2008.

Nordhoff et al., "Exploring the Limits and Losses in MALDI Sample Preparation of Attomole Amounts of Peptide Mixtures," *Int. J. Mass. Spec.* 268:139-146, 2007.

Ostrowski et al., "Mass Spectrometric Imaging of Highly Curved Membranes During Tetrahymena Mating," *Science* 305:71-73, 2004.

Pierson et al., "Molecular Profiling of Experimental Parkinson's Disease: Direct Analysis of Peptides and Proteins on Brain Tissue Sections by MALDI Mass Spectrometry," *J. Proteome Res.* 3:289-295, 2004.

Rohner et al., "MALDI Mass Spectrometric Imaging Biological Tissue Sections," *Mech. Ageing Dev.* 126:177-185, 2005.

Schwartz et al., "Direct Tissue Analysis Using Matrix-Assisted Laser Desorption/Ionization Mass Spectrometry: Practical Aspects of Sample Preparation," *J. Mass Spec.* 38:699-708, 2003.

Seeley et al., "Enhancement of Protein Sensitivity for MALDI Imaging Mass Spectrometry After Chemical Treatment of Tissue Sections" *J. Am. Soc. Mass Spec.* 19:1069-1077, 2008.

(56) References Cited

OTHER PUBLICATIONS

Stoeckli et al., "Imaging Mass Spectrometry: A New Technology for the Analysis of Protein Expression in Mammalian Tissues," *Nat. Med.* 7:493-496, 2001.
Sugiura et al., "Thin Sectioning Improves the Peak Intensity and Signal-To-Noise Ratio in Direct Tissue Mass Spectrometry," *J. Mass Spec. Soc.* Japan 54:45-48, 2006.
Takats et al., "Mass Spectrometry Sampling Under Ambient Conditions With Desorption Electrospray Ionization," *Science* 306:471-473, 2004.
Tan et al., "Atmospheric Pressure MALDI With Pulsed Dynamic Focusing for High-Efficiency Transmission of Ions Into a Mass Spectrometer" *Anal. Chem.* 76:2462-2469, 2004.
Tan et al., "Identification of Endogenous Acyl Amino Acids Based on a Targeted Lipidomics Approach," *J. Lipid Res.* 51:112-119, 2010.
Tanaka et al., "Protein and Polymer Analyses Up to M/Z 100 000 by Laser Ionization Time-Of-Flight Mass Spectrometry," *Rapid Commun. Mass Spec.* 2:151-153, 1998.
Touboul et al., "Changes in Phospholipid Composition Within the Dystrophic Muscle by Matrix-Assisted Laser Desorption/Ionization Mass Spectrometry and Mass Spectrometry Imaging," *Eur. J. Mass Spec.* 10:657-664, 2004.
Trimpin "A Perspective on MALDI Alternatives—Total Solvent-Free Analysis and Electron Transfer Dissociation of Highly Charged Ions by Laserspray Ionization," *J. Mass Spec.* 45:471-485, 2010.
Trimpin and Brizzard "Analysis of Insoluble Proteins," *Biotechniques* 46:409-419, 2009.
Trimpin and Deinzer, "Solvent-Free MALDI-MS for the Analysis of a Membrane Protein Via the Mini Ball Mill Approach: Case Study of Bacteriorhodopsin," *Anal. Chem.* 79:71-78, 2007.
Trimpin and Deinzer, "Solvent-Free MALDI-MS for the Analysis of Beta-Amyloid Peptides Via the Mini-Ball Mill Approach: Qualitative and Quantitative Advances," *J. Am. Soc. Mass Spec.* 18:1533-1543, 2007.
Trimpin et al., "Solvent-Free MALDI-MS: Developmental Improvements in the Reliability and the Potenial of MALDI in the Analysis of Synthetic Polymers and Giant Organic Molecules," *J. Am. Soc. Mass Spec.* 17:661-671, 2006.
Trimpin, "Total Solvent-Free Analysis and Tissue Imaging by Ion Mobility Spectrometry-Mass Spectrometry" 18th Intl. Mass Spectrometry Conf., Aug. 20-Sep. 4, 2009, Bremen, DE.(IMSA Conference).
Trimpin et al., "Automated Solvent-Free Matrix Deposition for Tissue Imaging by Mass Spectrometry" *Anal. Chem.* 82:359-367, 2010.
Trimpin et al., "Charge-Remote Fragmentation of Lithiated Fatty Acids on a TOF-TOF Instrument Using Matrix-Ionization," *J. Am. Soc. Mass Spec.* 18:1967-1972, 2007.
Trimpin et al., "Field-Free Transmission Geometry Atmospheric Pressure Matrix-Assisted Laser Desorption/Ionization for Rapid Analysis of Unadulterated Tissue Samples," *Rapid Commun. Mass Spec.* 23:3023-3027, 2009.
Trimpin et al., "Identification of Endogenous Phosphorylation Sites of Bovine Medium and Low Molecular Weight Neurofilament Proteins by Tandem Mass Spectrometry," *Biochem.* 43(7):2091-2105, 2004.
Trimpin et al., "Ion Mobility Spectrometry-Mass Spectrometry/Mass Spectrometry for Assessing the Molecular Compositions of Complex Polymeric Systems," *Anal. Chem.* 80:9073-9083, 2008.
Trimpin et al., "Laserspray Ionization—A New AP-MALDI Method for Producing Highly Charged Gas-Phase Ions of Peptides and Proteins Directly From Solid Solutions," *Mol. Cell. Proteomics* 9:362-367, 2010.
Trimpin et al., "Matrix-Assisted Laser Desorption/Ionization Mass Spectrometry Method for Selectively Producing Either Singly or Multiply Charged Molecular Ions," *Anal. Chem.* 82:11-15, 2010.
Trimpin et al., "Profiling of Phospholipids and Related Lipid Structures Using Multidimensional Ion Mobility Spectrometry-Mass Spectrometry," *Int. J. Mass Spectrom.* 287:58-69, 2009.
Wei et al., "Electrospray Sample Deposition for Matrix-Assisted Laser Desorptionlionization (MALDI) and Atmospheric Pressure MALDI, Mass Spectrometry With Attomole Detection Limits," *Rapid Commun. Mass Spec.* 18:1193-1200, 2004.
Winograd, "The Magic of Cluster SIMS," *Anal. Chem.* 77:142A-149A, 2005.
Wiseman et al., "Ambient Molecular Imaging by Desorption Electrospray Ionization Mass Spectrometry," *Nat. Protocols* 3:517-524, 2008.
Zimmerman et al., "Adapting the Stretched Sample Method From Tissue Profiling to Imaging," *Proteomics* 8:3809-3815, 2008.
Zydel et al., "Laserspray Ionization Using an Atmospheric Solids Analysis Probe for Sample Introduction" Submitted to *J. Am. Soc. Mass Spectrom.* 2010.
Galicia, et al., "Atmospheric Pressure Matrix-Assisted Laswer Desorption/Ionization in Transmission Geometry," Anal. Chem. 2002, 74, 1891-1895.
Translated Japanese Office Action mailed Apr. 22, 2014 for Japanese patent application No. 2012-514146, a counterpart foreign application of U.S. Appl. No. 13/376,132, 4 pages.
Office Action Dated Jun. 30, 2014 in Chinese Patent Application No. 201080024695.7.

* cited by examiner

*Peptides*
β-Amyloid (33-42)
MW 915.2

Lipotropin MW 951.1

Vasopressin
MW 1084.3

Solvent-free

Solvent-based

Dynorphin
MW 1137.4

Solvent-free

Solvent-based

β-Amyloid (1-11)
MW 1325.3

Solvent-free

Solvent-based

Substance P
MW 1347.8

Melittin
MW 2846.5

Solvent-free

Solvent-based

*Small proteins*
β-Amyloid (1-42)
MW 4511.3

Solvent-free

Solvent-based

*Small proteins*
Bovine insulin
MW 5733.5

*Lipids*

2-Arachidonoyl glycerol (2-AG)
MW 378.6

*Lipids*

***N*-Arachidonoyl gamma aminobutyric acid (NAGABA)**

MW 389.6

Solvent-free

Solvent-based

*Lipids*

Phosphatidyl inositol (PI)

MW 909.1

*Lipids*

Phosphatidyl cholin (PC)

MW 760.1

Mobility separation of aspirin and galactose as Li adducts

Note: Galactose peak broader than aspirin

Mobility Separation of O-AEA and N-AEA

The Adapter Set

The Ball Mill

Solvent-free DHB prep mouse brain

Solvent-free MALDI TOF/TOF of m/z 772.5 Da from Moust Brain Tissue

LSI: NAGly

LSI: Leu-Enkaphelin

LSI: Bradykinin

LSI: ACTH

LSI-IMS-MS/MS using Collision-Induced Dissociation Trap (m/z 747) Fragmentation

I) Total Solvent-free Analysis by LSI of a peptide and lipid mixture

II) IMS-MS by LSI of a peptide and lipid mixture

Drift Time (bins)
20
40
60
80
100
120
100
200
400
500
0
50
209.1787
195.1602
223.1992
238.2213
250.2241
264.2408
278.2597
292.2816
355.1404
181.1446

LSI - CID of different charge states

I) IMS-MS (SYNAPT G2) II) LTQ-ETD Velos (Thermo)

C 1

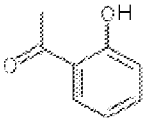
FIGURE 96
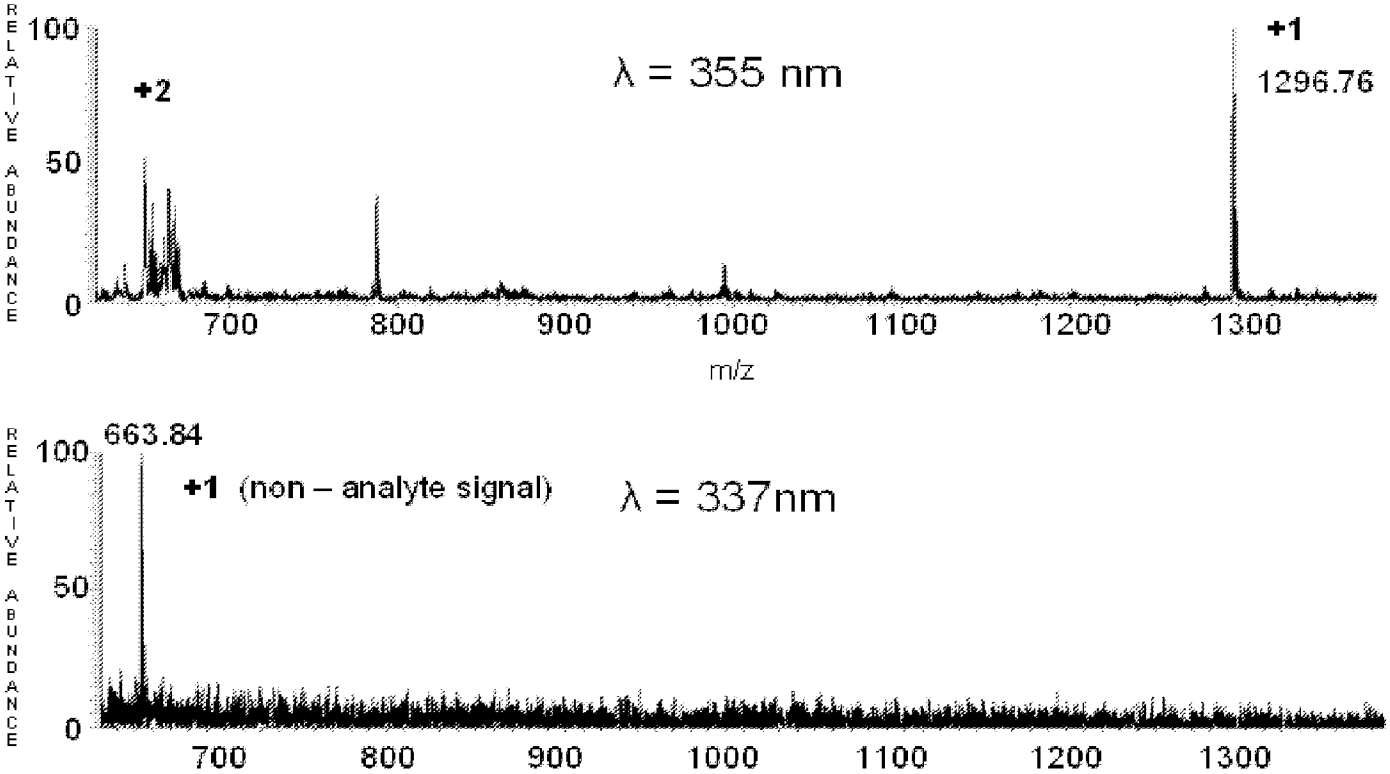

MALDI

ESI

Protein Mixture by LSI-IMS-MS

LSI and Cone Voltages

Analysis of Protein Complexes

Protein

Lysozyme

Protein Complex

Lysozyme+ Penta-N-acetylachitopentose

Total Solvent-free LSI-IMS-MS Analysis of Bovine Insulin

Solvent-based LSI-IMS-MS Analysis:
Defined Lipid/Peptide Mixture

Total Solvent-free LSI-IMS-MS Analysis: Defined Lipid/Peptide Mixture

FIGURE 136 B1
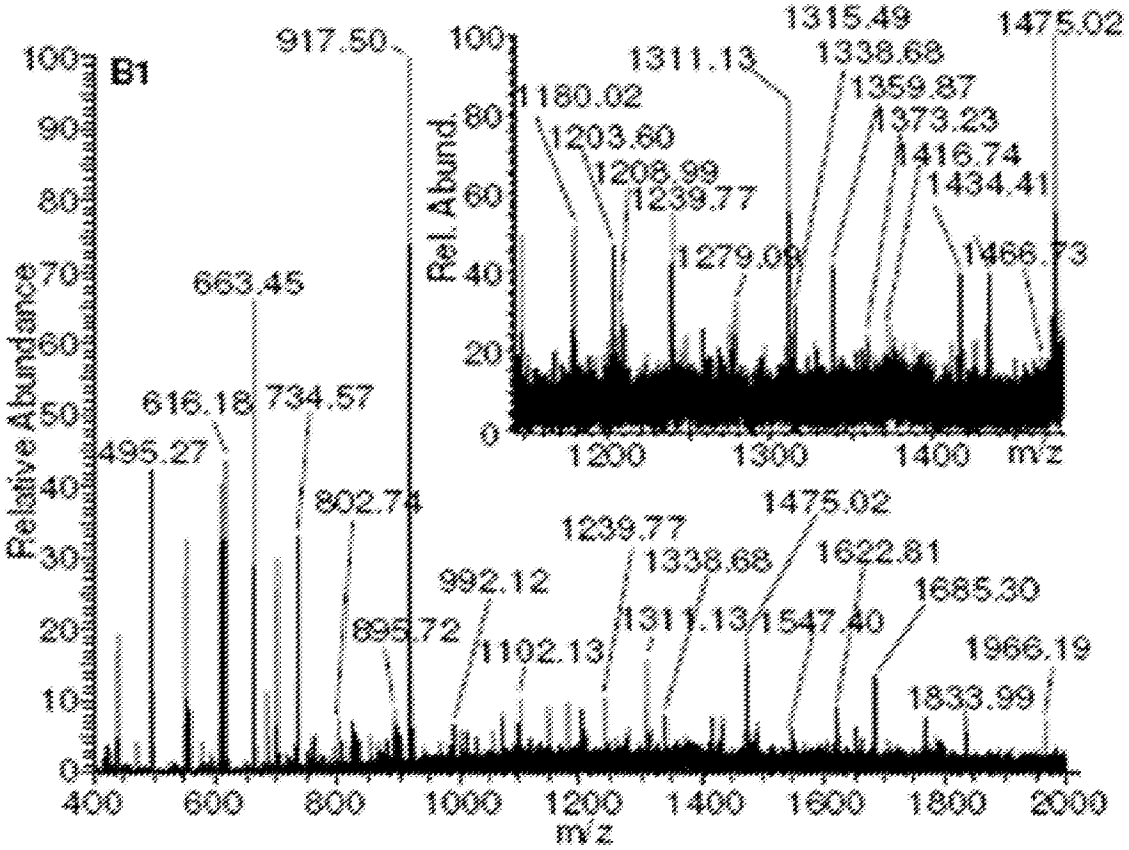

FIGURE 136B2
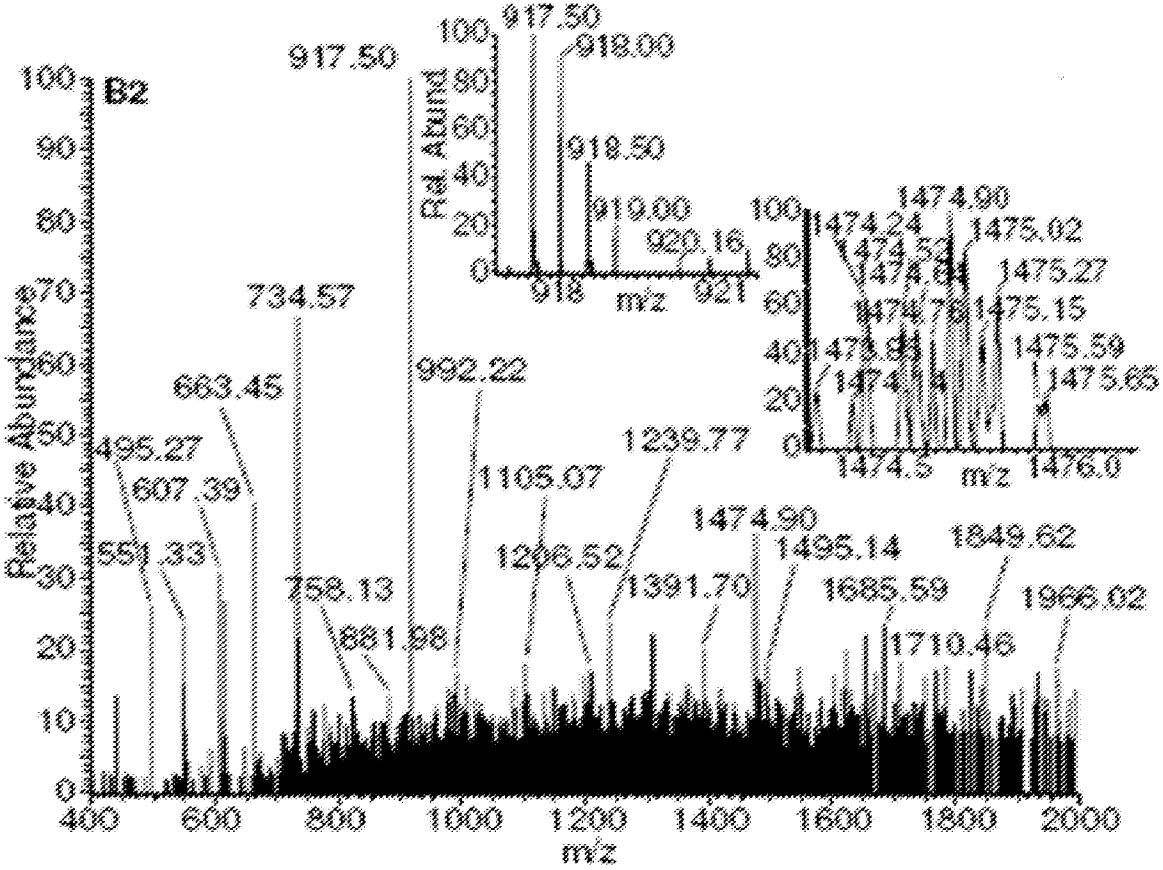

FIGURE 136B3
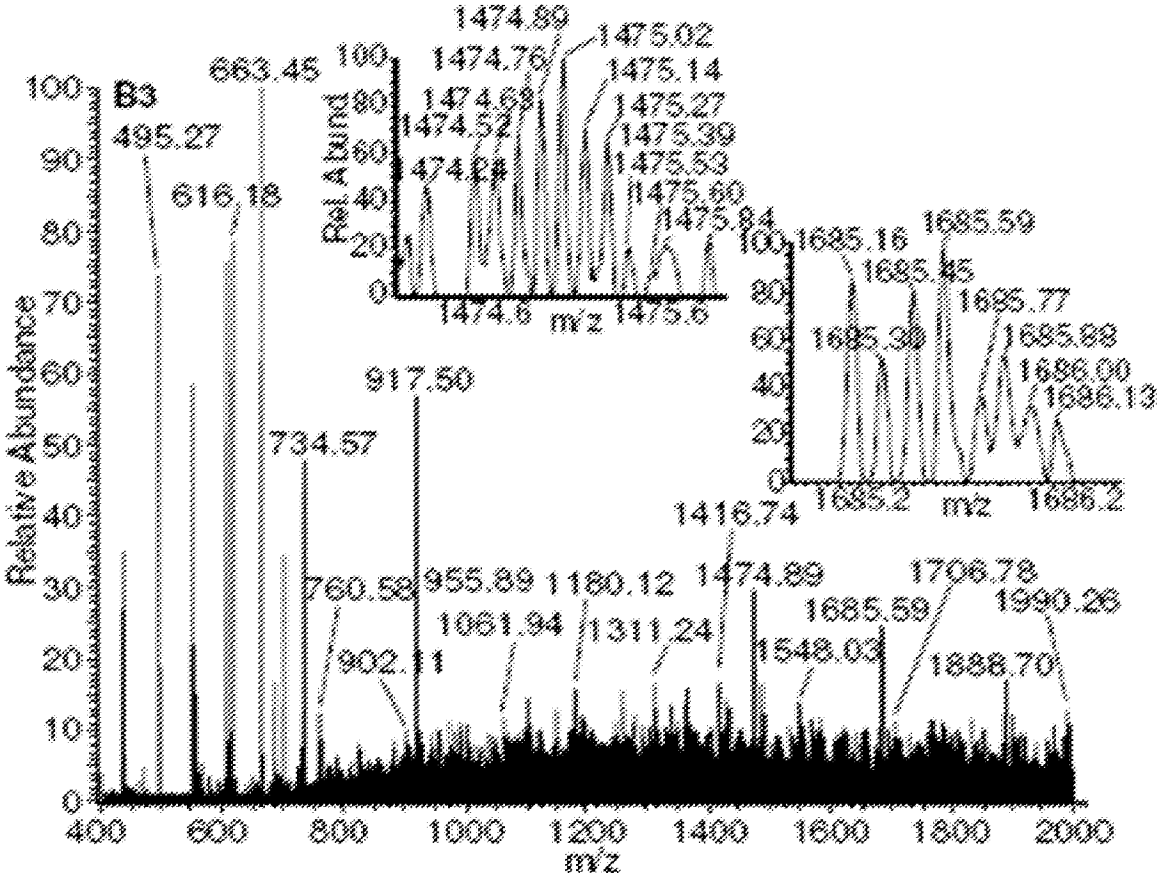

MASS SPECTOMETRY USING LASERSPRAY IONIZATION

CROSS REFERENCES TO RELATED APPLICATIONS

This application is a national phase of International Patent Application No. PCT/US2010/037311, filed on Jun. 3, 2010, which claims the benefit of United States (U.S.) Provisional Application No. 61/183,899, filed Jun. 3, 2009; U.S. Provisional Application No. 61/251,247, filed Oct. 13, 2009; U.S. Provisional Application No. 61/252,580, filed Oct. 16, 2009; U.S. Provisional Application No. 61/307,352, filed Feb. 23, 2010; and U.S. Provisional Application No. 61/348,676, filed May 26, 2010. U.S. Provisional Application No. 61/183,899, filed Jun. 3, 2009: U.S. Provisional Application No. 61/251,247, filed Oct. 13, 2009; U.S. Provisional Application No. 61/252,580, filed Oct. 16, 2009; U.S. Provisional Application No. 61/307,352, filed Feb. 23, 2010; and U.S. Provisional Application No. 61/348,676, filed May 26, 2010 are incorporated herein by reference in their entirety.

FIELD OF THE DISCLOSURE

Systems and methods for mass spectrometry using laserspray ionization (LSI) are disclosed herein. LSI can create multiply-charged ions at atmospheric pressure for analysis and allows for analysis of high molecular weight molecules including molecules over 4000 Daltons. The analysis can be solvent-based or solvent-free. Solvent-free analysis following LSI allows for improved spatial resolution beneficial in tissue imaging and analysis of solubility-restricted compounds.

BACKGROUND OF THE DISCLOSURE

Matrix-assisted laser desorption/ionization (MALDI) is an ionization technique used in mass spectrometry (MS) that allows for the analysis of many (bio)molecules. Ionization of the (bio)molecule is triggered by a laser while a matrix is used to protect the (bio)molecule from the laser. Appropriate matrix materials generally have a low molecular weight and are frequently acidic to provide a proton source to give preferentially positively charged (bio)molecular ions; basic matrix material can also be used to provide preferentially negatively charged (bio)molecular ions. Matrix materials also have good optical absorption at the laser wavelength employed so that they rapidly absorb laser irradiation. Solvents are also frequently used during this process.

Surface imaging has the potential to be immensely useful in areas as diverse as detecting cancer boundaries, determining drug uptake locations and in mapping signaling molecules in brain tissue or synthetic materials analysis (cracks in polymer composition). Imaging by MS is well established, especially using secondary ion mass spectrometry (SIMS), but SIMS is only marginally useful with intact biological tissue. MALDI MS, on the other hand, has been employed for tissue imaging with some success, especially for high-abundant components such as membrane lipids, drug metabolites, and proteins. However, there are a number of disadvantages in using such vacuum-based MALDI MS for tissue imaging, especially in relation to unadulterated tissue. Atmospheric pressure (AP)-MALDI tissue imaging circumvents many of the disadvantages of vacuum MALDI but is limited because of its sensitivity issues at high spatial resolution. Importantly, MALDI is noted as an ionization method for producing primarily singly charged ions for analysis by MS. Powerful MS instrumentation, however, often does not detect singly charged ions and as a result, AP-MALDI can be incompatible with high resolution mass spectrometers.

Traditional analysis methods using solvents also create a number of drawbacks. For example, while currently-used MALDI techniques can be used to analyze some (bio)molecules, a significant technical barrier remains for many (bio) molecules including proteins, that are frequently insoluble in common solvents. For example, some proteins such as membrane proteins are insoluble because they are hydrophobic. Moreover, misfolded proteins have exposed hydrophobic regions and can form insoluble aggregates. Many recombinant proteins, when overexpressed in a heterologous host, become insoluble because of misfolding or in the progression of disease states such as Alzheimer's Disease.

Moreover, in solvent-based MS sample preparation, artifacts can occur, such as oxidation of tryptophan and methionine residues (Cohen, Anal. Chem. 2006; 78:4352-4362; Froelich, et al, Proteomics 2008; 8:1334-1345). These artifacts can be produced in the same time period in which the solutions of sample and matrix are combined. Thus, solvent-based MS may not be optimal for applications related to understanding oxidative stress.

MS has suffered these and other drawbacks in its use in the characterization of materials because it is not able to analyze materials that are unadulterated, complex, ionization- or solubility-retarded. Biological materials are one type of such complex materials.

SUMMARY OF THE DISCLOSURE

The present disclosure provides systems and methods that improve material analysis and surface imaging (including tissue imaging) by mass spectrometry (MS). The systems and methods utilize laserspray ionization (LSI) methods that produce a number of multiply-charged ions more detectable by MS instrumentation rather than the predominantly singly-charged ions produced by conventional matrix-assisted laser desorption/ionization (MALDI). The laser aligned in transmission geometry improves the spatial resolution especially important for surface imaging analysis. MS following LSI can be either solvent-based or solvent-free. Solvent-free analysis following LSI avoids many of the drawbacks associated with solvent-based analysis noted above. Solvent-free analysis also allows for improved spatial resolution beneficial in MS surface imaging.

Particularly, one embodiment disclosed herein provides a method for producing multiply-charged ions for analysis of a material comprising applying the material and a matrix to a surface as a material/matrix analyte; ablating the material/matrix analyte at or near atmospheric pressure with a laser; and passing the laser-ablated material/matrix analyte through a heated region before the material/matrix analyte enters the high vacuum area of a mass spectrometer. The produced multiply-charged ions can be positive or negative.

In another embodiment, the matrix is composed of small molecules that absorb energy at the laser's wavelength. In another embodiment, the small molecules are selected from the group consisting of dihydroxybenzoic acids and dihydroxyacetophenones. In another embodiment, the small molecules are selected from the group consisting of 2,5-dihydroxybenzoic acid (2,5-DHB; an acidic matrix material); 2,5-dihydroxyacetophenone (2,5-DHAP); 2,6-dihydroxyacetophenone (2,6-DHAP); 2,4,6-trihydroxy acetophenone (2,4,6-THAP); a-cyano-4-hydroxycinnamic acid (CHCA); 2-aminobenzyl alcohol (2-ABA; a basic matrix material); and/or other small aromatic molecules with similar positional functionality.

In another embodiment, the laser has an output in the ultraviolet region. In another embodiment, the laser is a nitrogen laser (337 nm) or a frequency tripled Nd/YAG laser (355 nm).

In a further embodiment, the heated region is a heated tube. In particular embodiments, the heated tube is constructed of heat-tolerant material that does not emit vapors detrimental to the mass spectrometer vacuum system. In another embodiment, the tube is constructed of metal or quartz. The tube can be heated directly or indirectly. In some embodiments, it can be directly or indirectly heated to a temperature between 50-600° C. In another embodiment the tube can be heated directly or indirectly to a temperature between 150-450° C.

In another embodiment an electric field in the ion source region defined by the point of laser ablation of the material/matrix analyte and the ion entrance to the vacuum of the mass spectrometer is less than 800 V. In another embodiment, the electric field in the ion source region is less than 100 V. In another embodiment, the electric field in the ion source region is 0 V. In another embodiment, the electric field in the ion source region is less than 0 V.

The material can be a biological material or a non-biological material. In certain embodiments, the material is biological and can be, without limitation, a protein, a peptide, a carbohydrate or a lipid. In other embodiments, the material is non-biological and can be, without limitation, a polymer or an oil.

Embodiments disclosed herein can include analyzing the material/matrix analyte using solvent-free or solvent-based material/matrix analyte preparation methods. In one embodiment, the analyzing includes surface imaging and/or charge remote fragmentation for structural characterization. In another embodiment, a mass spectrometer is used to analyze the analyte in the material/matrix. The analysis can be performed in a positive or negative ion mode.

Laser ablation can be accomplished in transmission or reflective geometry. Transmission geometry minimizes the ablated area (e.g. subcellular in tissue).

The surface can be, without limitation, glass, quartz, ceramic, metal, polymer in reflective mode or glass, quartz, and/or polymer in transmission mode.

BRIEF DESCRIPTION OF THE DRAWINGS

FIG. 22A shows 100 magnification (500 μm scale bar) and an inset of 100 magnification (50 μm scale bar). FIG. 22B shows 10 μm scale bar with Scanning electron microscopy (SEM) magnification 3000×.

FIG. 42(A) shows RG and FIG. 42(B) shows TG.

FIG. 73A depicts mass spectrum and FIG. 73B depicts two-dimensional plot of drift time (td) vs. m/z of neat crude oil in 2,5-DHB under solvent-free conditions with heat (over 200° C).

FIGS. 78A-F depict the comparison of LSI-LTQ-MS analysis of: FIG. 78A LSI-MS of Mixture I using the DHAP matrix; FIG. 78B LSI-CID of GF (m/z=612.4) using the DHAP matrix; FIG. 78C LSI-CID of angiotensin 1 (m/z=648.9) using the DHAP matrix; FIG. 78D LSI-MS of Mixture I using the DHB matrix; FIG. 78E LSI-CID of GF using the DHB matrix; and FIG. 78F LSI-CID of antiotensin 1 using the DHB matrix.

FIG. 96 depicts LSI-MS spectra of angiotensin 1 ablated with DHAP matrix.

FIG. 120 depicts the results for LSI-IMS-MS of ubiquitin displayed in a 2-dimensional drift time vs. m/z plot.

FIG. 121 depicts the results for ESI-IMS-MS of ubiquitin displayed in a 2-dimensional drift time vs. m/z plot.

FIG. 122 depicts the extracted drift time distributions for all charges states of FIGS. 120 and 121.

FIG. 123 depicts the conditions used for the results displayed in FIGS. 124-127.

FIG. 124 depicts the MS obtained with increasing cone voltage showing an increase in ion abundance and lower charge states (charge stripping). Drift time distributions were extracted for charge states +9, +7, +5.

FIG. 125 depicts the drift time for charge state +9 extracted from FIG. 124.

FIG. 126 depicts the drift time for charge state +7 extracted from FIG. 124.

FIG. 127 depicts the drift time for charge state +5 extracted from FIG. 124.

FIG. 128 depicts LSI-IMS-MS drift time distributions of protein complexes (right panel) compared to the protein (left panel).

FIG. 129 depicts TSA of bovine insulin.

FIG. 130 depicts TSA of angiotensin 1.

FIG. 131 depicts solvent-based analysis of a defined of lipid (sphingomyelin, SM) and a peptide (angiotensin 1, Ang. I) in a molar ratio of 1:1.

Figure 132:
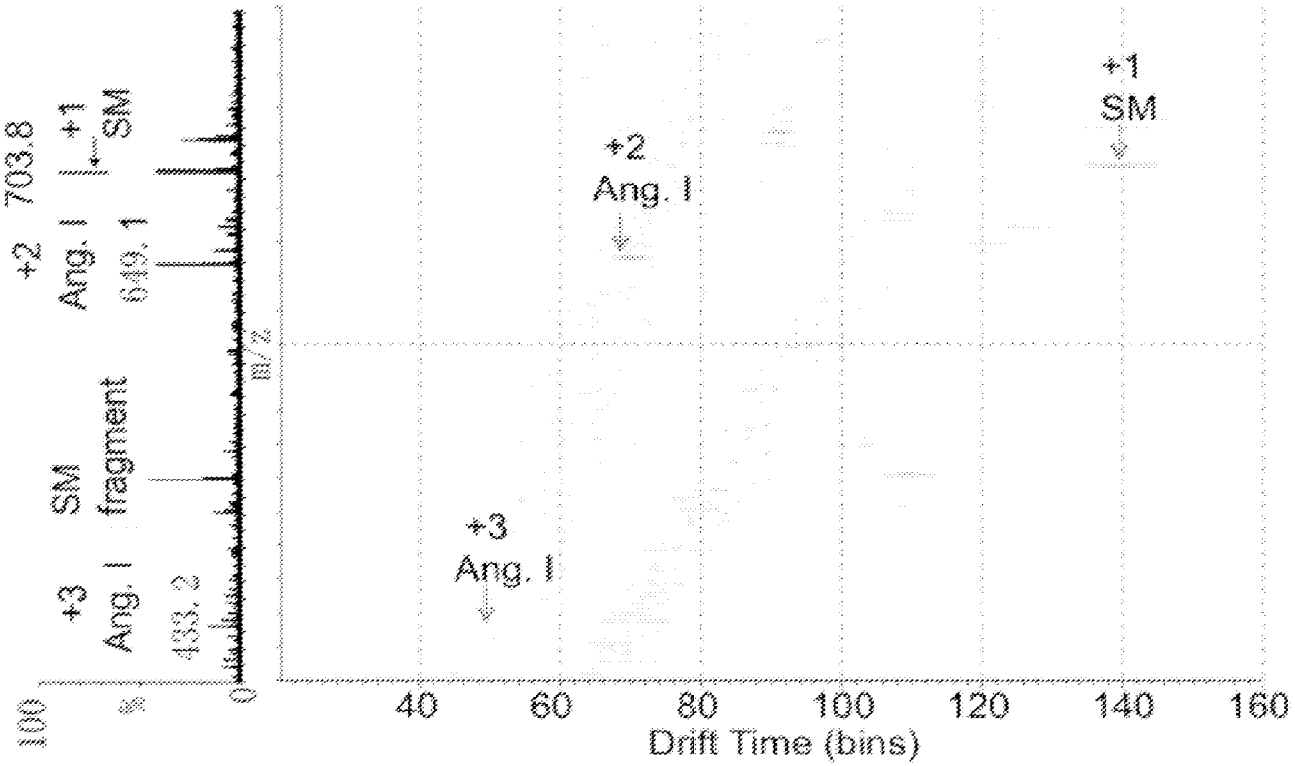

FIG. 132 depicts TSA analysis of a defined of lipid (sphingomyelin, SM) and a peptide (angiotensin 1, Ang. I) in a molar ratio of 1:1.

Figure 133:
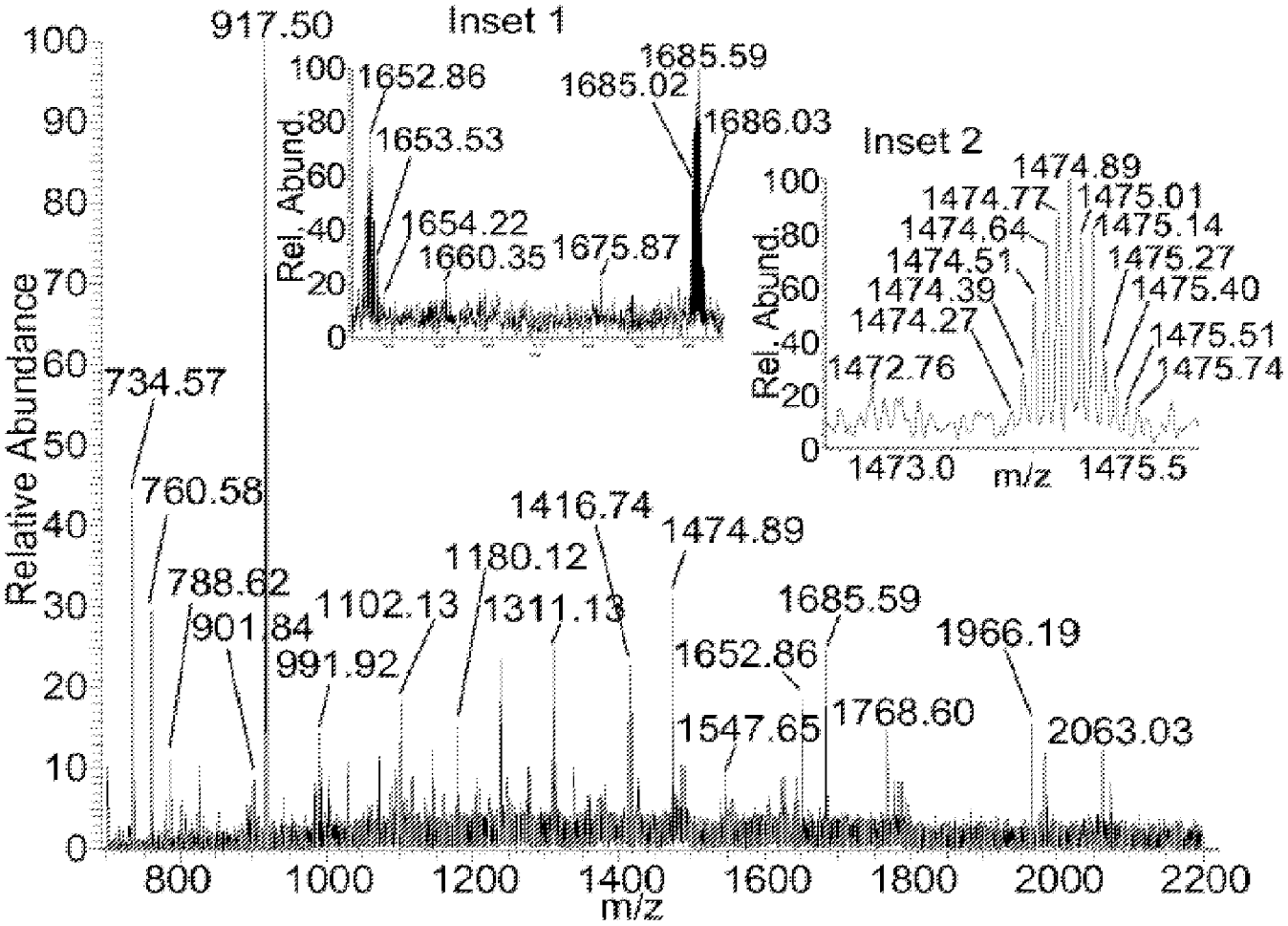

FIG. 133 depicts LSI-MS summed full and Inset mass spectra of delipified fresh tissue on a plain glass slide spotted with 2,5-DHAP matrix in 50:50 ACN/water showing multiple charged protein ions using the Orbitrap Exactive.

Figure 134:
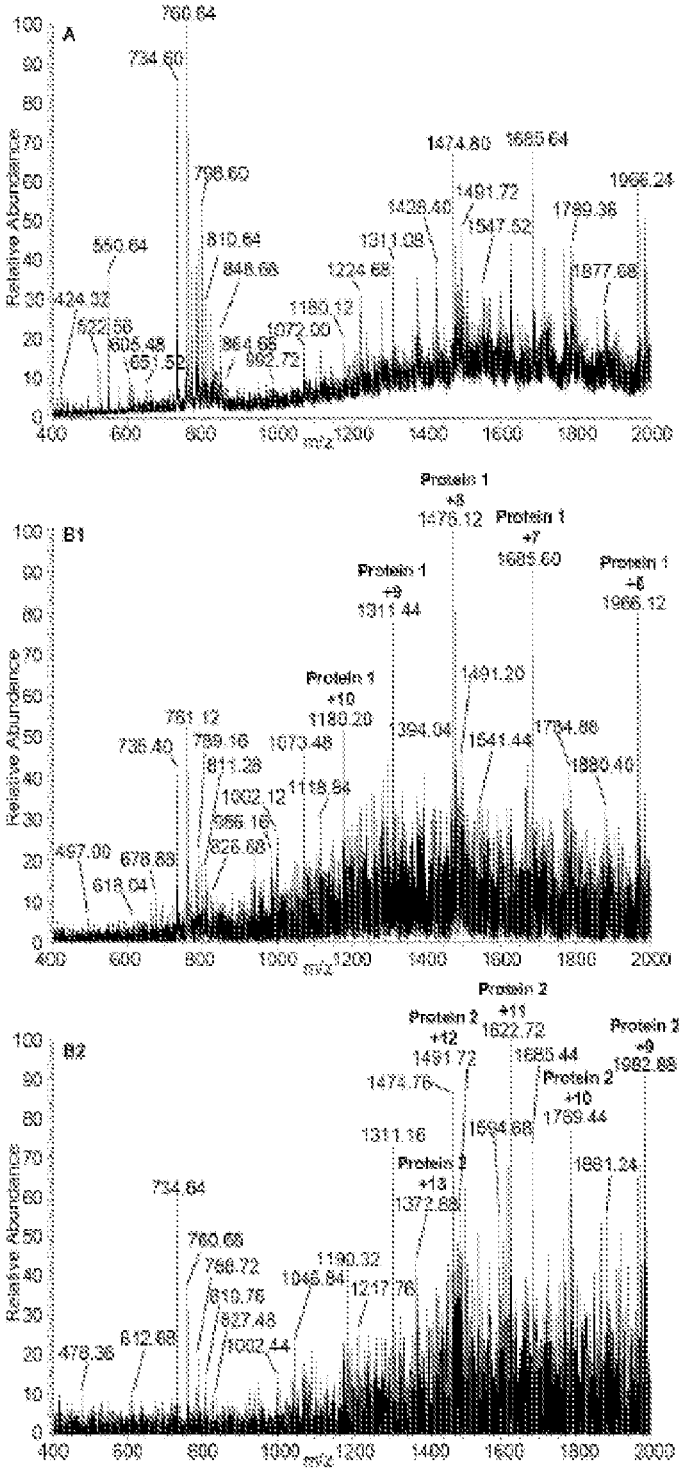

FIGS. 134A-B2 depict LSI-MS spectra of delipified fresh tissue on a plain glass slide spotted with 2,5-DHAP matrix in 50:50 ACN/water using the LTQ-Velos.

Figure 135:
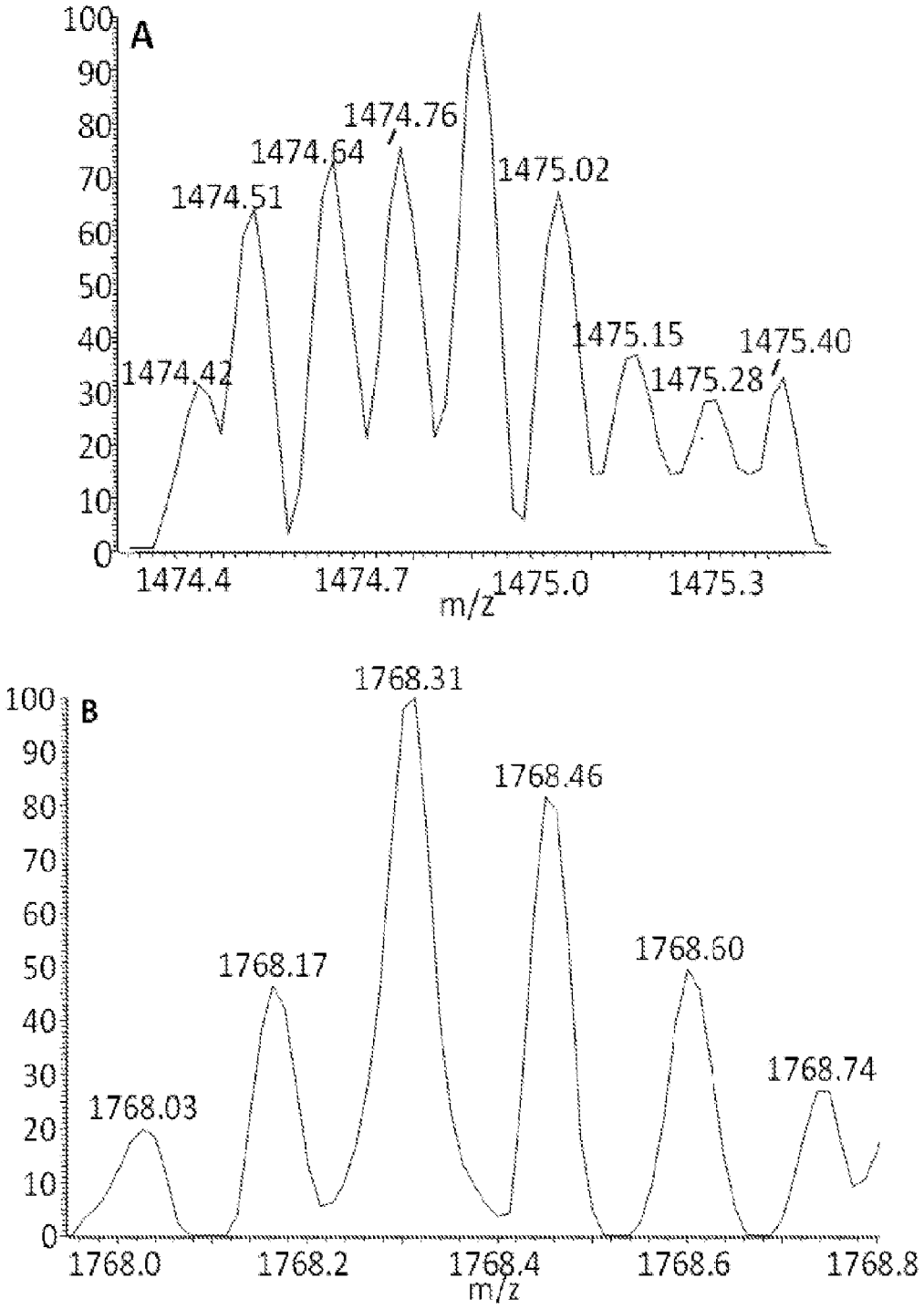

FIG. 135 depicts LSI MS showing isotopic distribution of the highest mass ions detected from the delipified aged tissue spotted with 2,5-DHAP in 50:50 ACN/water on a plain glass slide using the Orbitrap Exactive.

Figure 136A:
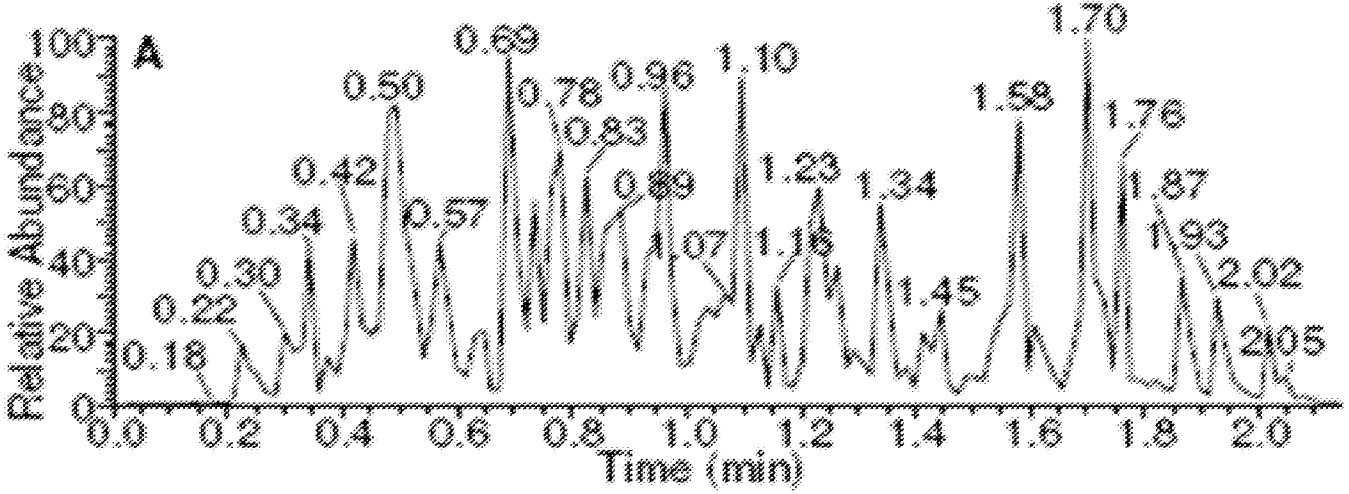

FIGS. 136A-B3 depict LSI MS of delipified fresh tissue on a gold coated glass slide spotted with 2,5-DHAP in 50:50 ACN/water on a plain glass slide using the Orbitrap Exactive.

Figure 137:
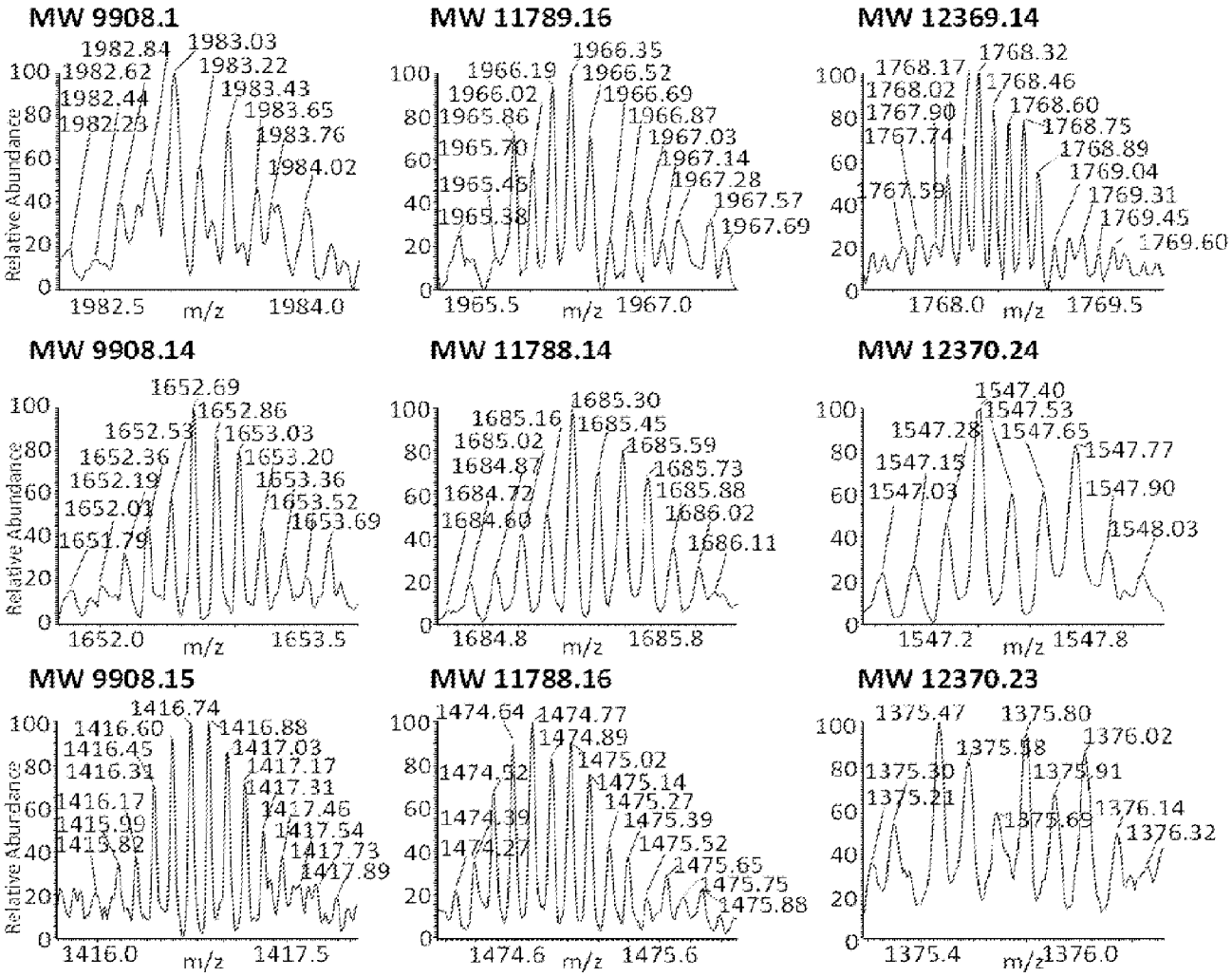

FIG. 137 depicts insets of LSI MS.

Figure 138:
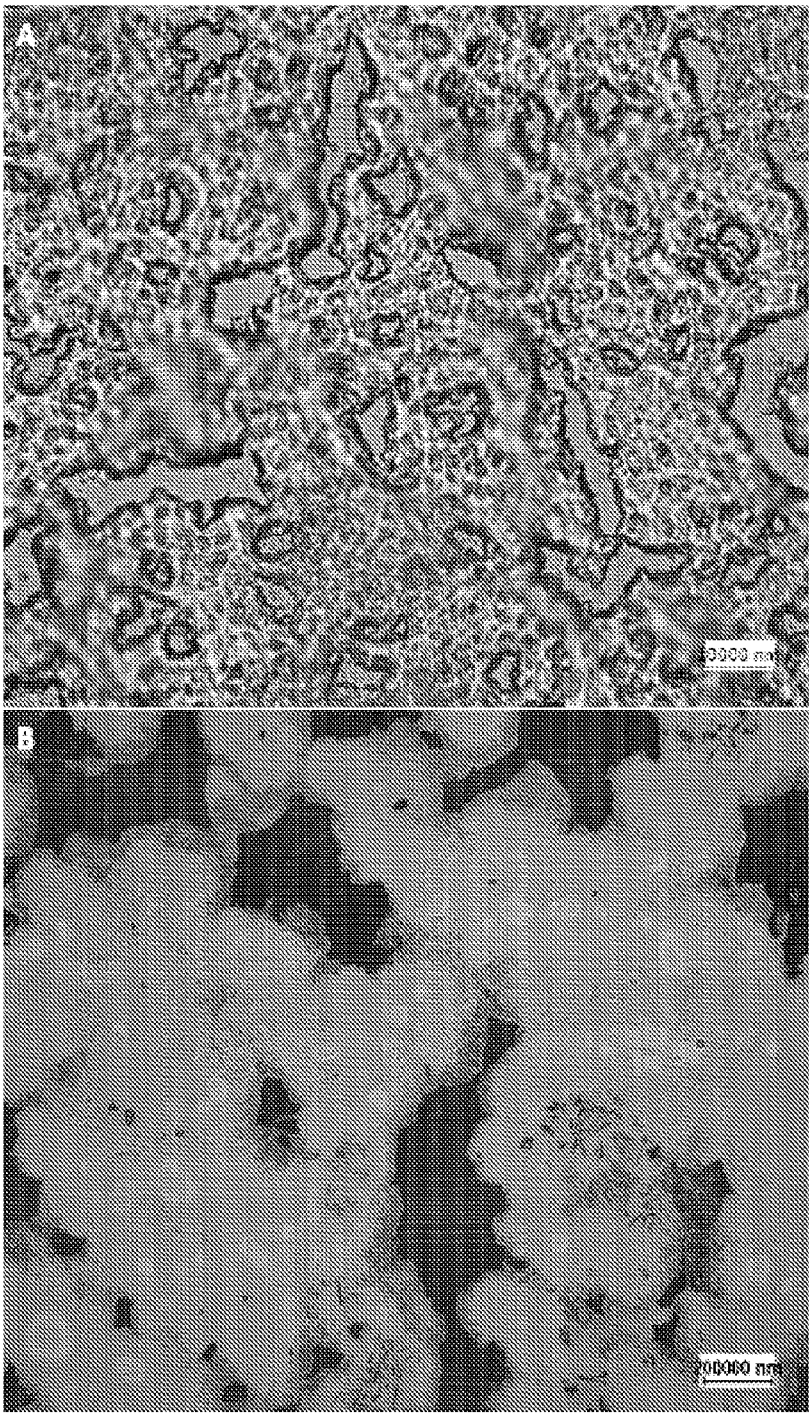

FIGS. 138A-B depict microscopy after laser ablation using LSI-IMS of delipified fresh tissue on a plain glass slide spotted with 2,5-DHAP matrix (100× magnification)(FIG. 138A) and 2,5-DHB (5× magnification) in 50:50 ACN/water (FIG. 138B).

Figure 139:
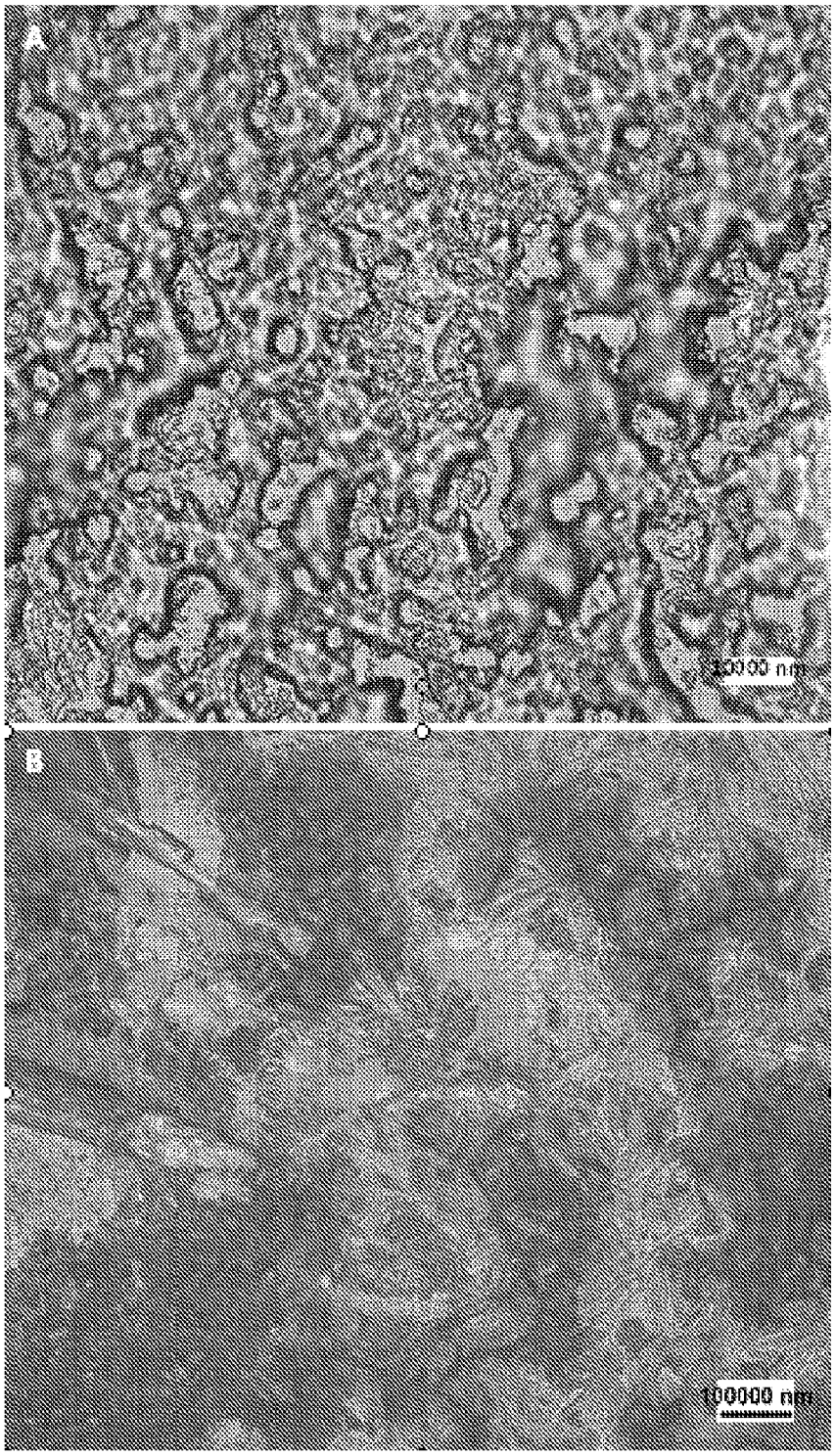

FIGS. 139A-B depict microscopy after laser ablation using LSI-IMS of delipified fresh tissue on a gold-coated glass slide spotted with 2,5-DHAP matrix (100× magnification)(FIG. 139A) and 2,5-DHB (10× magnification) in 50:50 ACN/water (FIG. 139B).

Figure 140:
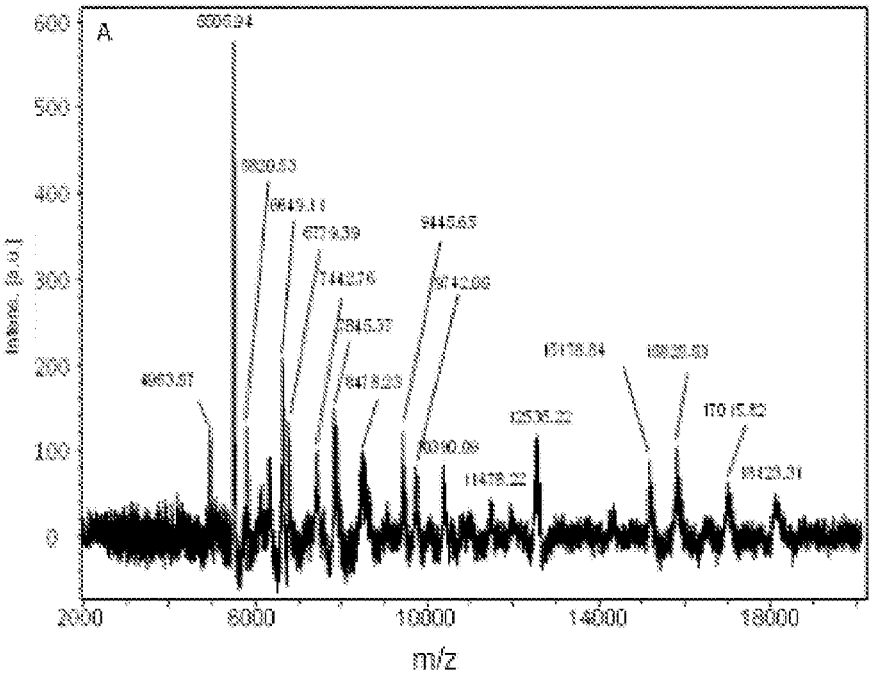
Figure 140:
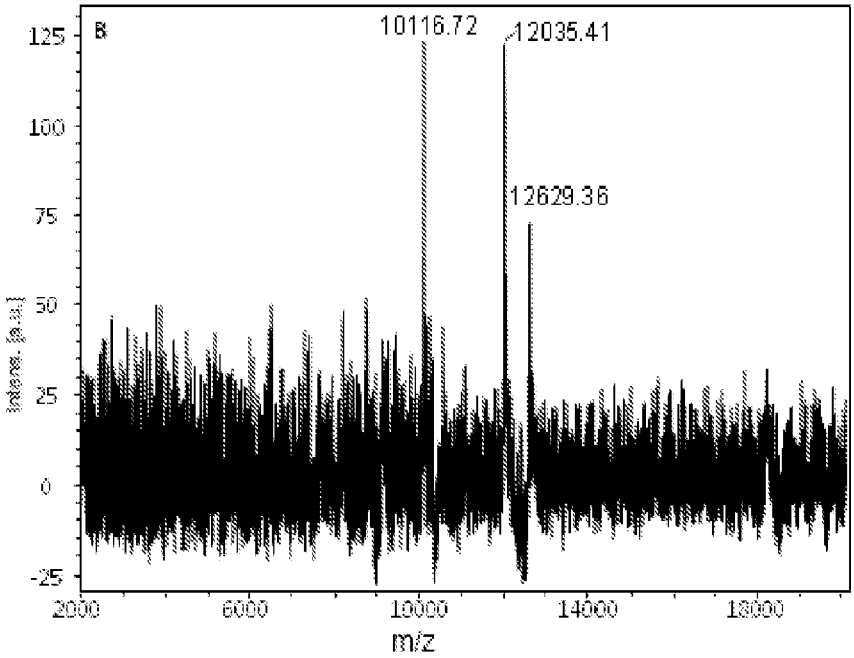

FIGS. 140A-B depict MALDI MS of delipified fresh tissue on a gold coated glass slide spotted with sinapinic acid in 50:50 ACN:water in 0.1% TFA (FIG. 140A) and 2,5-DHAP in 50:50 ACN:water (FIG. 140B).

Figure 141:
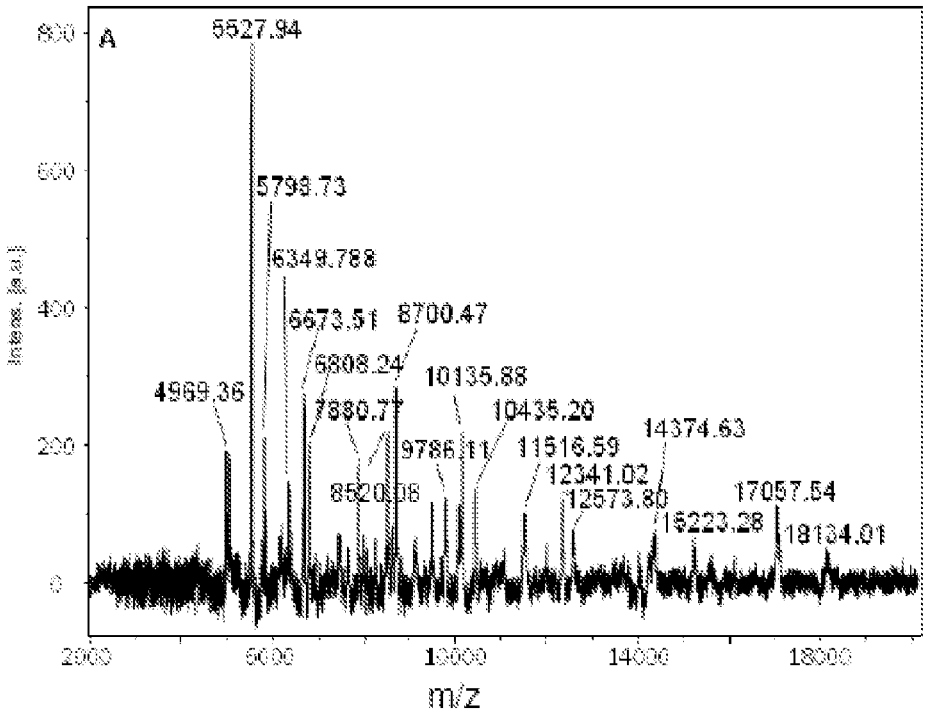
Figure 141:
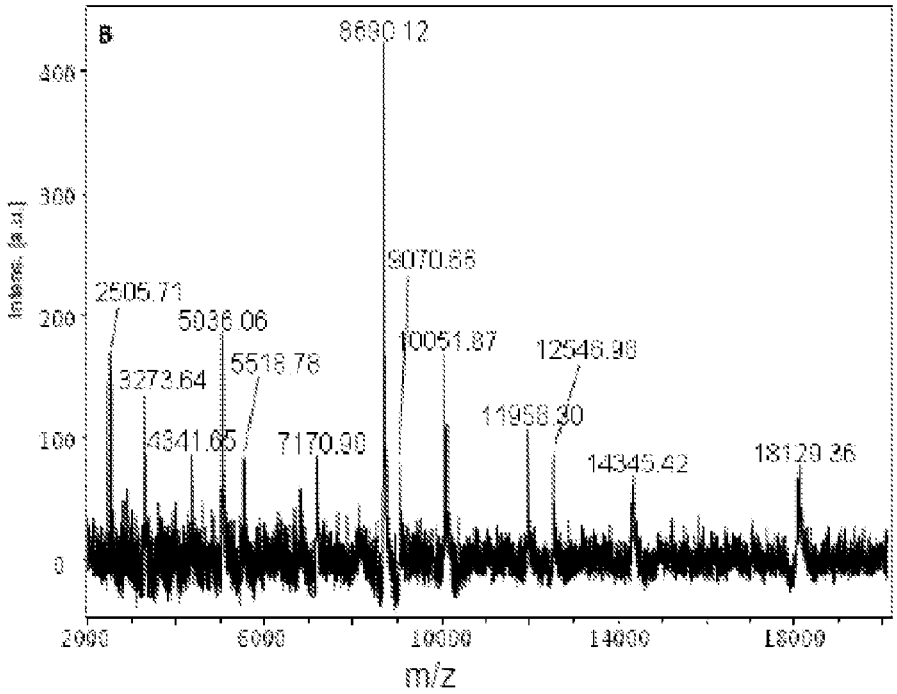

FIGS. 141A-B depict MALDI MS of delipified fresh tissue on a plain glass slide spotted with sinapinic acid in 50:50 ACN:water in 0.1% TFA (FIG. 141A) and 2,5-DHAP in 50:50 ACN:water (FIG. 141B).

DETAILED DESCRIPTION

Matrix-assisted laser desorption/ionization (MALDI) is an ionization technique used in mass spectrometry (MS) that allows for the analysis of many (bio)molecules. Imaging by MS is also well established, especially using secondary ion mass spectrometry (SIMS). SIMS, however, is only marginally useful with intact biological tissue or other surfaces. (AP)-MALDI imaging is similarly limited because of its sensitivity issues at high spatial resolution.

Conventional AP-MALDI produces primarily singly, or low charge state ions by laser ablation of a matrix/analyte. In AP-MALDI, a voltage is applied to the sample holder plate to help lift and focus the low charge state ions into the ion entrance aperture of the mass spectrometer. Commercial AP-MALDI sources reach maximum ion abundance with ~2000 V applied to the sample plate and produce few ions below ~500V. Normally, the sample support is positioned inside the ionization chamber so that the deposited sample is close to an inlet orifice of the interface between the ionization chamber and the spectrometer, and so that the sample can be illuminated by the laser beam in reflective geometry. This sample support is normally selected from the group comprising conductive materials. If the sample support is conductive, it is normally used as an electrode to provide an electric field that moves the ionized analyte from the target surface to the inlet orifice on the interface through which the ionized analyte enter the spectrometer.

Traditional analysis methods using solvents during MS also create a number of drawbacks. For example, many (bio) molecules including proteins, are frequently insoluble in common solvents. Moreover, misfolded proteins have exposed hydrophobic regions and can form insoluble aggregates. Many recombinant proteins, when overexpressed in a heterologous host, become insoluble because of misfolding or in the progression of disease states such as Alzheimer's Disease.

Moreover, in solvent-based MS sample preparation, artifacts can occur, such as oxidation of tryptophan and methionine residues (Cohen, Anal. Chem. 2006; 78:4352-4362; Froelich, et al, Proteomics 2008; 8:1334-1345). These artifacts can be produced in the same time period in which the solutions of sample and matrix are combined. Thus, solvent-based MS may not be optimal for applications related to understanding oxidative stress.

The present disclosure provides systems and methods that improve material analysis and surface imaging (including tissue imaging) by mass spectrometry (MS). The systems and methods utilize laserspray ionization (LSI) methods that produce a number of multiply-charged ions more detectable by MS instrumentation rather than the predominantly singly-charged ions produced by conventional matrix-assisted laser desorption/ionization (MALDI). The laser can be aligned in reflective or transmission geometry with respect to the sample holder, but when aligned in transmission geometry improves the spatial resolution especially important for surface imaging analysis. MS following LSI can be either solvent-based or solvent-free. Solvent-free analysis following LSI avoids many of the drawbacks associated with solvent-based analysis noted above. Solvent-free analysis also allows for improved spatial resolution beneficial in MS surface imaging.

The multiply charged ions of the present disclosure allow extending the mass range of high performance mass spectrometers which are often limited to a mass-to-a-charge (m/z) ratio of 4000. For singly charged ions, this limits the molecular weight to 4000 Daltons. Multiple charging can also provide improved fragmentation as was demonstrated using electron transfer dissociation (ETD).

Provided herein are methods for producing multiply-charged ions, similar to electrospray ionization (ESI), at or near atmospheric pressure, but using laser ablation of a matrix/analyte rather than an applied voltage and liquid solution as in ESI. A number of ESI-like methods such as desorption ESI (DESI), and AP-MALDI methods, can produce multiply charged ions but always in the presence of an electric field (usually kilovolts) and with liquid solvent. The methods disclosed herein allow for fast analysis (approx. 1 sec per sample) and accurate mass measurements (<5 ppm) by LSI. The methods further allow for mass specific surface imaging (including tissue imaging) by LSI and optionally solvent-free analysis. The methods also allow hyphenation of LSI with liquid separation, and relative quantitation by TSA. Other compound classes such as, without limitation, oligonucleotides, glycans, and glycoproteins can be analyzed by LSI.

No electric field is required to produce the multiply-charged ions by LSI and the high electric fields used with AP-MALDI can be detrimental to production of multiply charged ion production. In some embodiments, the laser ablated material can pass through a heated region before entering the high vacuum of the mass spectrometer used for mass analysis. Advantages of LSI are the use of a laser, thus high spatial resolution, either solvent-based or solvent-free sample preparation (solvent-free for solubility restricted compounds and for improved spatial resolution with tissue imaging), multiply charged ions extend the mass range of high performance mass spectrometers and improve fragmentation for structural analysis. LSI also allows rapid switching between multiply and singly charged ions. Switching solvent-free conditions also, at will, produce singly or multiply charged ions. It is expected that the spatial resolution can be enhanced when working at atmospheric pressure and in vacuum, aligning the laser from the back side in transmission mode.

The matrix can be any of a number of small molecules that absorb at the laser wavelength such as, without limitation, 2,5-dihydroxybenzoic acid (2,5-DHB), 2,5-dihydroxyacetophenone (2,5-DHAP), and 2-aminobenzyl alcohol (2-ABA) at 337 nm and 2,5-DHAP at 355 nm; and/or other small aromatic molecules with similar positional functionality. Materials/matrix can be employed to produce multiply charged ions that have low vapor pressure or are liquid at room temperature such as ethyl 2-amino benzoate ($N_2$ laser, 337 nm) or 2-hydroxyacetophenone (Nd/YAG laser, 355 nm). Matrix materials that are wet with solvents or even evaporated in solvents frequently produce multiply charged ions under the conditions of LSI.

The laser used for these experiments can be any laser with output in the ultraviolet region but is most typically a nitrogen laser (337 nm) or a frequency tripled Nd/YAG laser (355 nm).

In some embodiments, the heated region can be a heated tube through which the laser ablated material must pass in transient to vacuum. The tube can be of metal, quartz, or any heat tolerant material that does not emit vapors detrimental to the mass spectrometer vacuum system. In some embodiments, the tube can be heated, either directly or indirectly, from 50-600° C., or in one embodiment, between 125-450° C.

Electric fields in the ion source region defined by the point of laser ablation of the matrix/analyte and the ion entrance to the vacuum of the mass spectrometer, can be less than 500 V. In some embodiments, the electric field can be less than 100 V, or 0 V, or even −100 V.

The laser beam can strike the matrix analyte surface in a reflective geometry in which the laser strikes the sample from the same side as ablation (ablating toward the MS ion entrance aperture) or by passing the laser beam transmission geometry mode through a laser wavelength transparent sample holder to strike the sample from the opposite side of the matrix/analyte relative to laser ablation with the expanding matrix analyte plume toward the ion entrance aperture.

In reflective mode, metal or non-conducting surfaces such as, without limitation, metal, glass or plastic can be used as the sample holder, and in transmission geometry laser beam conducting materials such as, without limitation, glass, quartz, and plastic can be used as a sample holder.

Laser ablation of tissue with added matrix can produce multiply charged ions of, for example, proteins if the ion source voltages are low and a heated transfer region is applied. This can be especially valuable as it allows high performance mass spectrometers to be used for tissue imaging and at AP conditions.

A spectrum of proteins from tissue was obtained using this method with a mass resolution of 100,000 (a large increase over the previous resolution of 1000-2000), and mass accuracy of 5 ppm (as compared to previous mass accuracy of 25-100 ppm), allowing much improved protein identification.

Solvent-free matrix-assisted laser desorption/ionization (MALDI) analysis performed as described herein shows that homogeneous coverage can be obtained. The resultant homogenous sample consequently can produce ions from literally every laser spot, using less laser power because of the absence of variability in crystal sizes, thus effectively reducing chemical inhomogeneity ("sweat spots" or "hot spots", improving qualitative and quantitative aspects of mass measurements) undesired analyte fragmentation and chemical background (matrix signals).

Figure 56:
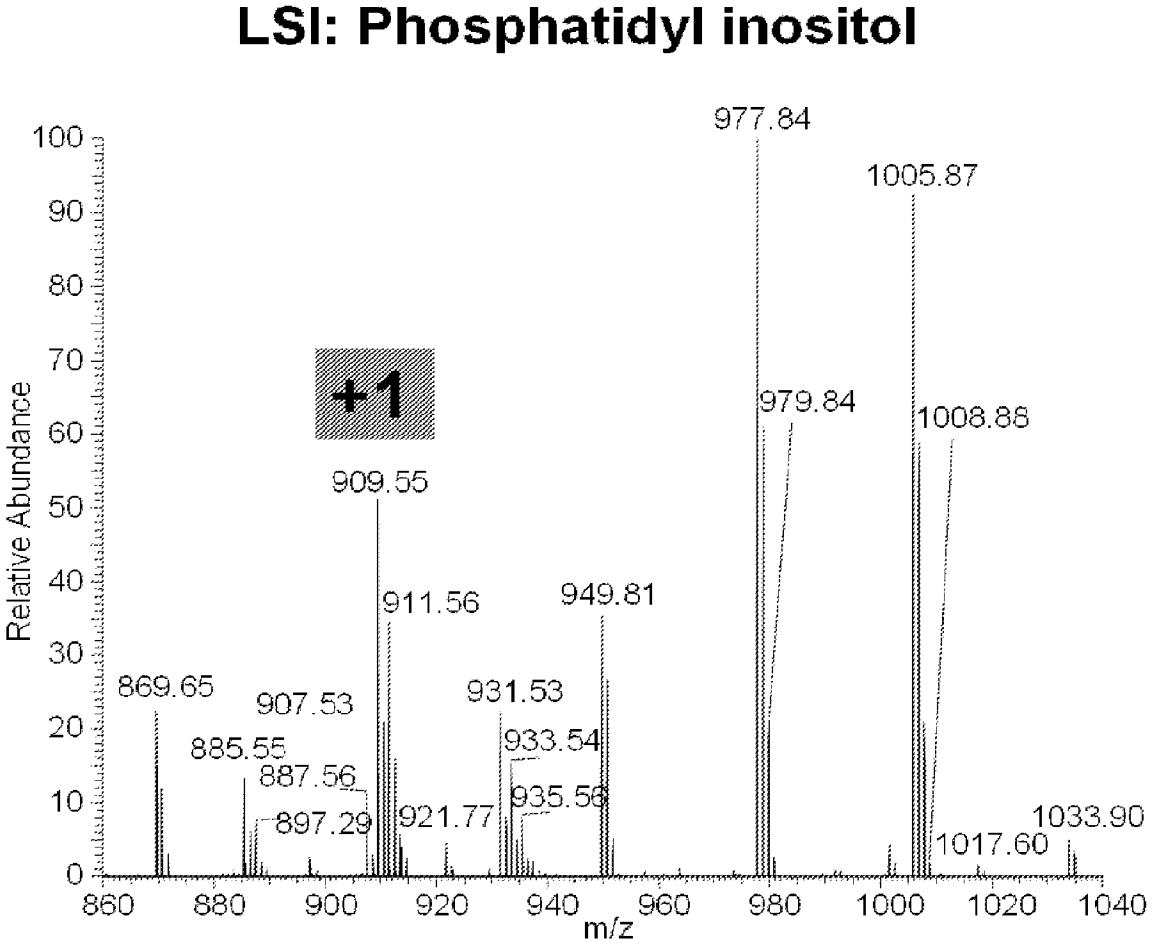
FIG. 56 depicts a spectrum of phosphatidyl inositol in 2,5-DHB showing singly charged ions.
Figure 57:
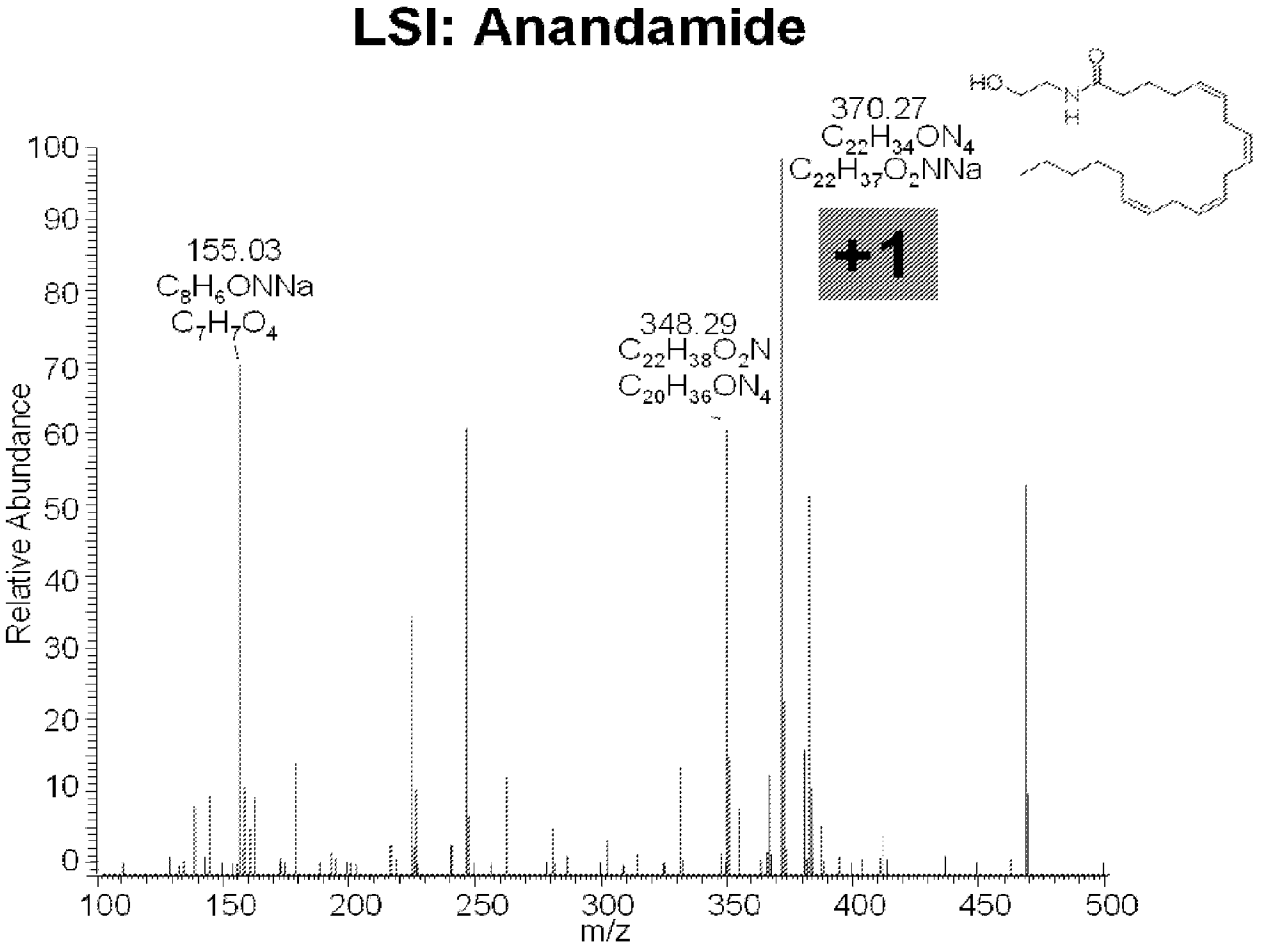
FIG. 57 depicts a spectrum of anandamide in 2,5-DHB showing singly charged ions.

Additionally, the loss of sample during protein downstream handling can be as high as 50% in solvent-based approaches. This limitation can be reduced, in some cases significantly, in the solvent-free MALDI method because the sample can be effectively recovered from the wall of the vial during the step of mixing the analyte and material/matrix using beads mechanically. FIGS. 56 and 57 provide schematic drawings indicating the general differences between traditional and solvent-free MALDI.

The methods disclosed herein can also be used with an automated solvent-free matrix deposition method, permitting the preparation of unadulterated tissue samples in about 1 minute with homogeneous matrix coverage of crystal sizes in the range of <1 to 12 μm using a 20 μm mesh. The size can be further reduced to <1 to 5 μm sized crystals by ball-milling the respective matrix through a 3 μm mesh within about 5 minutes. This rapid surface application method was applied to mouse brain tissue and results compared with a solvent-based spray-coating method using a MALDI-Time of Flight (TOF) mass spectrometer (Examples 4). Total solvent-free analysis (TSA) performed on a MALDI-ion mobility spectrometry-mass spectrometry (IMS)-TOF mass spectrometer can be shown to separate an isobaric composition using solvent-free gas-phase separation.

An example of a solvent-free MALDI method according to this disclosure is the analysis of amyloid peptides (Example 8). The amyloid peptide (1-42) is pivotal in the pathogenesis of Alzheimer's disease, promoting oxidative stress and converting to insoluble neurotoxic β-amyloid fibril forms. Besides changes in protein modifications related to acetylations and phosphorylations relevant to Alzheimer's disease, evidence suggests crucial involvement of His-6, His-13, His-14 and Met-35. Oxidation of Met-35 is also discussed as a cause of the onset of misfolding the amyloid precursor protein (APP) and Alzheimer's disease.

However, according to the present disclosure, hydrophobic components of amyloid peptides showed that solvent-free MALDI analyses can overcome these oxidation artifacts, as well as solubility issues, without use of MS incompatible detergents. Ionization suppression of hydrophobic peptides along with shot-to-shot irreproducibility can also be greatly reduced, improving quantitative aspects of analysis. The tryptic digested amyloid peptide (1-42) can give 100% sequence coverage with a solvent-free approach, whereas solvent-based MALDI may not detect the hydrophobic peptides due to solubility and ionization issues. Similar improvements can be found for the analysis of bacteriorhodopsin, a membrane protein.

According to the present disclosure, solvent-free MALDI methods utilizing respective sample holders (e.g., micro-titre plates) with simultaneous preparation, homogenization, and deposition directly onto the MALDI plate, can enhance the potential of high-throughput analysis.

Current limitations of the solvent-free MALDI method for protein/peptide analysis include a higher material requirement relative to solvent-based methods and a greater tendency for metal adduction which can increase the analysis time. This can be overcome by attaching at least one metal cation ($Na^+$) that makes the analysis of hydrophobic peptides reliable using solvent-free MALDI analysis.

Either solvent-free or solvent-based preparation of the matrix/analyte can produce multiply charged ions. Solvent-free sample preparation can have advantages with tissue samples because it can eliminate compound spreading by solvents. It can also be applicable without the requirement of solvent solubility.

A further embodiment of the present disclosure is the SurfaceBox/TissueBox, which can provide a solvent-free method for applying a matrix to tissue to provide high resolution imaging. It can also be used with microtiter plates to simultaneously prepare multiple sample solvent-free samples and transfer directly to the MALDI target plate, which can be, without limitation, a glass microscope slide. Glass slides eliminate carryover and cleaning issues associated with expensive metal sample plates.

Transmission geometry can allow higher spatial resolution surface imaging. The combination of the tissue box, transmission geometry and laserspray multiply charged ions can be useful in imaging larger molecules.

Atmospheric pressure can make the method faster and more physiologically relevant than vacuum ionization. Both spatial and mass resolution can be high with these methods as described herein.

Figure 65:
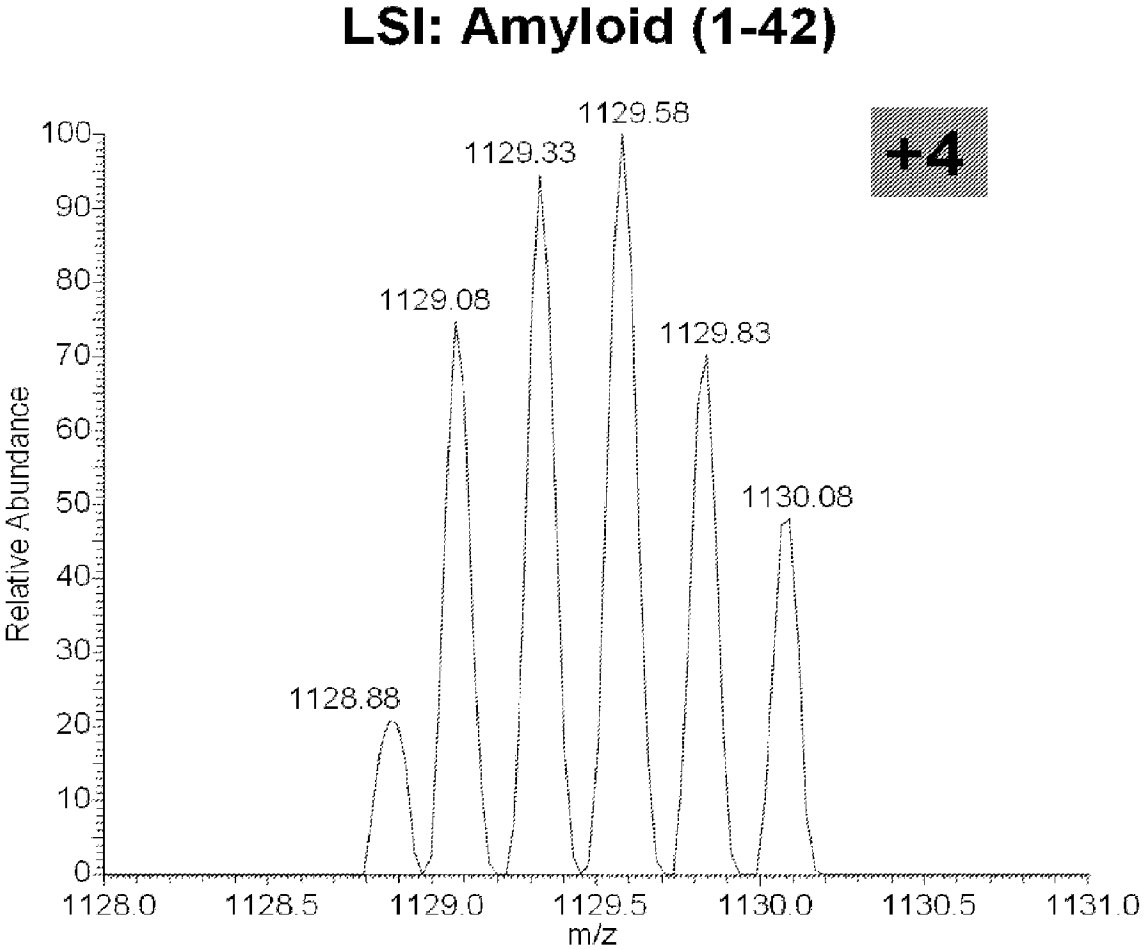
FIG. 65 depicts a spectrum for amyloid 1-42 with charge state +4.
Figure 70:
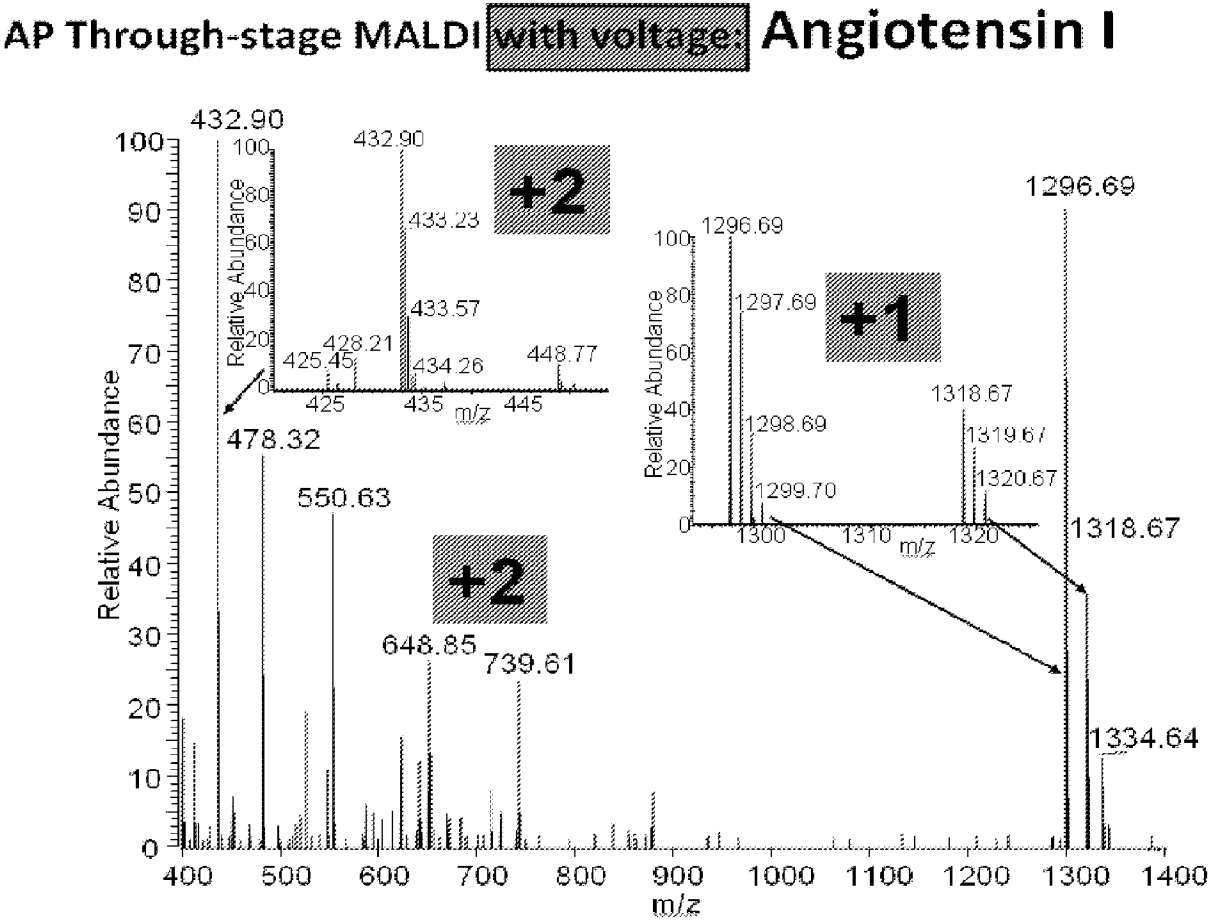
FIG. 70 depicts the results using the wire mesh of FIG. 69.

Accordingly, the systems and methods described herein provide a fast and simple means of LSI with optional solvent-free matrix deposition and/or separation. The systems and methods demonstrate that multiple charges in MALDI can provide more efficient fragmentation and extend the applicable mass range. Advantages of the disclosed methods include the ability to image proteins over 4,000 Da molecular weight, such as beta amyloid (1-42) as shown in FIG. 65. The disclosure also shows the effect of high voltage on the ability to image the molecules, as shown in FIG. 70.

The systems and methods described herein allow production of multiply-charged ions similar to ESI. LSI can be produced with solvent-based sample preparation methods traditionally used in vacuum or AP-MALDI or with solvent-free sample preparation. The matrix/analyte LSI sample can be ablated with the laser ($N_2$ laser 337 nm; Nd/YAG laser 355 nm) in transmission geometry or in reflective geometry to produce the LSI ions.

The ions are obtained at low or no voltage between the sample plate and the ion entrance orifice. This allows use of, without limitation, glass, plastic or metal sample holders. Transparent glass and plastic (with or without a metal coating) allow transmission geometry. Low voltage can include levels of below 500 or 1000 volts.

The multiply charged ions of the methods disclosed herein are produced by a mechanism in which the analyte is captured in multiply-charged matrix droplets produced by the absorption of the laser energy by the matrix. A gas jet is formed propelling the multiply-charged droplets toward the ion entrance orifice. The momentum of this process allows the charged droplets to reach the ion entrance orifice without an electric field.

These multiply-charged droplets are desolvated to produce the multiply charged ions. Thus the multiply charged ions are produced at a distance from the surface measured in millimeters and not microns. With certain matrices, the desolvation energy can be less than others but all will preferably use heat to produce the matrix evaporation (desolvation) that produces the multiply charged anlayte ions.

Thus, a desolvation region is used to produce laserspray ions, but is not generally of use in producing MALDI ions. Heated tubes (composed of different metals, such as, without limitation, copper or stainless steel; varying diameters and length; and with and without the application of heat other than the cone heat) are used in which the ions are transferred from atmospheric pressure to vacuum as a region for desolvation. This has an advantage that the ions can be produced in a laminar flow which reduces losses to the walls and allows focusing of the ions at the lower pressure exit of the capillary, using such means as ion funnels operating in the lower pressure region.

Another advantage of the formation of multiply-charged droplets (or clusters) in the absence of an electric field is that losses at the ion entrance orifice ("rim losses") to the vacuum region from AP are minimized.

Examples of the systems and methods disclosed herein can be used to analyze and/or image, without limitation, proteins, lipids, surfaces and tissues. However, the systems and methods are not limited to use with proteins, peptides, and lipids, also directly from complex surfaces such as tissue. Polymers and plastics are among other non-limiting exemplary materials that are suitable for analysis as disclosed herein. Oligonucleotides can also be analyzed. The systems and methods disclosed herein are also suitable for analysis in the fields of proteomics and metabolomics.

Lasers can be infrared (IR) or ultraviolet (UV). Laserspray ionization (LSI) can be used interchangeably with field-free transmission geometry AP-MALDI. Citations to references within methods descriptions are incorporated by reference herein for their teachings regarding the referenced method.

I. Example I

This example describes the use of laserspray ionization for protein analysis directly from tissue at AP and with high spatial resolution and ultra-high mass resolution. The results from the experimentation described within this example suggest that LSI-MS can combine the speed of analysis, high spatial resolution, and imaging capabilities of MALDI with the soft ionization, multiple charging, fragmentation, and cross-section analysis of ESI.

A. Introduction

Tissue imaging by MS is proving useful in areas such as detecting tumor margins, determining sites of high drug uptake, and in mapping signaling molecules in brain tissue. Imaging using secondary ion mass spectrometry (SIMS) is well established, but is only marginally useful with intact molecular mass measurements from biological tissue and other surfaces. MALDI MS operating under vacuum conditions has been employed for tissue imaging with success, especially for highly-abundant components such as membrane lipids, drug metabolites, and proteins. Spatial resolution of ~20 μm has been achieved and the MALDI-MS method has been applied in an attempt to shed light on Parkinson's, muscular dystrophy, obesity, and cancer diseases.

Tissue fixation or washing with solvents that are pure, diluted with water, or mixed with organic solvents can enhance the signal quality of peptides and proteins, as well as extend the life of the tissue before matrix application. Schwartz, et al., developed a set of practical guidelines for the proper handling of tissue sections (tissue storage, sectioning, and mounting) for peptide and protein analyses, and for the choice and concentration of matrix, solvent composition, matrix deposition strategies, and instrumental parameters for optimal mass spectrometric data acquisition using MALDI. (Schwartz, et. al., J. Mass Spectrom 2003; 38:699-708). Tissue thickness also affects the overall peak intensities and the total number of observed peaks for peptides and proteins. Additionally, the choice of matrix and its deposition onto the tissue is important in determining the subset of proteins extracted from the tissue and detected.

Unfortunately, there are disadvantages in using vacuum based MS for tissue imaging in relation to analysis of unadulterated tissue. Also, the mass spectrometers used in these studies frequently have insufficient mass resolution and mass accuracy. Because the vacuum ionization methods produce singly charged ions, mass selected fragmentation methods provide only limited information, especially for peptides and proteins. In addition, no advanced fragmentation, such as electron transfer dissociation (ETD), is available for confident protein identification.

AP-MALDI tissue imaging can be coupled to high resolution mass spectrometers but suffers from sensitivity issues at high spatial resolution. AP-MALDI also primarily produces singly charged ions. Thus, mass and cross-section analysis of intact proteins is not possible using AP-MALDI on these mass spectrometers because of their intrinsic mass range limitations, frequently having a mass-to-charge-ratio (m/z) <4000.

LSI, a new MALDI-like method that operates at AP, has advantages relative to other MS based methods for tissue imaging of proteins including speed of analysis, improved spatial resolution, more relevant AP conditions, extended mass range and improved fragmentation through multiple charging, and the ability to obtain cross-section data on appropriate instrumentation. The applicability of LSI to high-mass compounds on high performance AP ionization mass spectrometers (Orbitrap Exactive, SYNAPT G2) has been demonstrated producing ESI-like multiply protonated ions. The first experiments showing sequence analysis by ETD using the LSI method were successfully carried out on a Thermo Fisher Scientific LTQ-ETD mass spectrometer. Nearly complete sequence coverage was obtained for ubiquitin, an important regulatory protein. Applying ETD fragmentation to LSI-MS analyses potentially provides a new method for studying biological processes, including the mapping of phosphorylation, glycosylation, and ubiquitination sites from intact proteins and directly from tissue.

Further, unlike ESI and related ESI-based methods such as desorption-ESI, the LSI method allows high spatial resolution imaging as was shown for lipids (~10 to ~80 μm). In comparison to reports for AP-MALDI at the same stage of development, LSI is more than an order of magnitude more sensitive and is capable of analyzing proteins on high resolution mass spectrometers, as was demonstrated by obtaining full acquisition mass spectra after application of only 17 femtomoles of bovine pancreas insulin onto a glass microscope slide. The speed of the LSI method has been shown by obtaining mass spectra of five samples in 8 seconds, and predict the method has the potential of analyzing a sample in less than a second with mechanical movement. Unrepresented in MS, the utility of intact protein analysis was demonstrated directly from mouse brain tissue using an Orbitrap mass spectrometer set at 100,000 mass resolution and a nitrogen laser focused to ablate ~300 μm3 spatial volume.

B. Experimental Procedures

1. Materials

The matrixes, 2,5-dihydroxybenzoic acid (2,5-DHB) 98%, 2,5-dihydroxyacetophenone (2,5-DHAP) 99.5%, and sinapinic acid (SA) 99% were purchased from Sigma Aldrich, Inc., St. Louis, Mo. The solvents, ACN, trifluoroacetic TFA, and EtOH, were purchased from Fisher Scientific Inc., Pittsburgh, Pa. Purified water was used (Millipore's Corporate, Billerica, Mass.). The plain microscopy glass slides (76.2×25.4×1 mm in dimensions) were obtained from Gold Seal Products, Portsmouth, N.H. ITO-coated conductive glass slides for imaging experiments were a gift from Bruker (Billerica, Mass.).

2. Mouse Brain Tissue

C57 BI/6 mice, 20 weeks old, were euthanized with CO2 gas and transcardially perfused with ice-cold 1× phosphate buffered saline (150 mM NaCl, 100 mM NaH2PO4, pH) 7.4) for 5 minutes to remove red blood cells. The brains were frozen at −22° C. and sliced into 10 μm sections in sequence using a Leica CM1850 cryostat (Leica Microsystems Inc., Bannockburn, Ill.). The tissue sections were placed onto pre-chilled microscopy glass slides (plain or gold-coated) that were briefly warmed with the finger from behind to allow sections to relax and attach. Care was taken to avoid water condensation by storing (at −20° C.) and transporting (under dry ice) the tissue mounted glass slides in an airtight box containing desiccant until use.

3. Analysis of Aged and Fresh Tissue Sample

The mouse brain tissue sections used in this study were shipped in dry ice before being delipified and then shipped overnight in dry ice. The aged delipified tissue sample was stored for approximately two months at −5° C. The delipification was initially obtained on the aged tissue sample and verified by MALDI-TOF-MS analysis. The optimized delipification conditions were used for further study comparing results obtained from MALDI and LSI-MS analysis.

A second set of mouse brain tissue samples were cut, frozen and immediately shipped overnight. Each microscopy glass slide, plain and gold-coated, was mounted with four to five tissue sections. On receipt of the frozen samples, delipification of the tissue on glass slides was performed as described below and again immediately frozen and shipped overnight for prompt LSI-MS analysis on an Orbitrap Exactive (Thermo Fisher Scientific) mass spectrometer. These samples were again frozen and shipped overnight for microscopy and subsequent MALDI-MS and LSI-LTQ Velos analysis.

4. Delipification of Tissue

The lipids in the tissue sections were removed according to a published procedure. Briefly, the glass slide mounted with tissue was dried in the desiccator before washing twice with ethanol. In the first wash, the glass slide with the mounted tissue was immersed in a glass Petri dish filled with 70% EtOH, swirled for 30 seconds, and removed carefully. The glass slide was then tilted to remove the solvent for about 10 seconds, and immediately washed with 95% EtOH in another Petri dish for an additional 30 seconds. After the second wash, the glass slide was allowed to dry in the dessicator for 20 minutes prior to analysis, or stored at approximately −20° C. until use or shipment under dry ice.

5. Laserspray Ionization (LSI) Mass Spectrometry (MS) of Mouse Brain Tissue

LSI on either the Orbitrap Exactive or LTQ-Velos mass spectrometers involves removal of the Ion Max source and overriding the interlocks or removing the front and side windows to allow laser and sample access to the ion entrance orifice. Briefly, the laser beam (337 nm, Newport Corporation VSL-337ND-S) was aligned with the ion entrance orifice of the mass spectrometer. The glass microscope slide mounted with mouse brain tissue was prepared with the LSI matrix (2,5-DHB or 2,5-DHAP) dissolved in 50:50 ACN:water by placing a number of 0.2 μL drops on top of the tissue material. After solvent evaporation, the glass slide containing LSI matrix applied to mouse brain tissue was placed closely (1 to 3 mm) in front of the mass spectrometer ion transfer tube entrance (orifice) and was moved manually through the laser beam aligned 180 degree relative to the ion entrance orifice (transmission geometry). The AP to vacuum ion transfer capillary was heated to 375° C. for 2,5-DHB and 300° C. for 2,5-DHAP and the laser fluence per pulse was about 0.5-1 J cm-2. Multiply charged ions were observed in the absence of an electric field in the ion source region. Such an arrangement allows manual crude tissue studies for observing multiply charged ions. Both plain and gold-coated glass slides were used.

6. MALDI MS of Mouse Brain Tissue

A MALDI-TOF Bruker Ultraflex mass spectrometer (Bruker, Bremen, Germany) equipped with a nitrogen laser (337 nm) was used to monitor the success of the tissue delipification and for comparison with LSI results. The MALDI sample preparation was performed according to published work. After washing the tissue and drying in the dessicator, the tissue was spotted with 0.2 μL of either SA matrix dissolved in 50:50 ACN:water in 0.1% TFA or 2,5-DHAP in 50:50 ACN:water. The mass spectrum was acquired using the linear positive-ion mode with an accelerating voltage of 20.16 kV, an extraction voltage of 18.48 kV, lens voltage of 7.06 kV, and pulsed ion extraction of 360 ns. Delayed extraction parameters were optimized to have the optimal resolution and sensitivity for the 12 kDa mass range. An increment of 30 laser shots was used, and shots were positioned and moved within a single matrix spot to obtain a mass spectrum having a total of 120 laser shots. The mass spectrum was processed and baseline corrected using the Flex Analysis software. Both plain and gold-coated microscopy slides were used; only gold-coated microscopy slides are expected to provide the correct mass calibration.

7. Microscopy and Spatial Volume Measurement

Optical microscopy (Nikon, ECLIPSE, LV 100) was performed to obtain qualitative information on the spatial resolution by measuring the ablated area on the tissue after LSI-Orbitrap analysis (and transport to WSU). Various magnification conditions were used, ranging from ×5 to ×100, providing detailed views down to <1 μm resolution. Microscopy data was obtained for both the aged and fresh tissue samples. A typical example for the well-defined, high spatial volume determination of <300 μm3 is provided with <3 μm width by <10 μm length spatial resolution on a 10 μm thick tissue section, as was observed for the aged tissue section. The fresh tissue section provided slightly better resolution.

C. Results

1. Evaluation of Experimental Conditions on an Aged Tissue Sample

Figure 31:
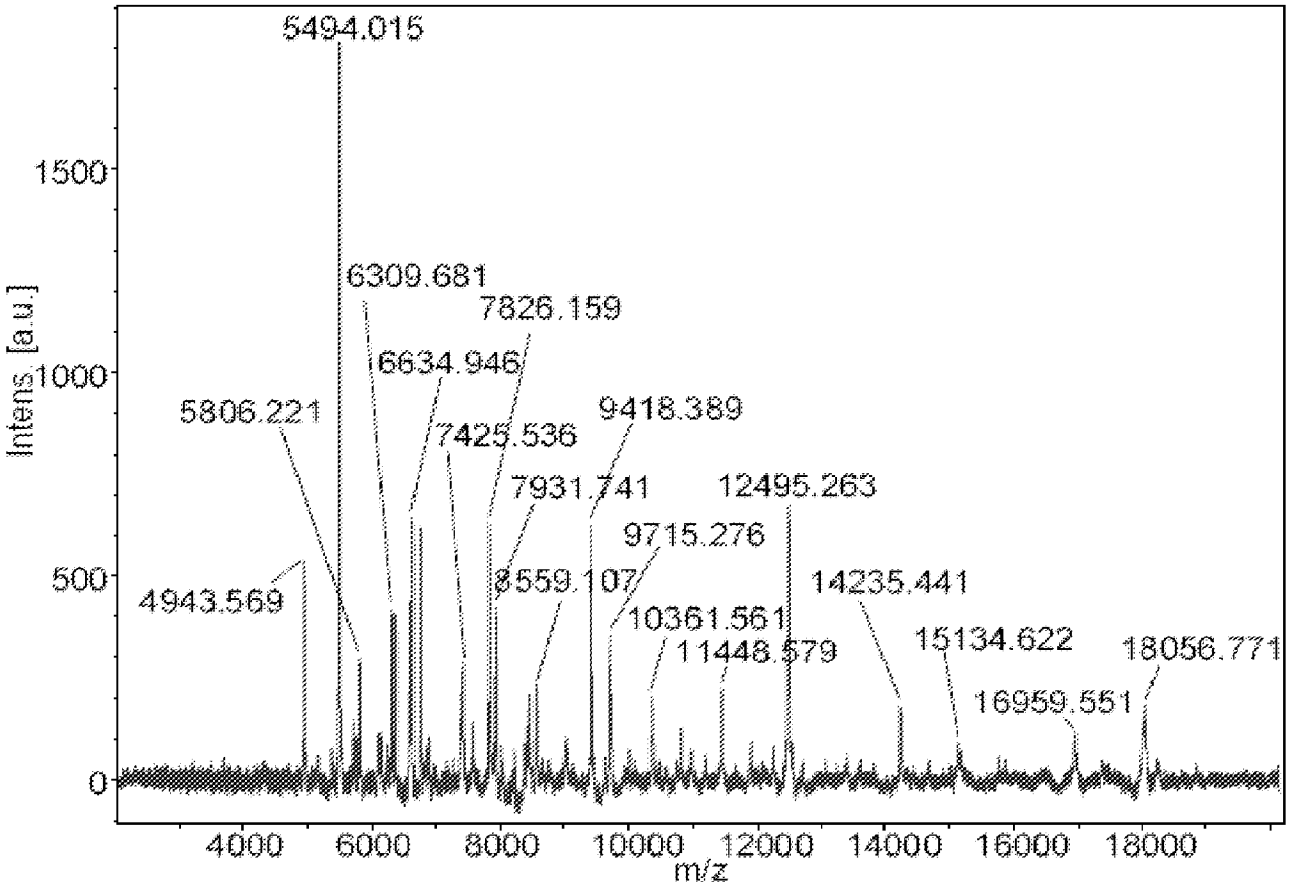
FIG. 31 depicts MALDI-Time of Flight (TOF) MS mass spectrum of mouse brain washed with ethanol and spotted with sinapinic acid matrix in 50:50:0.2 acetonitrile (ACN)/water/trifluoroactetic (TFA).

The solvent used in this study to extract lipids prior to mass spectral tissue analysis was selected based on previously reported studies as well as from results we obtained from MALDI-MS analyses. Two solvents were used to delipify the aged tissue section, but the ethanol wash gave higher intensity protein MALDI-MS signals than the isopropanol wash using SA as the matrix. Mass spectral acquisition was at approximately the same location on different tissue sections from the same mouse brain mounted on plain microscopy glass slides for both delipification procedures. FIG. 31 shows the MALDI-TOF MS mass spectrum of the mouse brain washed with ethanol and spotted with sinapinic acid matrix in 50:50:0.2 ACN/Water/TFA. As shown in FIG. 31, the detected peptide and protein signals range from an m/z of about 5,000 up to 19,000 (FIG. 31), which is within the m/z range that Seeley et al. presented (Seeley, et. al., J. Am. Soc. Mass Spectrom 2008; 19:1069-1077); the mass calibration is expected to be somewhat off because plain microscopy glass slides without conductive coating were used. Only a few of the proteins detected give significant signal intensity and are presumed to be from the most abundant protein species in the tissue.

Figure 32:
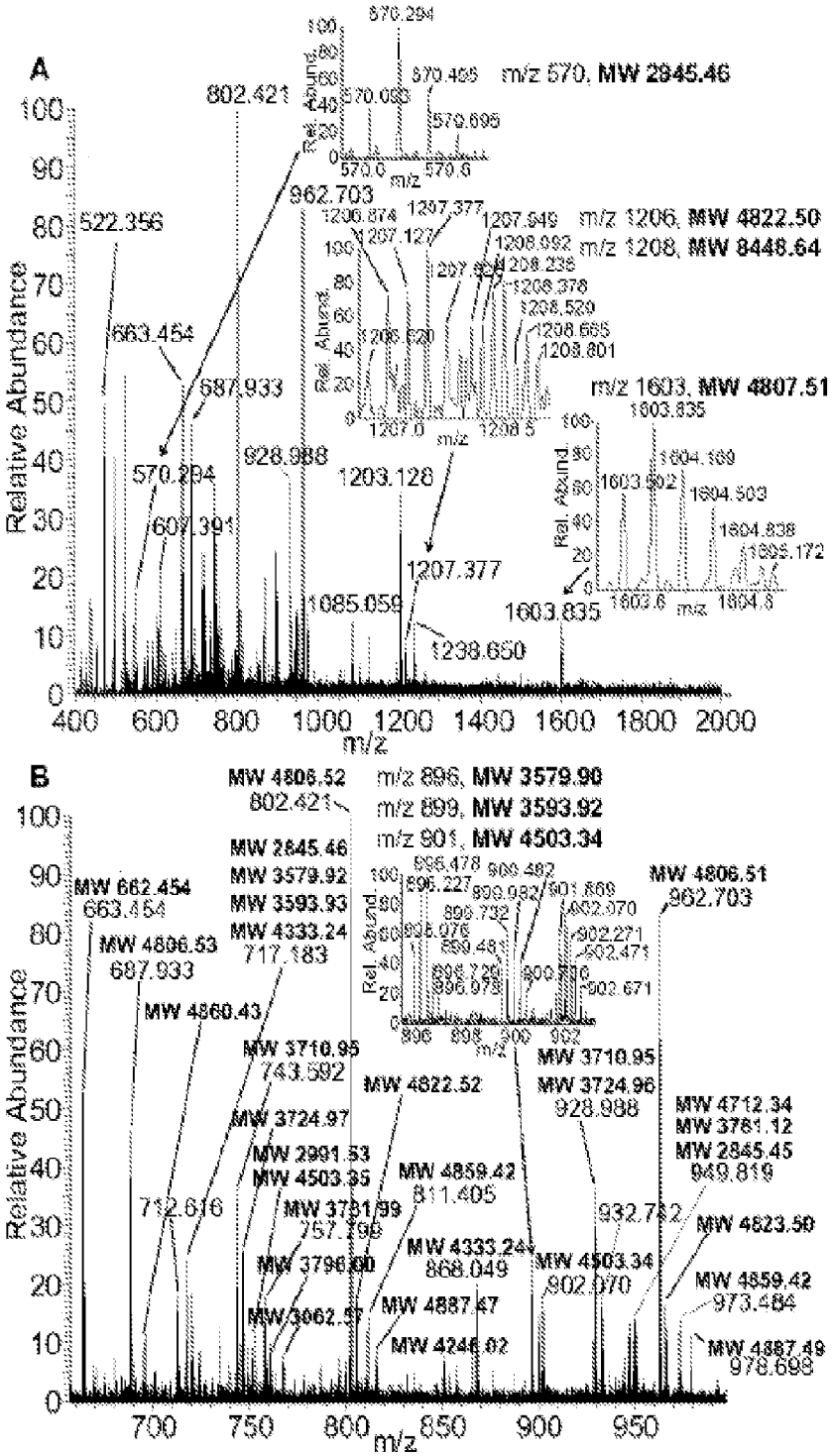
FIGS. 32A-B depict LSI-MS mass spectra from mouse brain washed with ethanol and spotted with 2,5-DHAP matrix in 50:50 ACN/water.

Using the LSI method on an Orbitrap Exactive instrument with mass range m/z set to <2200 shows a large preference of 2,5-DHB for ionization of lipids compared to 2,5-DHAP predominantly ionizing proteins. Only lipid signals were observed with LSI using 2,5-DHB as the matrix even in the delipified tissue, similar to previous reports, but were present in lower abundances in the well washed tissue. On the other hand, as depicted in FIG. 32A, the full mass spectrum of the mouse brain washed with ethanol and spotted with 2,5-DHAP matrix in 50:50 ACN/Water shows mostly multiply charged ions. Because of the mass spectral resolution providing $^{13}C$ isotope separation, a single charge state distribution is all that is necessary to determine the protein molecular weight with high accuracy. Thus, even ions observed just above noise, for which the monoisotopic peak cannot be reliably identified provide average mass data comparable to linear MALDI-TOF values. FIG. 32B shows an Inset region from FIG. 32A with the mass range set from m/z 650 to 1000. The multiply charged ions range from +3 to +8, representing ions having molecular weights from ca. 650 to 5000 Da. For this dataset, most ions were from compounds below 10 kDa, and are likely small proteins. FIG. 135 shows the isotopic distribution of the highest mass ion detected from the delipified aged tissue spotted with 2,5-DHAP in 50:50 ACN/Water on a plain glass slide was of a ~13 kDa compound (FIG. 135). It is possible, because of the long storage time for the aged sample, that some of the observed proteins are from postmortem enzymatic digestion.

Figure 33:
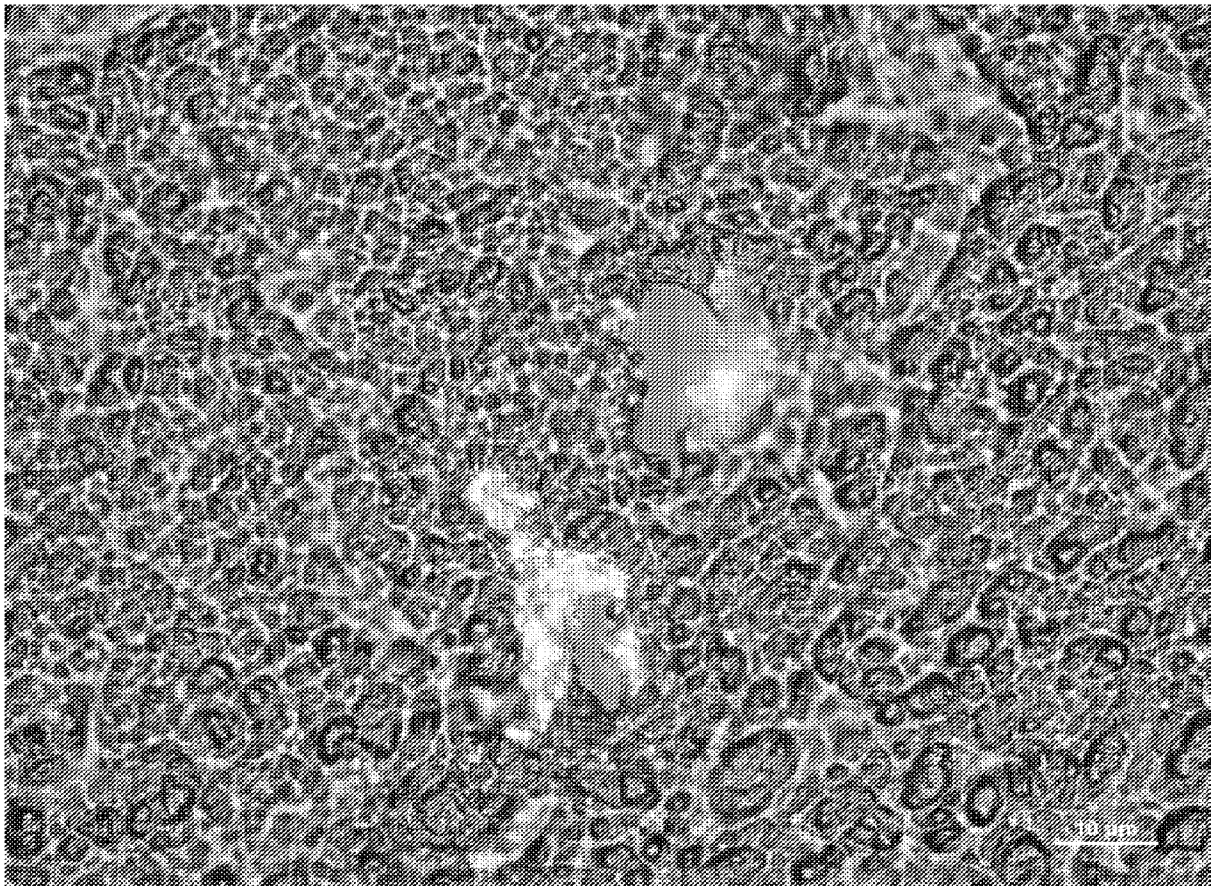
FIG. 33 depicts mouse brain washed with ethanol and spotted with 2,5-DHAP matrix in 50:50 ACN/water after laser ablation.

After laser ablation, microscopy data was obtained to examine the spatial resolution of the LSI ablated tissue area. A previous tissue analysis study using similar source geometry gave a spatial resolution of about 80 μm on average using solvent-free application of 2,5-DHB as the matrix, and significantly larger ablated areas using solvent-based matrix deposition onto unwashed tissue sections. As shown in FIG. 33's optical microscopy image, with improved laser focusing and using 2,5-DHAP as the matrix, the ablated areas ranged from <3 to 10 μm in width. The elongated feature of the ablated area (~8 to 15 μm in length) can possibly be explained by the continuous movement of the mounted tissue through the focused laser beam. The matrix seen as deposits near the ablated areas indicates a function of the LSI matrix in the desorption/ionization of the tissue material.

Figure 1:
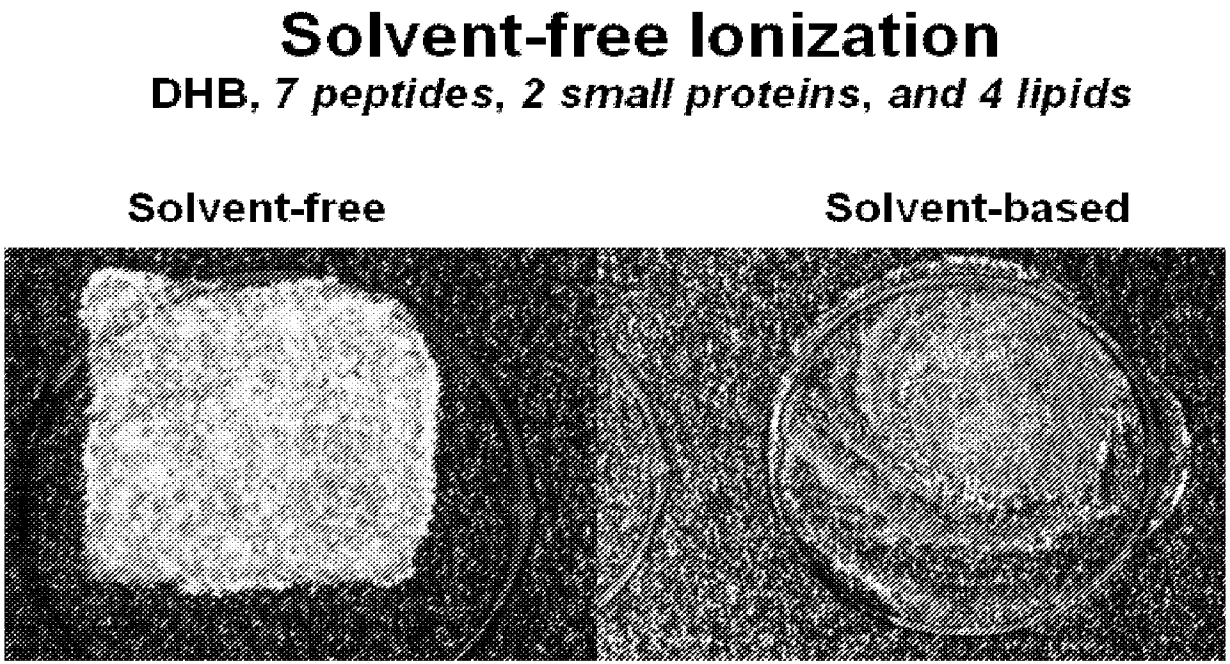
FIG. 1 shows a photograph of the matrix (2,5-dihydroxybenzoic acid (DHB))/analyte) used to obtain the images shown in FIGS. 2-14 (seven peptides, two small proteins, and four lipids).
Figure 2:
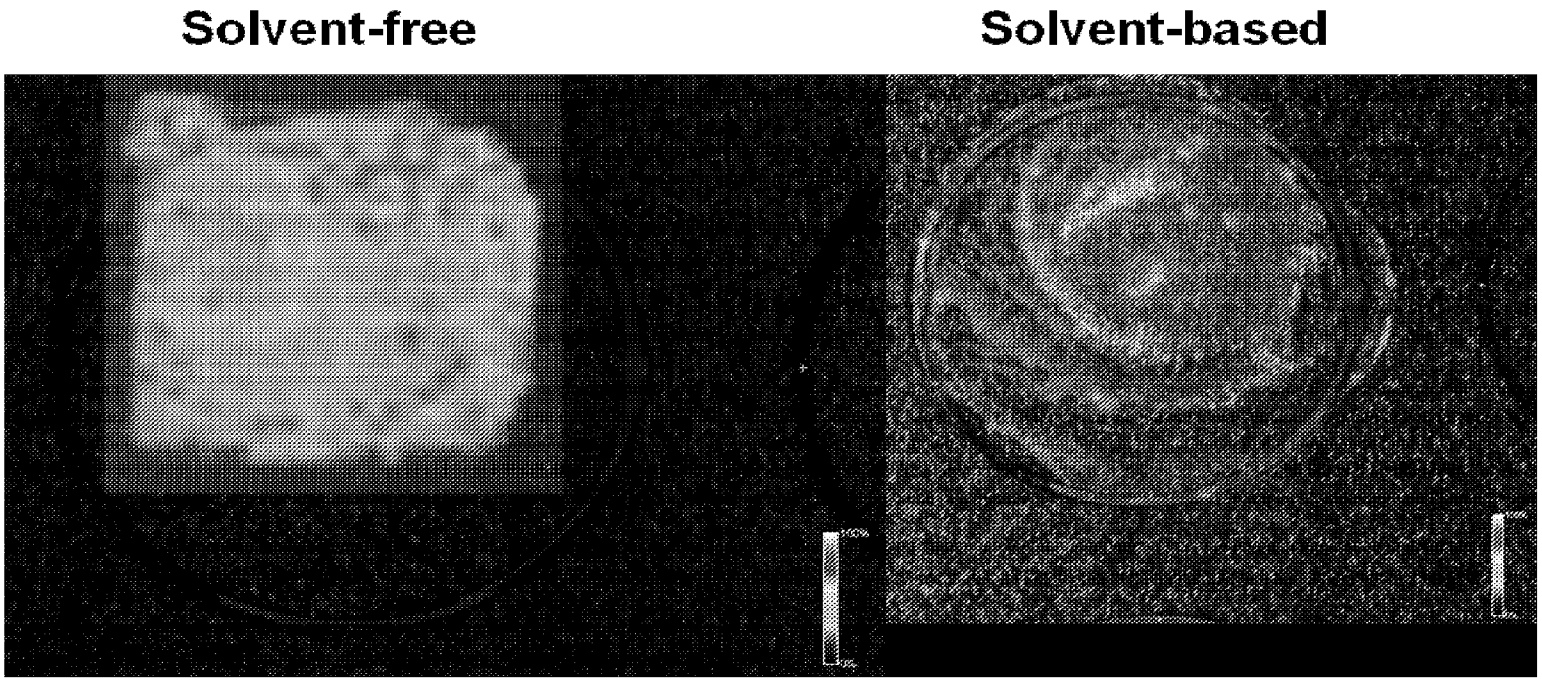
FIG. 2 depicts solvent-free and solvent-based analysis of β-amyloid (33-42).
Figure 3:
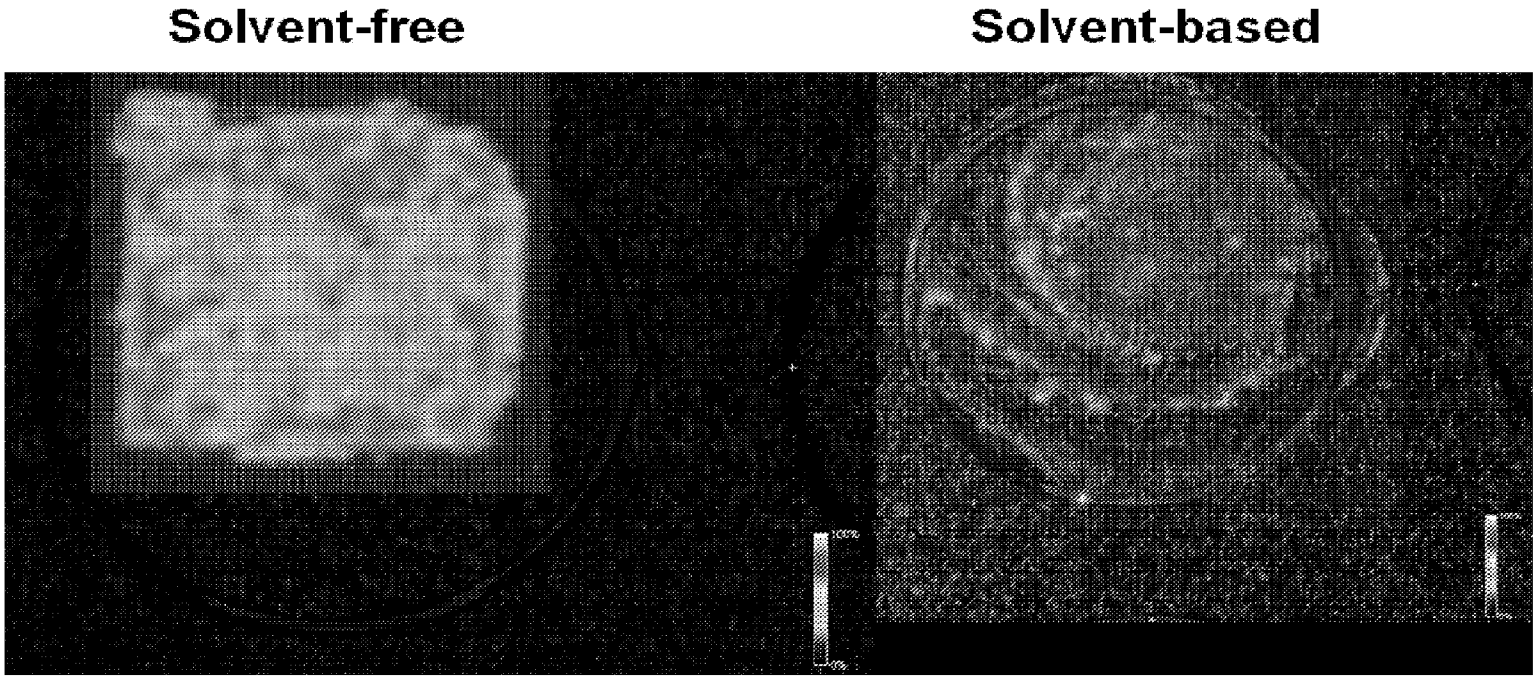
FIG. 3 depicts solvent-free and solvent-based analysis of lipotropin.

2. A Comparison of LSI-MS, Microscopy and MALDI-MS Analysis on Fresh Tissue Samples Successful results with the aged tissue samples prompted the examination of fresh tissue sections that were maintained at or below −20° C. except for short times required for mounting the tissue to the glass slide, delipification, mass spectral analysis, and microscopy. FIG. 133 shows the summed full and inset MS of the fresh delipified samples using 2,5-DHAP matrix in 50:50 ACN/Water on a plain glass slide displaying an abundant doubly charged LSI ion at m/z 917.50 (MW 1833.0) and mostly multiply charged ions at higher m/z values. The highest mass protein with at least two observed charge state distributions had a molecular weight of 17,882 Da, although a single low abundance isotope distribution was observed for an ion having a molecular weight of ca. 19,665 Da. Some of the lower molecular weight proteins observed in the aged tissue sample (FIG. 32B) were also observed in the fresh sample, but in lower abundance while the higher mass proteins were significantly more abundant. FIGS. 136A-B3 show that in a single laser shot the most abundant proteins are observed. FIG. 136A shows the total ion current obtained by moving the tissue through the laser beam and within 3 mm of the ion entrance orifice. The laser was operated at 1 Hz and one mass spectral acquisition was obtained per second. FIG. 136B1 shows the sum from full acquisition, FIG. 136B2 shows the single shot acquisition and FIG. 136B3 shows the sum of 7 consecutive mass spectral acquisitions representing approximately 7 laser shots. Notable differences between gold-coated (FIG. 136) and plain glass slide (FIG. 133) were not observed. FIG. 137 shows three isotope distributions each for proteins having molecular weights of 9908, 11788, and 12369 Da (monoisotopic mass). The isotopic distributions of the proteins displayed in FIG. 137 were from delipified fresh tissue on a gold-coated glass slide spotted with 2,5-DHAP matrix in 50:50 ACN:water using the Orbitrap Exactive set at 100,000 mass resolution.

A fresh tissue section from the same mouse was delipified and immediately mass measured on a LTQ Velos instrument. Most of the multiply charged ions described above were observed. However, the peptide with molecular weight 1830 was not observed and may have been removed during delipification. FIG. 134B1 displays single 0.1 sec acquisitions showing the multiple charge state distribution of the protein having MW 11,788. FIG. 134B2 displays a single acquisition for another area of the mouse brain tissue and shows the protein at MW 11,788 in lower abundance than a second protein of MW 17882. The summed mass spectrum of multiple scans is provided in FIG. 134A. The ions observed around m/z 760 in FIGS. 134A-B2 are from lipids. These results demonstrate the potential of this method for high spatial resolution tissue imaging.

Further, LSI-MS analysis without the addition of the LSI matrix did not provide any useful analytical results. The use of gold-coated and plain microscopy slides after the deposition of LSI matrixes provided comparable abundance mass spectra of the delipified tissue. As expected, no mass shift is observed in the AP LSI results using conductive or non conductive glass slides. Just as with the aged tissue, 2,5-DHB preferentially detects lipid components and 2,5-DHAP protein components.

FIG. 138A shows the microscopy, with 100× magnification, after laser ablation using LSI-IMS of the fresh delipified tissue mounted on the plain glass microscopy slide and treated with 2,5-DHAP shows spatial resolution of <3-8 μm in width and <5-25 μm in length. FIG. 139A's microscopy, with 100× magnification, after laser ablation using LSI-IMS of the fresh delipified tissue using a gold-coated glass slide provides slightly better spatial ablations than seen in FIG. 138A. FIG. 138B depicts another delipified section on the same glass slide of FIG. 138A and with approximately the same laser focus, but with 2,5-DHB matrix, with 10× magnification. The microscopy of FIG. 138B shows spatial resolution of ~200 μm. Similarly, FIG. 139B depicts another delipified section on the same gold-coated glass slide of FIG. 139A, with approximately the same laser focus, but with 2,5-DHB matrix, with 10× magnification. The microscopy of FIG. 138B shows spatial resolution ~100 μm. Clearly, with the 2,5-DHB it is significantly more difficult to obtain higher spatial resolution and volume analysis. The spatial resolution of the different experimental conditions show the following general trend: 2,5-DHB (gold-coated and plain glass slide) >>2,5-DHAP (gold-coated and plain glass slide)>no matrix (gold-coated and plain glass slide).

For comparison purposes, a sequential tissue section from a mouse brain mounted on a gold-coated and plain glass slide were used for vacuum MALDI-MS analysis. One-half of each delipified tissue section was coated with 2,5-DHAP and the other half with SA applying several 0.2 μl matrix solutions. Interestingly, none of the same molecular weights for multiply charged ions are common between LSI with 2,5-DHAP and MALDI with either 2,5-DHAP or SA. MALDI with the 2,5-DHAP matrix gave poor results which may help explain the discrepancy between vacuum MALDI and LSI. FIGS. 140A and 141A depict the MALDI-MS of delipified fresh tissue spotted with sinapinic acid in 50:50 ACN:water in 0.1% TFA on a gold-coated glass slide and a plain glass slide respectively. FIGS. 140B and 141B depict the MALDI MS of delipified fresh tissue coated with 2,5-DHAP in 50:50 ACN: water on a gold-coated glass slide and plain glass slide respectively.

D. Discussion

Mass spectra are observed from mouse brain tissue using an Orbitrap Exactive mass spectrometer set at 100,000 mass resolution and <5 ppm external mass accuracy from a single 1 sec acquisition, representing a single laser shot. The mass spectrum shown in FIG. 133 required averaging about 15 sec of data representing ablation of most of a 0.2 μL matrix spot. Similar results but without the mass resolution were obtained using a LTQ Velos mass spectrometer as shown in FIGS. 134A-B2, described above.

The depth of an ablated area is a difficult value to obtain in reflective geometry MALDI measurements but is necessary information for tissue reconstruction. Imaging by reflective geometry MALDI applications has shown ablation of approximately 50 μm depth, with large depth and shape variability; the standard lateral ablation is ca. 100 μm. The variability can be a result of the laser impact angle and a poorly focused laser beam but in particular, the sample preparation conditions, introducing uncertainty in the determination of the spatial resolution of each analysis. SIMS on the other hand, ablates only the top layer (the exact depth is still being discussed); 50 μm lateral resolution is commercially available. However, SIMS produces significant fragmentation with many biological molecules, and ion yields decrease rapidly with increasing m/z, making analysis of tissue sections extremely difficult. Recent work introduced a new laser-based imaging technique, laser ablation electrospray ionization MS, that provides depth profiling with a 350 μm lateral and 50 μm depth resolution of living tissues. These studies provide some indication of how much material is ablated by laser impact in reflective geometry arrangements. The large ablated area (volume) provides poor spatial resolution. Variability in ablated area may also be a reason for the poor quantitative performance of MALDI. Employing vacuum MALDI, 5 μm lateral resolution was reported accomplished with the focusing lens ~12 mm distant from the ablated area of purchased peptides and protein standards. Such a short distance to the MALDI sample can only be achieved by using the laser beam in transmission geometry. Our measured ablation values and the known 10 μm tissue section thickness demonstrates that a well-defined spatial volume of <300 $\mu m^3$ can be achieved.

The dried droplet method of spotting matrix that was used in the present study is inappropriate for tissue imaging studies as soluble proteins extracted into the ACN:H2O solvent are expected to spread over much of the area exposed to the solvent-based applied matrix. To alleviate this problem, we are using solvent-free matrix preparation methods. The fact that in LSI with transmission geometry the entire tissue thickness is ablated may explain the different mass spectral results obtained for LSI and MALDI-MS, with the latter ablating only the surface area of the tissue section. Further, based on the ablated area obtained from LSI-MS, the extent of tissue harm by the solvent/matrix and ablation by the laser appears to be significantly less using 2,5-DHAP vs. 2,5-DHB and delipified vs. unwashed tissue.

Another difficulty that needs to be addressed are the laser ablated areas in which the laser beam does not penetrate the tissue. This appears to be related to uneven tissue thickness and matrix application. Future advances will need improved sensitivity, conditions that allow every laser shot to penetrate the tissue, and solvent-free gas-phase separation for efficient simplification of complexity of the produced gas-phase ions Even though current imaging mass spectrometers using TOF analyzers can provide mass resolution in excess of 10,000 and mass accuracies better than 20 ppm, this is inadequate to identify or even confirm a protein structure. Further, fragmentation by advanced techniques such as ETD are not applicable because of the low charge states of the protein ions. With the LSI approach, the spatial advantages of MALDI are achieved, along with the mass resolution and accuracy of API mass spectrometers, and the potential ability to apply ETD and cross-section analysis because of the multiply-charged ESI-like ions that can be produced.

E. Conclusion

The first example of peptides and proteins observed directly from tissue producing multiply charged ions with simultaneous high spatial and mass resolution has been reported. Single laser shot acquisitions and ablated spatial volumes <300 $\mu m^3$ are achieved. The production of multiply charged ions allows high performance API mass spectrometers to be used for high-mass analyses providing isotopic resolution and accurate mass measurement. The multiply charged ions potentially allow electron transfer dissociation (ETD) fragmentation for improved protein identification. The use of a laser for direct ionization from tissue allows high spatial resolution for mass specific tissue imaging. Numerous potential applications related to mapping proteins in tissue imaging exist for this new approach. Improved sensitivity, sample preparation and laser focusing are needed to advance this technology to single cell analyses.

II. Example 2

This example describes studies conducted using two desolvation devices and their capability to desolvate the 2,5-DHAP matrix. Comparative studies were conducted using desolvation devices constructed from copper and stainless steel. Additional studies covered in this example describe results obtained through the application of the desolvation device.

A. Overview

Laserspray ionization (LSI) is a method to produce multiply-charged ion by laser ablation of a matrix/analyte mixture. LSI is achieved on a commercial ion mobility spectrometry mass spectrometry SYNAPT G2 instrument by introducing efficient desolvation conditions.

B. Introduction

Figure 84:
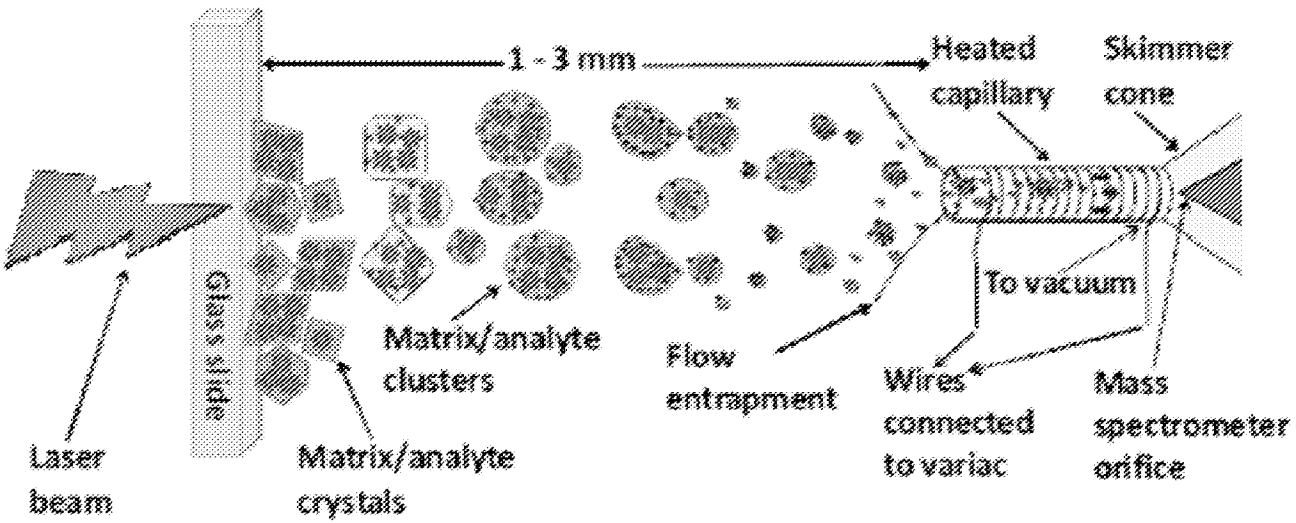
FIG. 84 depicts a source modification on IMS-MS SYNAPT G2 to enable desolvation of the matrix/analyte clusters formed during laser ablation so that the ESI-like multiply charged ions are obtained.

Laserspray ionization (LSI)-mass spectrometry (MS) was recently introduced on a Thermo Fisher Scientific Orbitrap™ Exactive (Thermo Scientific, Waltham, Mass.). The principle of this ionization method is that the analyte/matrix sample is ablated by the use of a laser operating at atmospheric pressure (AP) and ions are subsequently formed from multiply-charged matrix/analyte clusters during a desolvation process. Free choice of charge-state selection demonstrates the utility of LSI for the analysis of complex mixtures using singly charged ions similar to those obtained with matrix-assisted laser desorption/ionization (MALDI) and multiply charged ions similar to those produced by electrospray ionization (ESI). The latter is especially beneficial for providing the ability to ionize by laser ablation larger molecules such as proteins and synthetic polymers and subsequently analyze the multiply-charged ions on high performance but mass range limited instrumentation such as the Orbitrap Exactive. In this study, LSI is demonstrated on a commercial ion mobility spectrometry (IMS) SYNAPT G2 instrument to analyze proteins using a homebuilt desolvation device as depicted in FIG. 84. IMS-MS has many advantages compared with even high-resolution mass spectrometers because of its ability to extend the dynamic range and separate isomeric composition. The IMS dimension separates ions according to charge and cross-section (size and shape). IMS has the benefit of solvent-free gas-phase separation and with solvent-free sample preparation entirely decouples ionization, separation, and mass analyses from the use of any solvent achieving total solvent-free analysis by MS.

C. Methodology

1. Fabrication of the Desolvation Device

A ⅛ in. o.d., 1/16 in. i.d. ¾ in. L copper and stainless steel tubes were used as the desolvation chamber. The tube was wound with 24 gauge nichrome wire (Science Kit and Boreal Laboratories, Division of Science Kit, Inc., Tonawanda, N.Y., USA) with Saureisen P1 cement (Inso-lute Adhesive Cement Powder no. P1) for insulation and stability applied under and over the wire. The exit end of the tube was placed against the ion-inlet skimmer of the Waters Z-spray source. A nitrogen laser (Spectra Physics VSL 337 ND S) using transmission geometry ablated the matrix/analyte sample, deposited using the "dried droplet" method onto a glass microscope slide.

2. Materials

The 2,5-dihydroxyacetophenone (DHAP) matrix (98% purity), insulin (bovine pancreas), ubiquitin (bovine erythrocytes), lysozyme (chicken eggwhite), cytochrome C (horse heart), and myoglobin (horse heart) were purchased from Sigma Aldrich, Inc., St. Louis, Mo., USA, and angiotensin 1 (human) from American peptide. Acetonitrile (ACN), methanol (MeOH), trifluoroacetic acid (TFA) and acetic acid solvents were obtained from Fisher Scientific Inc., Pittsburgh, Pa., USA. Purified water was used (Millipore Corp., Billerica, Mass., USA). Microscopy slides (dimensions 1×3 in.) were obtained from Gold Seal Products, Portsmouth, N.H., USA.

3. Sample Preparation

Stock solutions of angiotensin, ubiquitin, lysozyme, cytochrome C, and myglobin were prepared individually in pure water and insulin in 50:50 MeOH:water. One μL was used to prepare the LSI sample on the glass slide employing solvent-based sample preparation protocols using 2,5-DHAP matrix prepared in 50:50 ACN:water and then blow dried to completeness. The dried LSI sample was placed in front of the desolvation device in a distance of about 1 to 3 mm. For comparison between ESI and LSI, ubiquitin was prepared in 49:49:2 ACN/water/acetic acid.

E. Results

A novel laser-based ionization method with fabricated desolvation device was demonstrated. A schematic of the desolvation device can be seen in FIG. 84. FIG. 84 depicts a source modification on IMS-MS SYNAPT G2 to enable desolvation of the matrix/analyte clusters formed during laser ablation so that the ESI-like multiply charged ions are obtained. The desolvation device can be heated using for example a Variac. The application of heat to the desolvation device is not ultimately necessary. By lowering the thermal requirements of the matrix, the desolvation can also be made more efficient enhancing the ionization efficiency. This can be shown for 2,5-dihydroxyacetophenone (2,5-DHAP). Other examples of matrices that can show the production of multiply charged ions is 2-aminobenzoyl alcohol (ABA) and some of the DHB isomers. Volatile and liquid matrixes can also employed.

Figure 85:
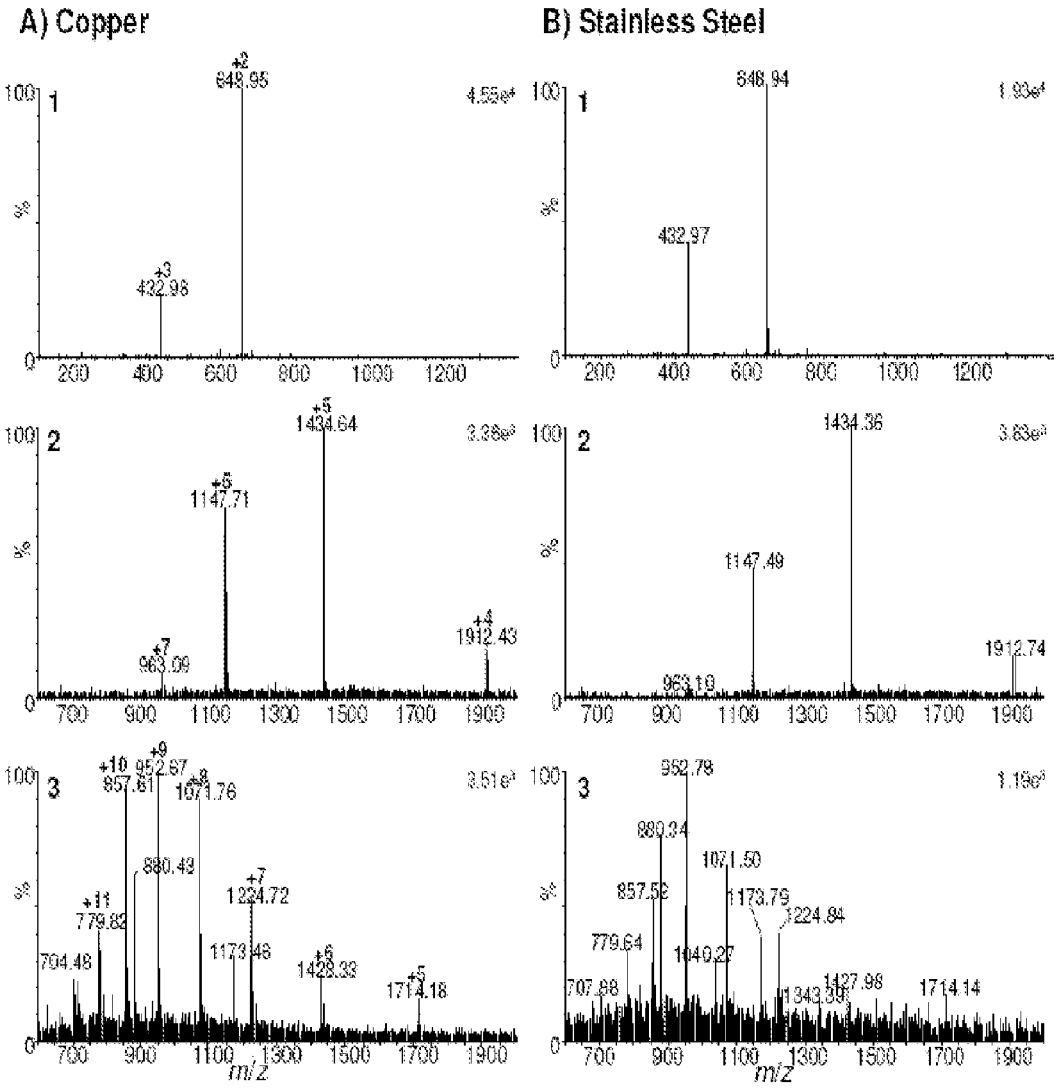
FIG. 85 depicts a comparative study of the desolvation device metal material. A) copper and B) stainless steel using 1) angiotensin 1, 2) insulin from bovine, and 3) ubiquitin as samples used to acquire the LSI-MS mass spectrum, prepared using 2,5-DHAP matrix in 50:50 ACN/water.

Two desolvation devices were studied on their capability to desolvate the 2,5-DHAP matrix. FIGS. 85A-B show MS obtained from copper and stainless steel desolvation devices and there is no difference in the signal intensities for low mass proteins. FIG. 85(A) shows the MS from a copper desolvation device and FIG. 85(B) shows the MS from a stainless steel desolvation device using sample (1) angiotensin (MW 1295), (2) insulin from bovine (MW 5731), and (3) ubiquitin (MW 8561) The samples were prepared using 2,5-DHAP matrix in 50:50 ACN/water. FIG. 85A3 shows that copper gave higher signal intensity for higher mass proteins.

Figure 86:
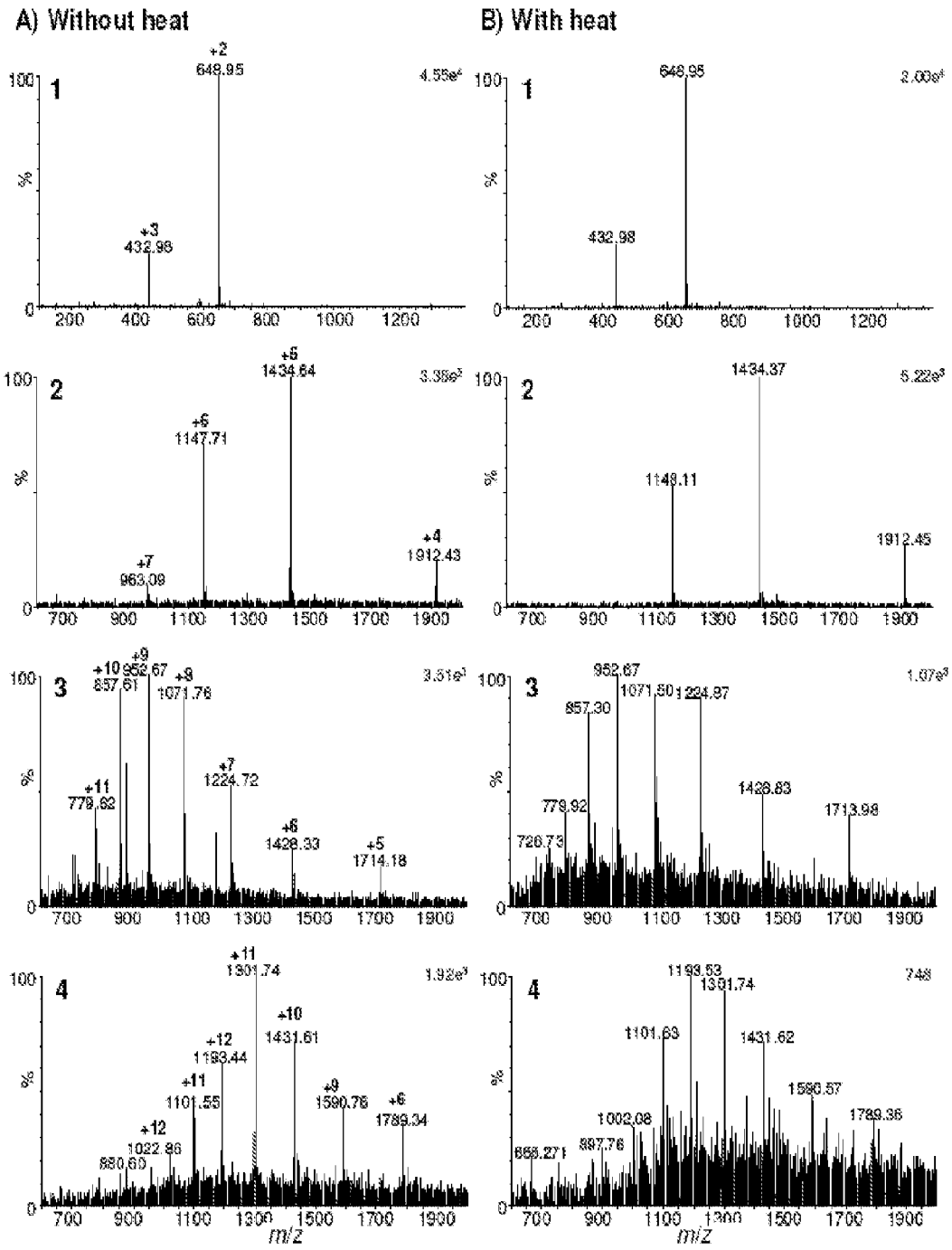
FIG. 86 depicts LSI-MS mass spectra using 2,5-DHAP as matrix of 1) angiotensin 1, 2) insulin, 3) ubiquitin, and 4) lysozyme using the copper desolvation device A) without heat, and B) with added heat applied (5 V).

FIG. 86 depicts LSI-MS mass spectra using 2,5-DHAP as a matrix of 1) angiotensin 1 (MW 1295), 2) insulin (MW 5731), 3) ubiquitin (MW 8561), and 4) lysozyme (MW 14300) using the copper desolvation device without heat, shown in section (A) and with added heat applied (5 V), shown in section (B). The source temperature is 150° C. The mass spectra of FIG. 86(A)(2) shows that the proteins have higher signal to noise ratio and better mass spectra without heat applied on the desolvation device as seen in FIG. 86(B)(2).

Figure 87:
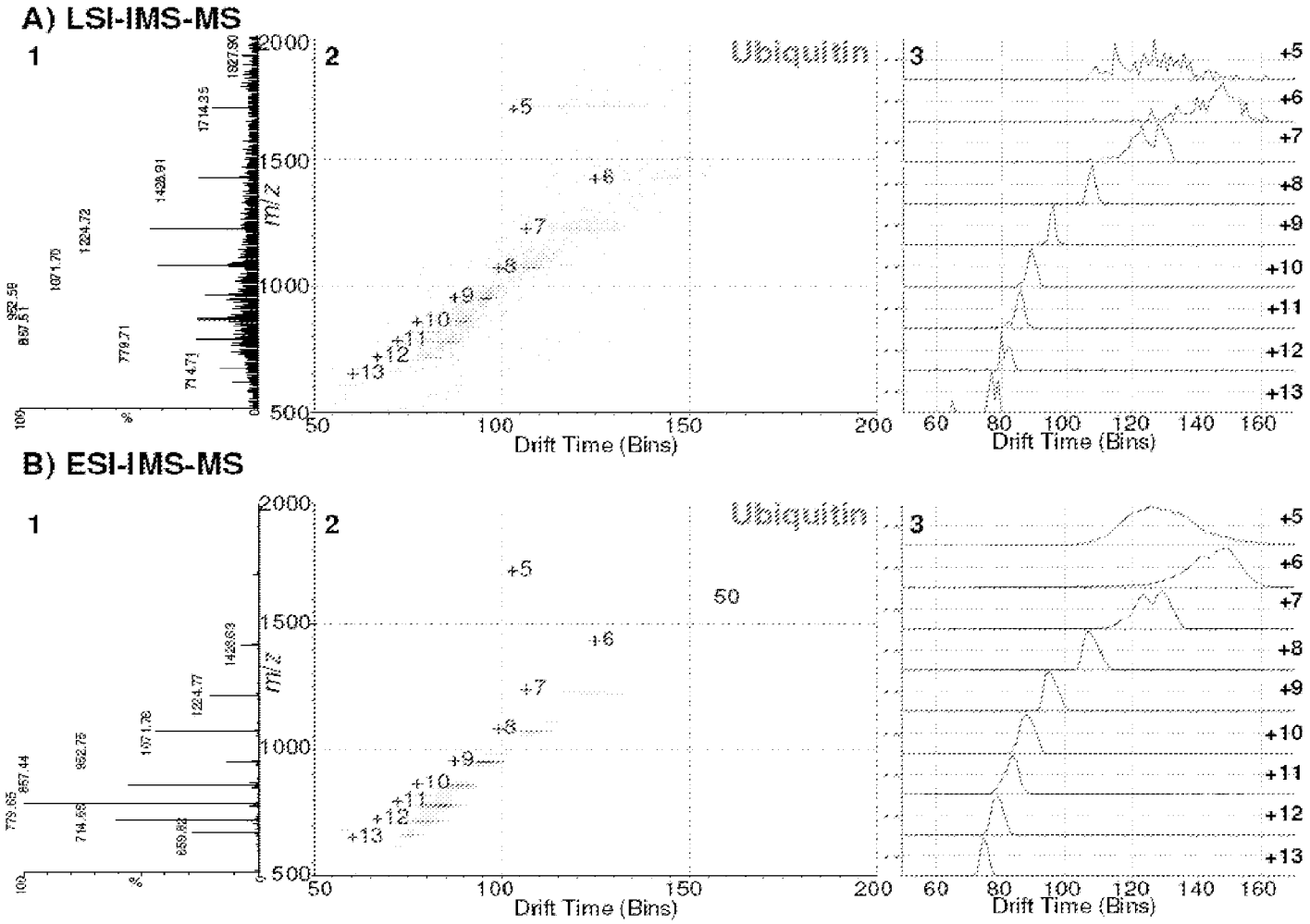
FIG. 87 depicts LSI-IMS-MS of the multiply-charged structures of ubiquitin.

FIG. 87 shows the IMS-MS data of Ubiquitin A) by LSI and B) by ESI. Section (1) depicts mass spectrum, section (2) depicts a 2D-plot of drift time vs. m/z, and section (3) depicts the drift time distribution of different charge states acquired using A) LSI incorporating 2,5-DHAP matrix in 50:50 ACN/water, and B) ESI in 49:49:2 ACN/water/acetic acid. For LSI, 2,5-DHAP was used as matrix and the data were acquired using the copper desolvation device without applied heat but with the ion source temperature set to 150° C. ESI was obtained at a flow rate of 5 μL/min and a source at 150° C. The mass spectral charge states in (FIGS. 87(A)(1) and 87(B)(1) are similar and the drift times in (87(A)(3) and 87(B)(3) nearly identical demonstrating similar gas phase ion structures by the two ionization methods.

Figure 88A:
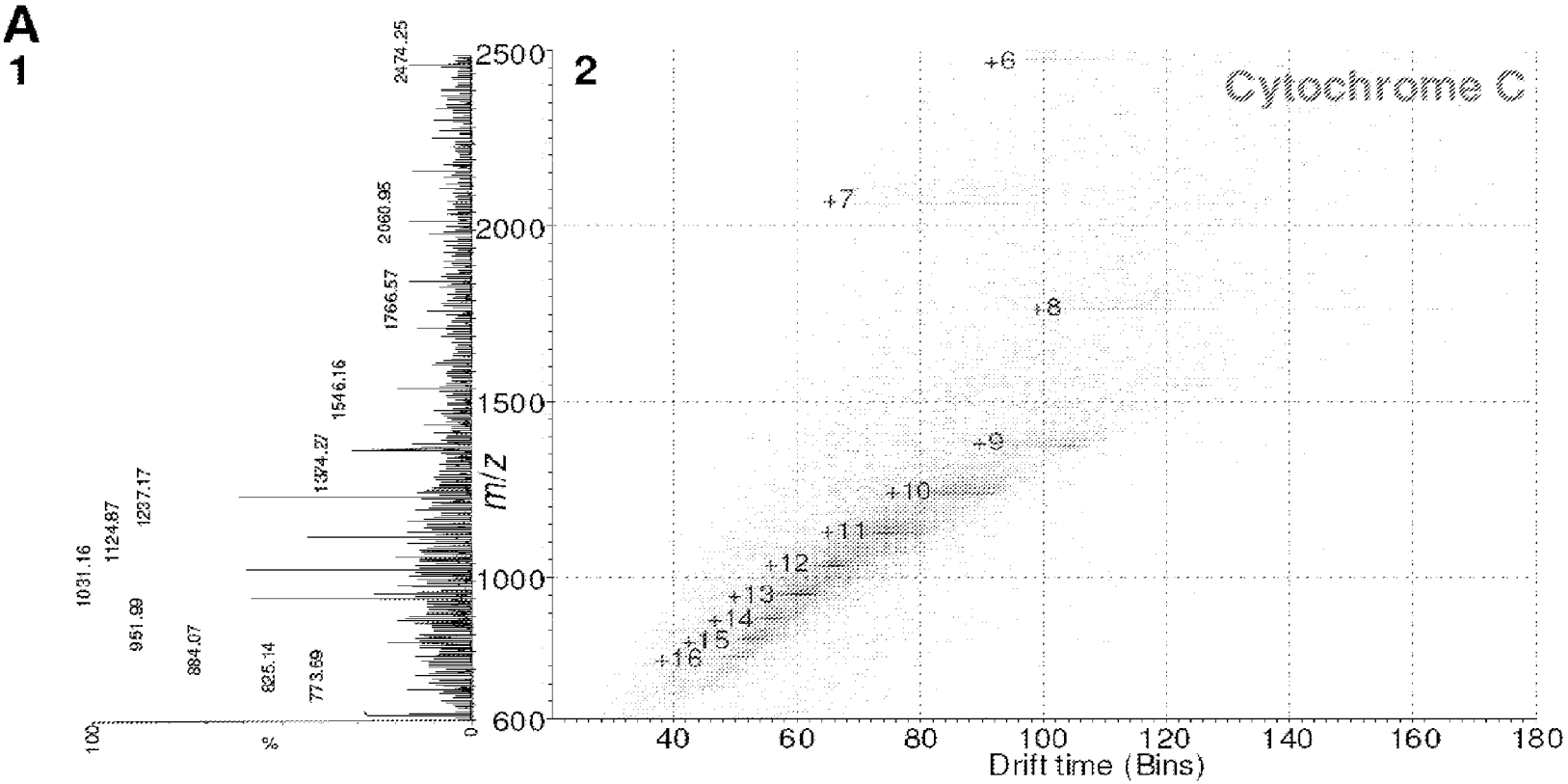
FIG. 88 depicts LSI-IMS-MS. Section (1) shows mass spectrum and section (2) shows 2D plot of $t_d$ vs. m/z, of A) cytochrome C, (B) lysozyme, and C) myoglobin prepared using the 2,5-DHAP matrix in 50:50 ACN/water and acquired using the copper desolvation device without heat.
Figure 88B:
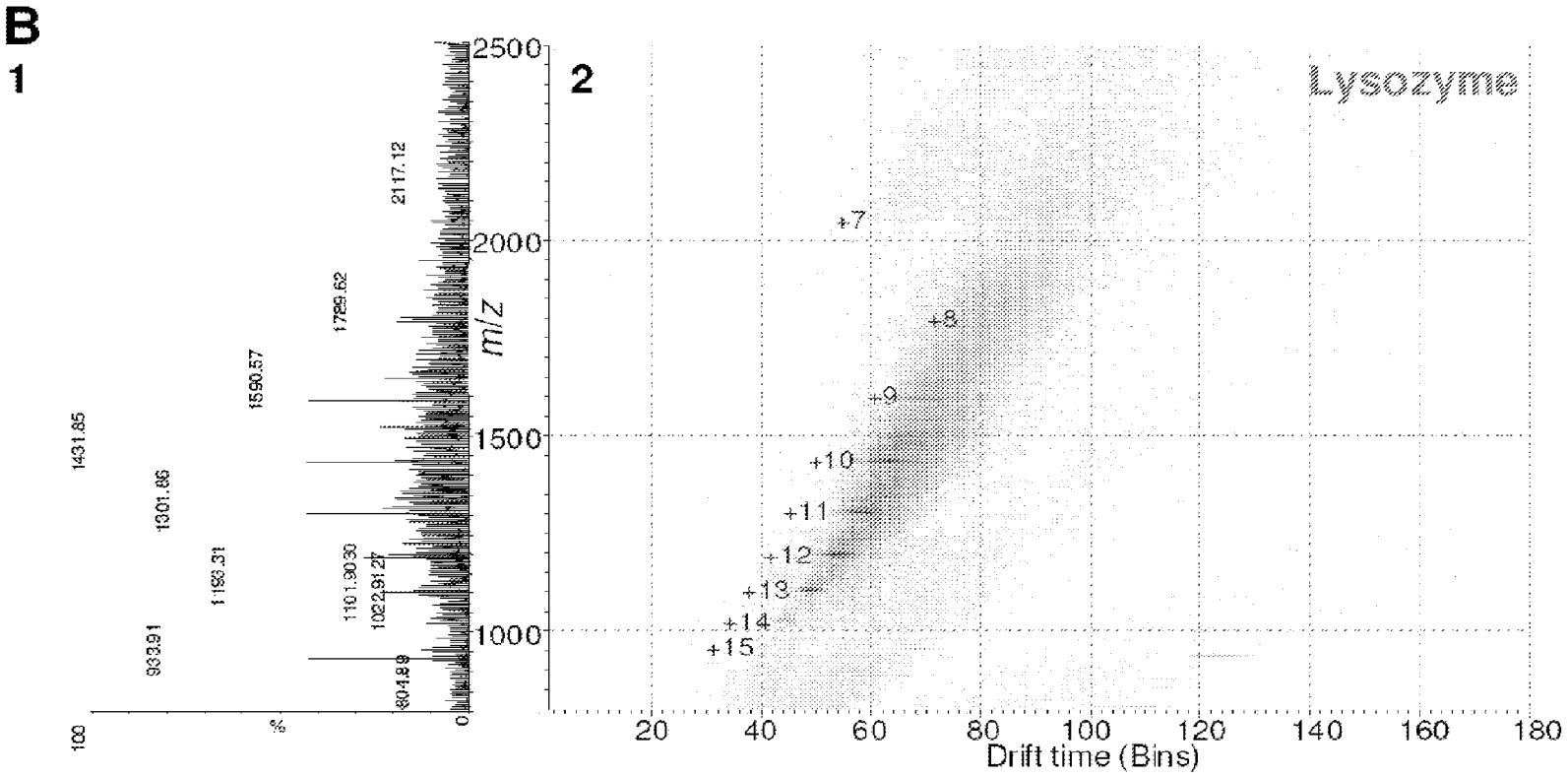
Figure 88C:
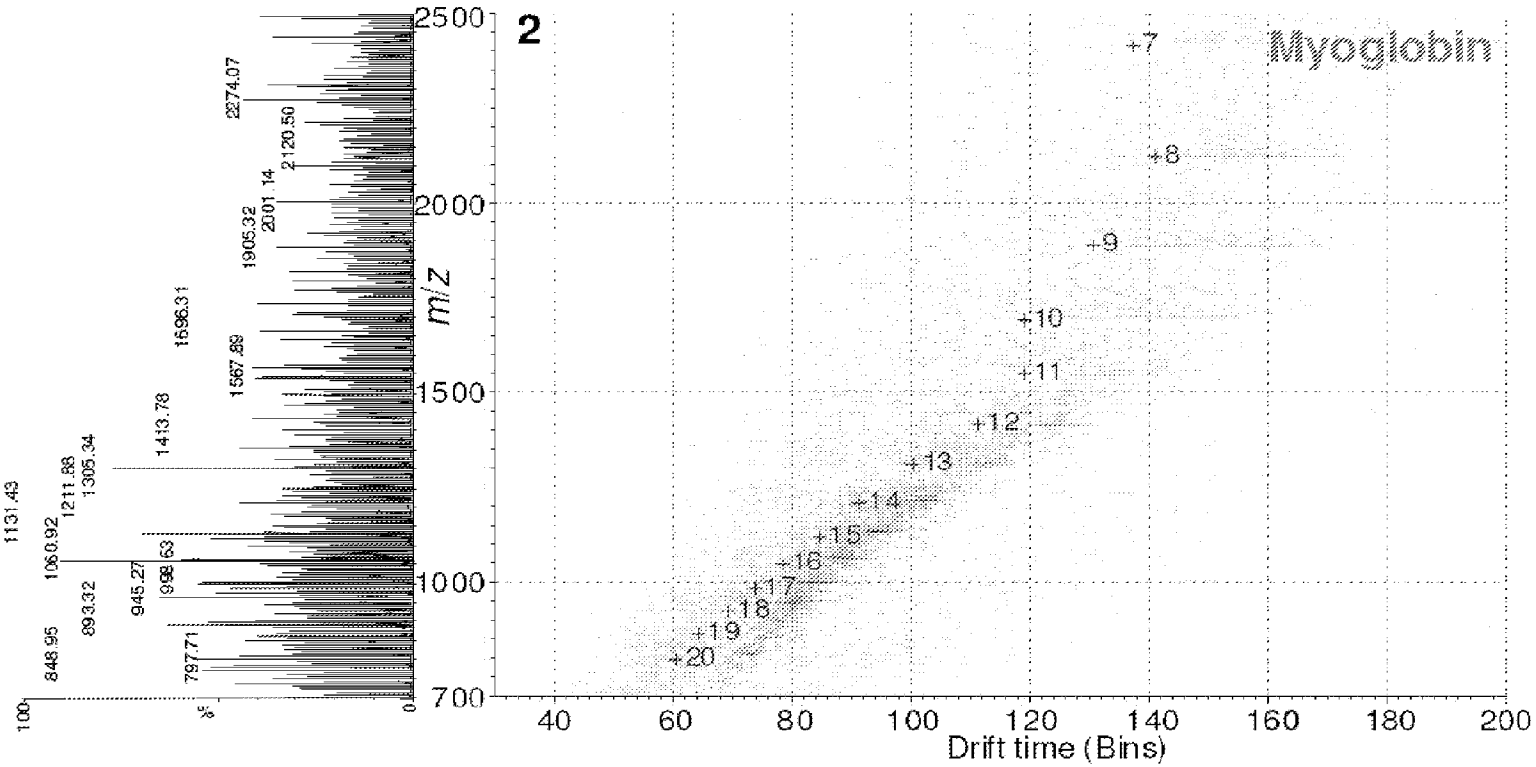

FIG. 88 depicts Section (1) depicts mass spectrum and section (2) depicts a 2D plot of $t_d$ vs. m/z, of high mass protein: (A) cytochrome C (MW 12310), (B) lysozyme (MW 14300), and (C) myoglobin (MW 16952) prepared using the 2,5-DHAP matrix in 50:50 ACN/water and acquired using the copper desolvation device without heat. The source temperature is 150° C. These higher mass proteins show the applicability of the LSI to acquire IMS-MS data (FIG. 88 (2)) using the copper desolvation device without applying heat but with a source temperature of 150° C.

Figure 89:
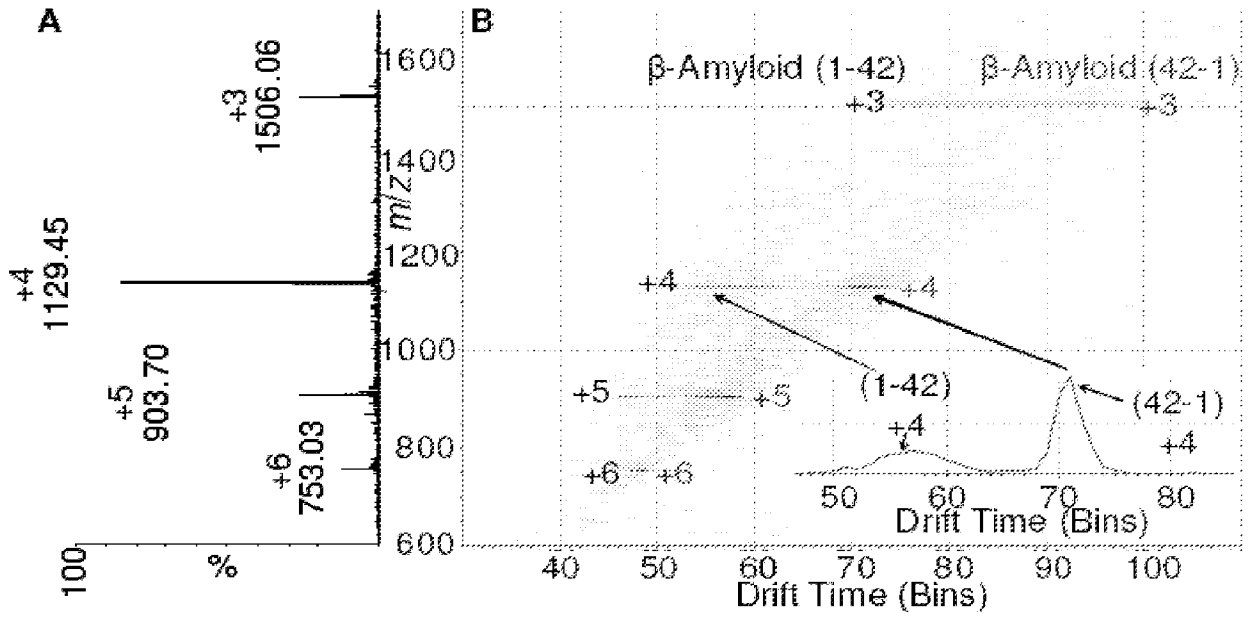
FIG. 89 depicts LSI-IMS-MS of an isomeric protein of β-amyloids (1-42) and (42-1) using 2,5-DHAP matrix in 50:50 ACN/water acquired using the copper desolvation device with no heat.
Figure 90:
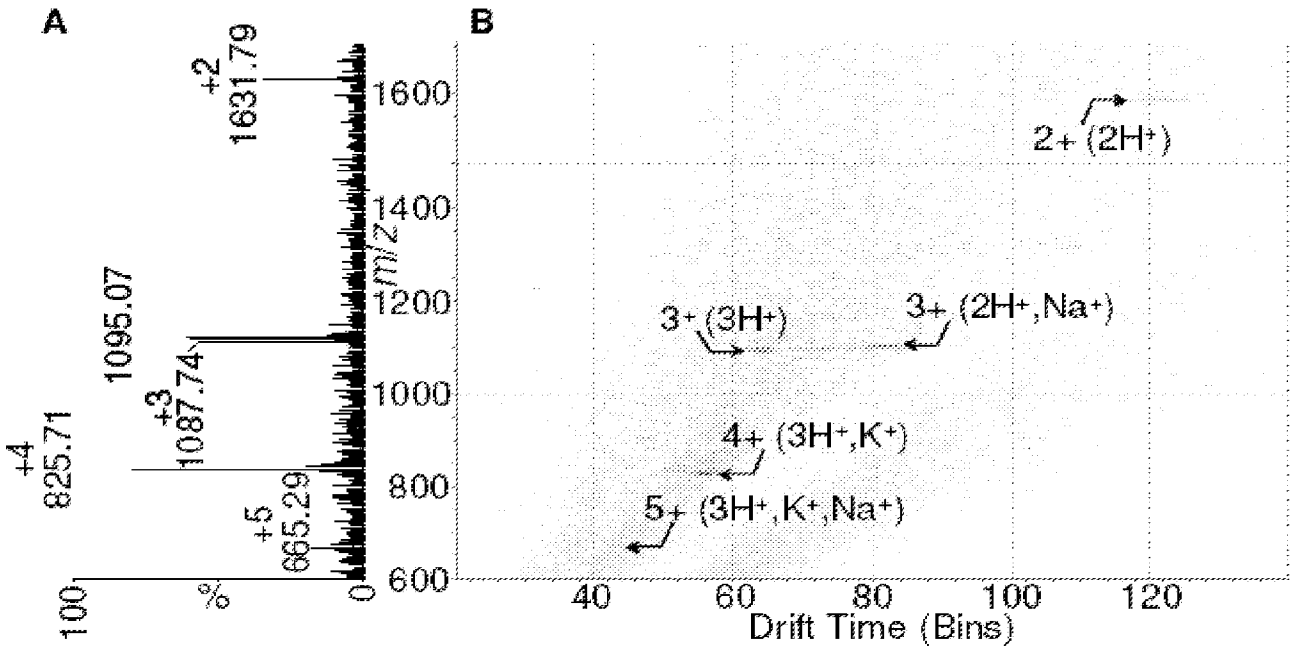
FIG. 90 depicts LSI-IMS-MS TSA of non-amyloid component of Alzheimer's disease (NAC) using a 2,5 DHAP matrix acquired using the copper desolvation device without heat applied.

The method was also used to analyze isomeric protein mixture of β(1-42) and (42-1). FIG. 89 depicts LSI-IMS-MS of an isomeric protein mixture of β-amyloids (1-42) and (42-1) using 2,5-DHAP matrix in 50:50 ACN/water acquired using the copper desolvation device with no heat. The mass spectrum, section (A), does not distinguish the presence of two compounds but the two dimensional plot of $t_d$ vs. m/z driftscope snapshot, section (B), clearly shows the two components. The inset in section (B) shows nearly baseline separation of the +4 charge state. The two dimensional drift time vs. m/z shows separation according to the number of charges and cross-section for both proteins and at superimposed positions compared to the pure samples analyzed in FIGS. 117 and 118, respectively. The charge states of the proteins are baseline separated as is shown with the extracted drift time distribution (lower right corner) of charge state +4. Beta-amyloid (1-42) is known for its low solubility and high aggregation tendency and plays a key role in neurotoxic plaque formation in Alzheimer Disease. This shows that the isomeric peptides can be ionized and separated using LSI-IMS-MS; the (1-42) has the more compact structure as observed with the faster drift times. The analysis was conducted using 2,5-DHAP as the matrix and no additional heat other than the 150° C. of the ion source was applied to the thermal device.

and the method was also used to analyze the total solvent-free analysis for the Non-Amyloid component of Alzheimer's disease (NAC). FIG. 90 depicts LSI-IMS-MS total solvent-free analysis of Non-amyloid component of Alzheimer's disease (NAC) using 2,5 DHAP matrix acquired using the copper desolvation device without heat applied. Section (A) depicts the mass spectrum and section (B) depicts the 2D time drift vs. m/z. The driftscope representation demonstrates the efficient production of large multiply charged peptide ions directly from a surface at atmospheric pressure. The higher charge states show cation addition as well as proton addition, similar to observations in vacuum MALDI. Lower charge states show two distinct shapes.

F. Conclusion

A simple desolvation device was fabricated to convert multiply-chargedmatrix/analyte clusters formed by laser ablation of a matrix/protein mixture into multiply charged ions for instruments that have low heat and/or thermal capabilities such as the Waters IMS-MS instrument. The success of using this fabricated desolvation device under AP conditions to produce multiply charged LSI ions supports the proposed ionization mechanism that LSI is similar to ESI. The applicability of the method to solvent-free decongestion (separation) of protein mixtures and total solvent-free analysis using IMS-MS technology is very promising for tissue imaging applications.

III. Example 3

This example studies the matrixes and matrix preparation methods that produce multiply charged positive and negative ions for total solvent-free analysis via laserspray ionization.

A. Introduction

Previous studies have only shown the production of multiply charged LSI ions from solvent-based dried droplet sample preparations. Efforts are devoted to understanding the processes involved in formation and charge reduction of ESI-like multiply charged ions produced in LSI by laser ablation of a matrix commonly used in MALDI MS. Understanding how incorporation of analyte in the matrix can produce primarily multiply charged ions and non-incorporation produces all singly charged ions, and whether or not this applies to matrices other than 2,5-dihydroxybenzoic acid, is of fundamental importance in understanding the MALDI mechanism and developing new and improved MS applications. It is expected that insights gained in these studies involving a number of common matrix materials, as well as the discovery of the production of multiply charged positive and negative ions for TSA, will provide improvements in producing multiply charged ions using laser-based AP ionization instrumentation. Solvent-free preparation was studied with LSI.

B. Methodology

The common MALDI matrixes 2,5-dihydroxybenzoic acid (DHB) and 2,5-dihydroxyacetophenone (DHAP) were studied, as well as matrixes that were previously untested with the LSI method, 2-aminobenzyl alcohol (ABA), anthranilic acid (AA), and 2-hydroxyacetophenone (HAP). In solvent-based applications, Angiotensin 1 analyte was prepared by dissolving powdered analyte (purchased from American Peptide Company Inc.) in 50:50 ACN:water at a concentration of 7.7 nmol $\mu L^{-1}$. Protein analyte was prepared by dissolving powdered bovine insulin (purchased from Sigma Aldrich) in 50:50 water:MeOH at a concentration of 90 pmol $\mu L^{-1}$. 2 μL of analyte solution was spotted on a glass slide (purchased from Gold Seal), and then 2 μL of saturated matrix solution was spotted on top, mixed, and dried. For solvent-free preparations, 10 μL of analyte (prepared in 50:50 water:MeOH solution) were poured onto stainless-steel beads and evaporated for 3 hours at 35° C. to remove the solvent. The TissueLyzer approach was then employed to place the solid analyte/matrix mixture on a glass slide. Samples involving ABA were prepared by directly mixing powered angiotensin 1 and matrix with the TissueLyzer. Samples involving HAP (liquid at 25° C.) were prepared by mixing 2 μL of analyte solution and 2 μL of matrix on a glass slide. All samples were ablated in transmission geometry with a Spectra Physics VSL 337 ND-S nitrogen laser into a modified Waters SYNAPT G2 mass spectrometer for ion mobility spectrometry (IMS)-MS analysis, or a Thermo LTQ-Velos mass spectrometer. A 355 nm Nd:YAG laser was also used for the microscopy studies and HAP samples. All matrixes were purchased from Sigma Aldrich.

C. Results

Figure 91:
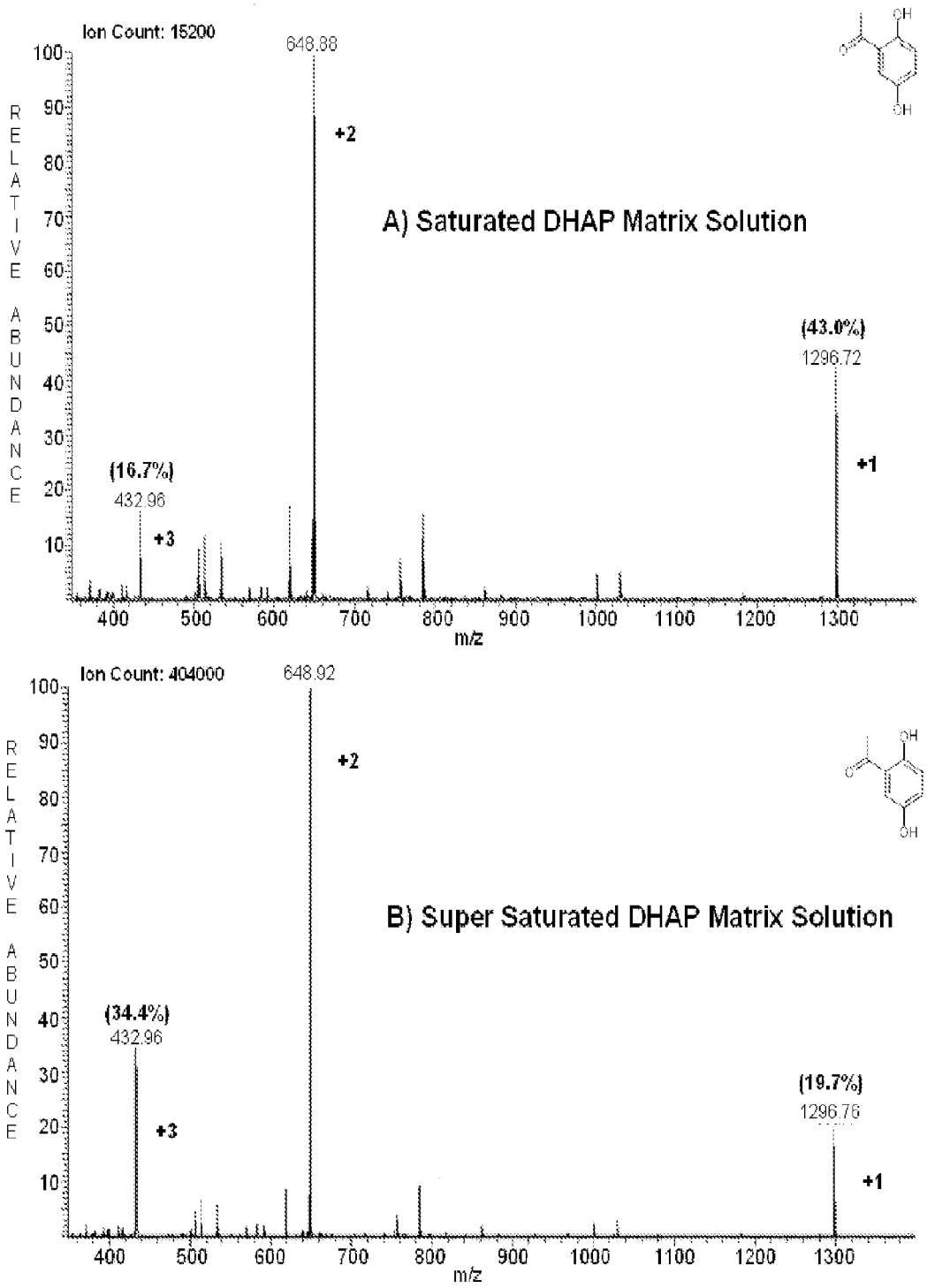
FIGS. 91A-B depicts LSI mass spectra of angiotensin 1 from the LTQ-Velos. (A) in a saturated DHAP solution (50:50 ACN/water) and (B) where the solution was warmed and became super-saturated, allowing more matrix in each 2 μL spot.
Figure 92:
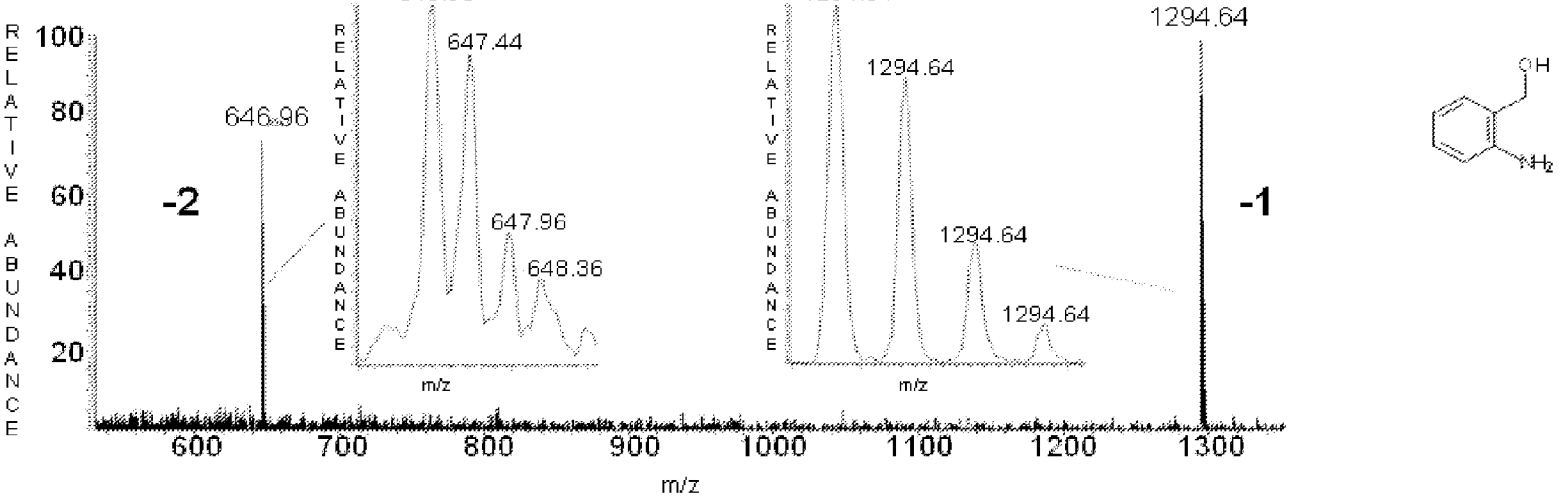
FIG. 92 depicts LSI LTQ mass spectra of singly and doubly charged negative angiotensin 1 ions from an ABA solution (50:50 ACN/water).
Figure 93:
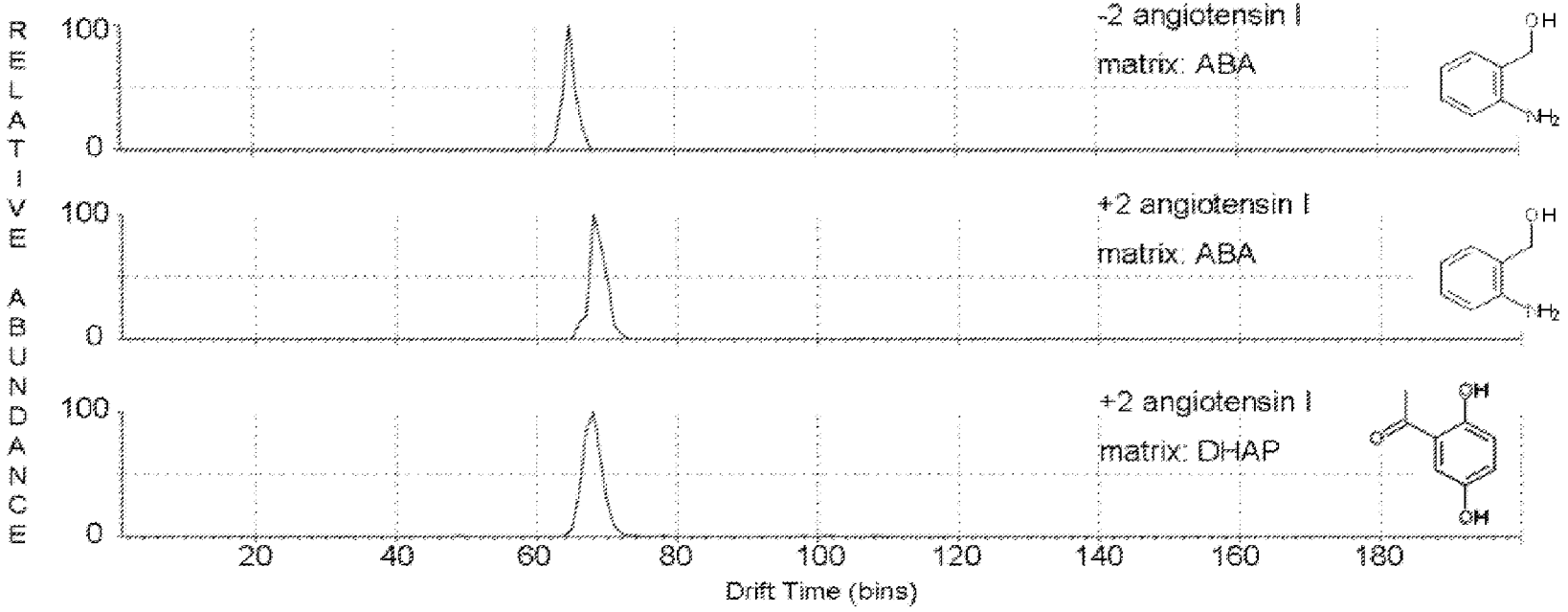
FIG. 93 depicts LSI-IMS-MS drift time distribution of negative and positive doubly charged angiotensin 1 ions.

Conditions for improved multiply charged ion formation in LSI are demonstrated. FIGS. 91A-B depicts LSI mass spectra of angiotensin 1 from the LTQ-Velos. In FIG. 91(A) a saturated DHAP solution (50:50 water:ACN) yields more +1 ions than +3 ions. In FIG. 91(B), the solution was warmed and became super-saturated, allowing more matrix in each 2 μL spot. This method yielded a spectrum with a higher +3 ion ratio and a higher overall ion intensity than the saturated solution. FIG. 92 depicts LSI LTQ mass spectra of singly and doubly charged negative Angiotensin 1 ions from an ABA solution (50:50 water:ACN). The zoomed in spectra show isotopic distributions corresponding to the charge. With a basic amino acid substituent, it is shown that LSI can produce multiply charged negative ions. Matrixes without an amino group only produced singly charged negative ions. Observation of drift time distributions for positive and negative doubly charged Angiotensin 1 ions reveal that the negative ion has a slower drift time and the positive ions have the same drift time, regardless of what matrix produces them. FIG. 93 reveals that the −2 ion travels slightly slower than the +2 ions and that the +2 ions show the same drift times regardless of what matrix is used.

Figure 94:
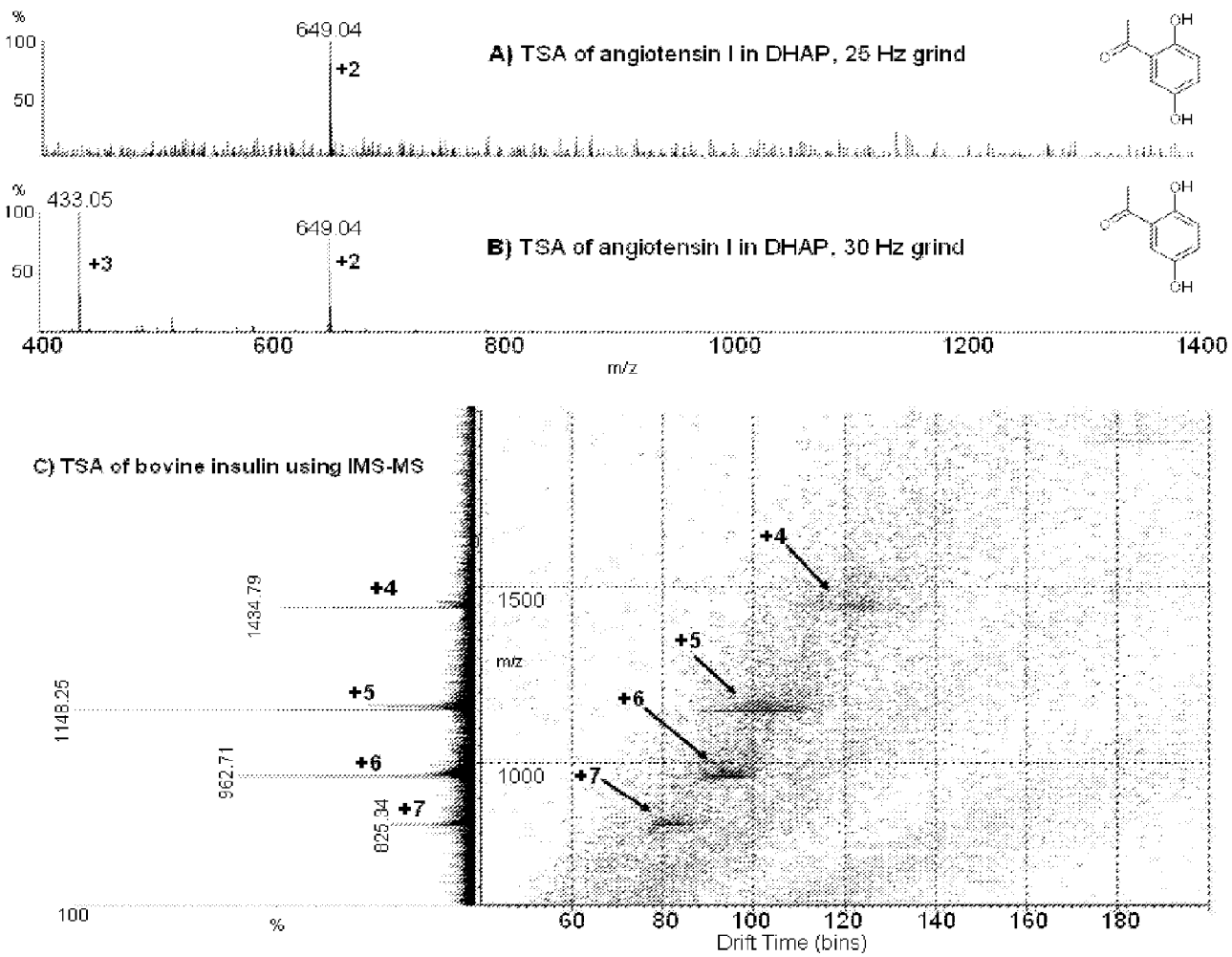
FIGS. 94A-C depict TSA production of multiple charges via DHAP.

The abundant production of multiply charged ions is demonstrated, with a grinding frequency of 30 Hz being optimal for analyte incorporation into the matrix. FIGS. 94A-C depict TSA production of multiple charges via DHAP. FIG. 94(A) depicts a 10 minute grind at 25 Hz gives only the +2 charge. FIG. 94(B) depicts a 10 minute grind at 30 Hz gives both +2 and +3 charges, with +3 having the highest relative abundance. FIG. 94(C) Depicts a 30 Hz grind is able to incorporate bovine insulin into crystals of DHAP so that charge states as high as +7 are attained in a strong 2-dimensional drift time plot.

Figure 95:
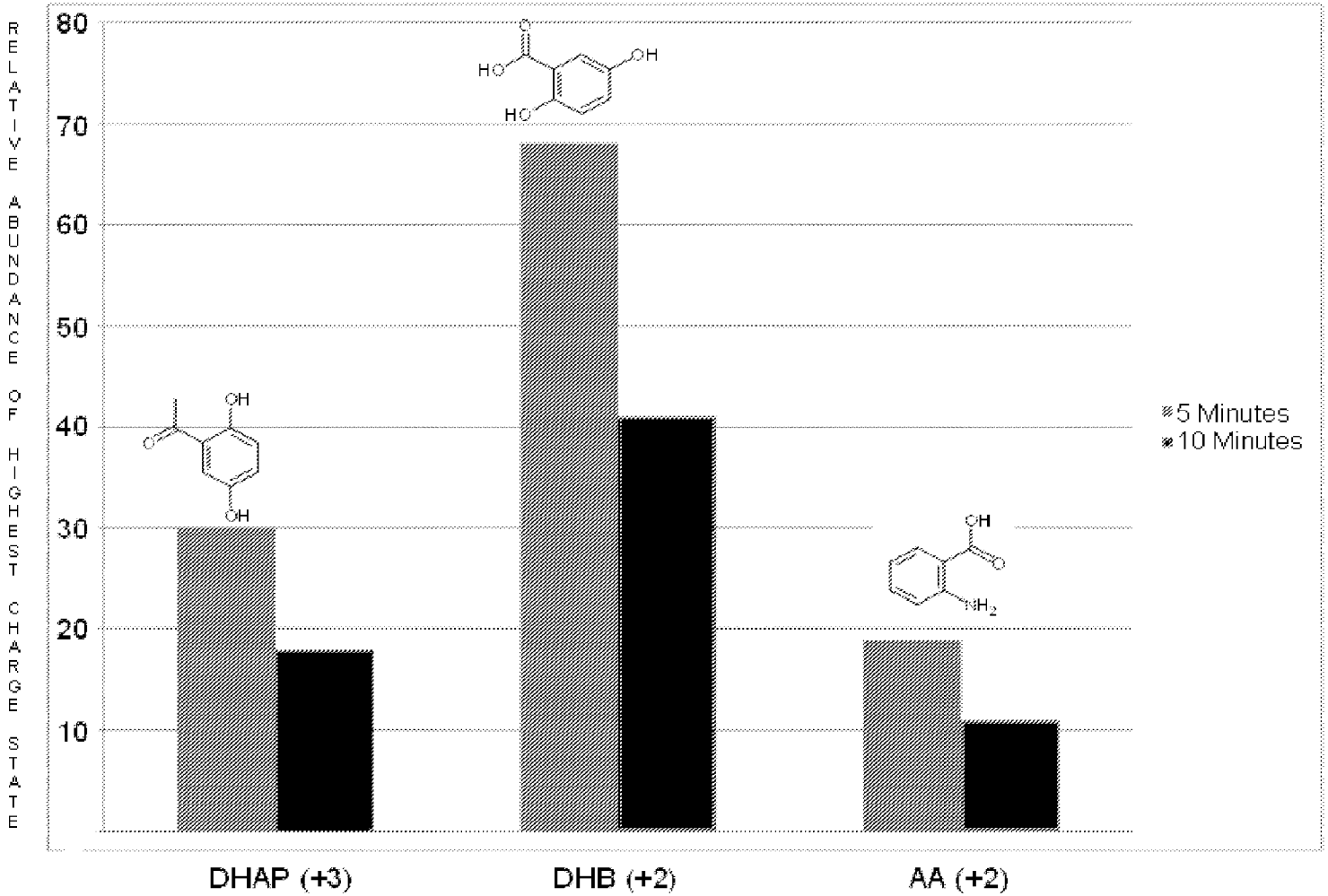
FIG. 95 shows a graph indicating that the ratio of the highest angiotensin 1 charge states (+2 to +3) produced by each matrix prepared solvent-free, is inversely proportional to grinding time past five minutes.
Figure 97:
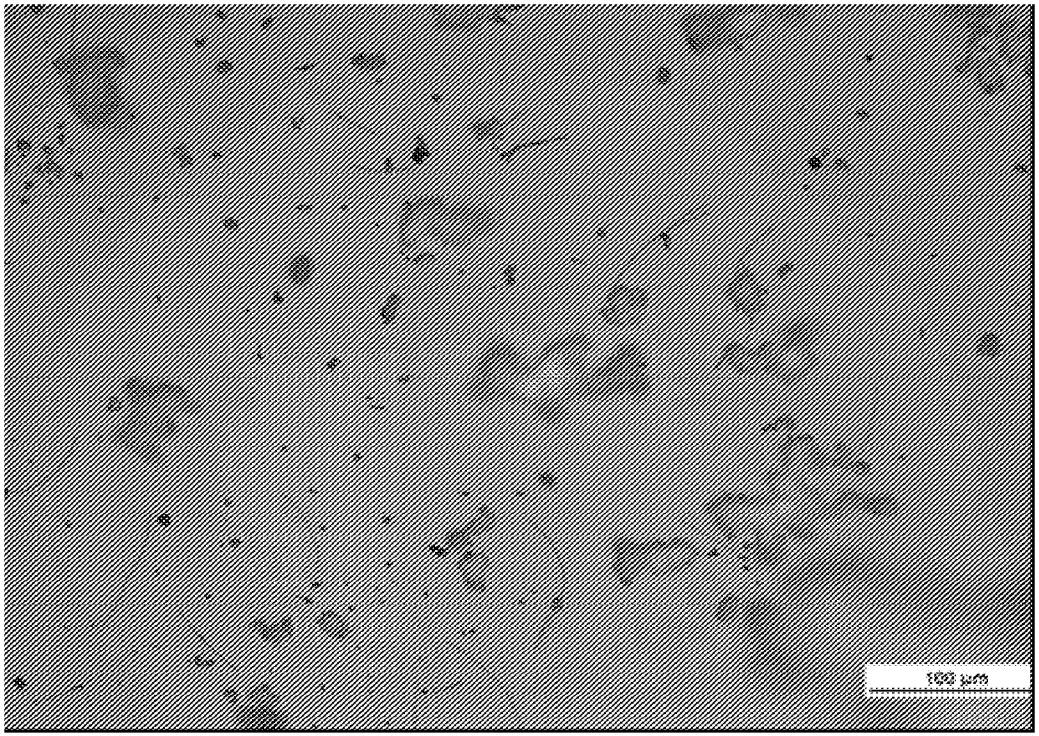
FIG. 97 depicts DHB ablated by a 337 nm laser.
Figure 98:
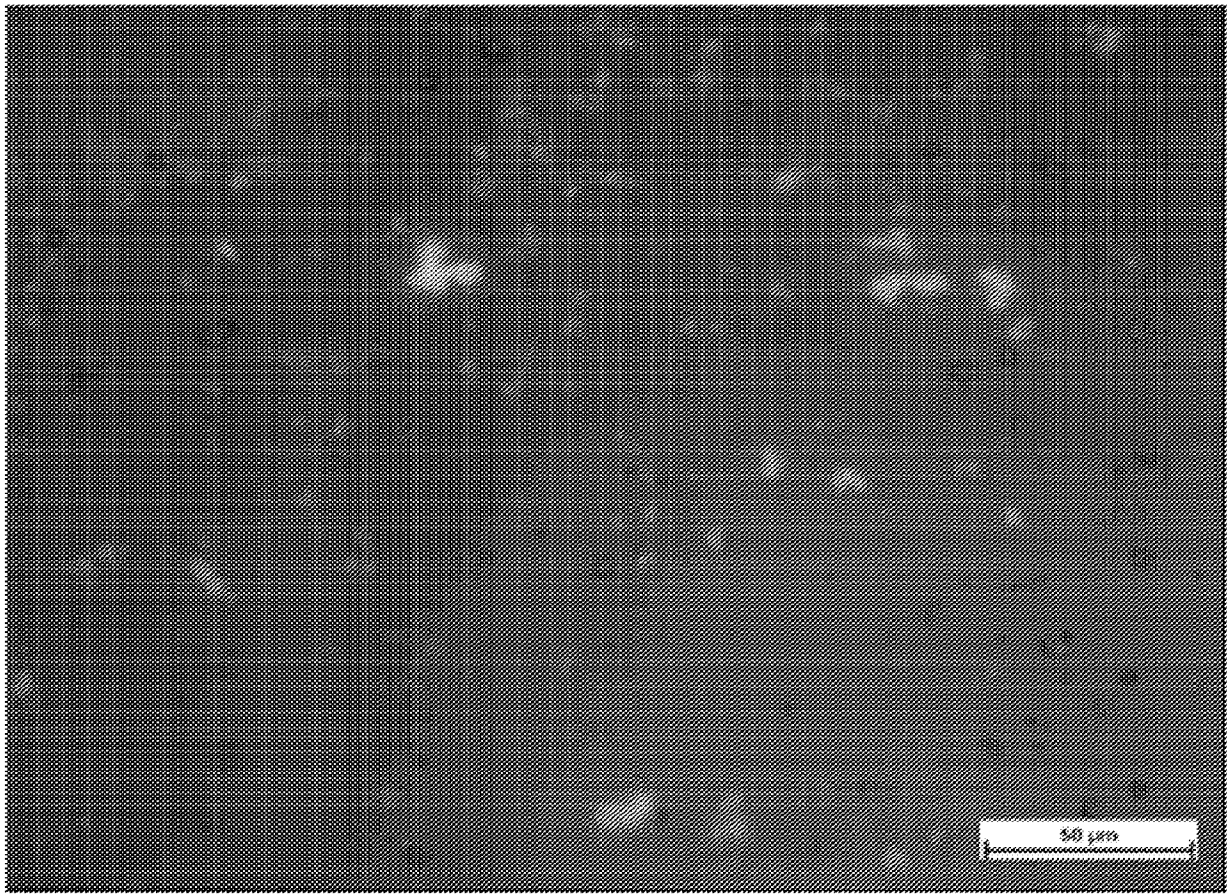
FIG. 98 depicts DHB ablated by a 355 nm laser with higher flux.
Figure 99:
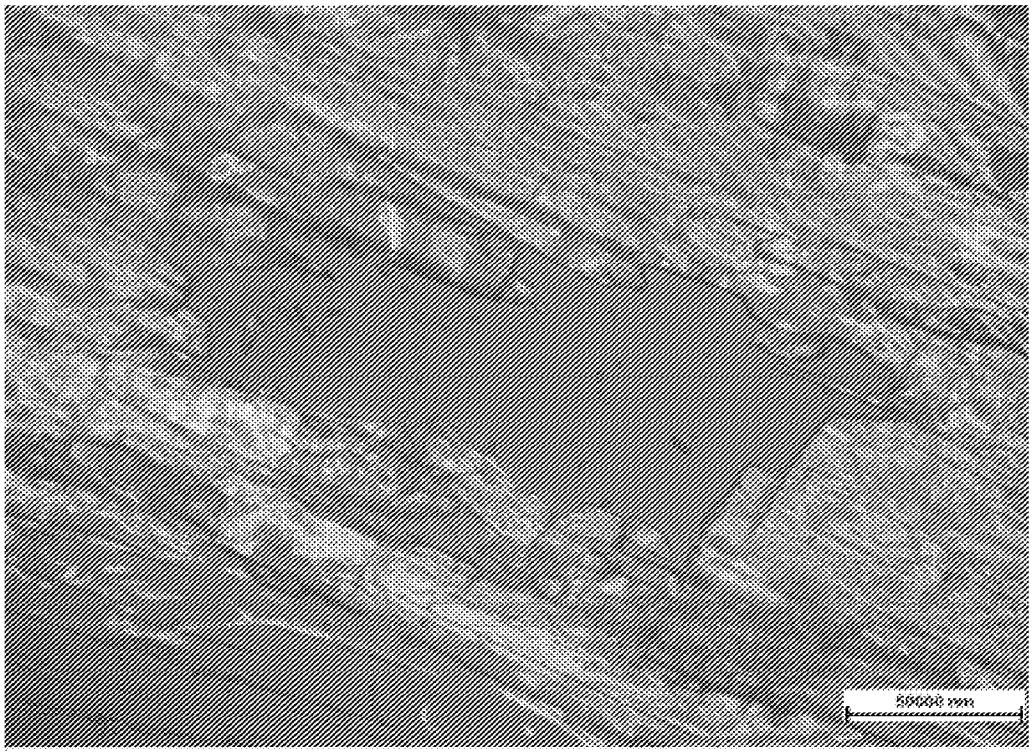
FIG. 99 depicts ABA ablated by a 337 nm laser.
Figure 100:
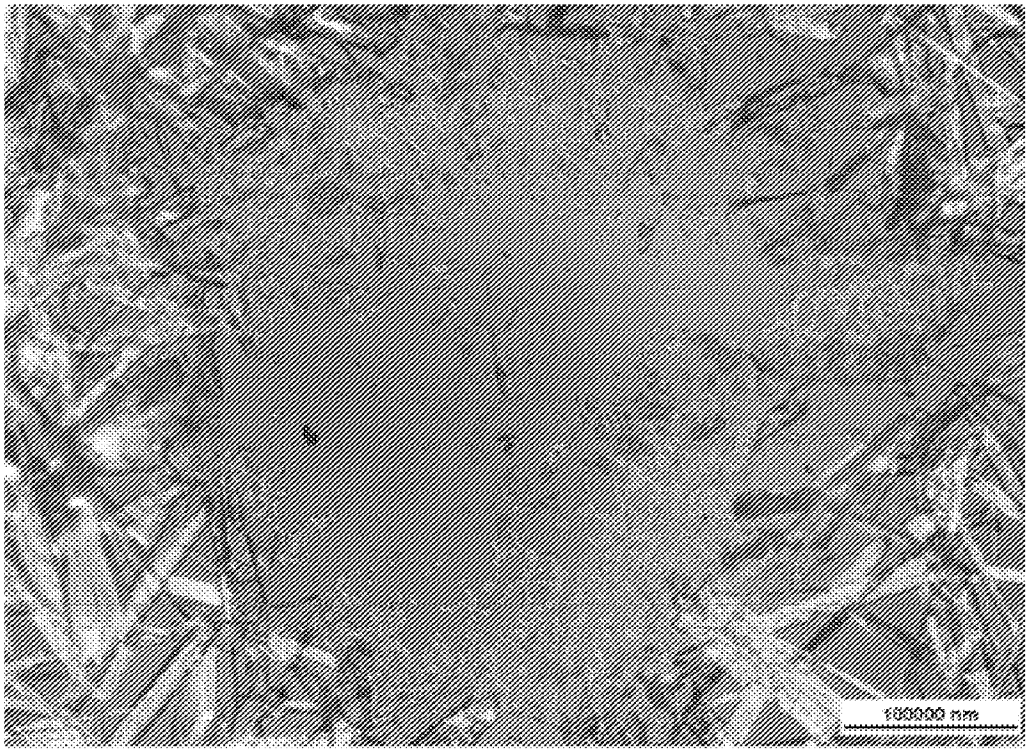
FIG. 100 depicts ABA ablated by a 355 nm laser.

Multiple charges were also produced by dissolving analyte into the matrix itself by using an organic liquid matrix, though as shown in FIG. 96, spectra of Angiotensin 1 ablated with HAP matrix (a liquid at 25° C.), display that results were only achieved using a Nd/YAG laser with a 355 nm wavelength. FIG. 95 shows a graph indicating the ratio of the highest Angiotensin 1 charge states (+2 to +3) produced by each matrix prepared solvent-free, is inversely proportional to grinding time past five minutes. When preparing solvent-free samples, each matrix mixture was shown to produce a smaller high-charge ratio when grinded for 10 minutes instead of 5 minutes. Finally, qualitative microscopy studies reveal the formation of molten DHB/analyte droplets when the 355 nm Nd:YAG laser is used with higher flux as shown in FIG. 98, as opposed to very little molten material from the 337 nm nitrogen laser as shown in FIG. 97. Solvent-free LSI experiments of the DHB ablated by a 337 nm laser yielded only single charges. Solvent-free LSI experiments of the DHB ablated by a 355 nm laser produced multiply charged ions. Additionally, the lack of molten ablation in solvent-based ABA experiments with the nitrogen laser is shown and contrasted to the copious amounts of molten material formed with the 355 nm Nd/YAG laser. FIG. 99 depicts ABA ablated by a 337 nm laser. This laser has trouble breaking the crystal structure of ABA, and thus gives a much lower signal for solvent-based LSI experiments. FIG. 100 depicts ABA ablated by a 355 nm laser. This laser yields much better multiple charged signals than the 337 nm in solvent-based LSI experiments because the higher laser flux allows for the formation of molten matrix/analyte droplets.

D. Conclusion

An understanding of which LSI conditions lead to the abundant production of multiply charged ions is very important for the improvement of MS applications. Solvent-free multiple charge production can possibly extend LSI fragmentation techniques to solubility-restricted analyte, and the formation of negative ions could improve the analysis of molecules much more prone to deprotonation than protonation.

IV. Example 4

This example describes solvent-free MALDI studies and results of samples produced using the TissueBox/SurfaceBox device for solvent-free MALDI matrix deposition to surfaces.

A. General Methods

For ball-milling, stainless steel beads (1.2 mm) and chrome beads (1.3 mm) were purchased from BioSpec Products, Inc. Bartlesville, Okla. The 3 and 20 μm mesh of material A was purchased from Industrial Netting, Inc., Minneapolis, Minn., and the 20 μm of material B from Hogentogler & Co, Inc. Colombia, Md. The matrixes, a-cyano-4-hydroxy-cinnamic acid (CHCA) and 2,5-dihydroxybenzoic acid, 98% (DHB), were purchased from Sigma Aldrich, Inc., St. Louis, Mo. The solvents, acetonitrile (ACN) and trifluoroacetic acid (TFA) were purchased from Fisher Scientific Inc., Pittsburgh, Pa. Purified water was used (Millipore's Corporate, Billerica, Mass.). The plain microscopy slides (dimensions 1 in.×3 in.) were purchased from Gold Seal Products, Portsmouth, N.H.

ITO-coated conductive slides for imaging were used (Bruker, Billerica, Mass.). The airbrush (⅕ horse power, 100 PSI compressor and airbrush kit) was obtained from Central Pneumatic Professional, Camarillo, Calif. A plastic vacuum sealed food container was used for sample transport and defrosting without disturbing the tissue/matrix composition was purchased from ZeVRO, Skokie, Ill.

1. Mouse Brain Tissue

C57 BI/6 mice, 18 weeks old, were anesthetized and transcardially perfused with ice-cold 1× phosphate-buffered saline (150 mM NaCl, 100 mM $NaH_2PO_4$, pH=7.4) for 5 min to remove red blood cells. The brains were frozen at −20° C. and sliced into 10 μm sections in sequence using a Leica CM1850 cryostat (Leica Microsystems Inc., Bannockburn, Ill.). Within the respective MALDI-TOF-MS and MALDI-IMS-MS studies, sections were used from the same mouse but the animals were different between the two different types of mass spectrometers used for analysis. Sections were placed onto prechilled slides. The glass slides were briefly warmed with the finger from behind to allow sections to relax and attach. Care was taken to avoid water condensation. Slides were stored at −20° C. in an airtight box containing desiccant until use.

Figure 18:
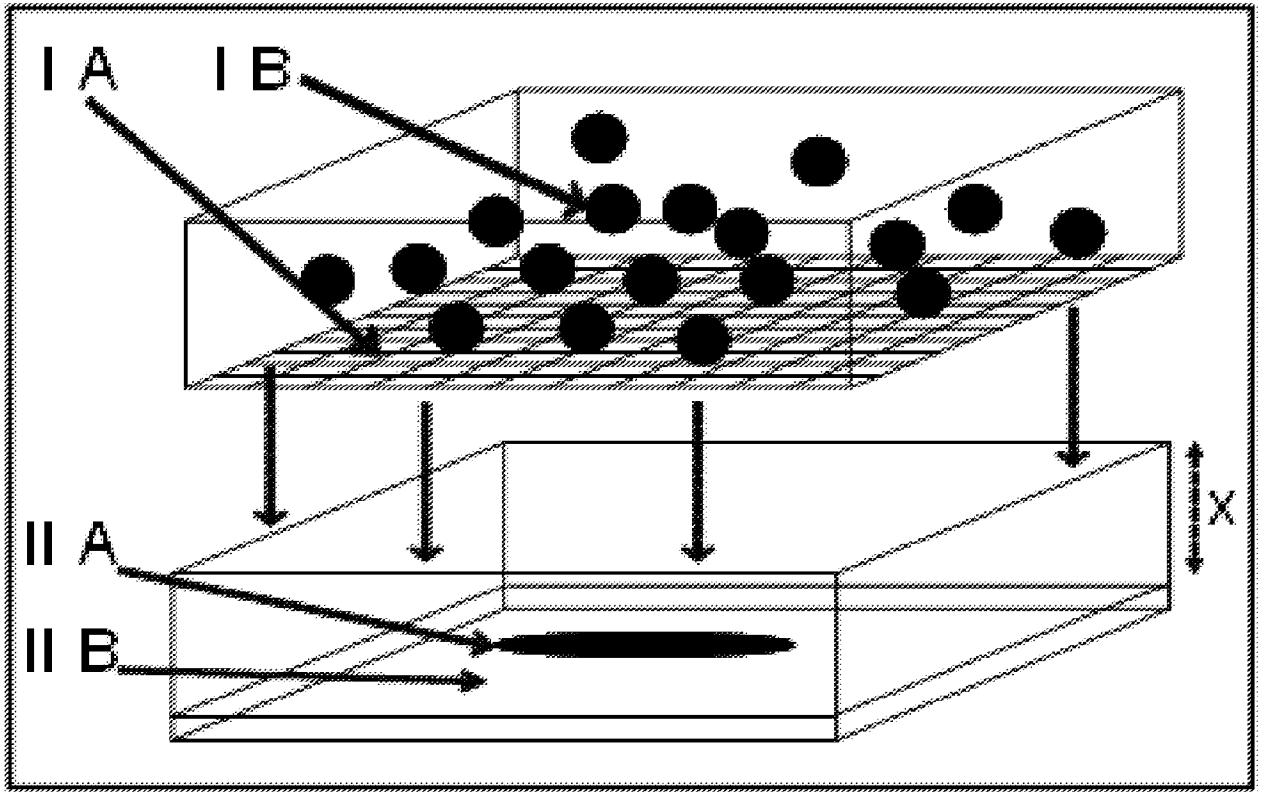
FIG. 18 depicts a schematic of a TissueBox showing preparation of matrix on a tissue section.

2. SurfaceBox for Rapid Solvent-Free Matrix Deposition Applications: Design and Fabrication A device was designed and fabricated for solvent-free MALDI matrix deposition to surfaces. FIG. 18 shows the principle design of this device consisting of two compartments tightly secured but in sufficient distance (about 1 cm) so that the vigorous movement of the beads, enabled by the ball-mill device (TissueLyzer), and the possible bending of the mesh did not harm the tissue section. The upper compartment is mounted with a mesh (20 or 3 μm) facing the lower compartment. The respective matrix materials and beads are added to the upper compartment of the SurfaceBox. The beads remain in the top section of the SurfaceBox along with the desired matrix material. The microscopy slide holding the tissue section facing the top compartment is placed in sufficient distance within the bottom compartment and fixed to the bottom compartment by either a slit in the side wall of the SurfaceBox or simply by the use of a double-sided adhesive tape on the bottom of the microscopy slide. The SurfaceBox is designed to prevent matrix contamination beyond the microscopy slide. The application of the respective matrix materials occurs through the vigorous movements of the SurfaceBox using the labor-free and flexible TissueLyzer device.

B. MS Analysis of Mouse Brain Tissue

1. Solvent-Free MALDI Analysis: MALDI-TOF Instrumentation

Frozen mouse brain tissue sections that were adhered to ITO glass slides (Bruker Datonics, Inc., Billerica, Mass.) were placed into a dry nitrogen chamber for 20 min during tissue thawing. A digital image of the tissue was taken with an Epson scanner (Epson Perfection 4490 Photo) at a resolution of 2400 dpi. The tissue was placed into the Autoflex III MALDI TOF instrument (Bruker Datonics, Inc., Billerica, Mass.), and the xy-positioning of the sample stage was registered using three teach points within the FlexImaging 2.1 software (Bruker Datonics, Inc., Billerica, Mass.). The instrument was operated in positive ion, reflectron mode measuring a mass range from 500 to 2000 Da. The all solid-state smartbeam laser was operated at a repetition rate of 200 Hz, and the laser beam diameter was adjusted to 50 μm. The imaging raster resolution was also set to 50 μm to provide a high spatially resolved molecular image. A portion of the mouse brain (2 mm×5 mm) was manually defined for the imaging experiment which resulted in the acquisition of over 3600 spectra. A total of 200 laser shots were summed from each pixel. Upon completion of the analysis, FlexImaging is used to process the results by presenting the molecular detail of each voxel as a color gradient based on both the detection and intensity of queried signals.

2. Application of the SurfaceBox for Rapid Solvent-Free Matrix Deposition Using a TissueLyzer.

A large amount of stock matrix material (about 1 g) is preground in a 5 mL glass vial containing the bead material for a fixed time (here, 5 and 30 min) with the TissueLyzer (QIAGEN, Valencia, Calif.) and a set frequency (here, 15 and 25 Hz). In one set of experiments, 30-50 chrome beads (1.3 mm) were used. In the second set, 20-30 stainless steel beads (1.2 mm) along with three 4 mm beads were employed.

3 Evaluation of Matrix Transfer Conditions

The preground matrix (CHCA, DHB) is placed in the top compartment of the SurfaceBox along with 3 large (4 mm) and 10 to 20 small (1.2 mm) stainless steel beads. The microscopy slide with the mounted mouse brain section(s) is placed in the bottom compartment. The assembled SurfaceBox device is then placed in the TissueLyzer sample holder and secured to the TissueLyzer arm. The matrix thickness of the tissue section is controlled by the time (30 s to 5 min) with a set frequency of 25 Hz. For mesh materials with openings of 20 μm, homogeneous coverage was obtained in 60 s for DHB and CHCA matrix materials. For mesh material with 3 μm openings, the ball-milling time was increased to 5 min (DHB, CHCA matrixes). Two different matrix materials (DHB, CHCA) were also applied on two different tissue sections located on one microscopy slide. Two subsequent matrix application cycles were carried out simply by moving only the respective section within the matrix application range. Multiplexing can be achieved by placing two SurfaceBoxes in the TissueLyzer holder (photograph available in the Supplemental Information).

4. Spray-Coating for Solvent-Based Matrix Deposition

The solvent-based matrix was applied to the tissue section using an airbrush following a previously reported procedure (Garrett, et al., Int. J. Mass Spectrom 2007, 260, 166-176) which is incorporated by reference herein for its teachings regarding the same.

In brief, the matrix (CHCA) was dissolved in a solution of 50:50 ACN/water with 0.1% TFA and using the airbrush was sprayed on the tissue section mounted on a glass slide from a 12 to 15 cm distance. A total of 20 coatings of matrix solution was applied on each tissue section. The solvent-based matrix application protocol was maintained constant for all samples and as such was not optimal for all samples.

5. Microscopy

Optical microscopy (Nikon, ECLIPSE, LV 100) was used to provide a qualitative understanding of the deposited matrix on the glass slide and the matrix-covered tissue, as well as the pure tissue and the different meshes. Various magnification conditions were used (×5 to ×100) providing detailed views down to about 1-10 μm. The scanning electron microscopy (SEM) analysis was carried out on a Hitachi S-2400 scanning electron microscope. For the SEM studies, a carbon tape was placed on top of the matrix-covered tissue to obtain the SEM sample. The SEM sample was place it the SEM sample holder and analyzed under various magnifications.

6. Preparation and Storage of Samples

The MALDI matrix prepared tissue samples were placed securely in a plastic vacuum sealed food container and slightly evacuated to remove moisture contained in the air. Sample containers were kept at −80° C. for one night and placed on dry ice. Before use, containers were removed from the dry ice and the container was allowed to warm to room temperature before the slight vacuum seal was released. Mass measurements were obtained after one day on the MALDI-TOF and six days for the MALDI-IMS-TOF.

C. MS Analysis of Mouse Brain Tissue

1. Solvent-Free MALDI Analysis: MALDI-TOF Instrumentation

Frozen mouse brain tissue sections that were adhered to ITO glass slides (Bruker Datonics, Inc., Billerica, Mass.) were placed into a dry nitrogen chamber for 20 min during tissue thawing. A digital image of the tissue was taken with an Epson scanner (Epson Perfection 4490 Photo) at a resolution of 2400 dpi. The tissue was placed into the Autoflex III MALDI TOF instrument (Bruker Datonics, Inc., Billerica, Mass.), and the xy-positioning of the sample stage was registered using three teach points within the FlexImaging 2.1 software (Bruker Datonics, Inc., Billerica, Mass.). The instrument was operated in positive ion, reflectron mode measuring a mass range from 500 to 2000 Da. The all solid-state smartbeam laser was operated at a repetition rate of 200 Hz, and the laser beam diameter was adjusted to 50 μm. The imaging raster resolution was also set to 50 μm to provide a high spatially resolved molecular image. A portion of the mouse brain (2 mm×5 mm) was manually defined for the imaging experiment which resulted in the acquisition of over 3600 spectra. A total of 200 laser shots were summed from each pixel. Upon completion of the analysis, FlexImaging was used to process the results by presenting the molecular detail of each voxel as a color gradient based on both the detection and intensity of queried signals.

2. Total Solvent-Free Analysis (TSA): MALDI-IMS-MS Instrumentation

Digital scans of the tissue section were obtained prior to the imaging experiment using a CanoScan 4400F scanner (Canon, Reigate, U.K.) and imported into MALDI imaging Pattern Creator software (Waters Corporation, Manchester, U.K.) where the area to be imaged was selected. MALDI-IMS-MS analysis was acquired using a MALDI SYNAPT HDMS (Waters Corporation, Manchester, U.K.) operating in IMS mode. The instrument calibration was performed using a standard mixture of polyethylene glycol (Sigma-Aldrich, Gillingham, U.K.) ranging between m/z 100 and 1 000. The tissue imaging data were acquired on the MALDI SYNAPT HDMS operated in HDMS mode over the m/z range of 100-1 000, with a 200 Hz Nd:YAG laser. Spatial resolution of 150 μm was selected, and 400 laser shots were acquired per pixel. The gas used for the ion-mobility separation was nitrogen with a flow set at 22 mL $min^{-1}$. The pressure in the IMS device was $5.07\times10^{-1}$ mBar. The IMS wave velocity was set at 300 m $5^{-1}$ where the variable wave height was enabled. The wave height was set from 6 to 14 V. After acquisition, the data was converted into Analyze file format using the MALDI Imaging Converter (Waters Corporation, Manchester, U.K.) for image analysis using BioMap (Novartis, Basel, CH). The data was also evaluated using DriftScope 2.1 (Waters Corporation, Manchester, U.K.) where the m/z versus drift time 2-D plot can be visualized. Here, the "peak detection" algorithm was applied to generate a peak list that can be loaded into Excel where m/z, intensity, and drift time are reported. It was therefore possible to identify species with similar m/z (isobars) and different drift times (mobilities) as is shown for a low abundant set of isobaric species at m/z 863.5. Individual ion species can be selected and extracted from DriftScope 2.1, retaining specific m/z and drift time with their X and Y coordinates. The extracted raw data can then be converted for BioMap. The output is the ion image where only the ion of interest will be represented.

A number of solvent-free samples were prepared using the TissuLyzer. Thosesamples were anaylsed and the results are shown in FIGS. 1-14. FIG. 1 shows a photograph of the matrix (2,5-DHB)/analyte mixture) used to obtain the images shown in FIGS. 2-14 (seven peptides, two small proteins, and four lipids). The sample was prepared solvent-free using the TissueLyzer (10 minutes with a frequency of 20 Hz) for homogenization and transfer of the powder directly to the MALDI plate (left side). To insure that the same matrix/analyte conditions between the two different ionization approaches were met, parts of the solvent-free prepared matrix/analyte sample left in the container vial was dissolved in 50/50 acetonitrile/water and spotted on the MALDI target plate after which the solvent evaporated to give the solvent-based prepared sample (right side). This defined model mixture spans a variety of different compound classes (peptides, small proteins, and lipids), molecular weights (378.6 to 5733.5 Da), solubilities/hydrophobicities [e.g., bovine insulin (soluble) versus β-amyloid (1-42) (insoluble); β-amyloid (1-11) (hydrophilic) versus β-amyloid (33-42) (hydrophobic)]; and ionizations [e.g., 2-AG versus NAGABA; PI versus PC] to exemplify a simple challenge present in living tissue. Other matrixes (e.g., α-cyano-4-hydroxy-cinnamic acid (CHCA)) were also employed.

The two different prepared samples (with and without the use of solvent) were imaged using the MALDI-TOF/TOF instrument (Bruker). The resulting imaging showing homogenous sample distribution in the matrix by ion abundance measurement for the solvent-free preparation as opposed to the solvent-based preparation. The left image is solvent-free and the right image is solvent-based as demonstrated for peptides, small proteins and lipids in a defined model mixture for a variety of different compound classes (peptides, small proteins, and lipids), molecular weights (378.6 to 5733.5 Da), solubilities/hydrophobicities [e.g., bovine insulin versus β-amyloid (1-42); β-amyloid (1-11) versus β-amyloid (33-42)]; and ionizations [e.g., 2-AG versus NAGABA; PI versus PC]. Even similar compounds and molecular weights [e.g., peptides ordered with increasing molecular weights in FIG. 2 (m/z 915.2) to 11 (m/z 2846.5] give low reproducibility results using solvent-based ionization method (right) whereas solvent-free gives similar ion abundances across the entire sample (left). Using solvent-free sample preparation (left image) with a wide variety of compounds having various properties, the ion signal for the analyte is fairly constant over the entire sample, whereas, with solvent-based methods (right image) the ion signal is very non-homogenous.

Figure 4:
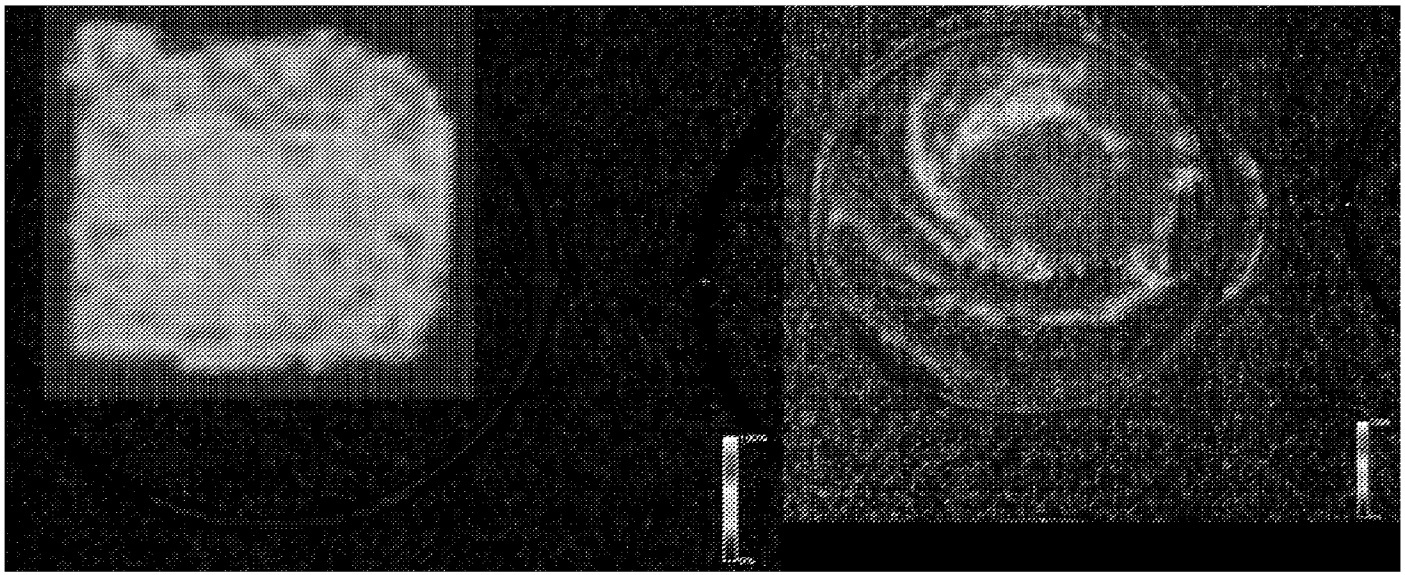
FIG. 4 depicts solvent-free and solvent-based analysis of vasopressin
Figure 5:
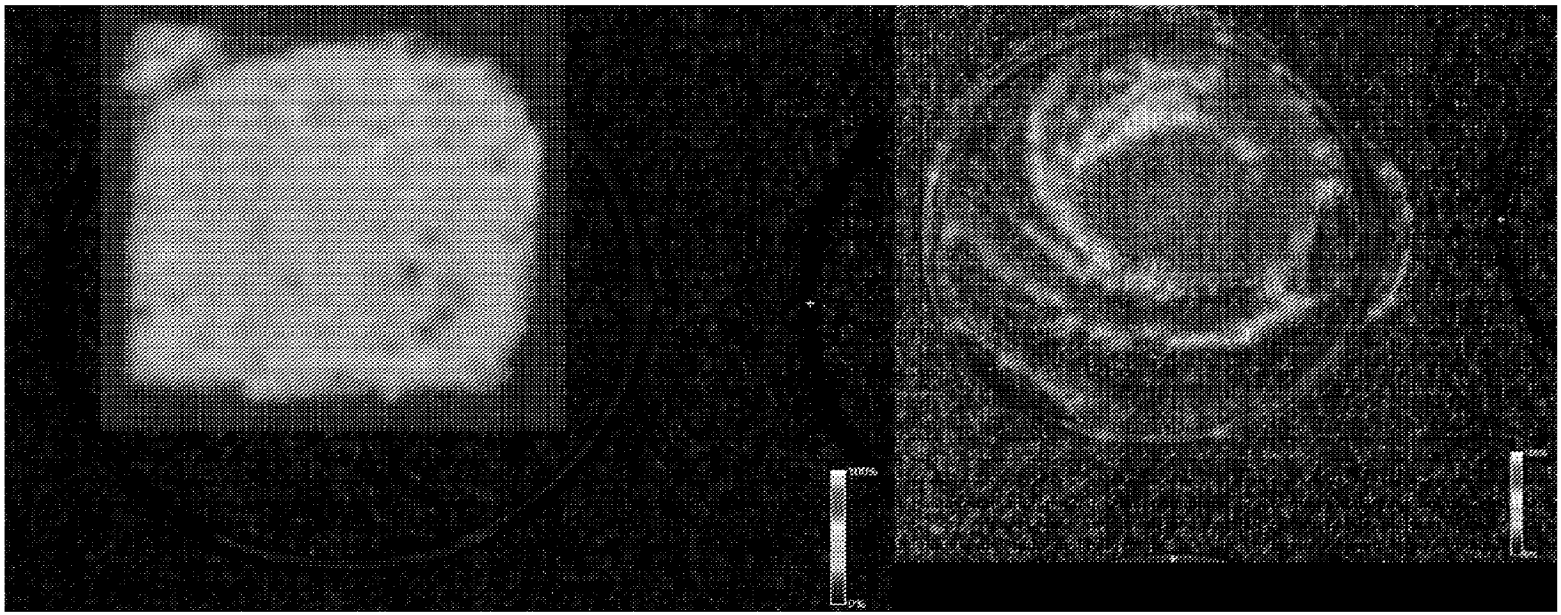
FIG. 5 depicts solvent-free and solvent-based analysis of dynorphin.
Figure 6:
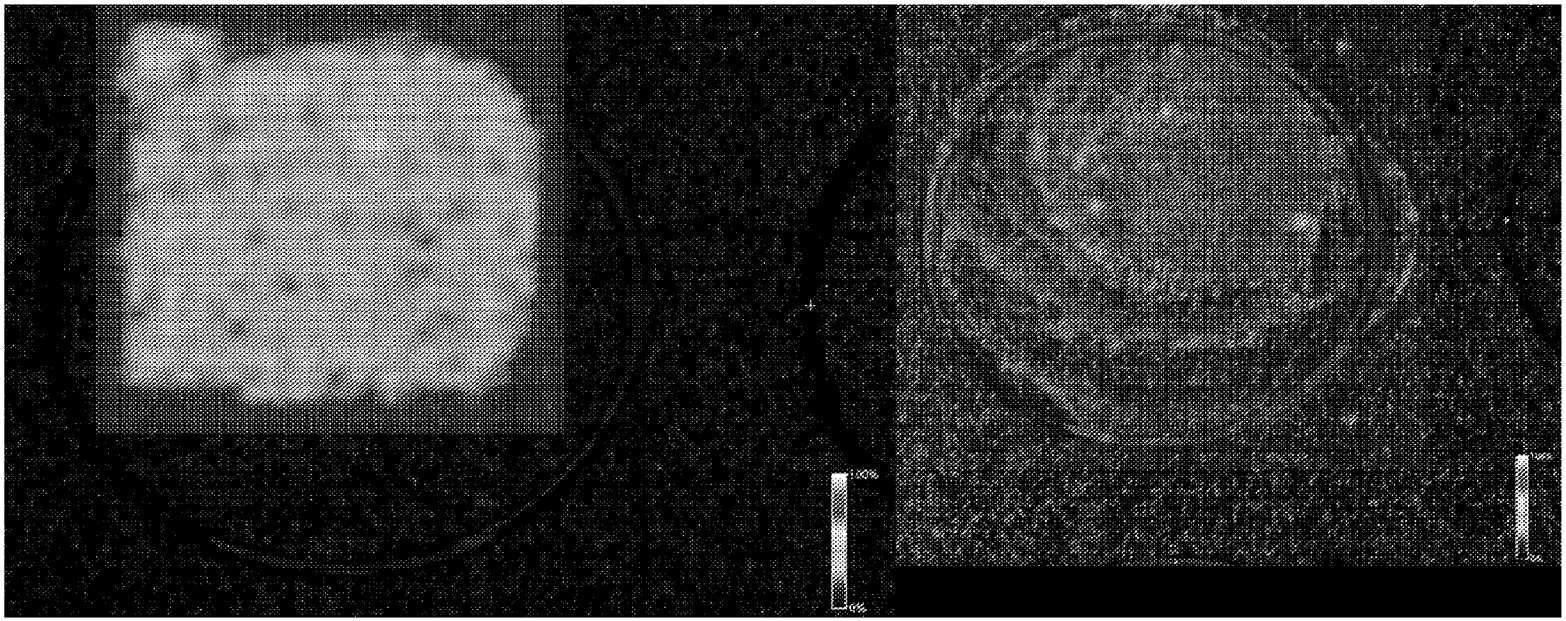
FIG. 6 depicts solvent-free and solvent-based analysis of β-amyloid (1-11).
Figure 7:
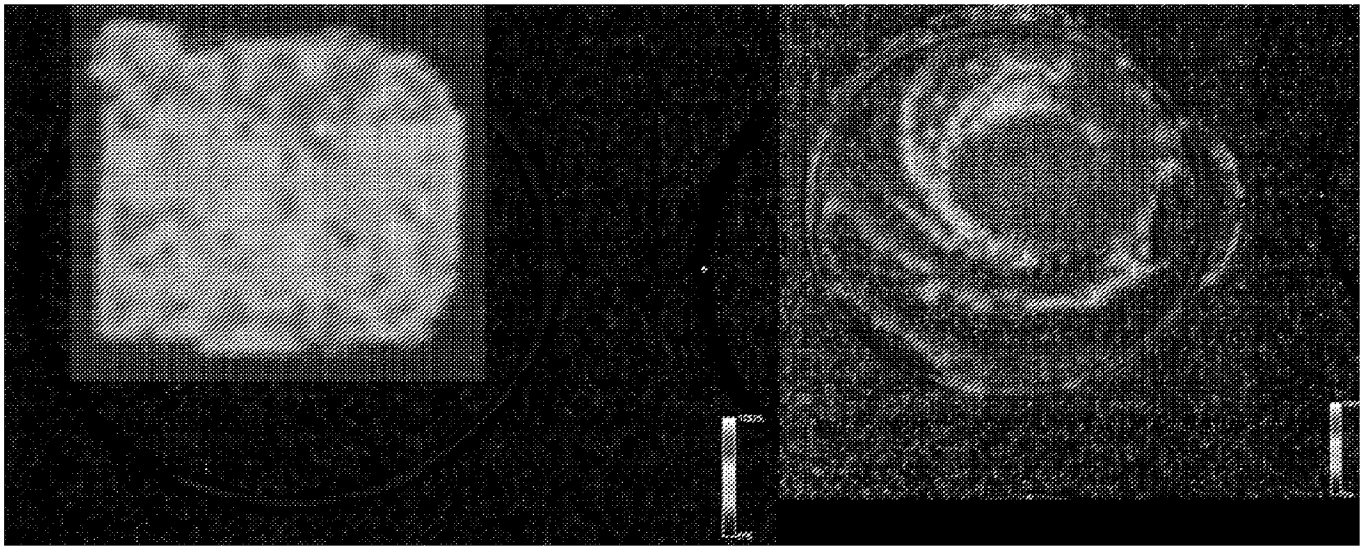
FIG. 7 depicts solvent-free and solvent-based analysis of substance P.
Figure 8:
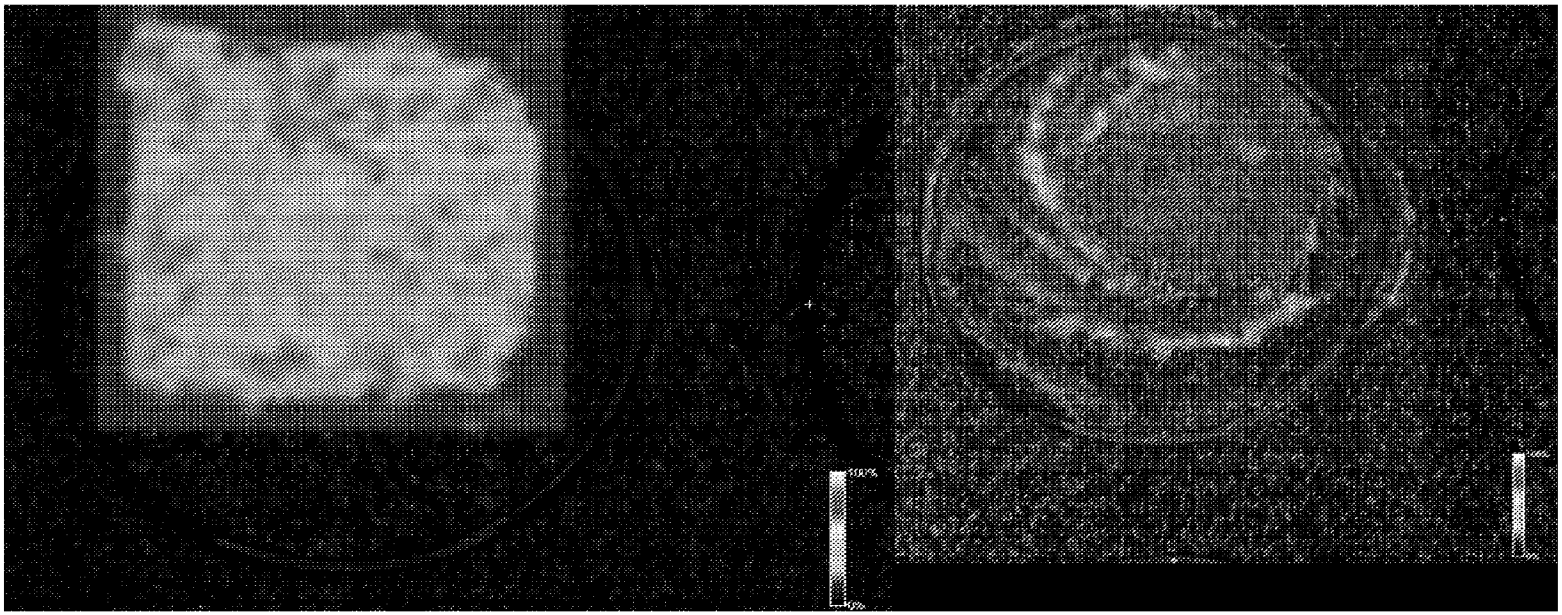
FIG. 8 depicts solvent-free and solvent-based analysis of mellitin.
Figure 9:
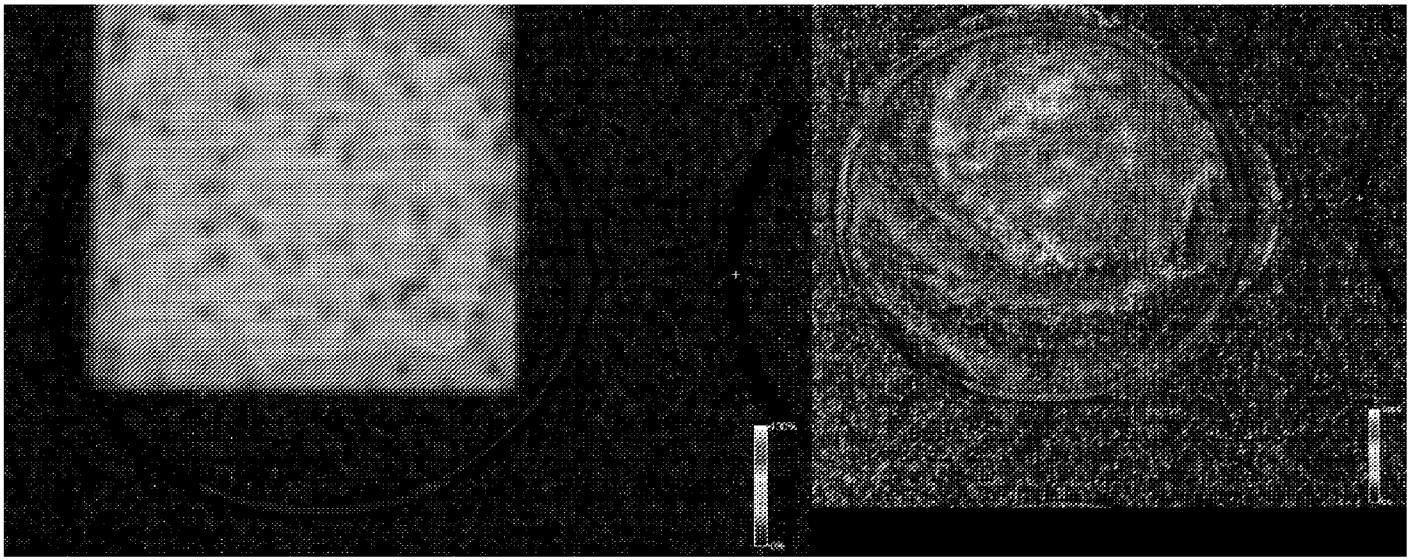
FIG. 9 depicts solvent-free and solvent-based analysis of β-amyloid (1-42).
Figure 10:
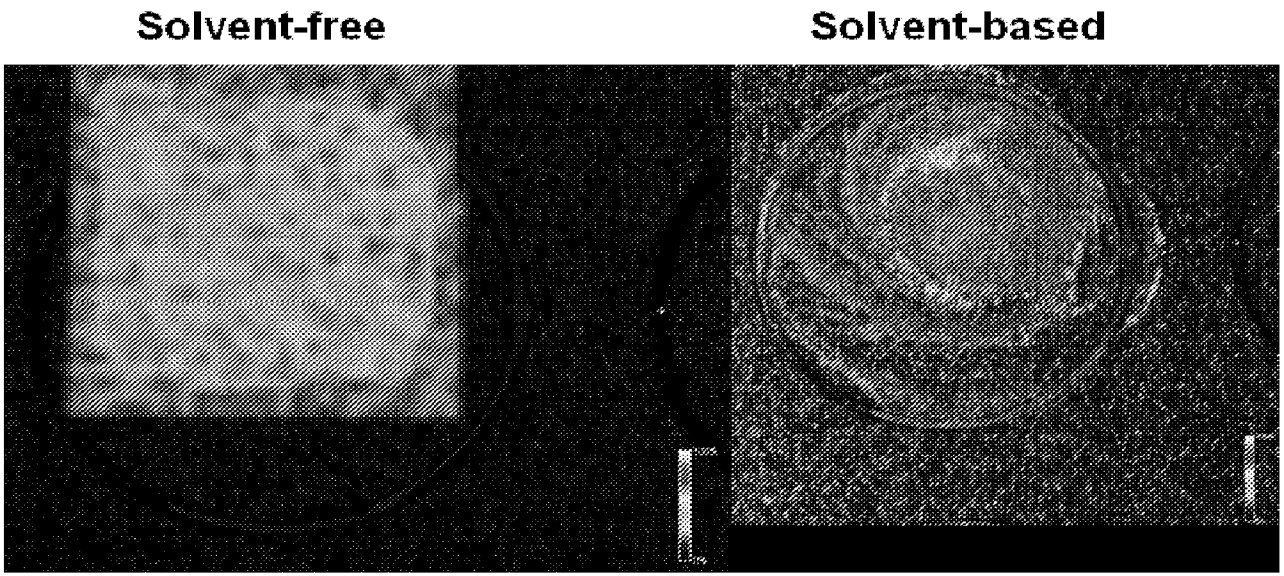
FIG. 10 depicts solvent-free and solvent-based analysis of bovine insulin.
Figure 11:
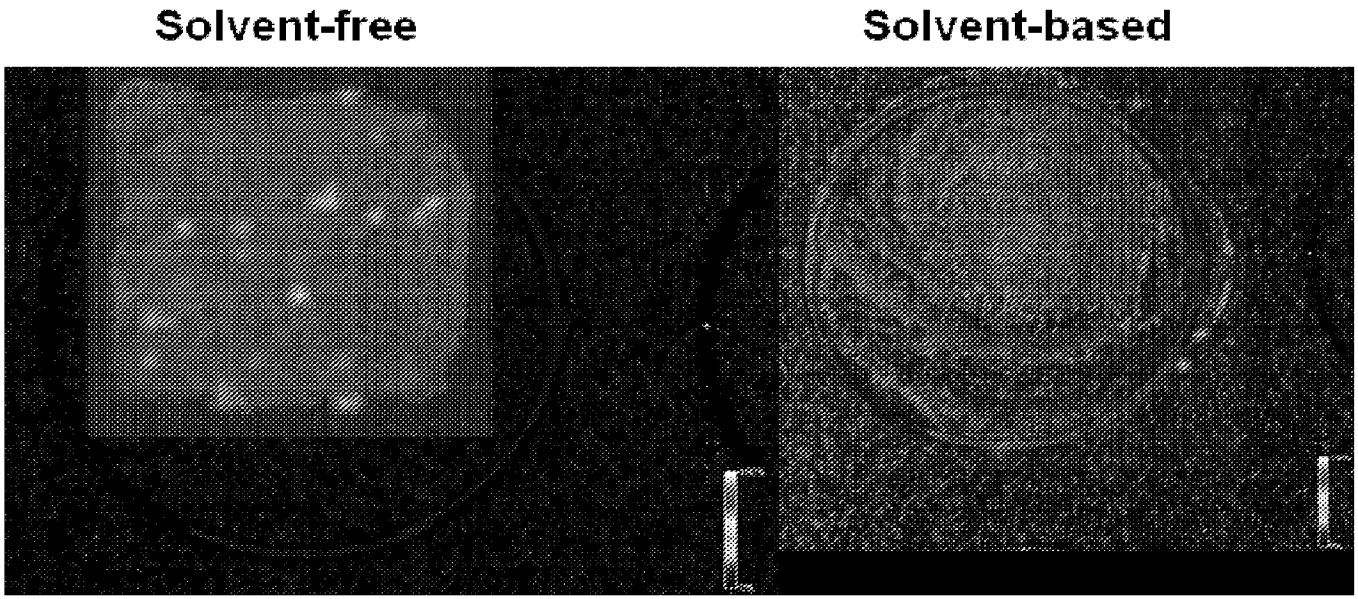
FIG. 11 depicts solvent-free and solvent-based analysis of 2-arachidonoyl glycerol (2-AG).

FIGS. 2-14 show the analyses of several proteins, peptides and lipids using solvent-free and solvent-based analysis. FIG. 2 depicts solvent-free and solvent-based analysis of β-amyloid (33-42; MW 915.2). FIG. 3 depicts solvent-free and solvent-based analysis of lipotropin (MW 951.1). FIG. 4 depicts solvent-free and solvent-based analysis of vasopressin (MW 1084.3). FIG. 5 depicts solvent-free and solvent-based analysis of dynorphin (MW 1137.4). FIG. 6 depicts solvent-free and solvent-based analysis of β-amyloid (1-11; MW 1325.3). FIG. 7 depicts solvent-free and solvent-based analysis of Substance P (MW 1347.8). FIG. 8 depicts solvent-free and solvent-based analysis of mellitin (MW 2846.5). FIG. 9 depicts solvent-free and solvent-based analysis of β-amyloid (1-42; MW 4511). FIG. 10 depicts solvent-free and solvent-based analysis of bovine insulin (MW 5733.5). FIG. 11 depicts solvent-free and solvent-based analysis of 2-arachidonoyl glycerol (2-AG) (MW 378.6).

Figure 12:
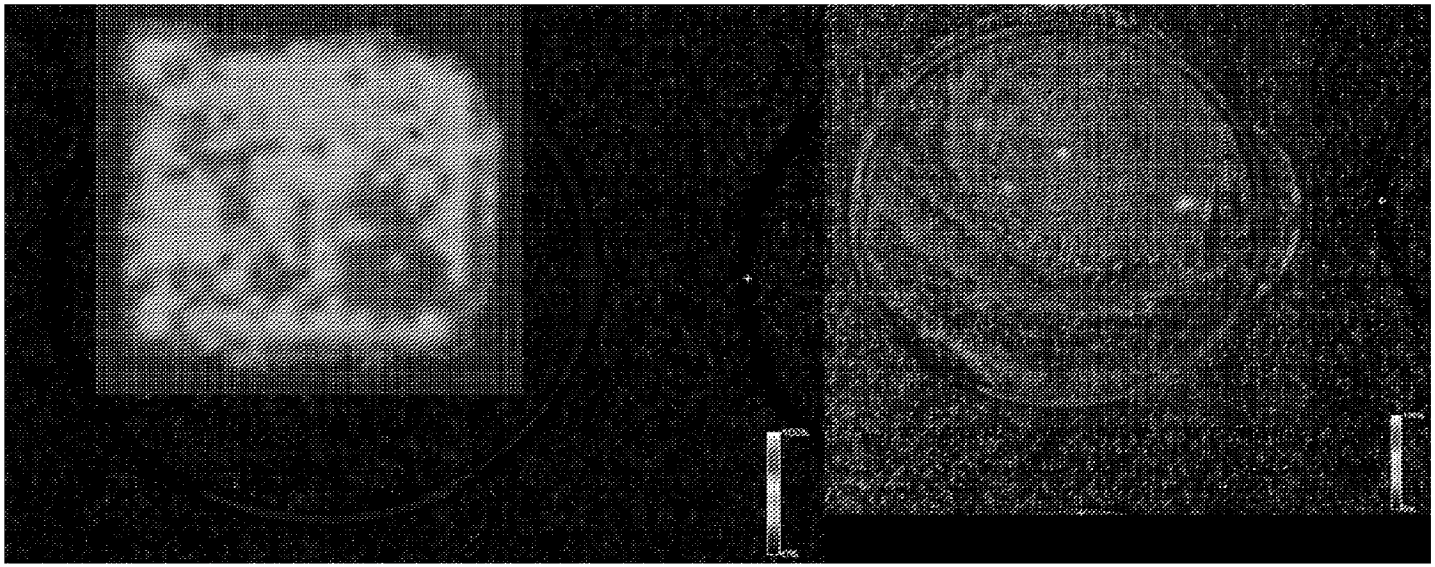
FIG. 12 depicts solvent-free and solvent-based analysis of N-arachidonoyl gamma aminobutyric acid (NAGABA).
Figure 13:
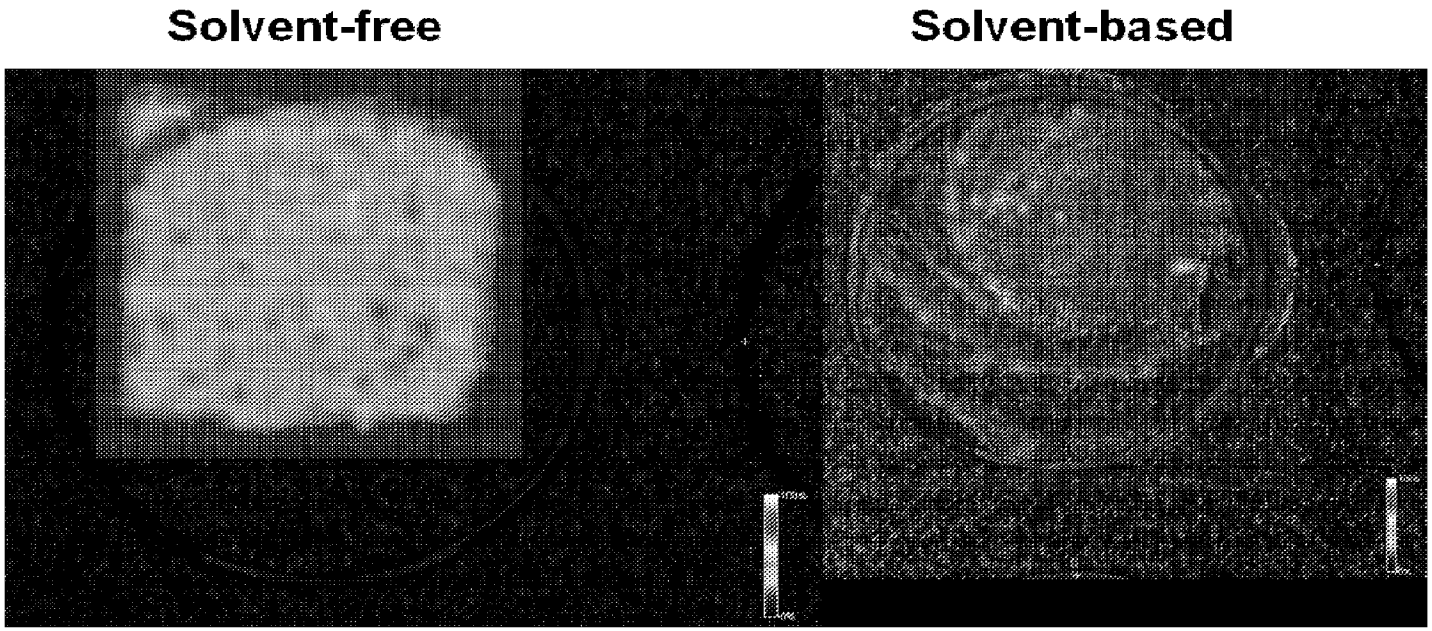
FIG. 13 depicts solvent-free and solvent-based analysis of phosphatidyl inositol (PI).
Figure 14:
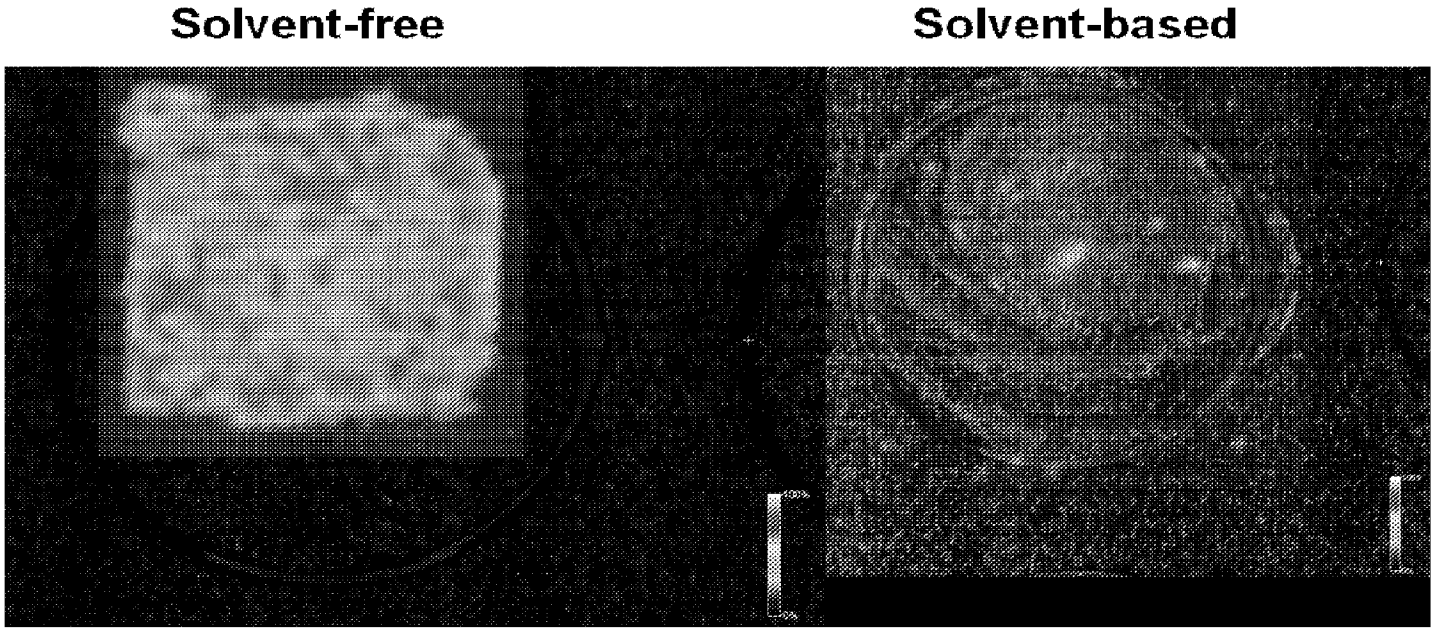
FIG. 14 depicts solvent-free and solvent-based analysis of phosphatidyl choline (PC).

FIG. 12 depicts solvent-free and solvent-based analysis of N-arachidonoyl gamma aminobutyric acid (NAGABA) (MW 389.6). FIG. 13 depicts solvent-free and solvent-based analysis of phosphatidyl inositol (PI) (MW 909.1). FIG. 14 depicts solvent-free and solvent-based analysis of phosphatidyl cholin (PC) (MW 760.1).

V. Example 5

This example describes the studies conducted to achieve a homogeneous reduction of the size of matrix crystal to be used in the SurfaceBox for improved coverage of the tissue section.

A. Matrix Application

FIG. 18 depicts a schematic of a TissueBox appropriate for use with imaging mass spectrometry using MALDI. The TissueBox can be multiplexed by adding more tissue sections or more boxes within the same holder which can then use different matrixes. Sections shown include SurfaceBox upper compartment holding the matrix material, mesh, and metal beads; and the lower compartment including the tissue slice and the glass slide. The TissueBox includes a nestable box having matrix and beads and a mesh bottom with openings of about 44 μm. A holding box can include a tissue sample on a glass slide. The components nest with a tight and close fit allowing sufficient space to keep the mesh separate.

Figure 22A:
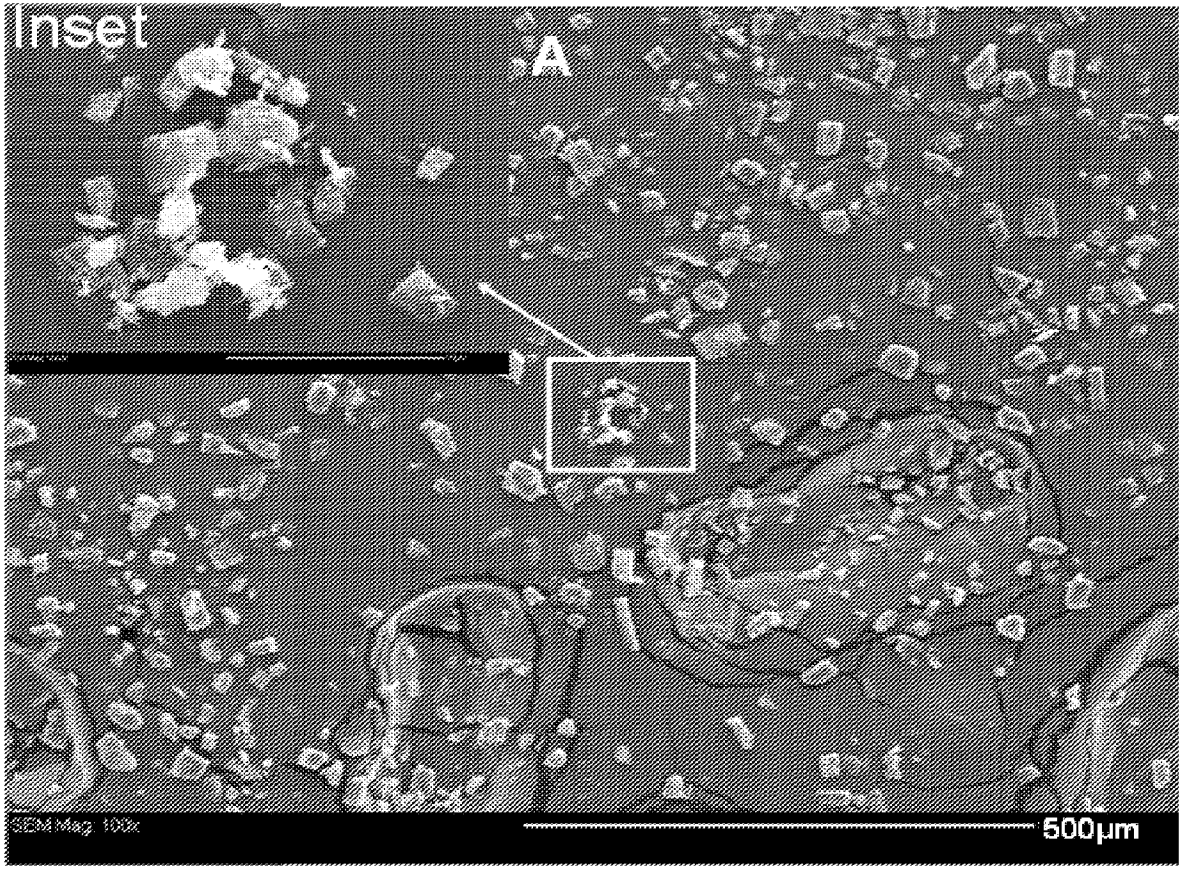
FIGS. 22A-B depict matrix crystal sizes after ball milling (DHB matrix, at 25 Hz for 30 sec) with a 44 micron mesh.
Figure 22B:
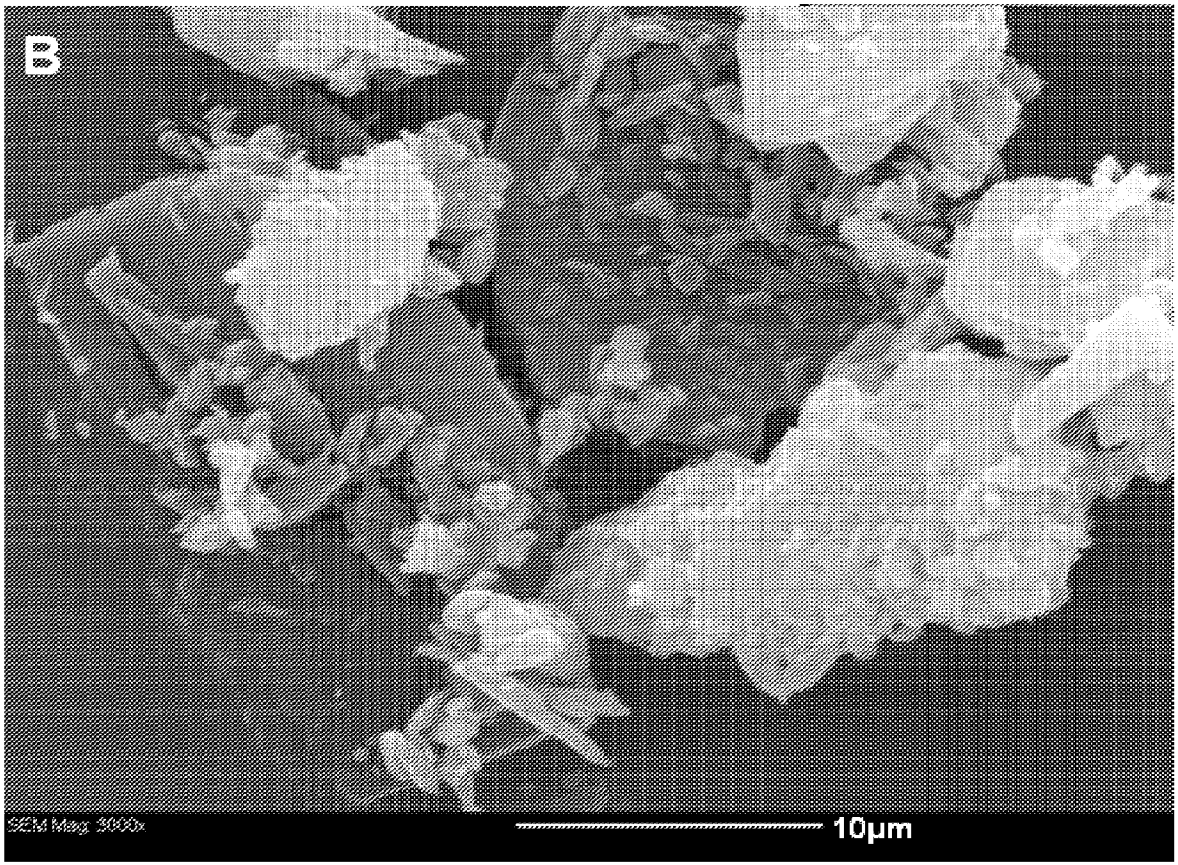

Ball-mill permits the choice of frequency and length of time for vigorous movements of content, as is the case here with the fabricated SurfaceBox. This in turn provides an extremely easy and simple means of varying the amount of material pushed through the mesh opening, thus, corresponding to the matrix thickness on the tissue section surface. The approach is rapid, with little operator intervention and experience producing homogeneous coverage with crystal sizes between <1 and 30 μm depending on the mesh used (SEM data from tissue using 44 μm mesh openings). FIGS. 22A-B depict matrix crystal sizes after ball milling (DHB matrix, at 25 Hz for 30 sec) with a 44 micron mesh. FIG. 22A shows 100 magnifications (500 μm scale bar) and an inset of 100 magnification (50 μm scale bar). FIG. 22B shows 10 μm scale bar with Scanning electron microscopy (SEM) magnification 3000×.

Figure 36:
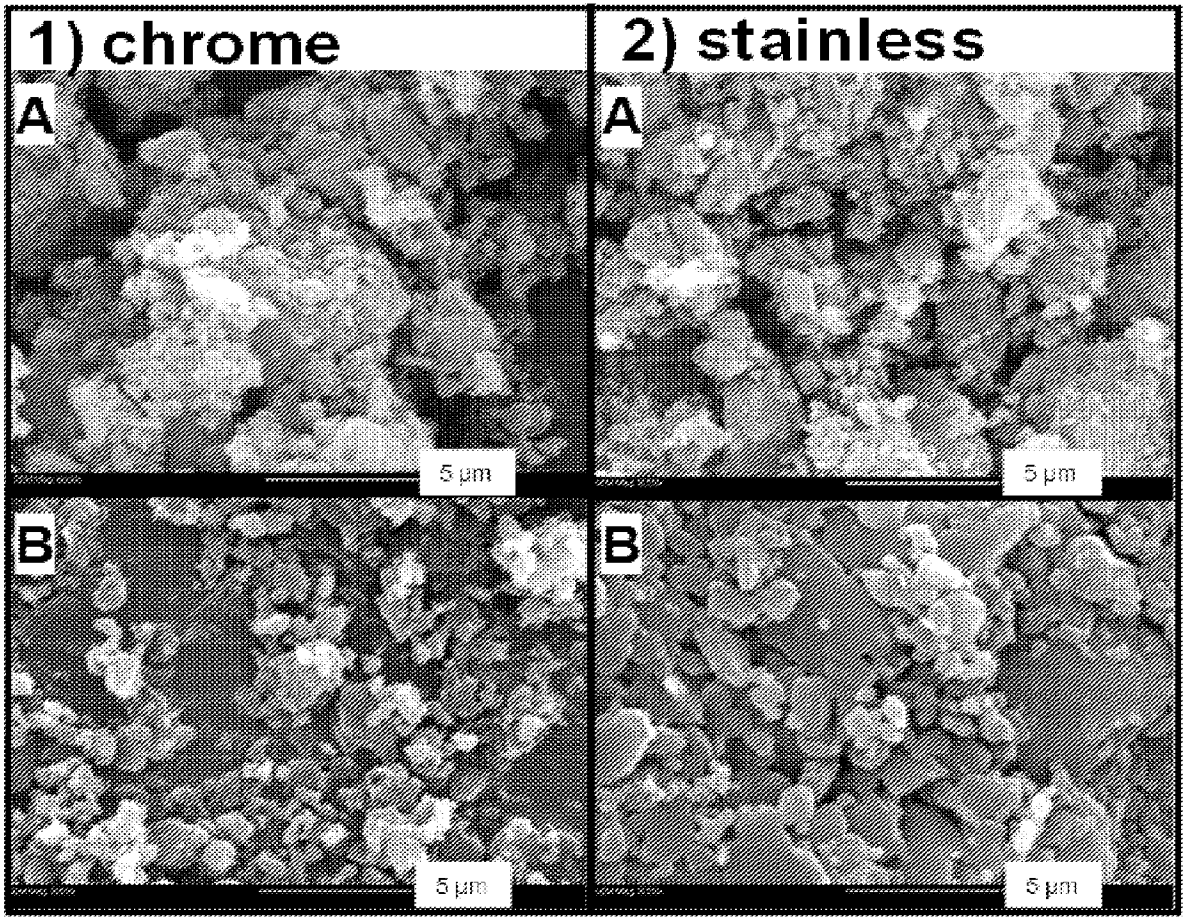
FIG. 36 shows the SEM images of the preground matrix using (1) chrome beads and (2) stainless beads with TissueLyzer conditions of (A) 15 Hz frequency for 30 min and (B) 25 Hz frequency for 5 min.

Conditions were explored to achieve a homogeneous reduction of the matrix crystals to be used in the SurfaceBox. FIG. 36 relates to the importance of proper grain size. FIG. 36 shows microscopy scan using (1) chrome beads and (2) stainless beads at a 6000 magnification with a 5 μm scale bar with TissueLyzer conditions of (A) 15 Hz frequency for 30 min and (B) 25 Hz frequency for 5 min. The optical microscopy results from the preground matrix in a vial containing 1.3 mm chrome beads shows that efficient and homogeneous reduction of the crystal sizes are achieved as compared to the stainless steel beads. The longer grinding times using the heavier chrome metal beads gave the best results as shown in FIG. 36 (1)(A) based on the smallest and homogeneous crystal sizes obtained (fluffy noncrystalline material with dimensions <1 to 5 μm).

Figure 24:
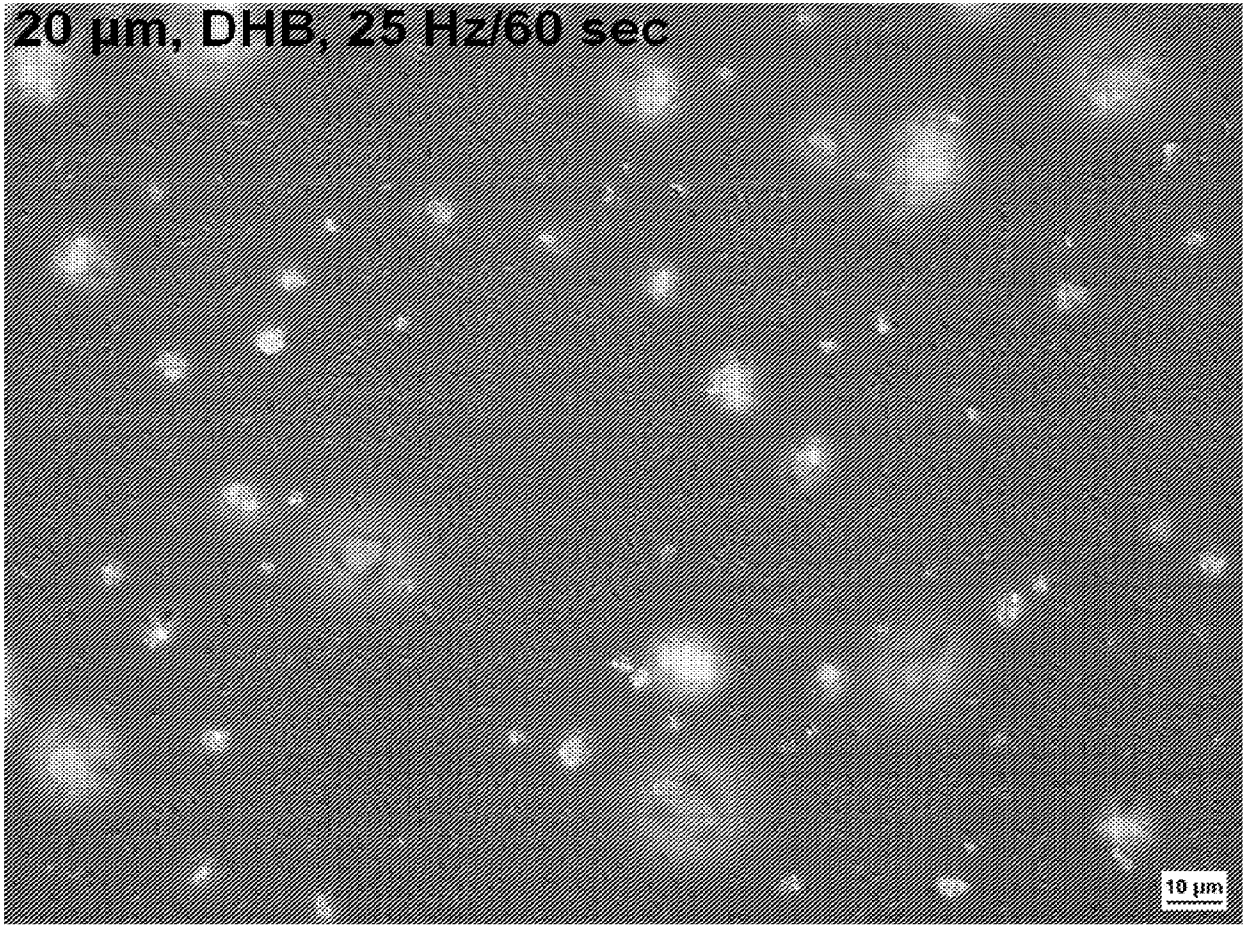
FIG. 24 depicts an enlarged view of the matrix crystals of FIG. 25 in the size of about 10 μm.
Figure 25:
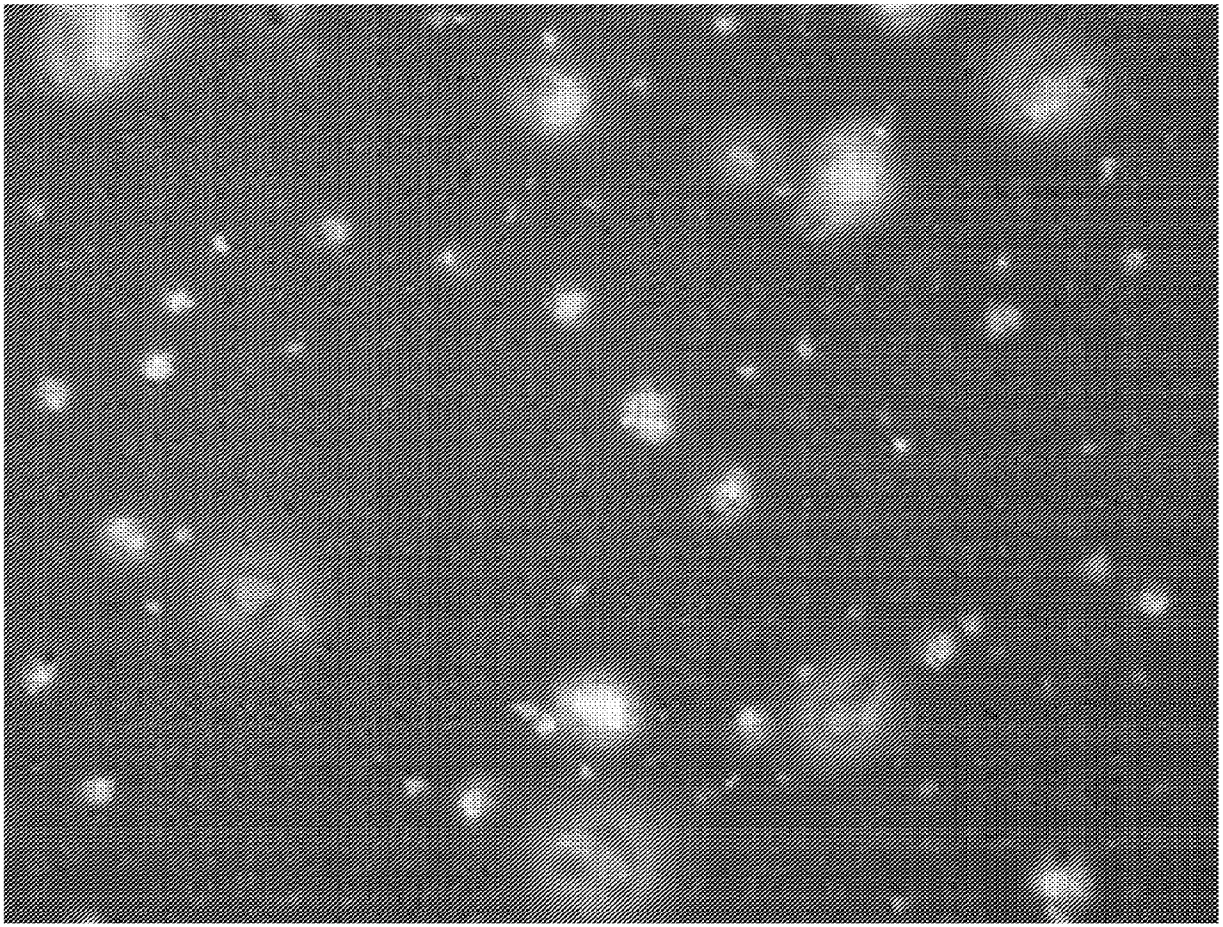
FIG. 25 depicts optical microscopy images of matrix deposited on the bare microscopy slide using the SurfaceBox mounted with different mesh sizes and of different stainless steel beads (1.2 and 4 mm) and with the TissueLyzer settings of a 25 Hz frequency and a duration of 60 s using a 20 μm mesh to transfer matrix. DHB matrix was employed.
Figure 26:
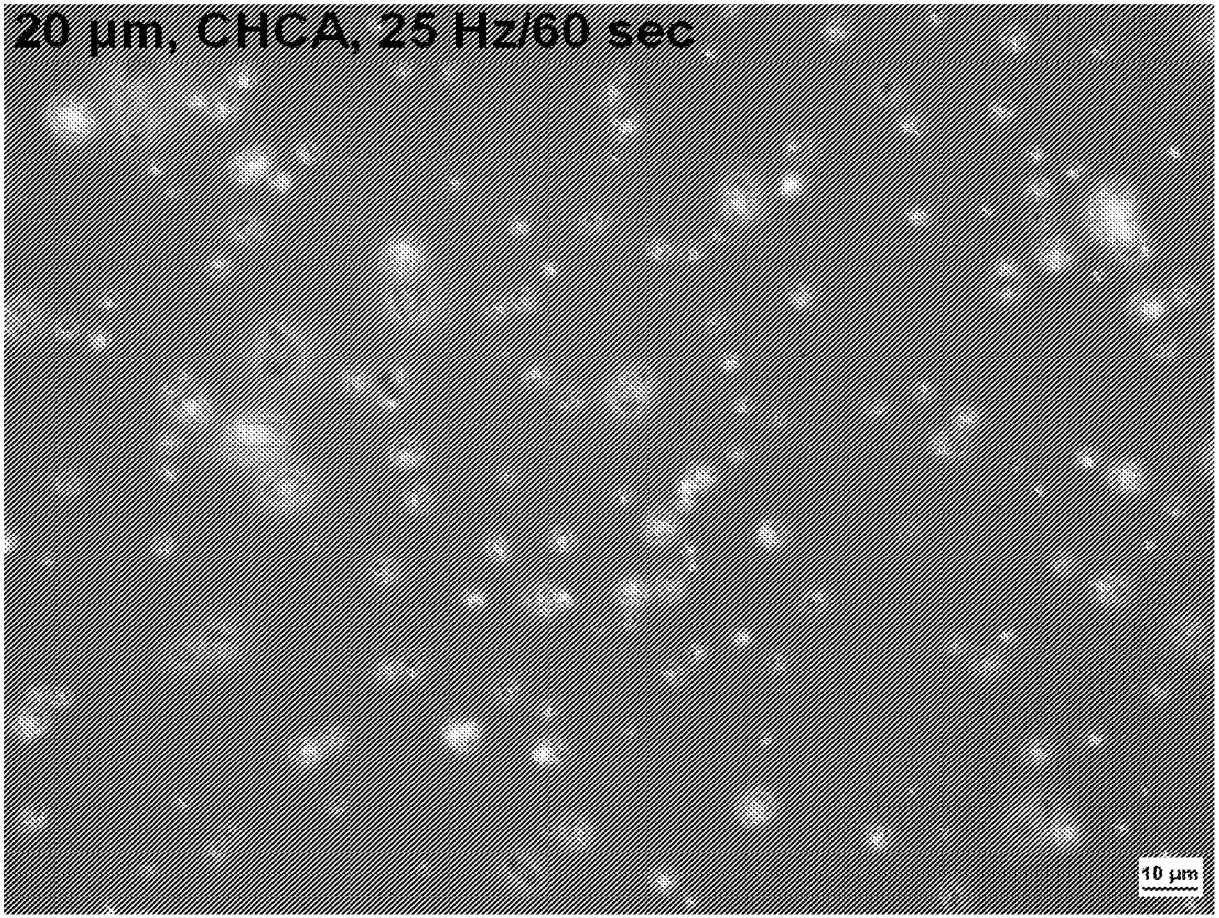
FIG. 26 depicts optical microscopy images of matrix obtained as in FIG. 25 but with an α-cyano-4-hydroxy-cinnamic acid (CHCA) matrix.
Figure 27:
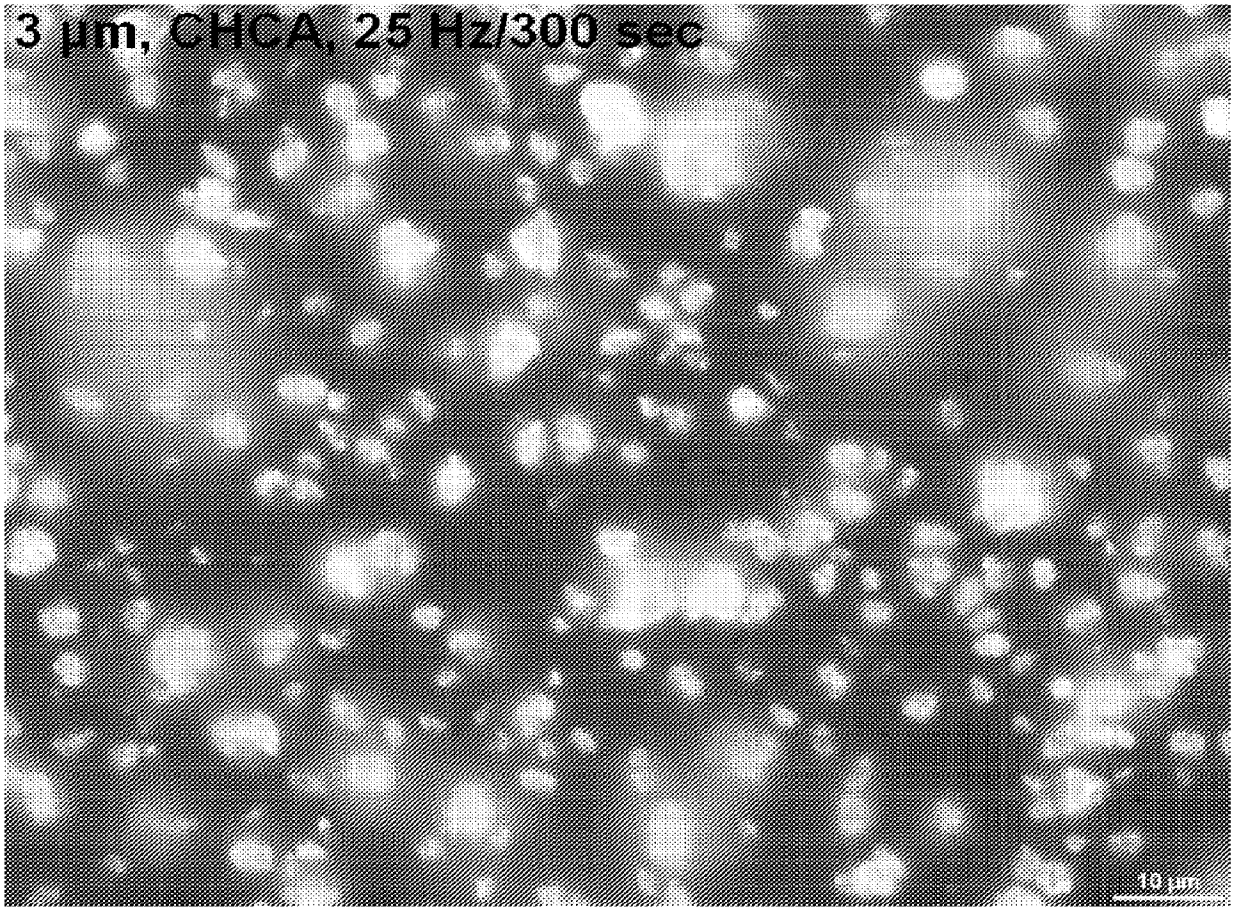
FIG. 27 depicts optical microscopy images of matrix deposited on the bare microscopy slide using the SurfaceBox mounted with different mesh sizes and of different stainless steel beads (1.2 and 4 mm) and with the TissueLyzer settings of a 25 Hz frequency and a duration of 5 min using a 3 μm mesh to transfer matrix. CHCA matrix was employed.

To achieve uniform crystal coverage, conditions were evaluated for decreasing mesh openings (20 and 3 μm) that would be used in the SurfaceBox device. To make the individual crystal size of a matrix layer more obvious, comparisons are obtained on bare microscopy glass slides and with short grinding times to avoid a thicker matrix layer that obstructs evaluation. FIGS. 24-27 show optical microscopy images of DHB or CHCA. FIGS. 24 and 25 provide optical microscopy images of DHB following 20 μm mesh at 25 Hz/60 sec providing a zoom scale of 10 μm. FIG. 26 provides an optical microscopy image of CHCA following 20 μm mesh at 25 Hz/60 sec providing a zoom scale of 10 μm. FIG. 27 shows optical microscopy images of CHCA matrix deposited on the bare microscopy slide using the SurfaceBox mounted with different mesh sizes and a mixture of different stainless steel beads (1.2 and 4 mm) and with the TissueLyzer settings of a 25 Hz frequency and a duration of 5 min using a 3 μm mesh to transfer matrix. Making use of the reduced and more homogeneous crystal sizes determined in FIG. 36 (1)(A) along with the SurfaceBox mounted with 20 μm mesh material (material A) provided DHB crystal sizes of <1 to 12 μm and CHCA between about 1 and 12 μm. The difference appears to be that DHB has a significant number of crystals at about 1 μm and smaller along with a second size of crystals that are considerably larger (3-12 μm). In the case of CHCA, the variability of small and large crystals is less notable with crystals ranging mainly around 1 to 3 μm with only a few as large as 12 μm.

The simplicity of the matrix application approach promises to prepare samples using meshes with even smaller openings. In a final experiment, the applicability of 3 μm mesh openings was explored. The construction of the 3 μm material is similar to 20 μm material A. For improved coverage of the tissue section, the duration of vigorous vibration of the SurfaceBox with the TissueLyzer was increased to 5 min with a frequency of 25 Hz. These conditions produce a very uniform coverage of homogenously sized crystals as exemplified in FIG. 27. CHCA crystals between <1 and 5 μm are observed.

Figure 23:
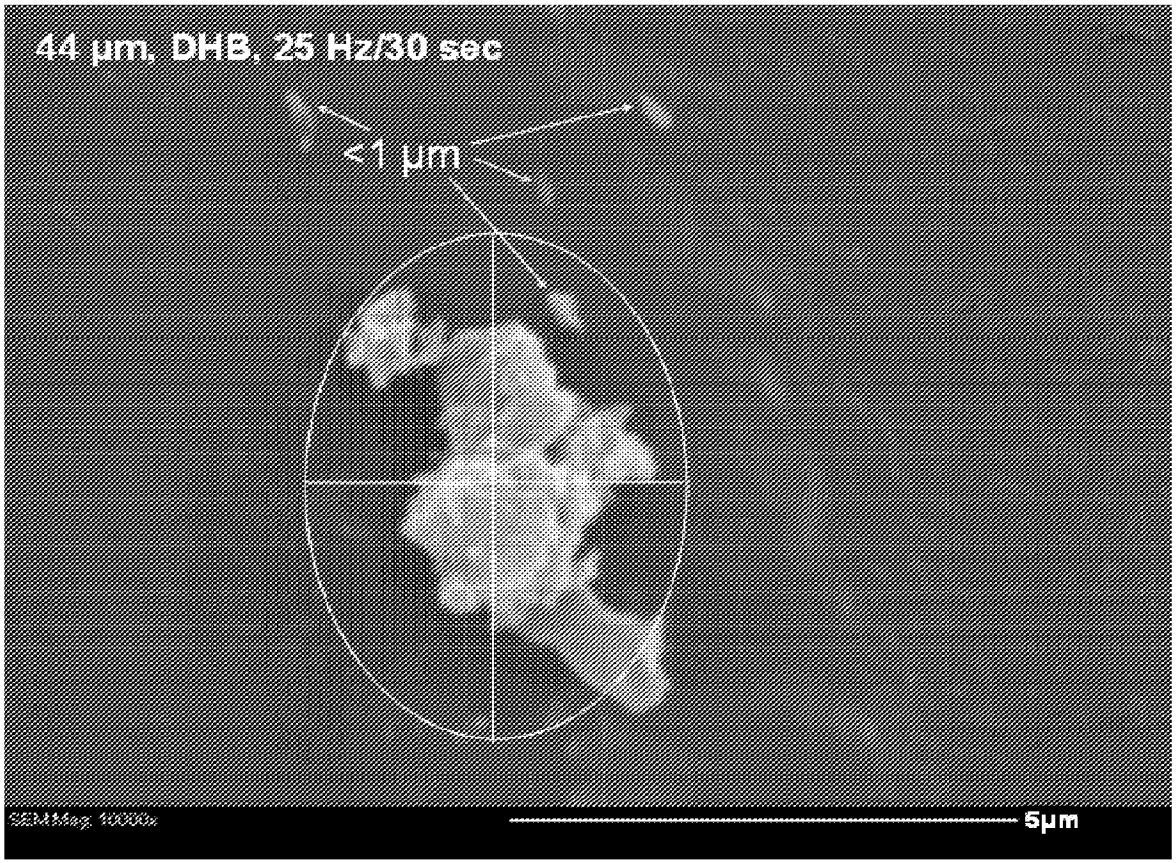
FIG. 23 depicts matrix crystal sizes after ball milling (DHB matrix, at 25 Hz for 30 sec) with a 44 micron mesh.
Figure 37:
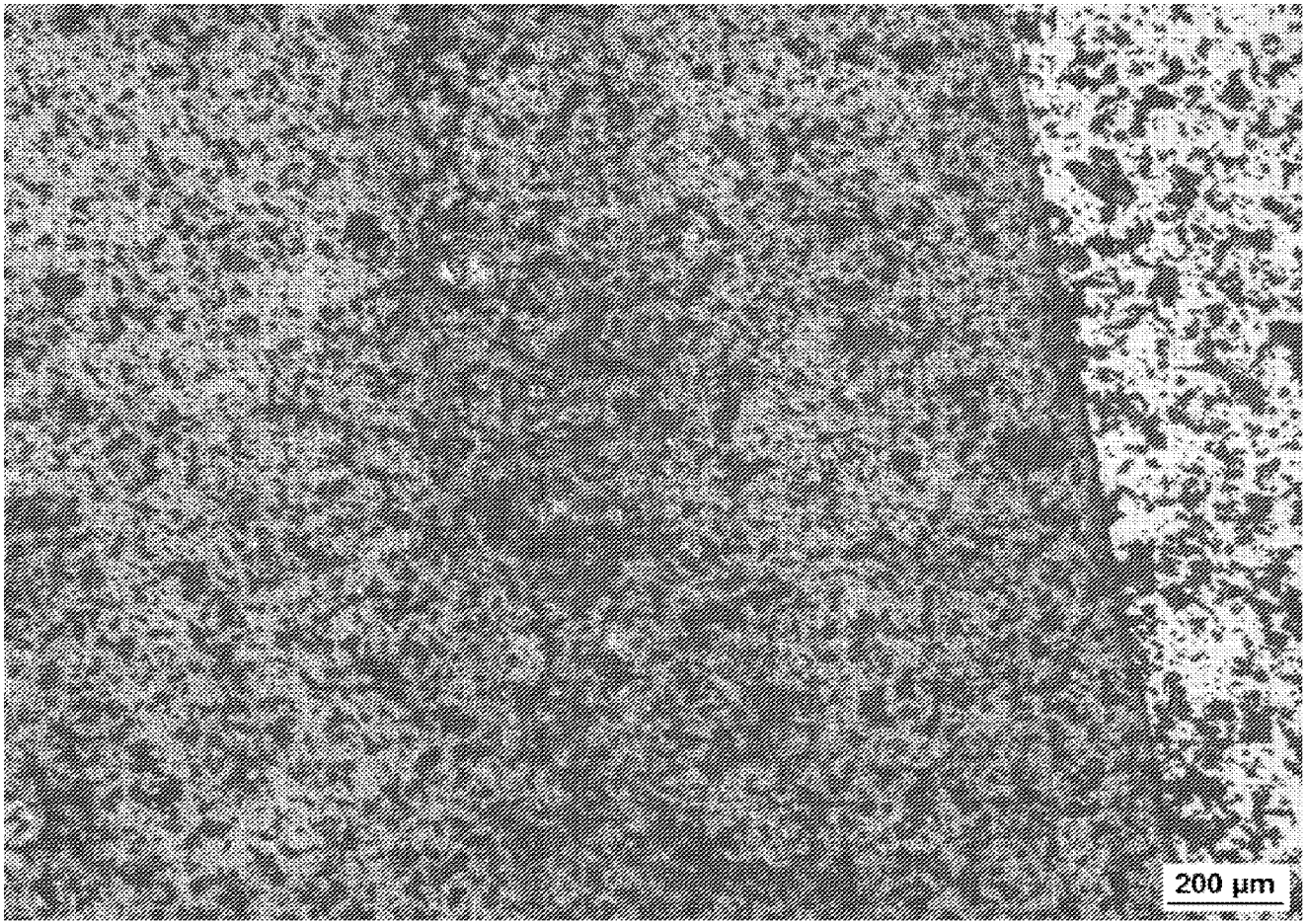
FIG. 37 shows optical microscopy images of DHB matrix deposited on a mouse brain tissue section using the SurfaceBox mounted with 3 μm mesh size and of different stainless steel beads (1.2 and 4 mm) using TissueLyzer settings of a 25 Hz frequency and 5 min duration. Transmitted light is shown.
Figure 38:
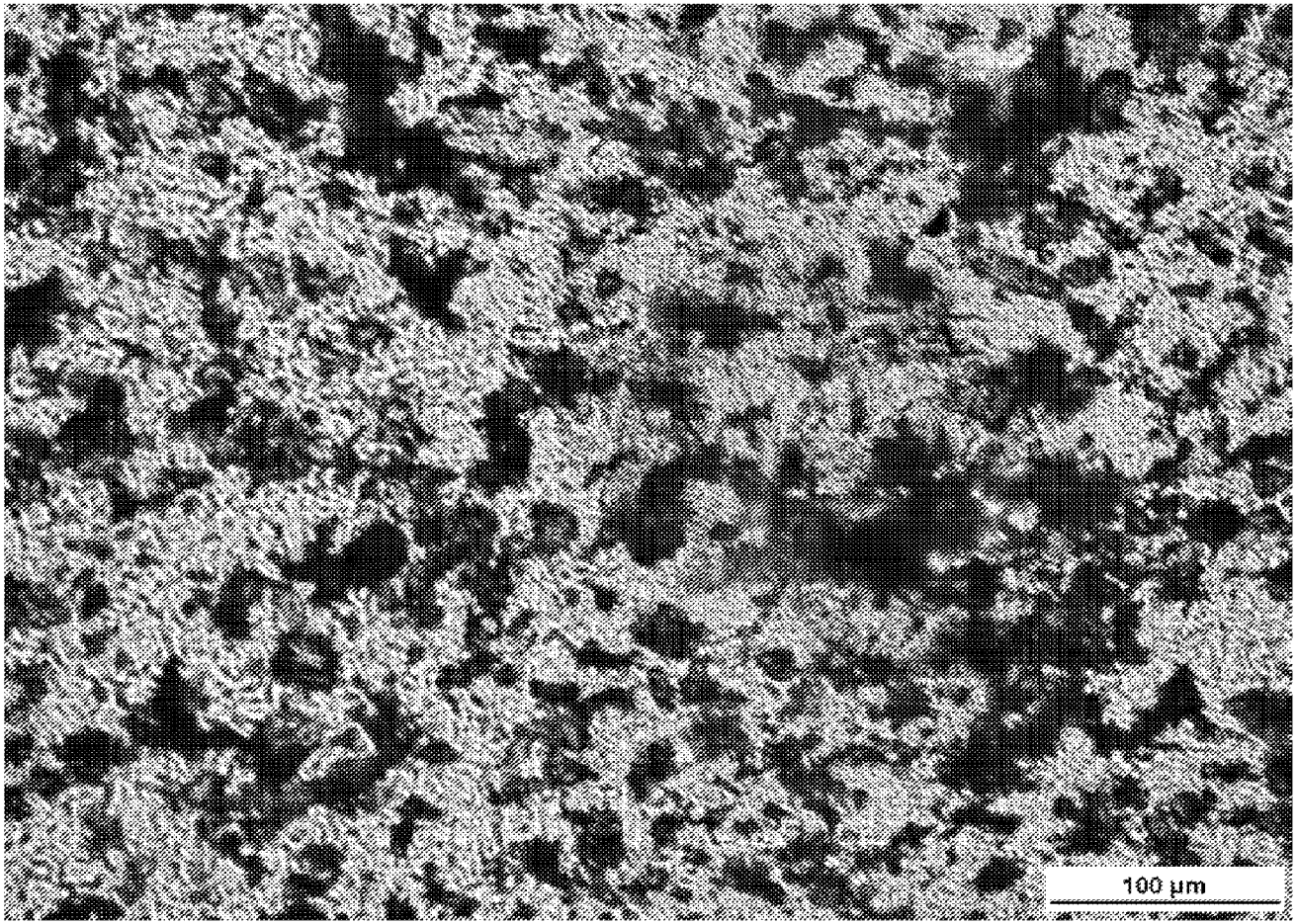
FIG. 38 shows optical microscopy images of DHB matrix deposited on a mouse brain tissue section using the SurfaceBox, and provides optical microscopy images of DHB following 44×3 μm mesh at 25 Hz/300 sec.
Figure 39:
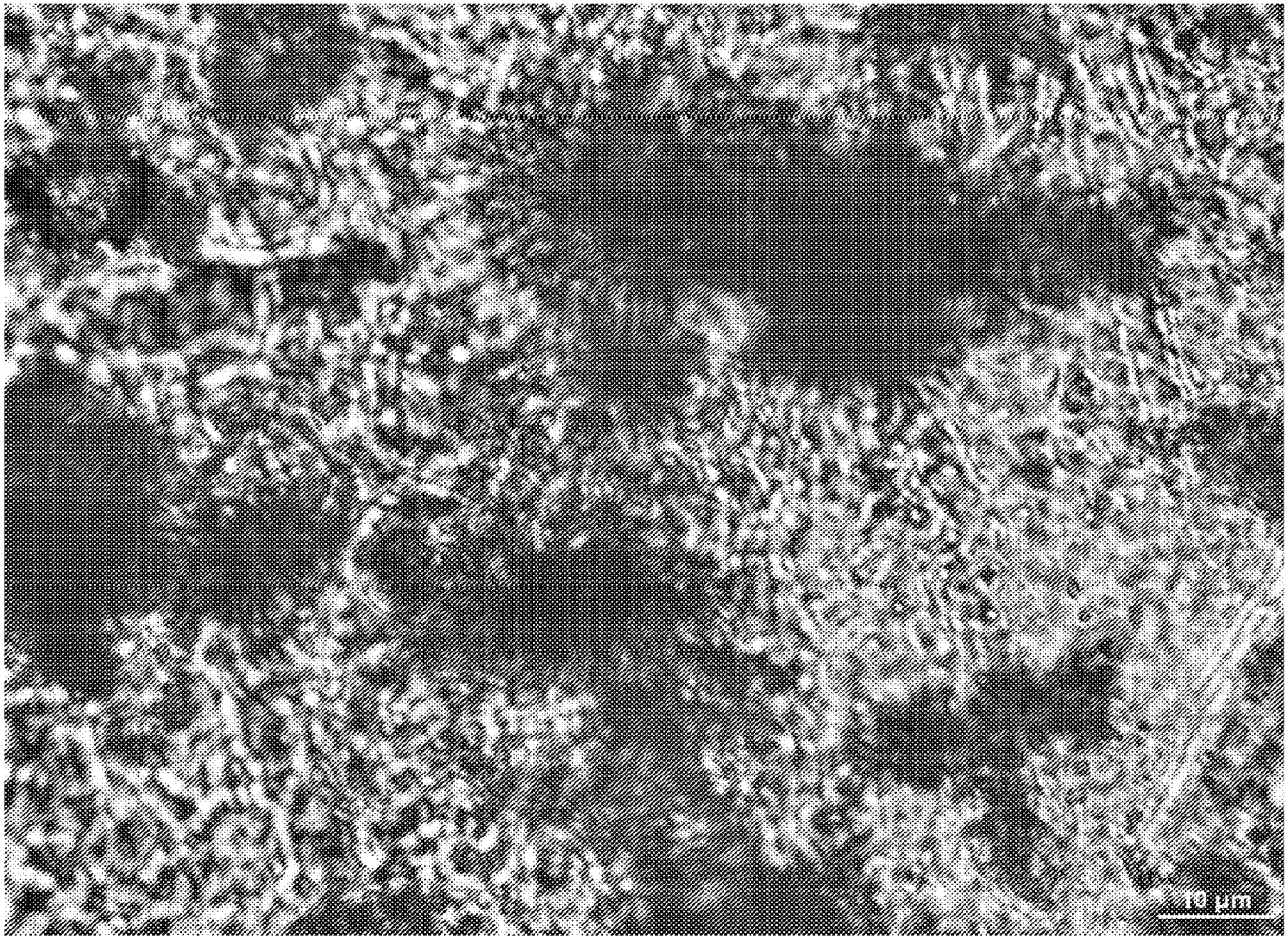
FIG. 39 shows optical microscopy images of DHB matrix deposited on a mouse brain tissue section using the SurfaceBox mounted with 3 μm mesh size and of different stainless steel beads (1.2 and 4 mm) using TissueLyzer settings of a 25 Hz frequency and 5 min duration. Reflected light is shown.
Figure 40:
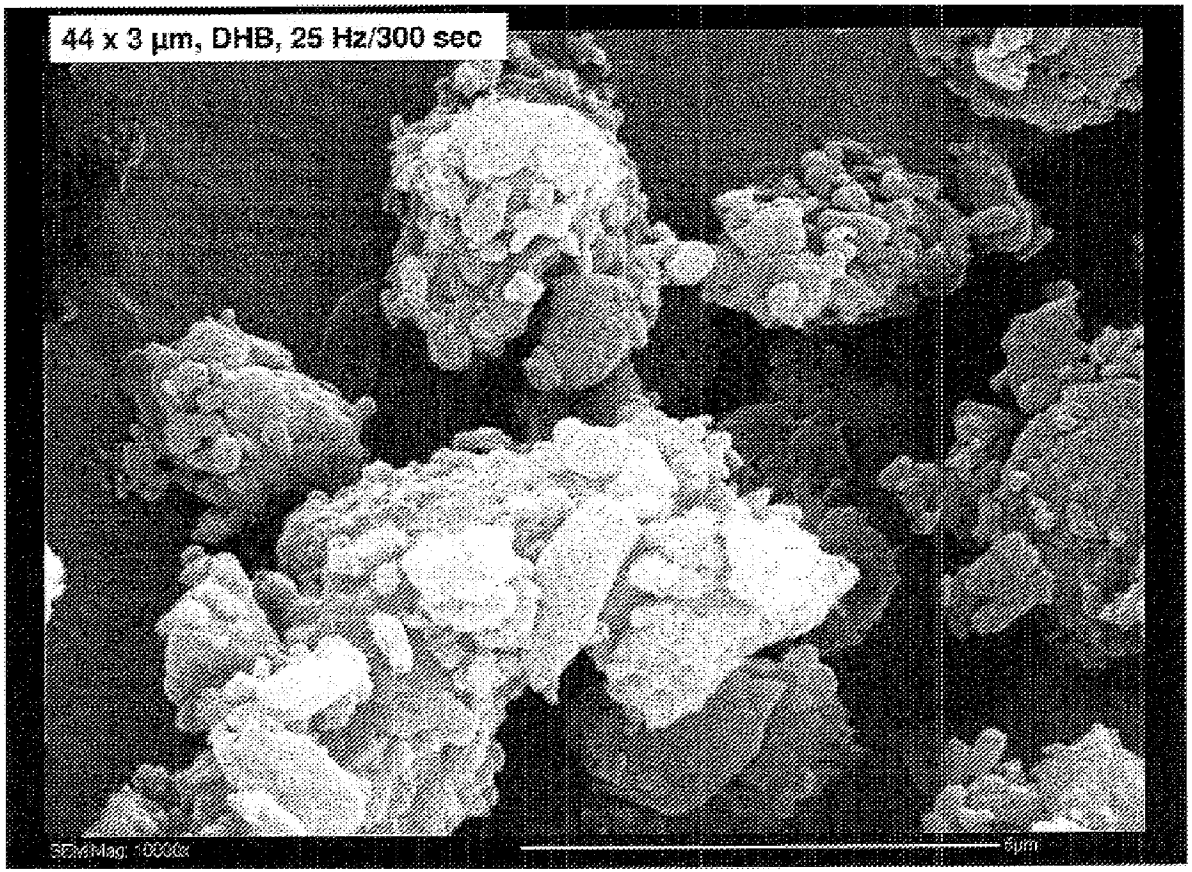
FIG. 40 shows that the double mesh TissueBox provides a notable increase in particles smaller than <5 μm (scale bar to the lower right) as compared to the single mesh TissueBox (FIG. 23).

FIGS. 37-39 show optical microscopy images of DHB matrix deposited on a mouse brain tissue section using the SurfaceBox and provide optical microscopy images of DHB following 44×3 μm mesh at 25 Hz/300 sec. A mixture of different stainless steel beads (1.2 and 4 mm) was used. FIG. 37 shows optical microscopy of images using transmission light and a zoom scale of 200 μm. FIG. 38 shows optical microscopy of images using reflected light and a scale of 100 μm. FIG. 39 shows optical microscopy of images using reflected light and a scale of 10 μm. FIG. 40 shows an SEM image of DHB following 44×3 μm mesh at 25 Hz/300 sec providing a zoom scale of 5 μm. The double mesh TissueBox provides a notable increase in particles smaller than <5 um (scale bar to the lower right) as compared to the single mesh TissueBox (FIG. 23). The results obtained for the matrix (here, DHB) deposited on the tissue are displayed in FIGS. 37 and 40. The coverage of the tissue using the 3 μm mesh is overall homogeneous as can be seen in FIG. 37 using transmission light microscopy (200 μm scale bar); in the reflective light, the matrix appears as dark spots. The reflective light using an enlarged view (FIG. 40, 5 μm scale bar) indicates a similar homogeneity previously observed for the bare glass slide (FIG. 27, CHCA). The data suggests that the matrix is included onto the tissue surface which might be the result of the velocity made possible by the vigorous movement of the TissueLyzer arm. Under the conditions used here, the homogeneity is improved compared to solvent-based application of the matrix. Thus, homogeneous matrix coverage (DHB) of a mouse brain tissue section is achieved.

Figure 28:
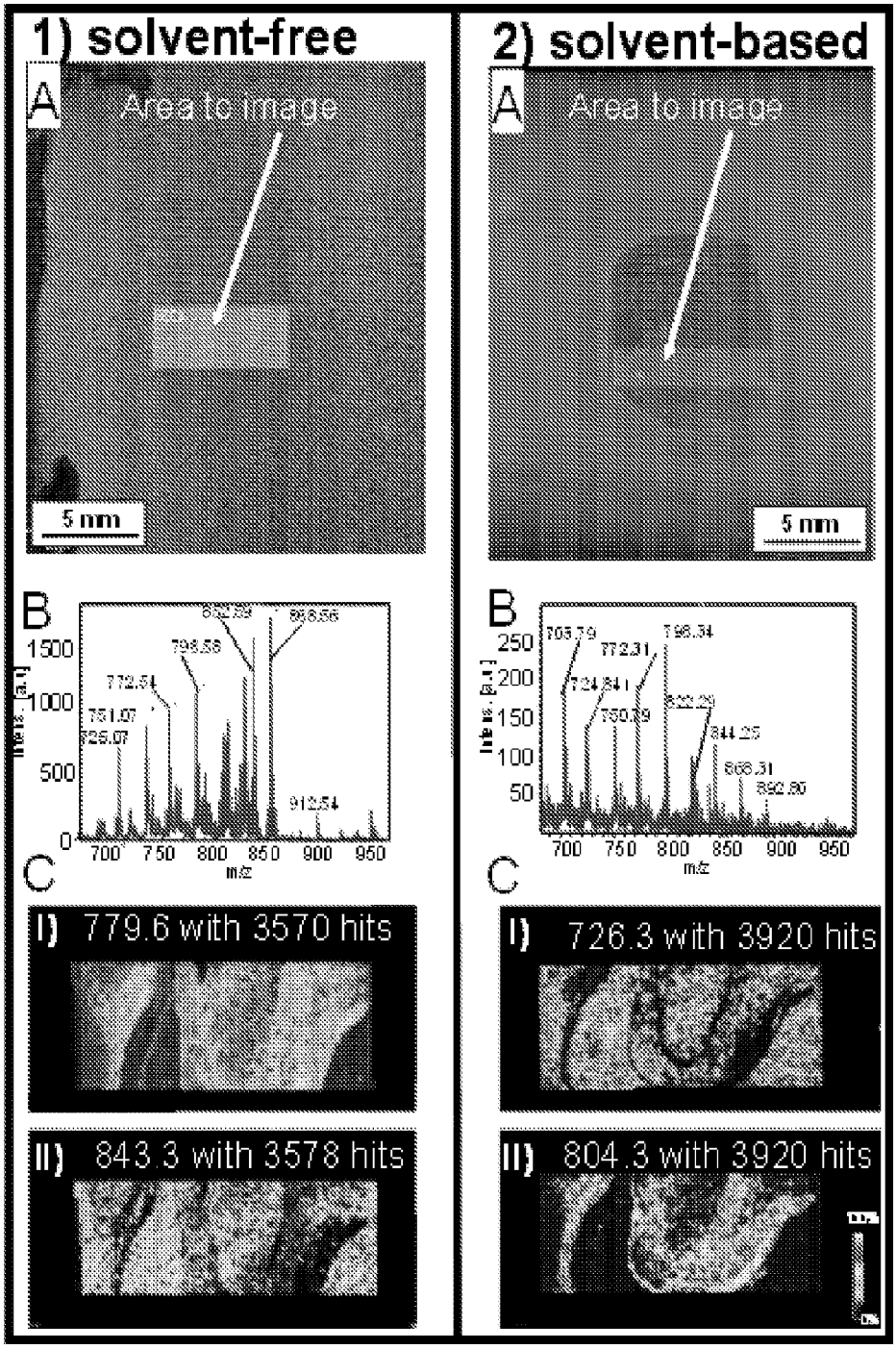
FIG. 28 shows tissue imaging of mouse brain tissue using (1) rapid solvent-free SurfaceBox matrix deposition (left) and (2) spray coating (right) and CHCA matrix: (A) photographs of the tissue covered with the CHCA matrix, (B) mass spectra, (C) MS images of respective m/z values: (I) 779.6 and (II) 843.3 for solvent-free and (I) 726.3 and (II) 804.3 for solvent-based.

The 20 μm material A was used for the tissue MS imaging studies shown in FIGS. 28A-C. FIGS. 28A-C compare tissue imaging of mouse brain tissue using (1) rapid solvent-free SurfaceBox matrix deposition (left images) and (2) spray coating (right images) and CHCA matrix. FIG. 28A show tissue covered with CHCA matrix, FIG. 28B show mass spectra, and FIG. 28C show respective m/z values: (I) 779.6 and (II) 843.3 for solvent-free and (I) 726.3 and (II) 804.3 for solvent based. MS tissue imaging results obtained using the rapid solvent-free matrix (here, CHCA) application to a mouse brain section are compared with a spray-coating method. (Garrett, et al., Int. J. Mass Spectrom 2007, 260, 166-176). With the use of this procedure, the solvent-based application produces crystal sizes of about 5-50 μm when a saturated solution of CHCA is applied as a mist. The data acquisitions using the MALDI-TOF instrument were kept identical for both tissue sections using 50 μm lateral resolution and a laser power just above the matrix threshold. In FIG. 28, the imaged area of each mouse brain section is shown in (A) along with typical mass spectra (B), and overlaid ion images (C) obtained with each method, respectively. The m/z of the more abundant ions (FIG. 28B) correspond to potassiated phosphaptidyl cholines, e.g., m/z 772 (32:0) and m/z 798 (34:1).

Overlaid ion images of m/z values along with the number of hits are displayed that provide complementary images such as m/z 779.6 and 726.3 and m/z 843.3 and 804.3. That different ions are detected using the solvent-based and solvent-free sample preparation is not unexpected. The methods are complementary with the solvent-free sample preparation better ionizing hydrophobic and solubility-restricted compounds. Obtaining lipid signals from tissue changes depends on matrix selection, solvent system, and polarity (Schwartz, et al., J. Mass Spectrom 2003, 38, 699-708).

The lipid profile and signal intensities are different between the two sample preparations. The individual ions were selected to have sufficient ion intensity, to provide visible molecular images, and to be a complementary pair within the same sample preparation. Of importance in this Example and FIGS. 28A-C are the homogeneous responses and not the m/z value or intensity of the ion signal.

Ion images are color coded to account for the ion intensity in each mass spectrum making up the entire image. A homogeneous distribution of the same color for the same m/z values in an ion image indicates mass signals with almost identical ion intensity. A homogeneous ion signal response is obtained using solvent-free MALDI analysis as seen, for example, by large patches of areas with the same color (FIG. 28, 1, C). The solvent-based MALDI analysis (FIG. 28, 2C) shows random variations of signal intensity changes as, for example, the red (high abundant) and blue (low abundant) pixels within a patch predominantly green (medium abundant). The ion signal intensity changes can be attributed to sweet spots often occurring in MALDI analysis and limiting MALDI tissue imaging applications. This comparison indicates that high-resolution images can be obtained employing the SurfaceBox for rapid matrix applications and high-resolution image analysis. Previous solvent-free applications using a MALDI-TOF-MS instrument for tissue imaging used 100 μm lateral resolution. (Puolitaival, et al., J. Am. Soc. Mass Spectrom 2008, 19, 882-886).

VI. Example 6

This example describes an analysis of mouse brain tissue using FF-TG-AP MALDI. Comparisons of solvent-free and solvent-based matrix applications is also described.

A. Tissue Mass Analysis of Mouse Brain

Figure 43:
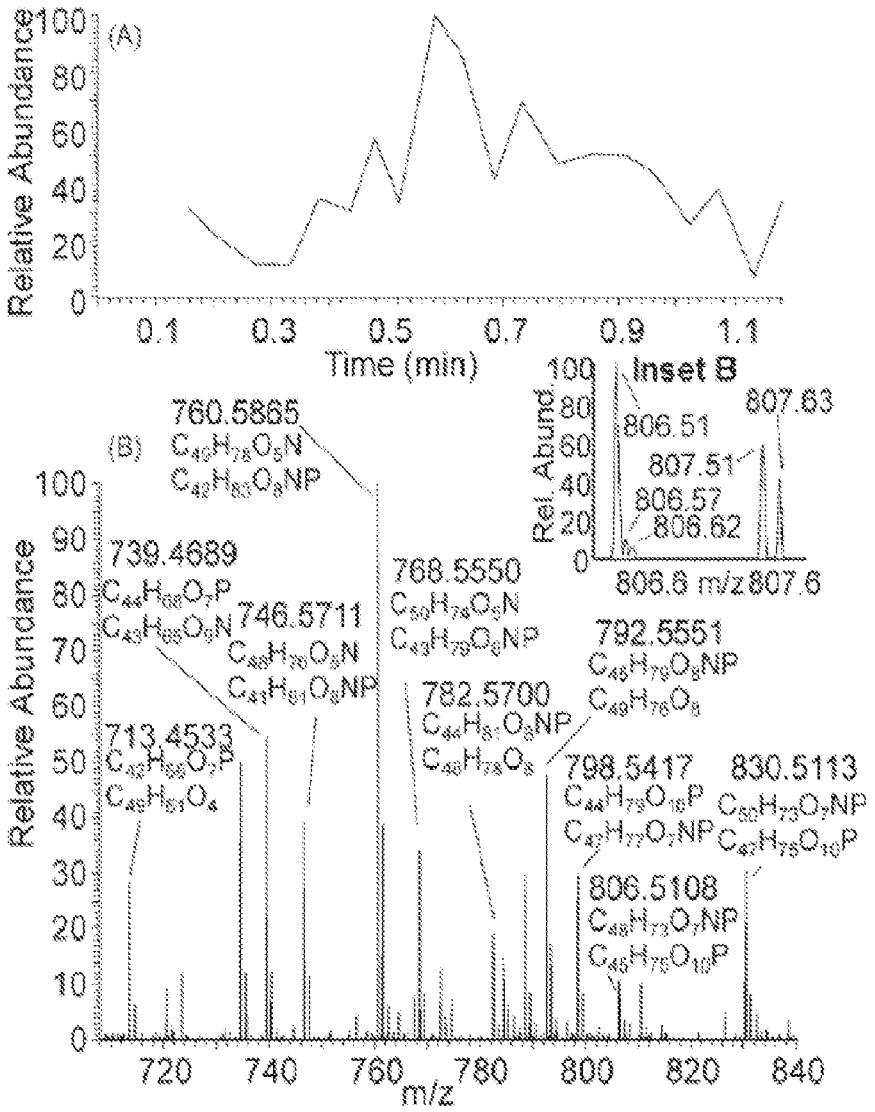
FIG. 43 shows results from analyzing mouse brain tissue using field-free transmission geometry atmospheric pressure (LSI).

FIGS. 43A-B show tissue mass analysis using a field-free transmission geometry atmospheric pressure (FF-TG-AP) MALDI source of mouse brain which was prepared by placing the matrix between the tissue and the glass slide. FIG. 43(A) shows total ion current obtained by sampling virgin tissue spots and FIG. 43(B) shows mass spectrum. The inset indicates the isobaric composition that is delineated using the high mass resolution instrument (50000 mass resolution, <5 ppm mass accuracy). This FF design enables the ablation of both the tissue and the matrix layer with the TG-AP source. Both the tissue and the matrix thickness can be precisely determined and optimized.

Figure 44:
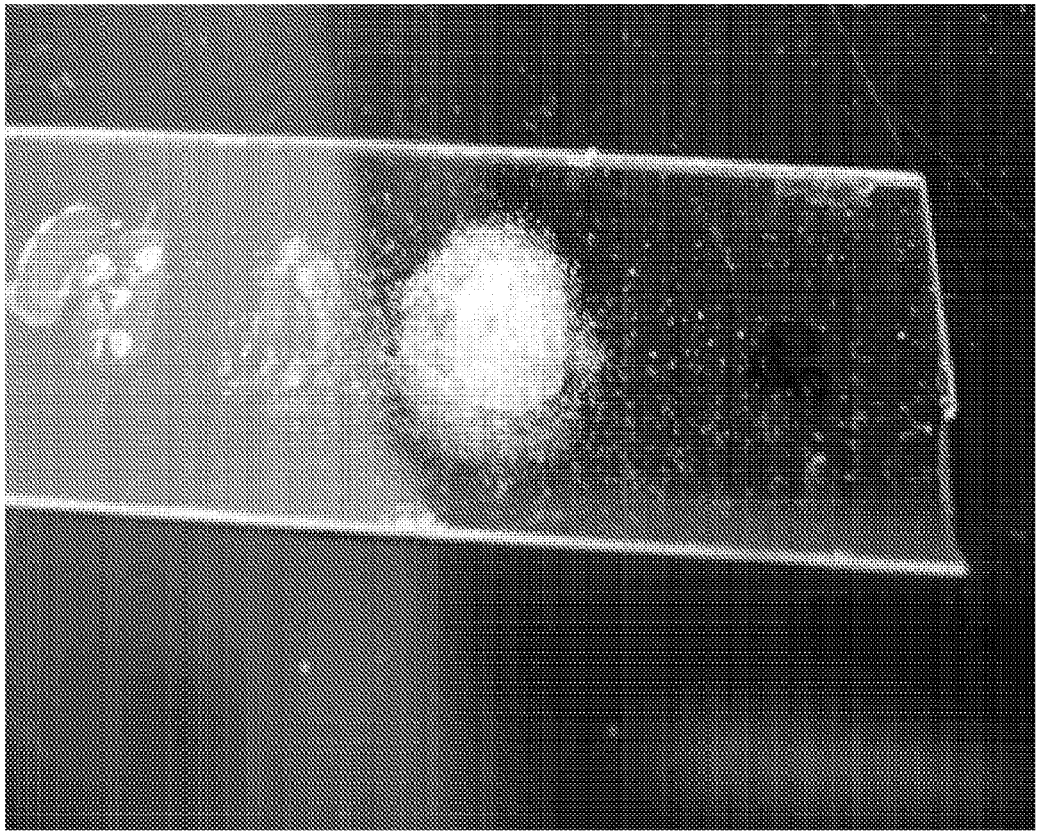
FIG. 44 depicts analysis of mouse brain sections.
Figure 45:
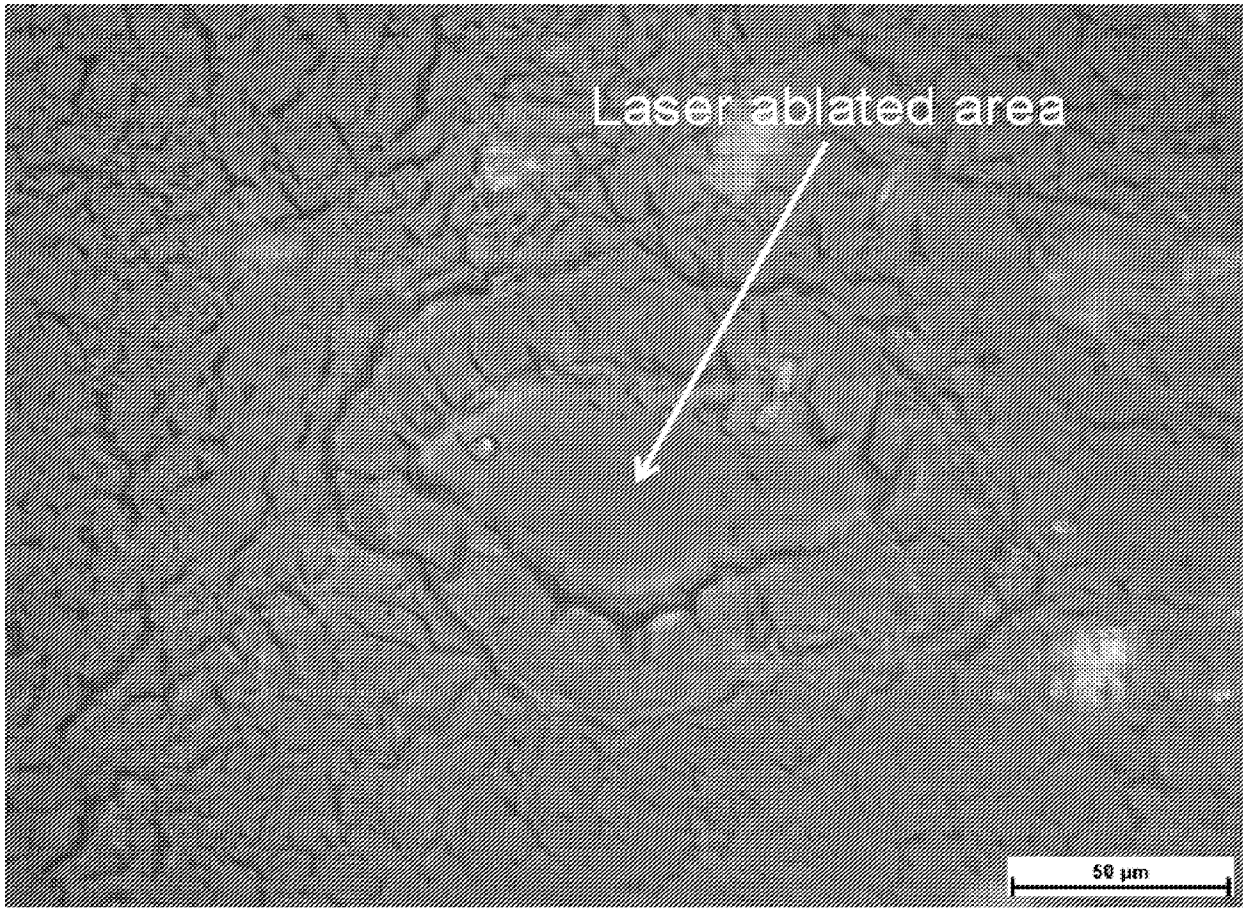
FIG. 45 depicts the solvent-free matrix-treated tissue section of FIG. 44 (1) after laser ablation.
Figure 46:
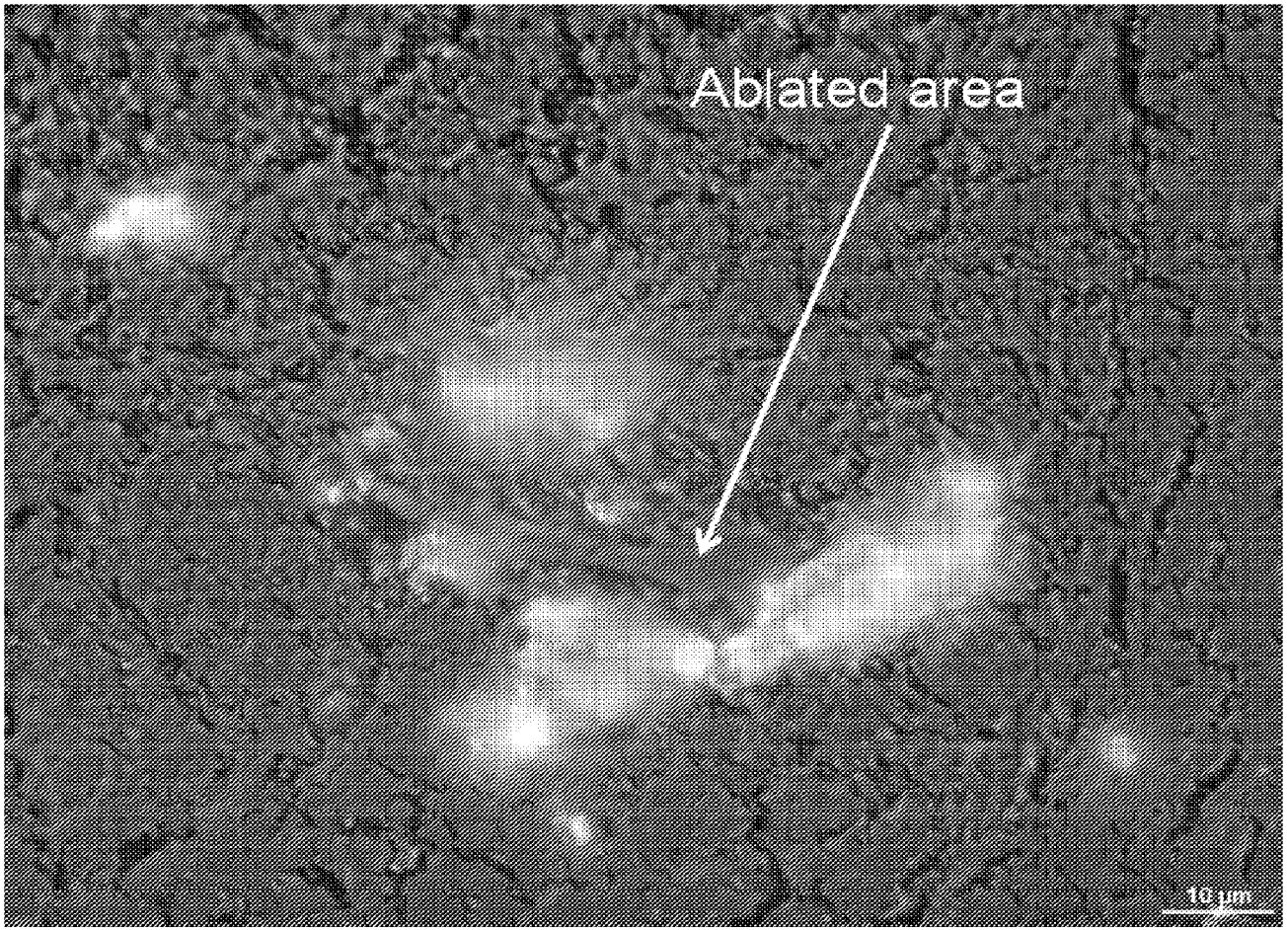
FIG. 46 depicts the solvent-free matrix-treated tissue section of FIG. 44 (1) after laser ablation; the remaining matrix surrounding the crater indicates the matrix assistance in the ablation process of the tissue.
Figure 47:
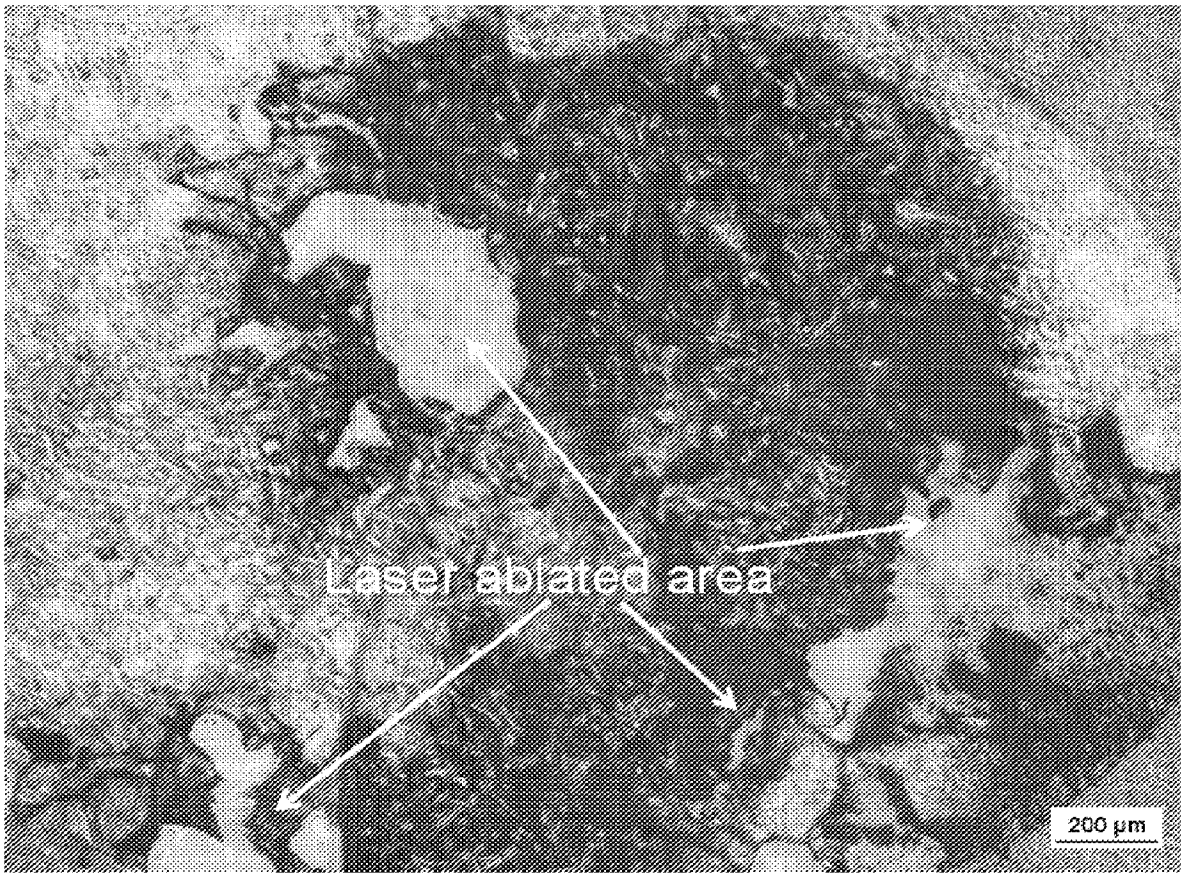
FIG. 47 depicts solvent-free matrix-treated tissue section of FIG. 44(2) after laser ablation.

As discussed in detail below, FIG. 44 shows a photograph of the microscopy slide with brain sections covered with DHB by sprinkling the dry material and before laser ablation was conducted. FIG. 44 shows the microscopy slide with brain sections (1) covered with DHB by sprinkling the dry material directly out of the container and before laser ablation; and (2) spiked with DHB matrix solvent-based using four drops. FIGS. 45 and 46 show optical microscopy images of the solvent-free matrix-treated tissue sections of FIG. 44 after laser ablation; in FIG. 45 (zoom scale of 50 μm), the shape of the crater indicates successful laser ablation through the tissue; in FIG. 46 (zoom scale of 10 μm), the remaining matrix surrounding the crater indicates the matrix assistance in the ablation of the tissue. FIG. 47 depicts solvent-free matrix-treated tissue section of FIG. 44(2) after laser ablation; the area exposed to the 0.2 μL matrix appears black.

The solvent-based and solvent-free matrix applications on top of the tissue section were examined by light microscopy after firing the laser to produce ions. The tissue section was covered with DHB matrix so that the laser beam traversed the tissue before reaching the matrix. The matrix supported ionization of the tissue material in this arrangement, but to a lesser extent than with the matrix between the tissue and microscope slide. The laser impact on the tissue was not visible to the naked eye.

Light microscopy examination revealed tissue-wide impact events. Two areas are shown in FIGS. 45 and 46. FIG. 45 shows solvent-free matrix-treated tissue sections of FIG. 44 and these can be compared with results from solvent-based applications shown in FIG. 47/The larger impact area in FIG. 45 indicates the shape of the ablated tissue area (~80 μm). Tissue damage is observed as seen by the elevated surrounding of the ablated tissue. The smaller of the two ablated areas shown in FIG. 46 indicates the possible role of the matrix. Only when matrix is sufficiently close to the tissue, can matrix assistance in desorption/ionization of the tissue molecules occur. A possible mechanism is that after the first shot, the heat melts the matrix to the tissue. This would explain the ablated tissue area with parts of the matrix crystals still present on each side of the crater.

Significantly better ion current was achieved when the matrix was placed below the tissue; however, the laser-ablated tissue area was notably larger. The abundance of ions produced with the FF-TG-AP approach suggests that sufficient signal is observed with improved laser beam focus.

VII. Example 7

This example shows the solvent-free MS analysis of Angiotensin 1

For MALDI sample preparation, the dried droplet method was followed (Karas, et al., Anal Chem 1998; 60:2299). Solvent-free sample preparations for direct deposition of samples to the glass slides were prepared using the protocol described in Trimpin, et al., Rapid Commun Mass Spec 2001; 15:1364. Peptides, proteins, DHB isomers, and solvents were obtained from Sigma Aldrich (St. Louis, Mo.).

Figure 62:
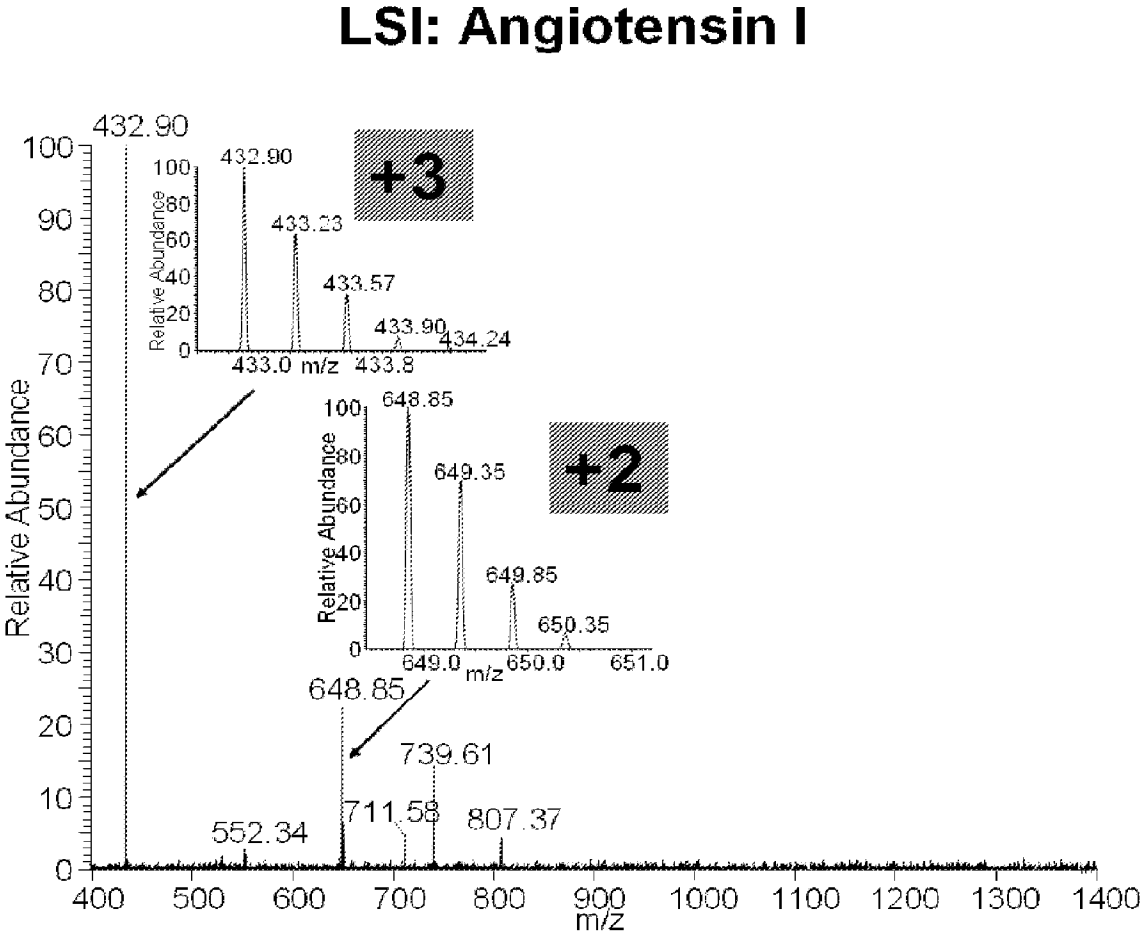
FIG. 62 depicts a LSI spectrum for angiotensin 1.

FIG. 62 shows mass spectra of angiotensin 1 obtained by LSI using 2,5-DHB. Insets show enlarged areas as indicated.

Figure 63:
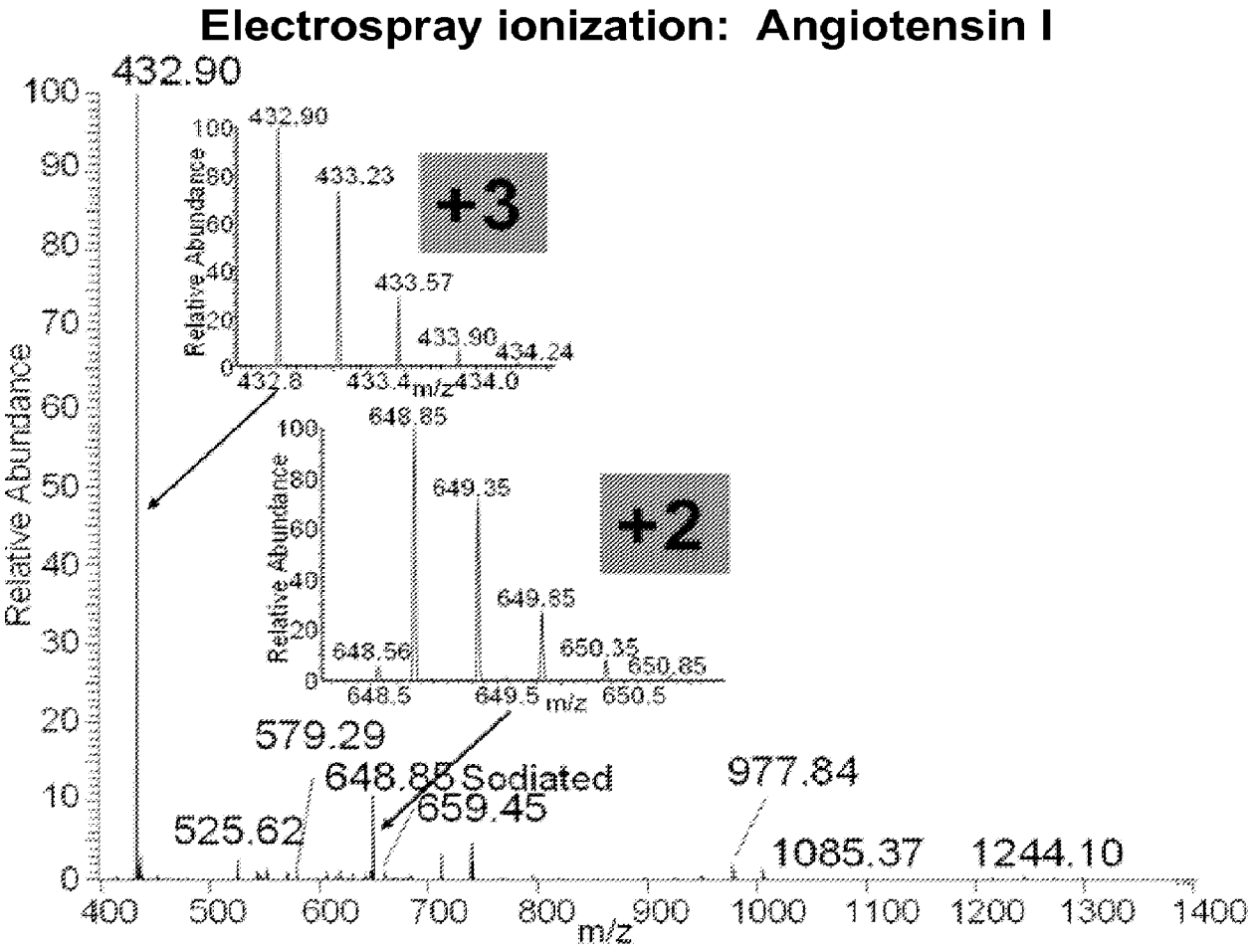
FIG. 63 depicts an ESI spectrum for angiotensin 1.

FIG. 63 shows mass spectra of angiotensin 1 obtained by electrospray ionization (ESI) using 50/50 CAN/water.

The results show that for a small system such as angiotensin 1, identical charge state distributions and abundances are observed between ESI and FF-TG AP-MALDI using 2,5-DHB and solvent-based sample preparation conditions.

VIII. Example 8

This example shows AP-MALDI of ionized amyloid peptide (1-42).

Figure 66:
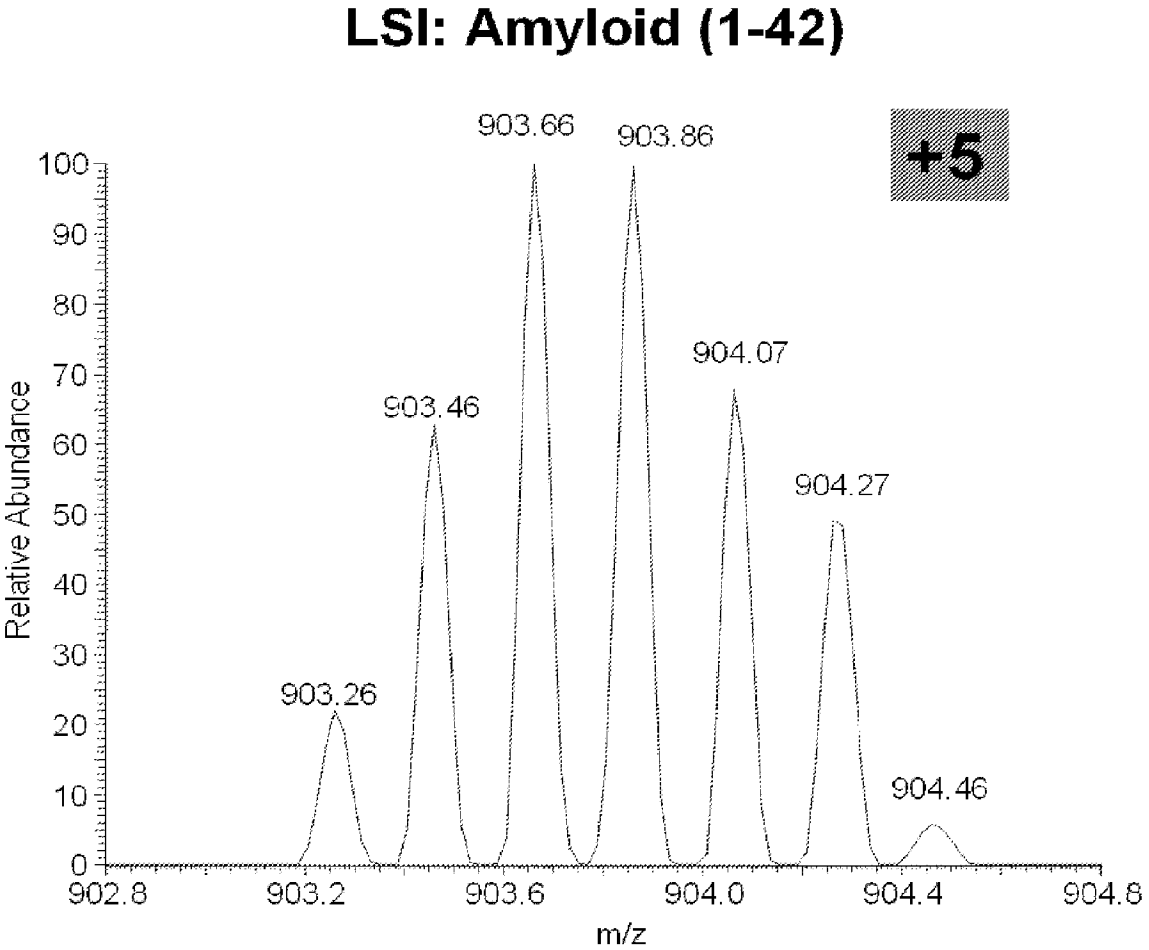
FIG. 66 depicts a spectrum for amyloid 1-42 with charge state +5.
Figure 67:
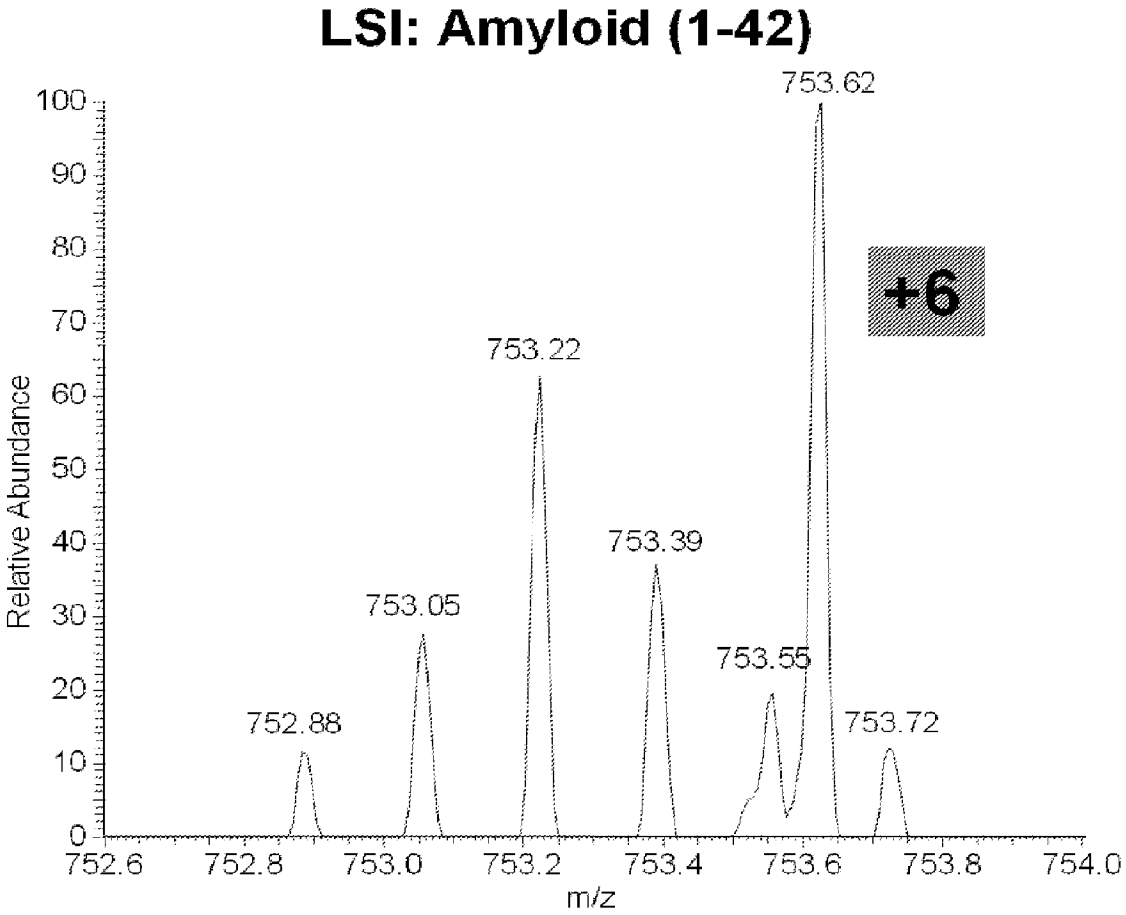
FIG. 67 depicts a spectrum for amyloid 1-42 with charge state +6.

The amyloid peptide (1-42) plays a major role in the pathogenesis of Alzheimer's disease. As part of the disease process, it becomes converted to insoluble neurotoxic β-amyloid fibril forms (Wunderlin, et al., Peptides-European Symposium 1999; 25; 330-331). For this Example, AP through-stage MALDI was performed on Amyloid (1-42). Because the protein molecular weight exceeds the standard MS range, the protein was ionized. FIGS. 65-67 show mass spectra with charges of +4, +5, and +6. This example shows that ionizing larger molecular weight proteins (over about 4,000 mw) can allow their analysis using AP through-stage MALDI.

IX. Example 9

This example shows preparations and MS analysis of bovine insulin.

Figure 68:
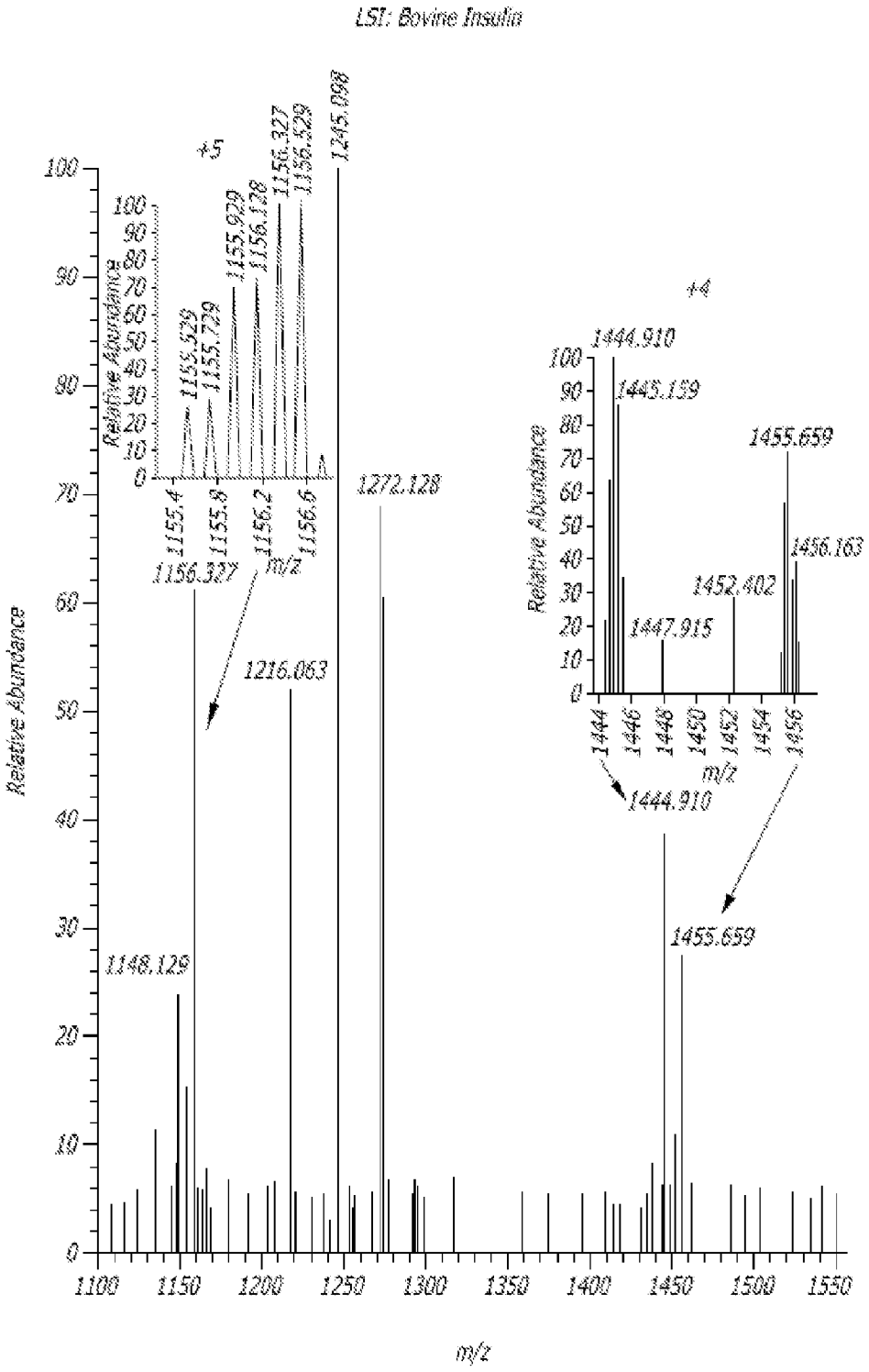
FIG. 68 depicts spectra for bovine insulin showing charge states +4 and +5.

Using 2,5-DHB and MALDI solvent-based matrix/analyte preparation methods mass spectra were produced for bovine insulin. (Karas, et al., Anal. Chem. 1988; 60:2299). The MALDI mass spectra (FIG. 68) were similar to ESI spectra for insulin. FIG. 10 shows solvent-free and solvent-based preparations of bovine insulin.

X. Example 10

Additional Data And Disclosures

The following figures represent additional data and disclosures relating to studies and experiments conducted to improve material analysis and tissue imaging by mass spectrometry (MS).

Figure 15:
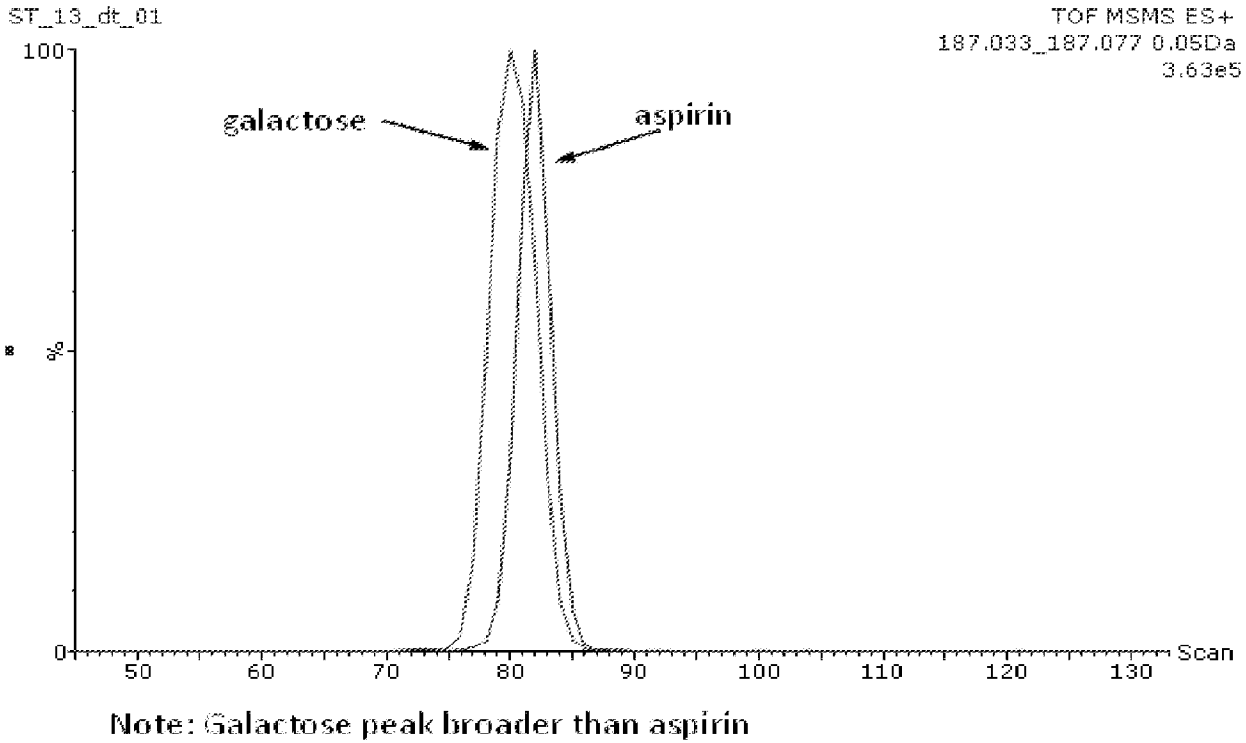
FIG. 15 depicts solvent-free separation of isobaric molecules (compounds having the same nominal mass) according to shape.

FIG. 15 depicts solvent-free separation of isobaric molecules according to shape. IMS-MS separates molecules according to number of charges and cross section (size and shape); galactose and aspirin have essentially the same molecular weight (essentially the same size) and are ionized by adding one cation (same number of charges). FIG. 15 shows the drift time spectra (solvent-free separation, the ion mobility out-put) using ESI-IMS-MS (SYNAPT G2, Waters Company) of galactose ($C_6H_{12}O_6$; exact molecular weight 180.063 Da) versus aspirin ($C_9H_8O_4$; exact molecular weight 180.042 Da).

Figure 16:
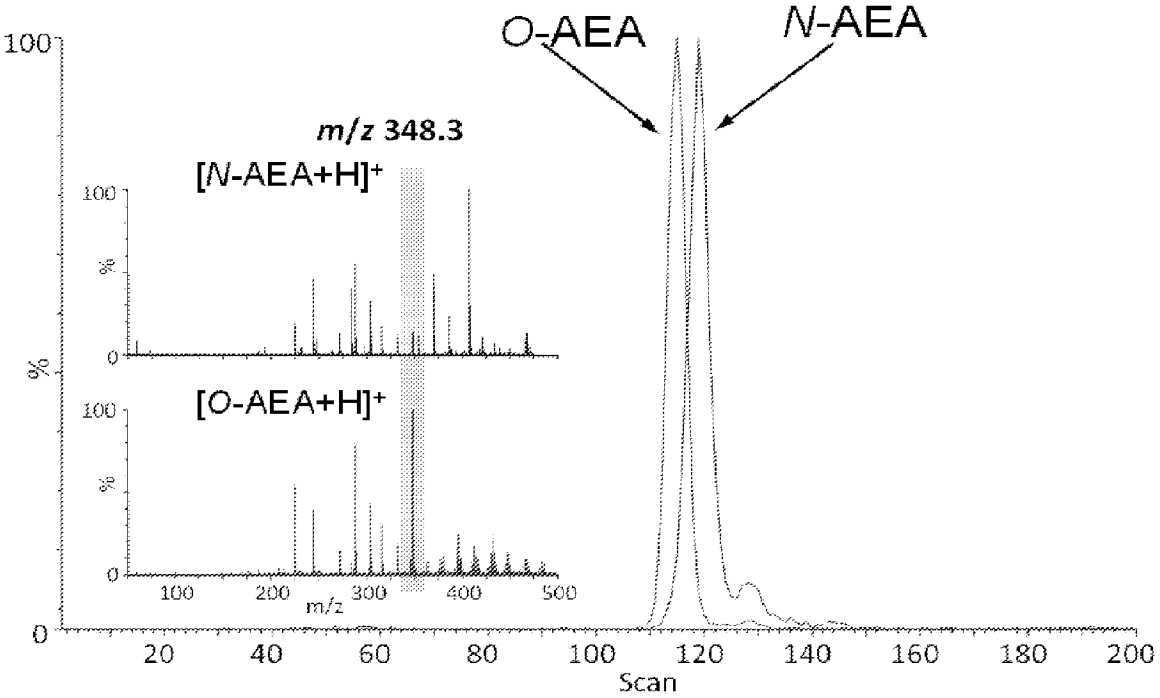
FIG. 16 shows solvent-free separation demonstrated for isomeric molecules (compounds with the same elemental composition but different structures) according to shape.

FIG. 16 depicts solvent-free separation of isomeric molecules according to shape. IMS-MS separates molecules according to number of charges and cross section (size and shape); N-AEA (anandamide; pharmacological relevant compound, an endocannabinoid; relevant in the function of brain and well being (happiness); arachidoinic acid and ethanolamine linked together via the amine functionality to give an amide bond) and O-AEA (anandamide; compound pharmacological likely not relevant; arachidoinic acid and ethanolamine linked together via the alcohol functionality to give an ester bond) have identical molecular weight (identical size) and are ionized by adding one cation (same number of charges). FIG. 16 shows the drift time spectra (solvent-free separation, the ion mobility data) using ESI-IMS-MS (SYNAPT G2, Waters Company) of O-AEA versus N-AEA. The Inset spectra are the mass spectra (MS output) of N-AEA and O-AEA providing abundant ions for [M+H]+ at mass-to-charge (m/z) 348.28. Because of their identical molecular weights and charges these ions cannot be distinguished in the MS dimension (separating only according to m/z).

Figure 17:
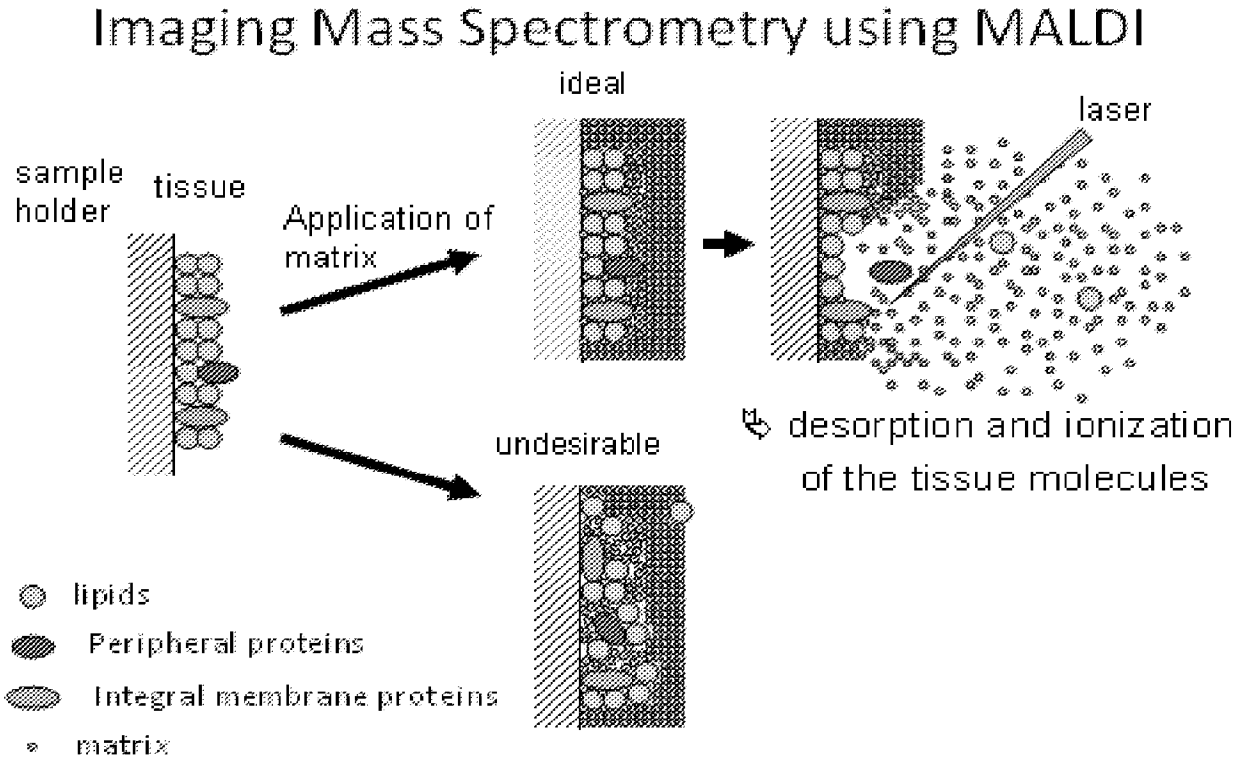
FIG. 17 provides a schematic of the process for imaging mass spectrometry using matrix-assisted laser desorption/ionization (MALDI), showing an advantage of the more homogenous solvent-free matrix/analyte preparation for vacuum or Atmospheric Pressure (AP) methods (AP-MALDI and Laserspray Ionization (LSI)).

FIG. 17 provides a scheme of sample preparation and reflective geometry (RG) MALDI showing issues especially related to the analysis of tissue material. Tissue is placed on a sample holder and a matrix is applied. A laser is directed at the matrix and sample resulting in desorption and ionization of the tissue molecules.

FIG. 17 particularly shows that it is undesirable for the matrix material not to fully encapsulate the tissue sample. RG MALDI is the exclusively used source geometry in vacuum and atmospheric pressure MALDI mass spectrometers currently on the market. The leftmost image shows a tissue material on top of a surface (frequently gold coated glass slide, metal plate, or a metal plate that can hold a glass slide).

To transfer the molecules into the gas-phase intact and attach a charge, especially crucial for larger molecules, a matrix must be employed that assists in the desorption and ionization of the analyte. The top middle image displays the ideal case and the bottom middle image displays the experimental reality when applying the matrix using a solvent-based application approach; the localization of the various compounds in the tissue section are dislocated and scrambled so that they lose their original and natural environment and location.

The top right image shows the RG MALDI producing the intact molecular ions in the gas-phase. The UV laser (frequently 355 nm [N2 laser], 355 nm [Nd:YAG laser]) excites the matrix from the 'front' and an angle (limiting the control over the ablated area in lateral and depth dimension). The produced ions are lifted from the surface by applying a voltage to accelerate them away and to the analyzer in which the molecules are separated frequently according to m/z.

Figure 19:
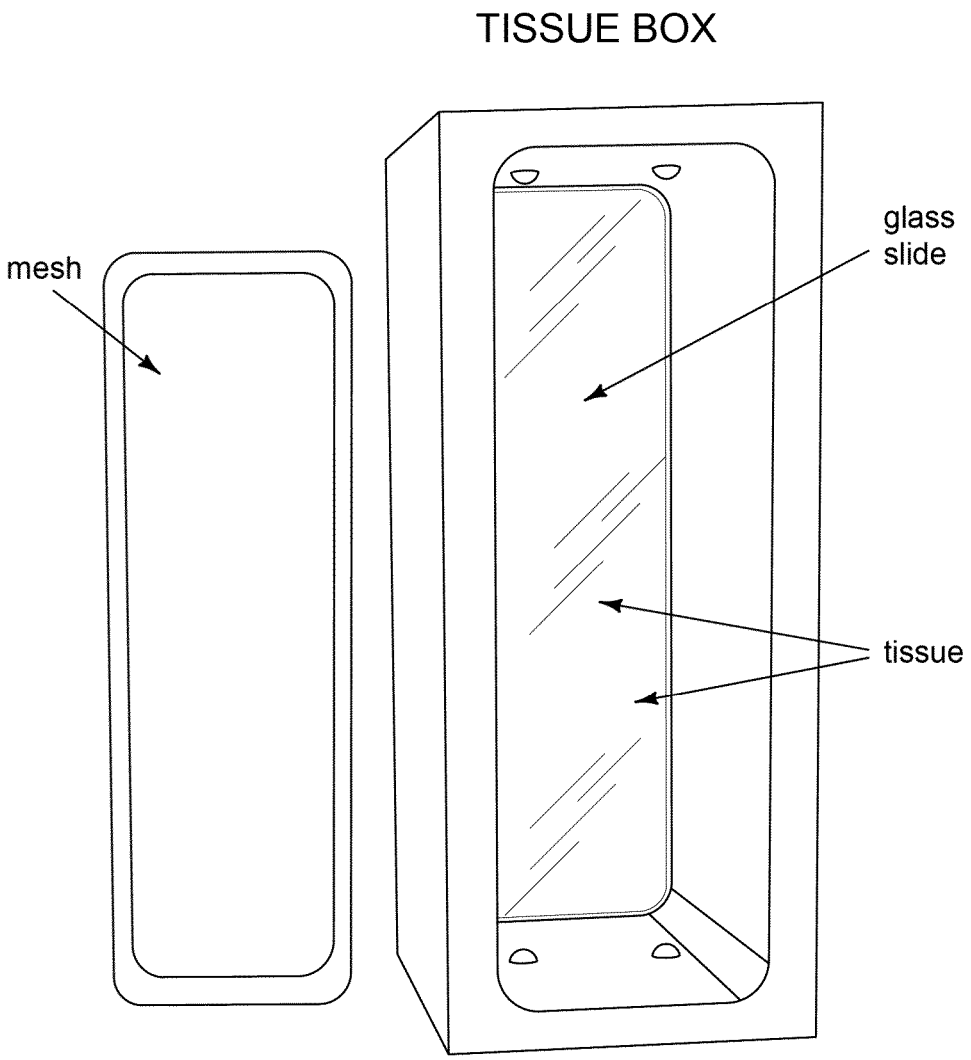
FIG. 19 depicts a photograph of a TissueBox.

FIG. 19 depicts a photograph of one representation of the TissueBox. Shown are fabricated parts used to assemble the TissueBox outlined in FIG. 18. The left image shows the upper compartment that holds a mesh (typically metal or plastic, with various 'pore' sizes >44 to 1 μm) on the bottom. This upper compartment, when assembled, is filled with the matrix and beads (frequently stainless steel, glass, chrome and with typical sizes ranging from 0.5 mm to 5 mm). The right images shows the lower compartment that holds the glass slide (mounted with two tissue sections) on the bottom and when assembled with the top compartment, the compartments are designed and fabricated so that there is sufficient space between the tissue and the mesh so that they do not meet even with the vigorous movement of the beads during the subsequent TissueLyzer application (time and frequency can be adjusted to gain optimal homogenous coverage of the desired matrix, e.g. 2,5-DHB and CHCA).

Figure 20:
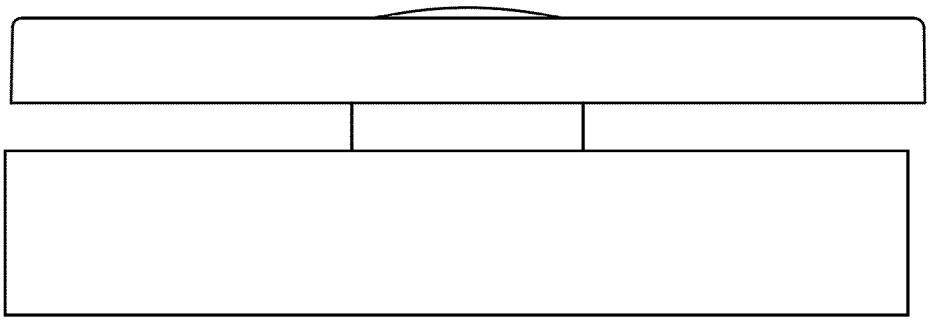
FIG. 20 depicts an adapter set holder for the TissueBox shown inside.

FIG. 20 depicts an adapter set holder for the TissueBox shown inside.

Figure 21:
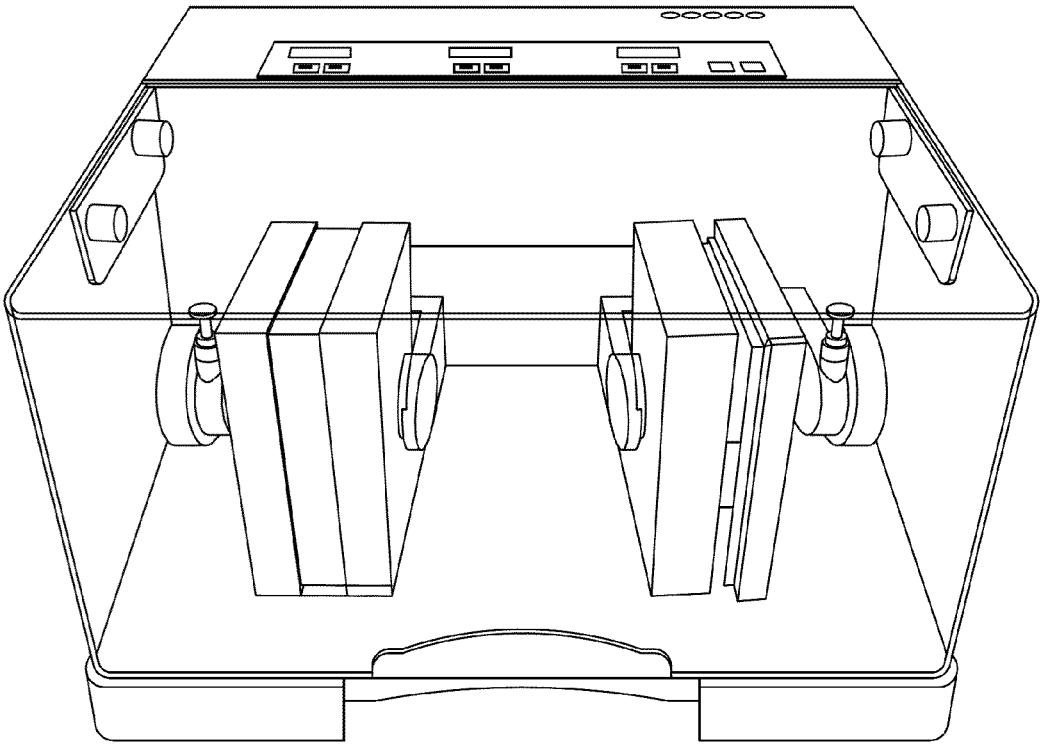
FIG. 21 depicts a ball-milling device (TissueLyzer (Qiagen, Valencia, Calif.)) that shakes two adapter sets simultaneously with the desired time and frequency so that the balls grind the matrix by a ball mill method.

FIG. 21 depicts a TissueLyzer device that shakes two adapter sets simultaneously with the desired time and frequency so that the balls grind the matrix by a ball mill method. If the screen is placed as shown in FIG. 18, the matrix is deposited onto the tissue slice(s). Without the screen, matrix/analyte solvent free preparation can occur as shown in FIGS. 1-14.

Figure 29:
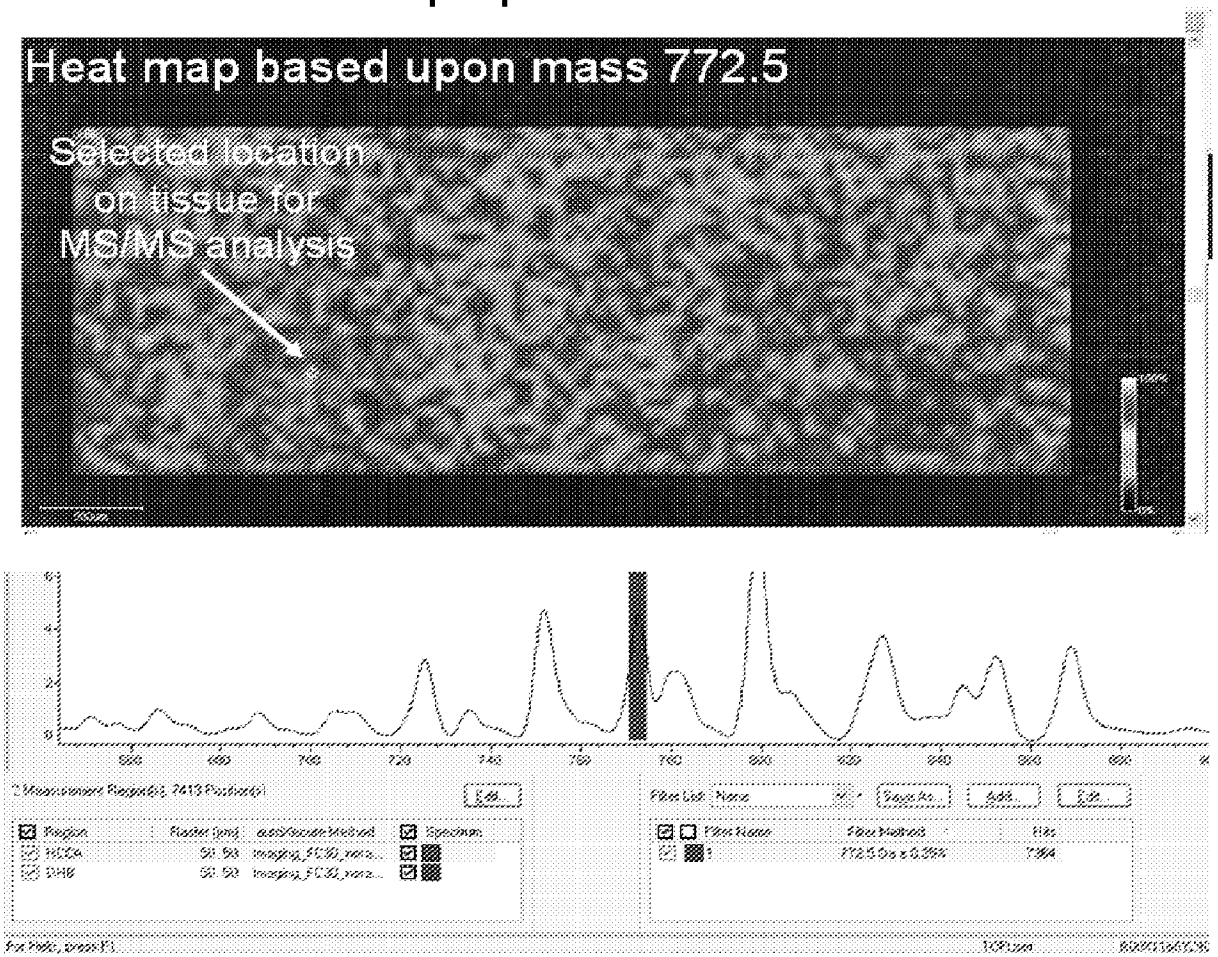
FIG. 29 depicts solvent-free DHB preparation of mouse brain.

FIG. 29 depicts solvent-free TissueBox preparation of mouse brain using 2,5-DHB as matrix on Bruker TOF/TOF instrument. The top image shows the tissue image and which spot is mass-selected and in the bottom image the mass spectrum is shows which mass is selected to acquire MS/MS fragmentation of the signal at m/z 772.5. The results are shown in FIG. 30, an example of tissue imaging using the TissueBox preparation method.

Figure 30:
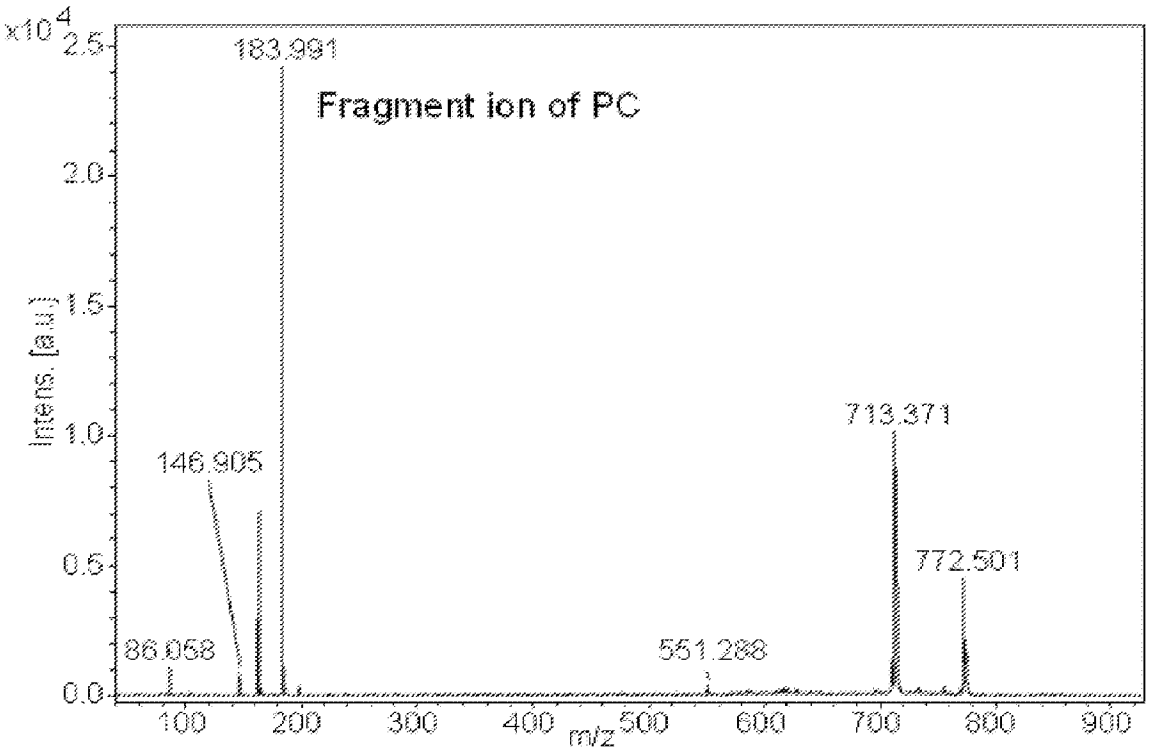
FIG. 30 depicts solvent-free TissueBox preparation of mouse brain using 2,5-DHB as matrix on Bruker instrument (Bruker Datonics, Inc., Billerica, Mass.).

FIG. 30 shows solvent-free MALDI TOF/TOF of m/z 772.5 Da from mouse brain tissue. Peaks are seen 86,058 m/z, 183,991 m/z, 551,288 m/z, 713,371 m/z and 772,501 m/z. Mass spectrum of the fragmentation of tissue spot selected and mass selected ion m/z 772.5 (see FIG. 29) from tissue material.

Figure 34:
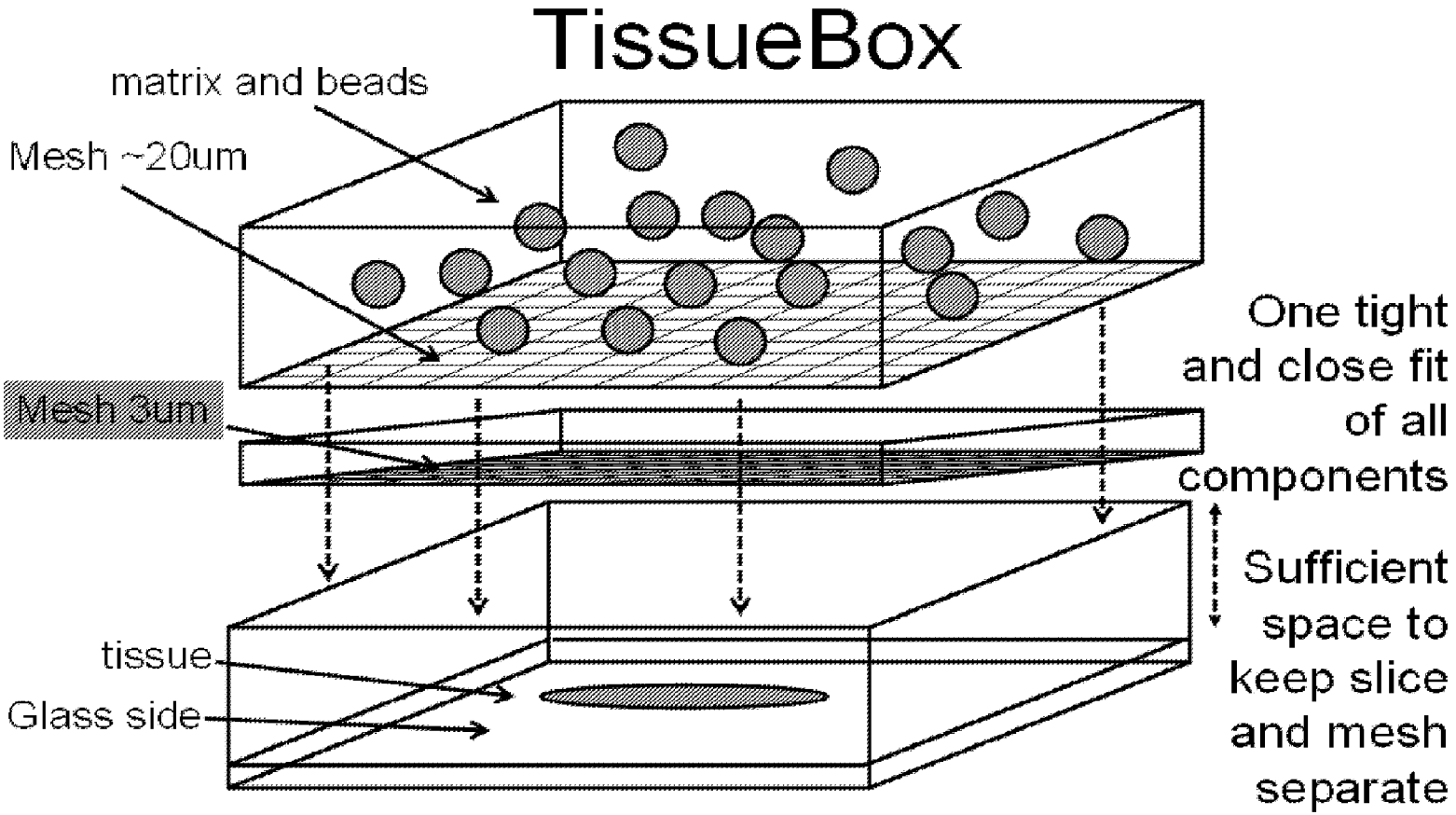
FIG. 34 depicts a representation for using a double mesh approach to produce finer particle sizes.

FIG. 34 depicts a tissue box representation for using a double mesh approach for even finer particle sizes. The design is similar to FIG. 18, the single mesh TissueBox, with the exception that two meshes are employed. The double mesh approach frequently employs two different sizes of meshes; the mesh with the smaller 'pore' opening is below the mesh with the larger opening which can hold beads. This middle compartment refines the grain sizes to even smaller particles covering the surface below (here illustrated is a glass slide mounted with a tissue section).

Figure 35:
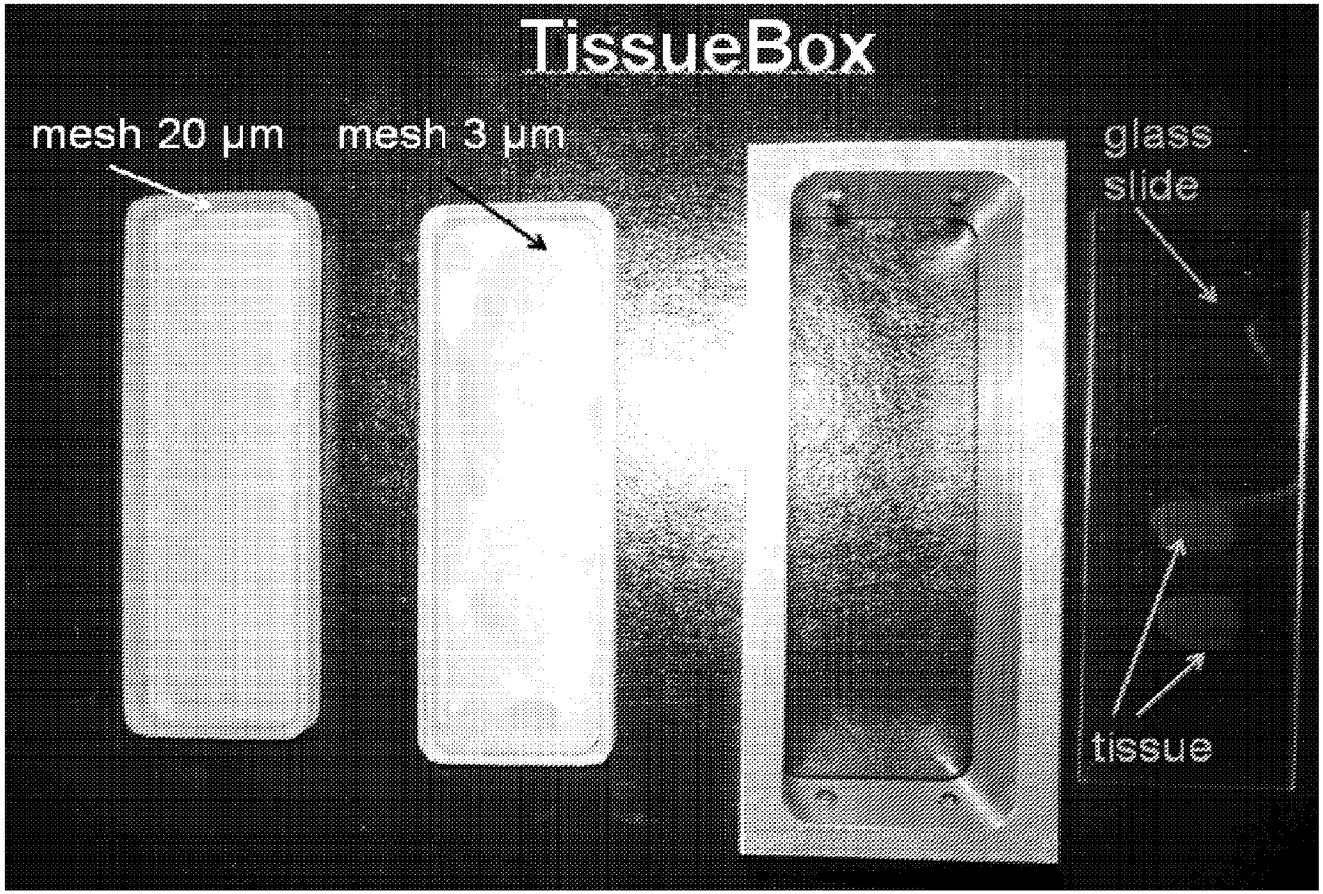
FIG. 35 depicts a representation of the double mesh TissueBox approach.

FIG. 35 depicts a representation of the double mesh TissueBox approach and the glass slide with the tissue. FIG. 35 shows fabricated parts used to assemble the double mesh TissueBox outlined in FIG. 34. To the left are shown the mounted meshes with two different 'pore' sizes (here 20 μm to be assembled on the top and 3 μm to be assembled in the middle). Second to the right is shown the lower compartment. To the far right is shown the glass slide (mounted with two tissue sections) that is to be assembled below the bottom compartment. Pre-grinding can be eliminated with the double mesh approach.

Figure 41:
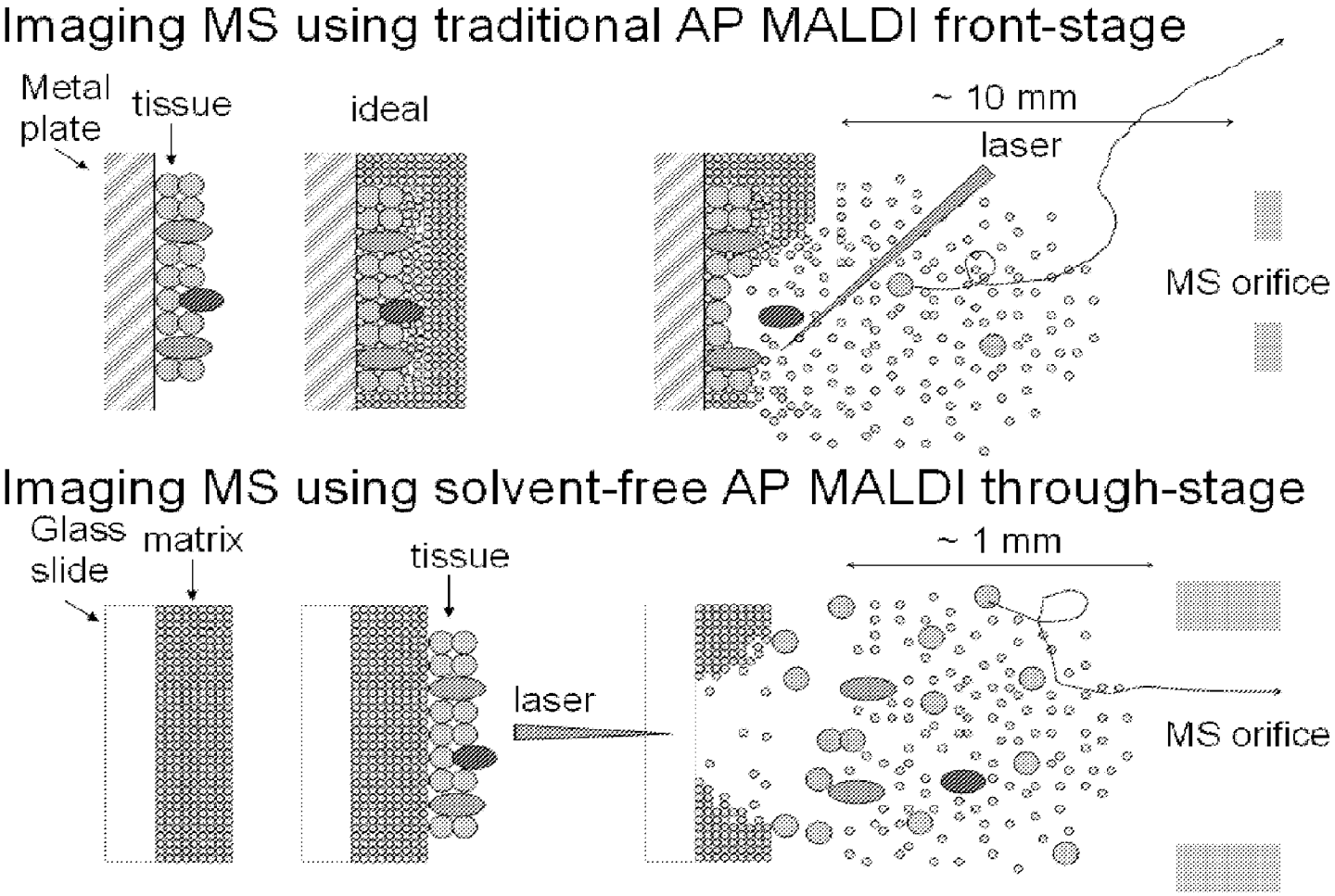
FIG. 41 depicts a scheme comparing the conventional RG (top) with TG (bottom).

FIG. 41 depicts a scheme comparing the conventional RG (top) with TG (bottom). Forward momentum in TG eliminates the need for a voltage applied between the sample plate and the ion entrance to the mass spectrometer for higher momentum particles.

Figure 42:
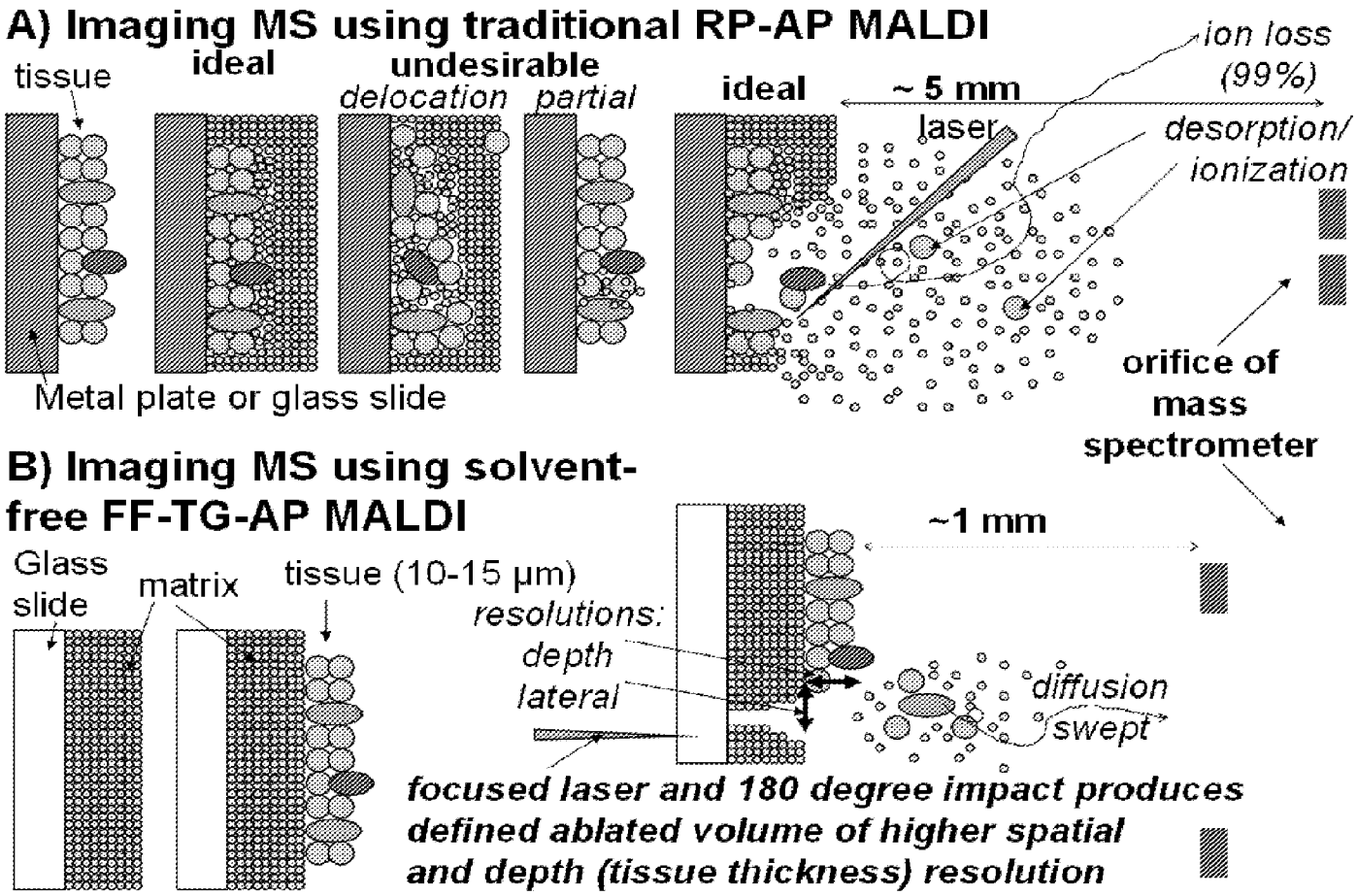
FIG. 42 depicts a schematic representation of matrix applications and laser-based source designs for the production of ions at AP.

FIG. 42 depicts a schematic representation of matrix applications and laser-based source designs for the production of ions at AP. FIG. 42(A) shows RG and FIG. 42(B) shows TG.

Figure 48:
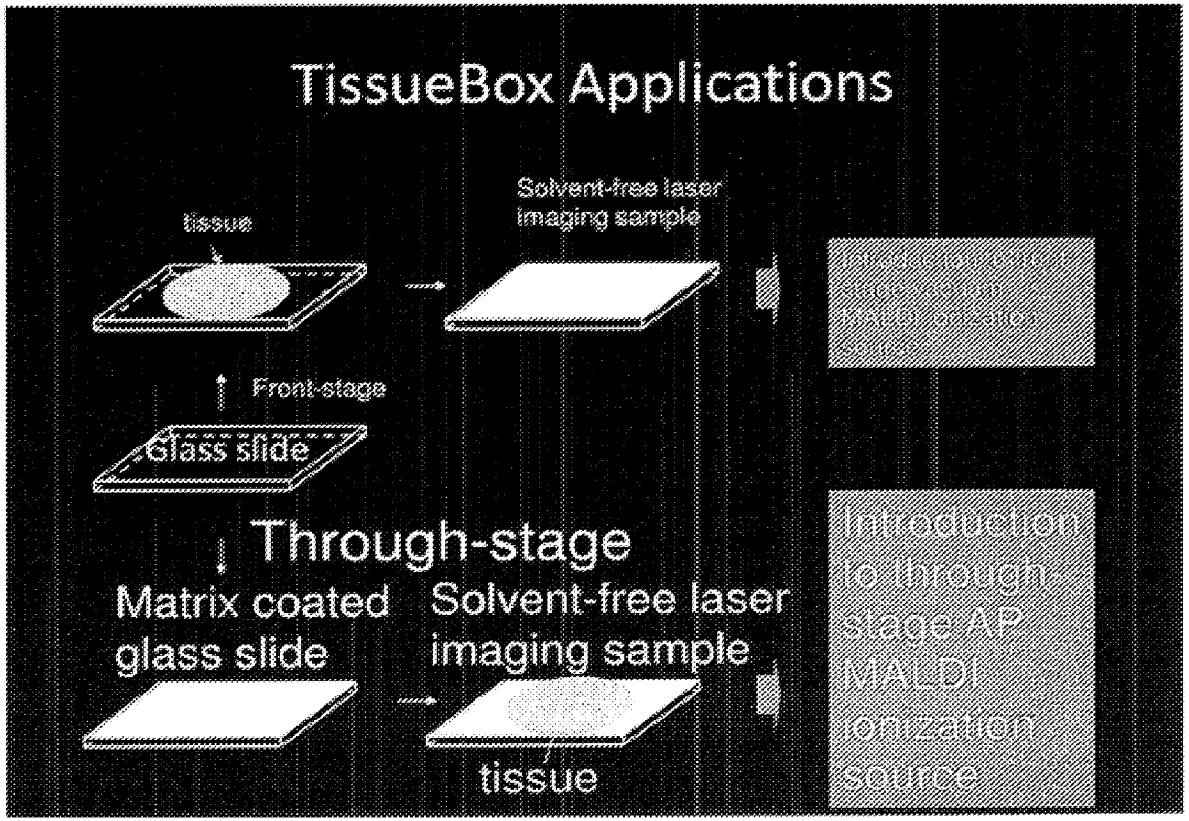
FIG. 48 is a representation of two different solvent free sample preparation methods.

FIG. 48 is a representation of two different solvent free sample preparation methods. The upper part of the scheme shows applying the matrix solvent-free using the TissueBox approach to the top of the tissue which would typically be used with RG MALDI. The lower half shows first coating the glass microscope slide with matrix using the TissueBox solvent free approach and then applying the tissue on top. This approach has advantages for transmission geometry. In both cases the laser energy is absorbed by the matrix rather than the tissue.

Figure 49:
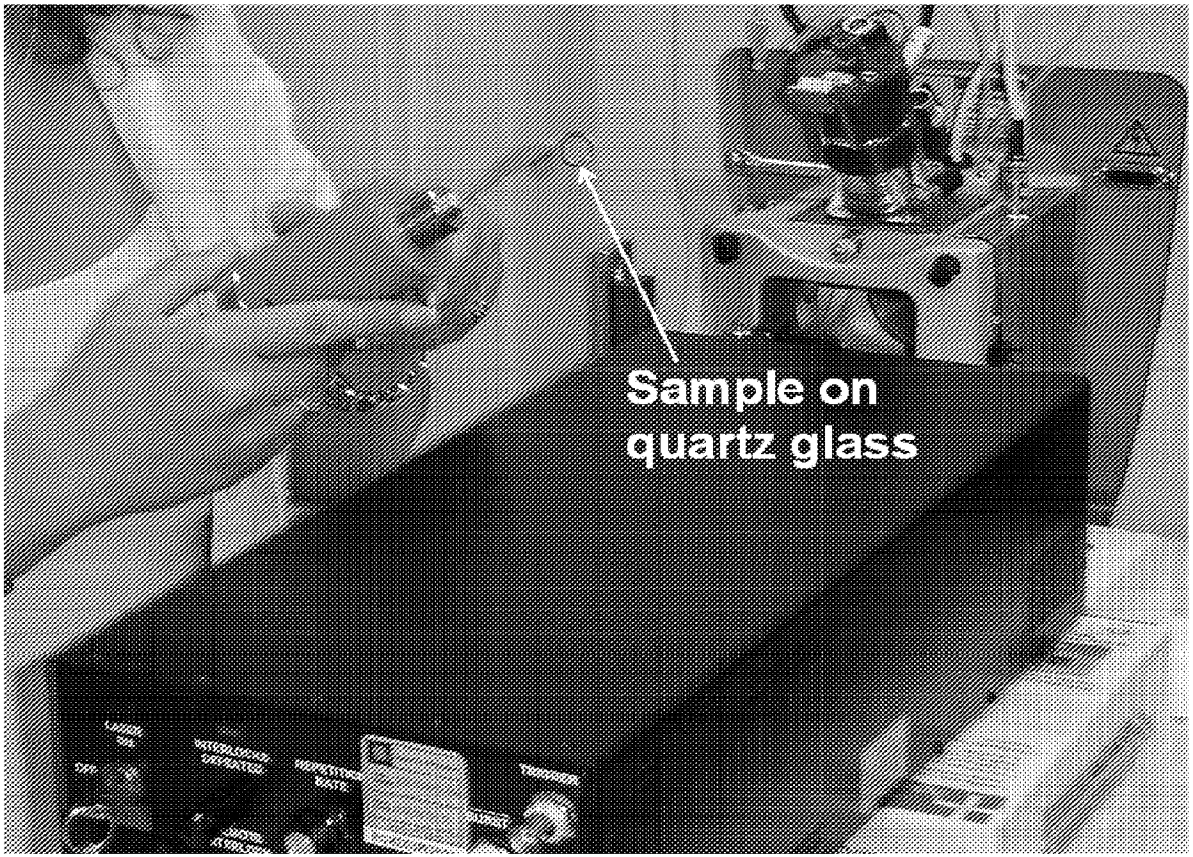
FIG. 49 depicts the results of an experiment with LSI to form multiply-charged ions.
Figure 50:
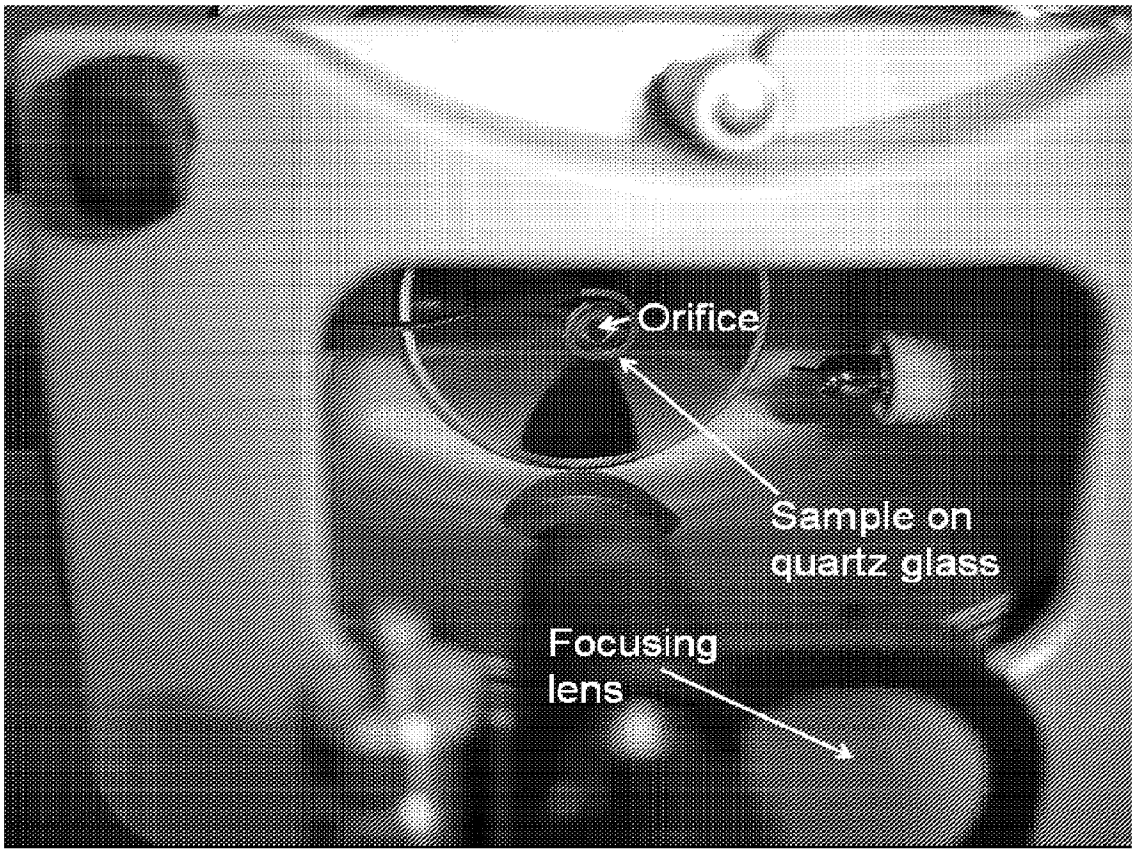
FIG. 50 depicts a close-up view of the Ion Max source from the front showing in the foreground the focusing lens held on an x, y, z stage.
Figure 51:
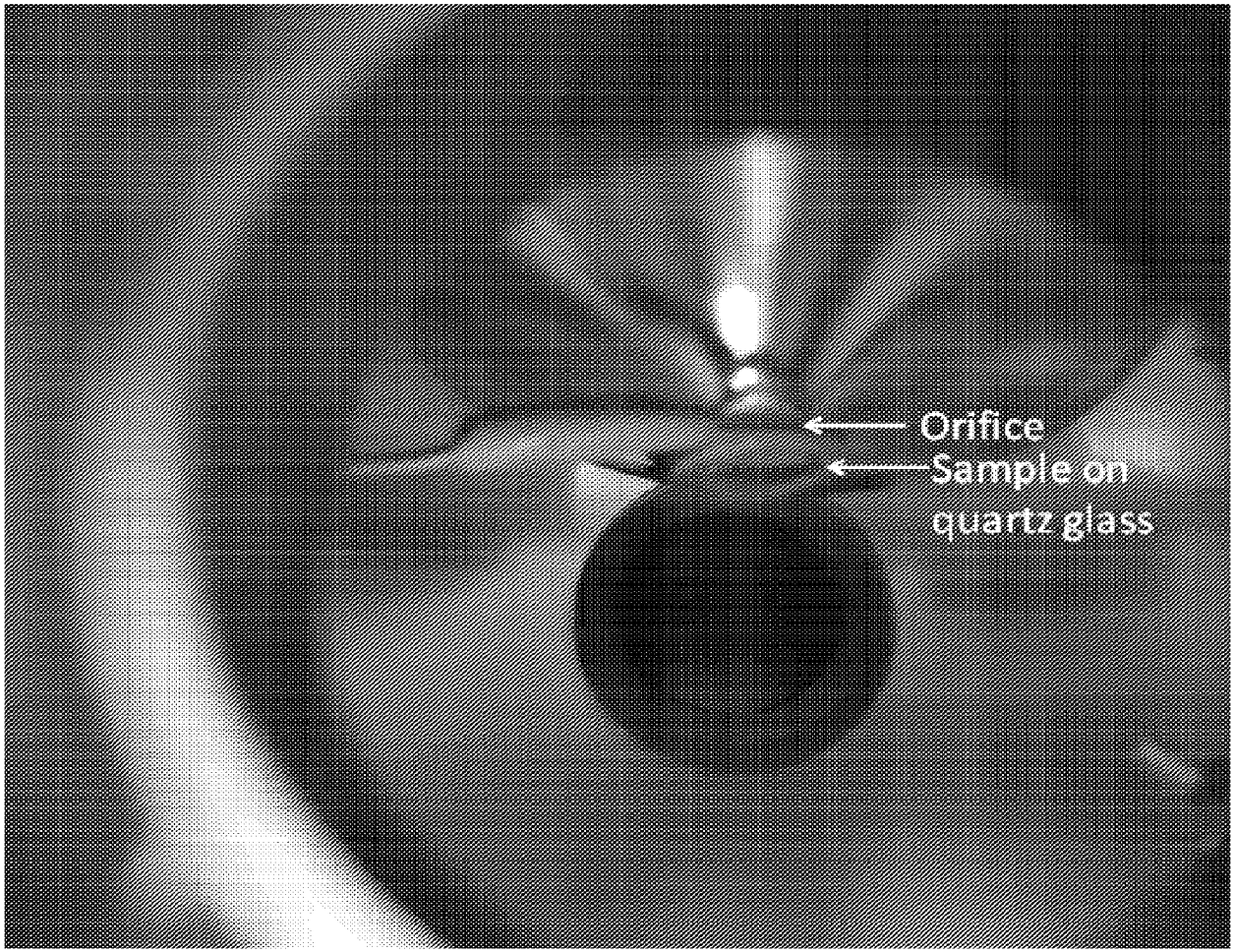
FIG. 51 depicts a close-up view of the quartz plate in close proximity to the ion entrance orifice (aperture).
Figure 52:
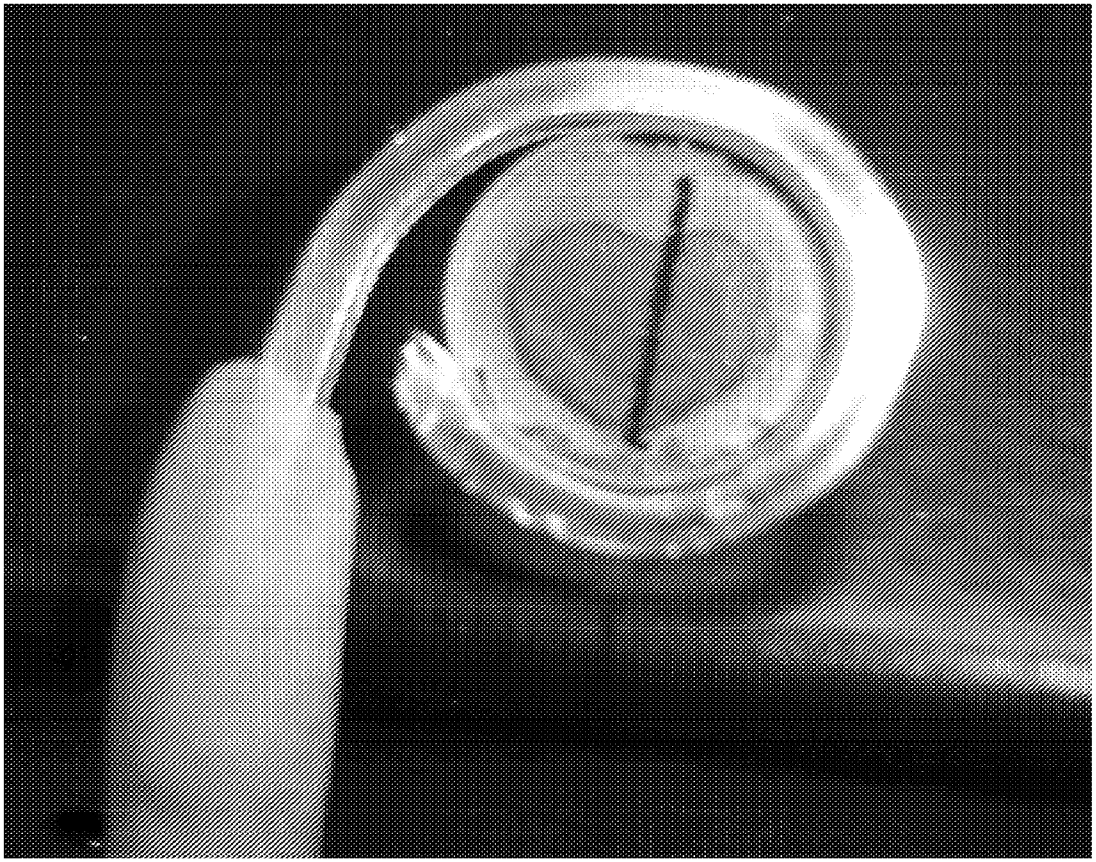
FIG. 52 depicts the line through the matrix (heart shaped) being made by multiple passes of quartz plate through the laser beam with only forward and reverse direction of motion.

FIGS. 49-52 provide photographs of equipment used to perform solvent-free MALDI. FIG. 49 depicts the results of an experiment with LSI to form multiply-charged ions. Shown is a holder of a quartz plate to which matrix/analyte has been applied using the dried droplet approach. The nitrogen laser is the black box and directly in front of it is the thermo Fisher Scientific Ion Max source. FIG. 50 depicts a close-up view of the Ion Max source from the front showing in the foreground the focusing lens held on an x, y, z stage. The laser beam is focused by the lens to strike the matrix/analyte sample being held on the quartz plate near the mass spectrometer ion entrance aperture. The laser beam is in-line with the ion entrance capillary (180 deg) and strikes the sample that is held between 0.2 mm and 20 mm of the ion entrance aperture of the MS. FIG. 51 also shows an orifice and a sample on quartz glass. FIG. 52 shows that the line through the matrix (heart shaped) is made by multiple passes of quartz plate through the laser beam with only forward and reverse direction of motion.

Figure 53:
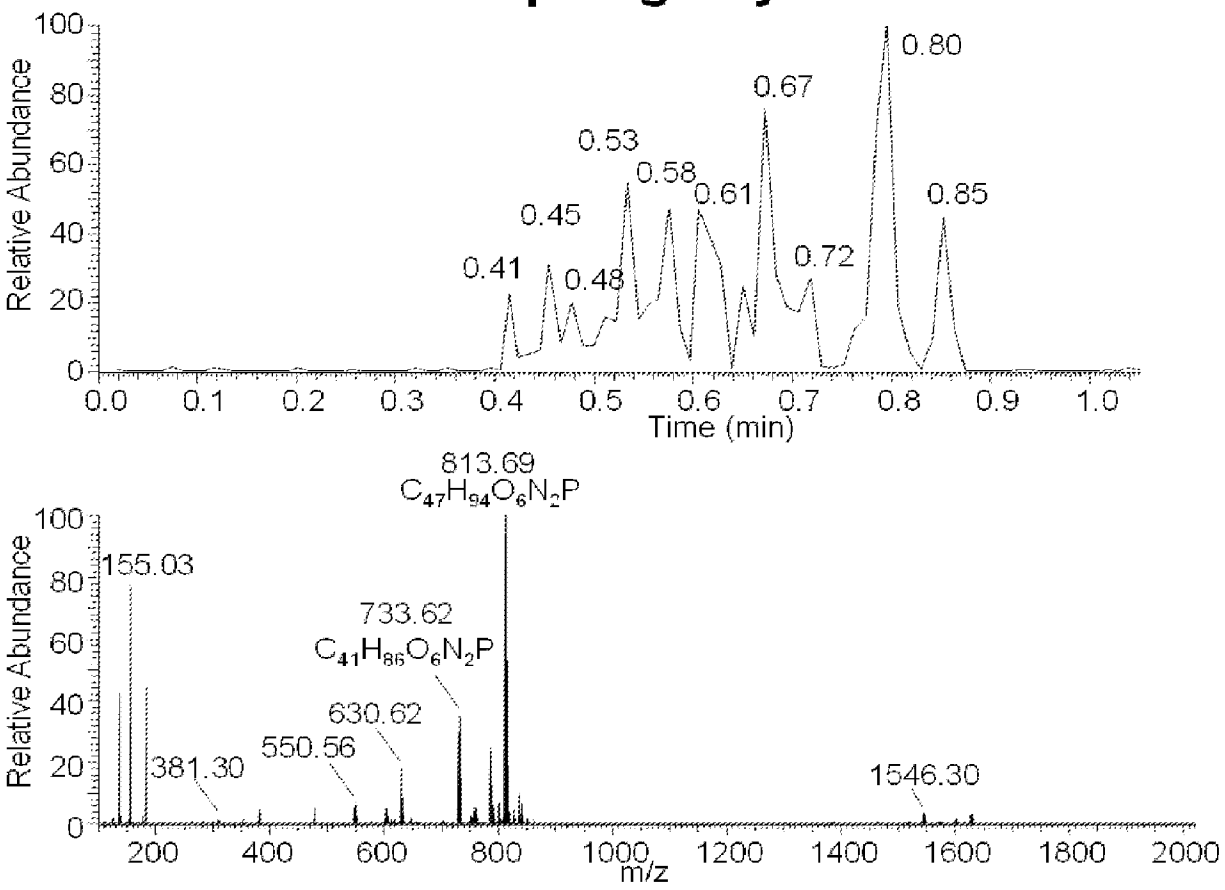
FIG. 53 depicts sphingomyelin in 2,5-DHB matrix.
Figure 54:
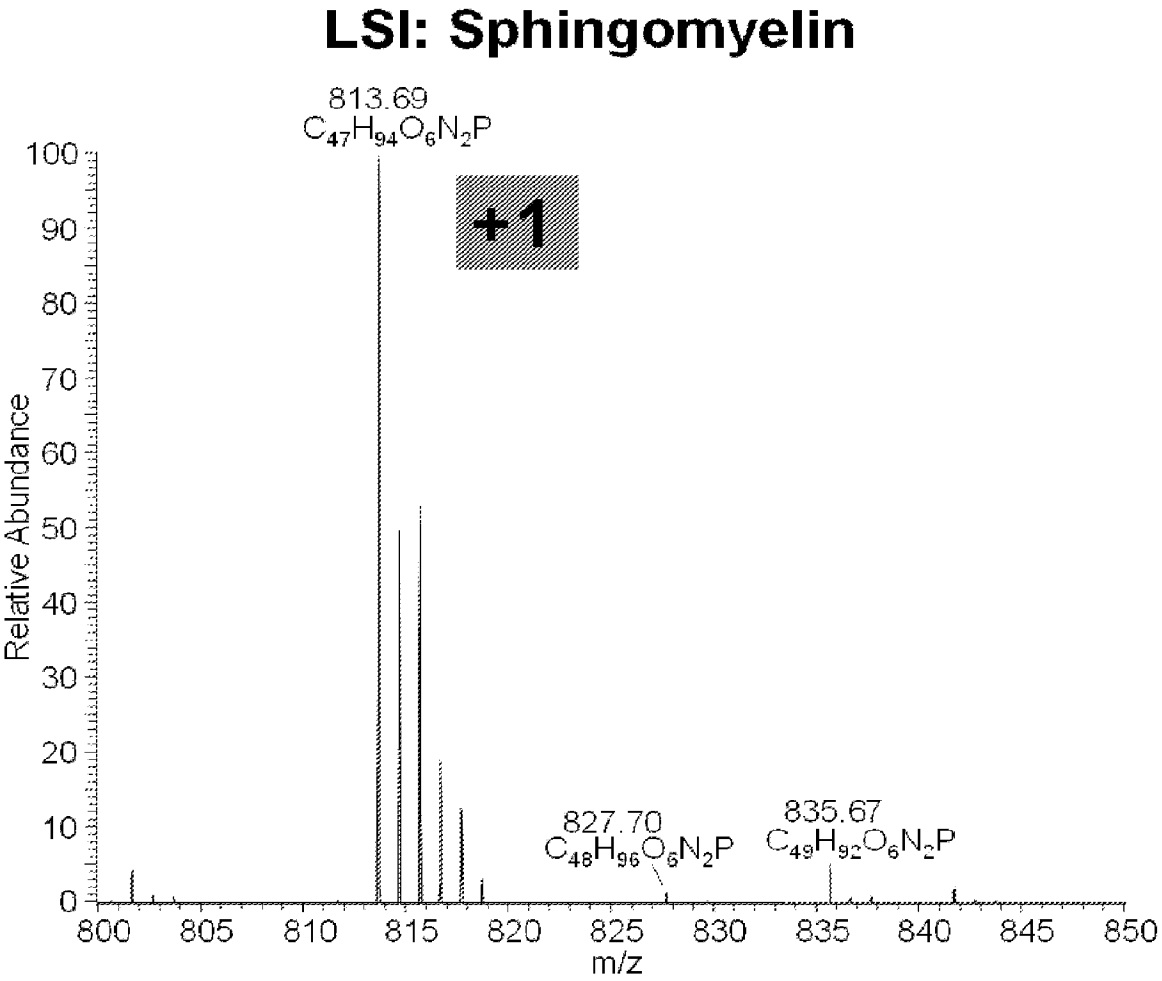
FIG. 54 shows the ions from sphingomyelin all being singly charged.
Figure 55:
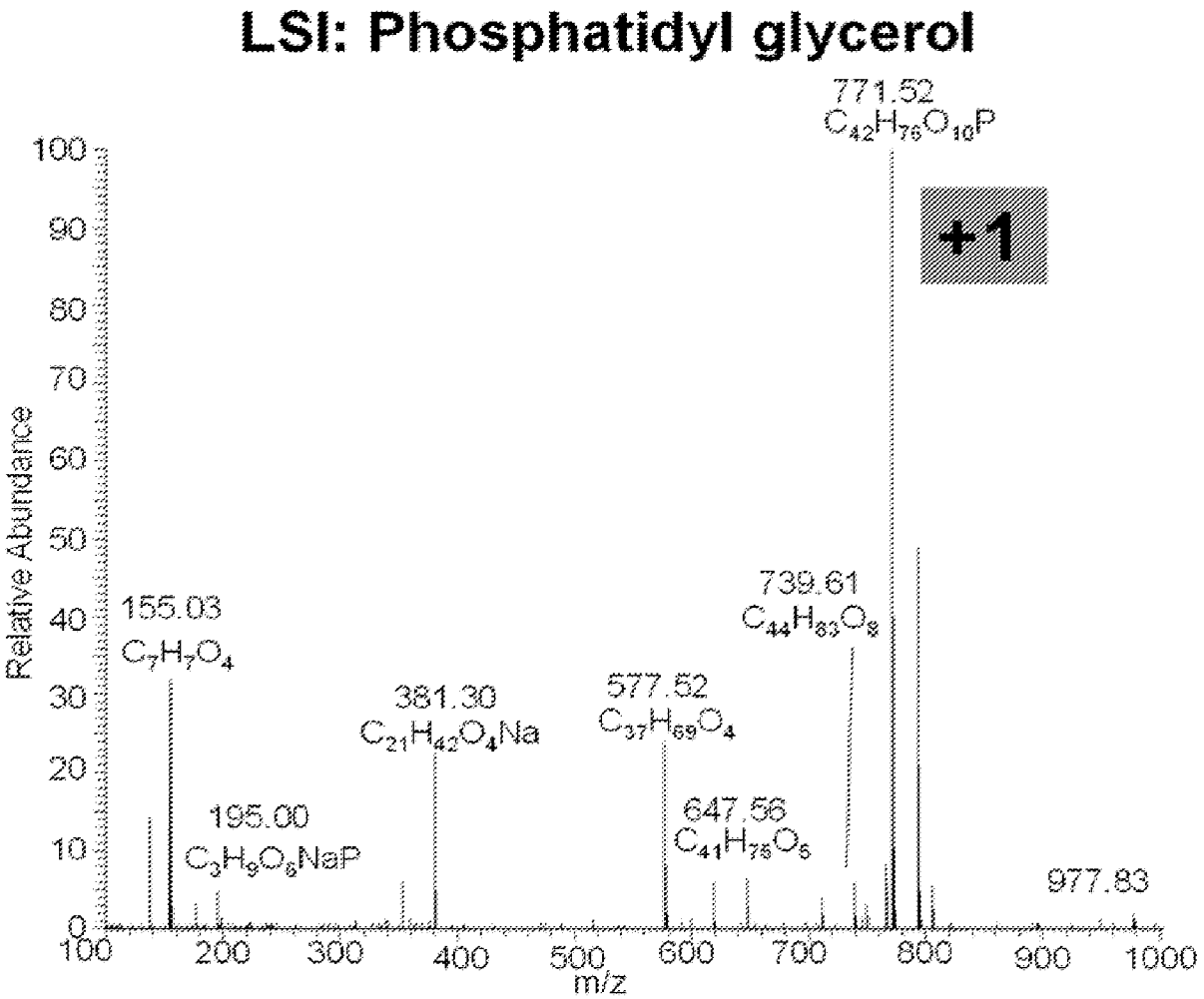
FIG. 55 depicts phosphatidyl glycerol in 2,5-DHB showing singly charged ions.
Figure 58:
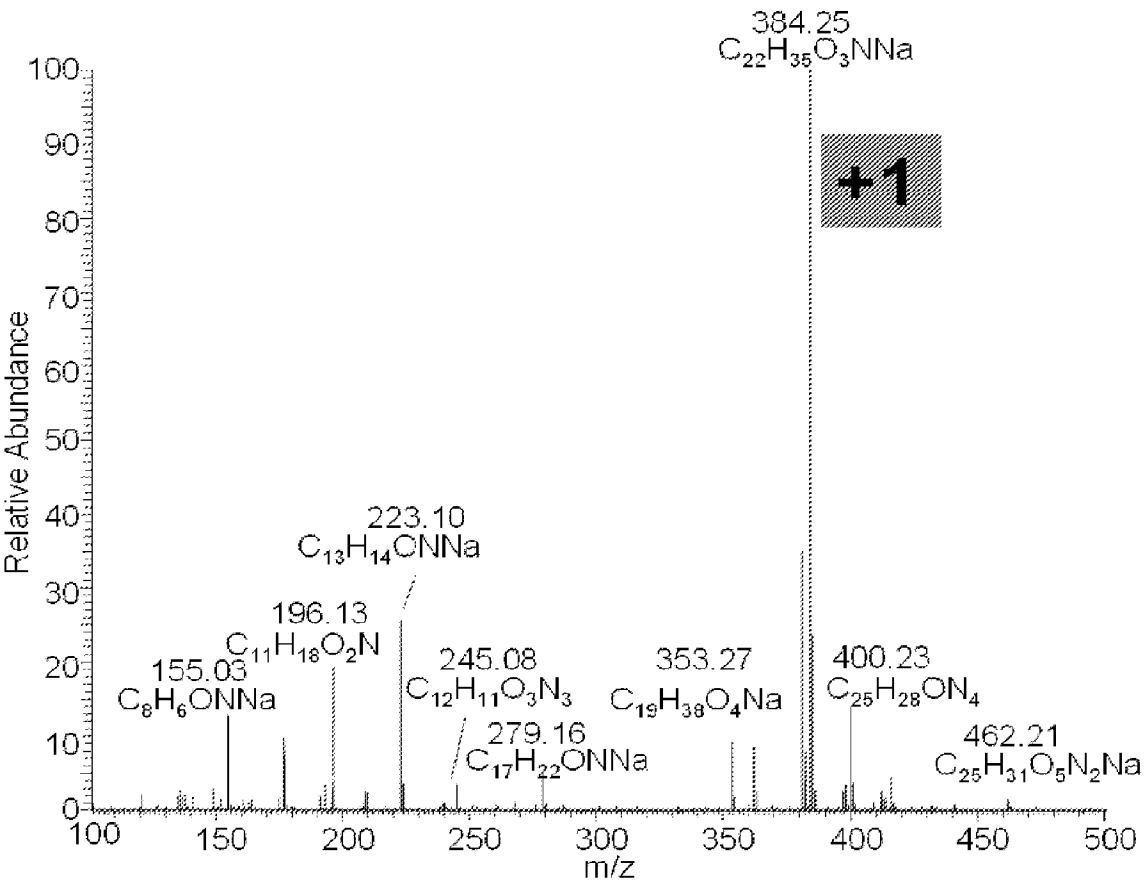
FIG. 58 depicts a spectrum of NAGly in 2,5-DHB showing singly charged ions.
Figure 59:
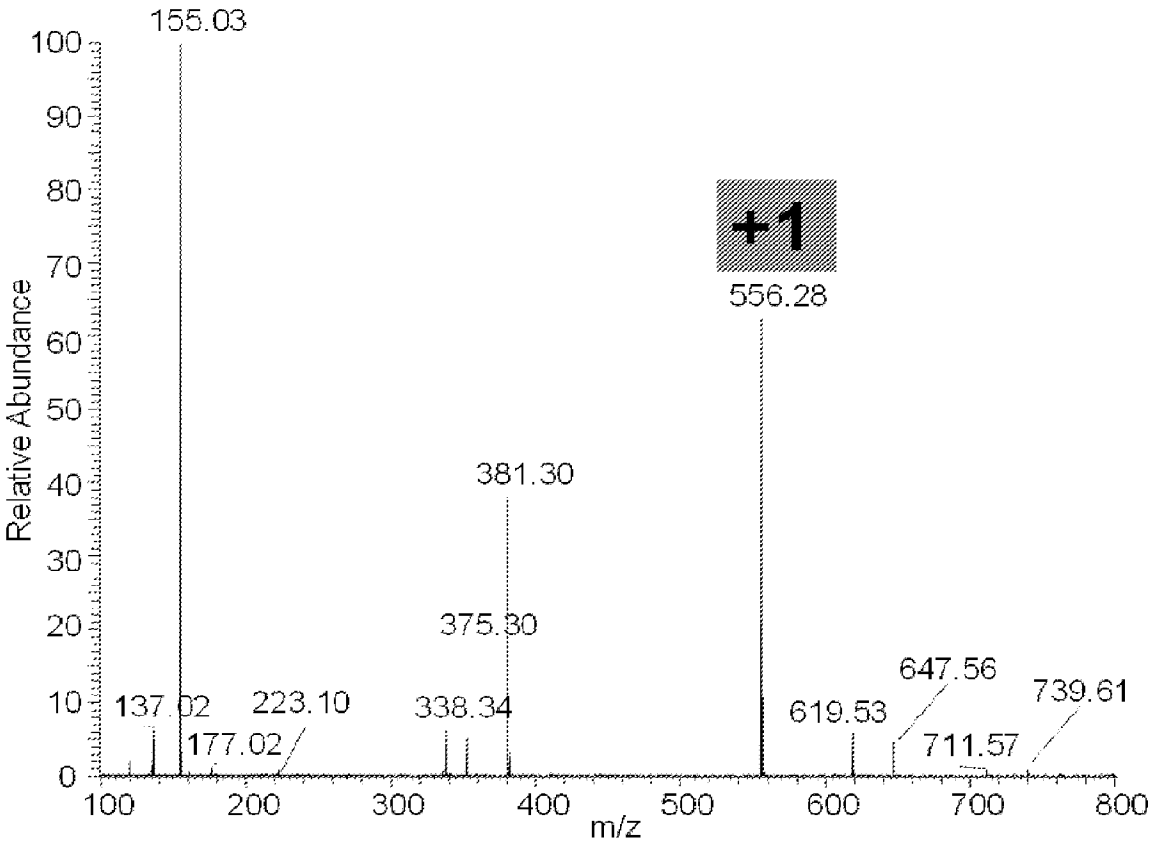
FIG. 59 depicts a spectrum of Leu-Enkaphelin showing singly charged ions by LSI.
Figure 60:
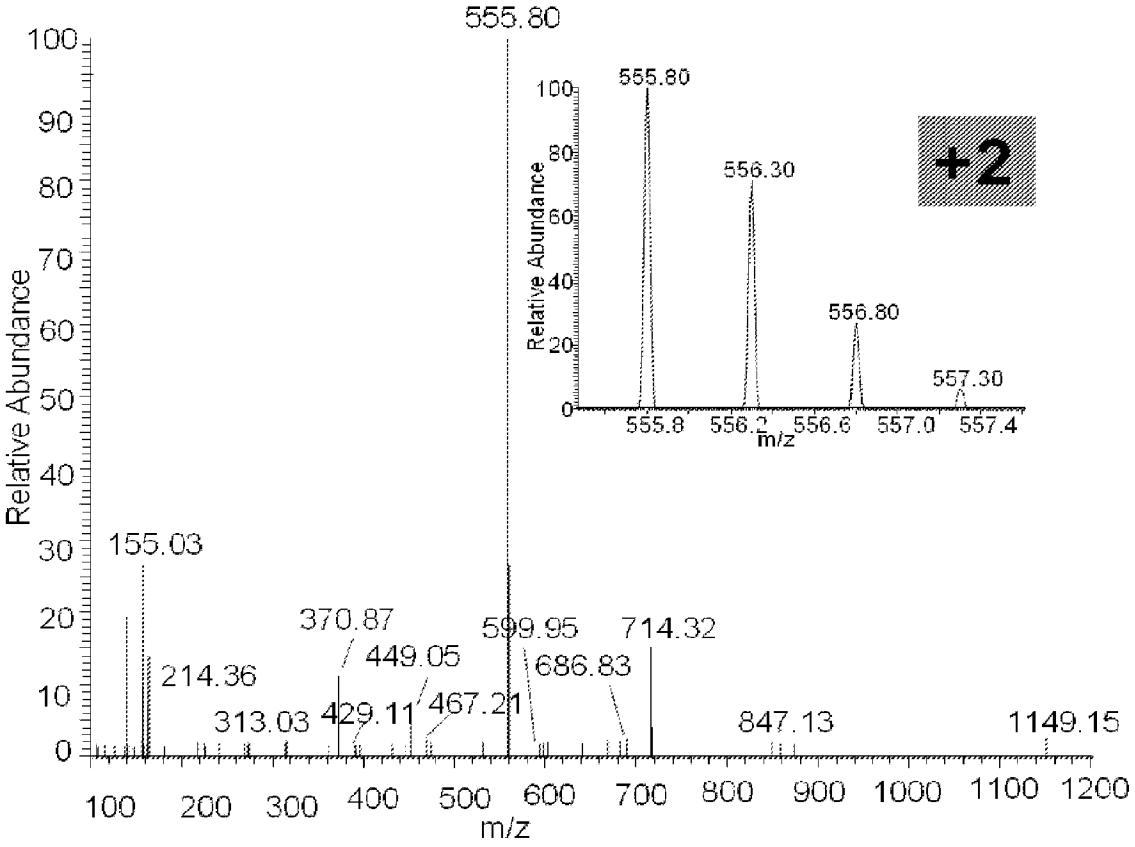
FIG. 60 depicts a spectrum of bradykinin showing doubly charged and no singly charged ions by LSI.
Figure 61:
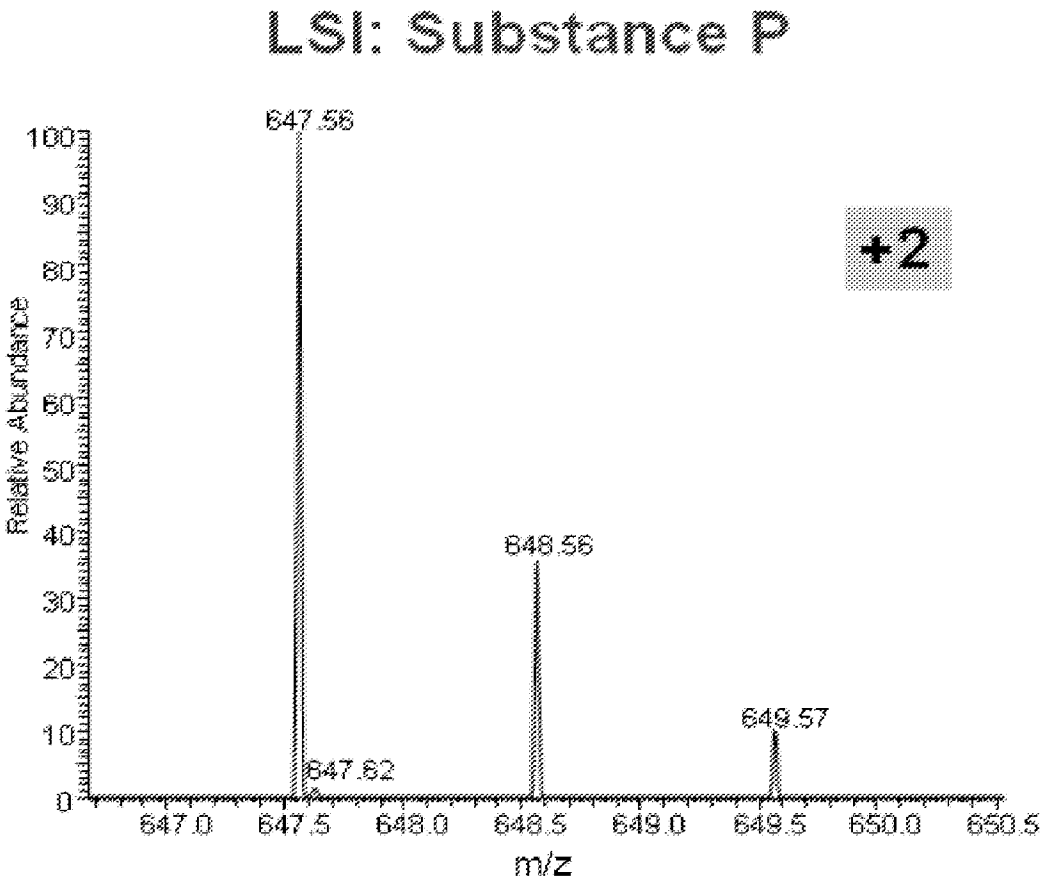
FIG. 61 depicts a spectrum of doubly charged ions of substance P.

FIGS. 53-61 show results obtained using LSI. FIGS. 53 and 54 show results for sphingomyelin obtained using LSI. FIG. 55 shows results for phosphatidyl glycerol, a lipid, in 2,5-DHB again showing singly charged ions in LSI just as in ESI. FIG. 56 shows results for phosphatidyl inositol obtained using LSI. FIG. 57 shows results for anadamide obtained using LSI. FIG. 58 shows results for NAGly obtained using LSI. FIG. 59 shows results for leu-enkaphalin obtained using LSI. FIG. 60 shows results for bradykinin obtained using LSI. FIG. 61 shows results for Substance P obtained using LSI.

Figure 64:
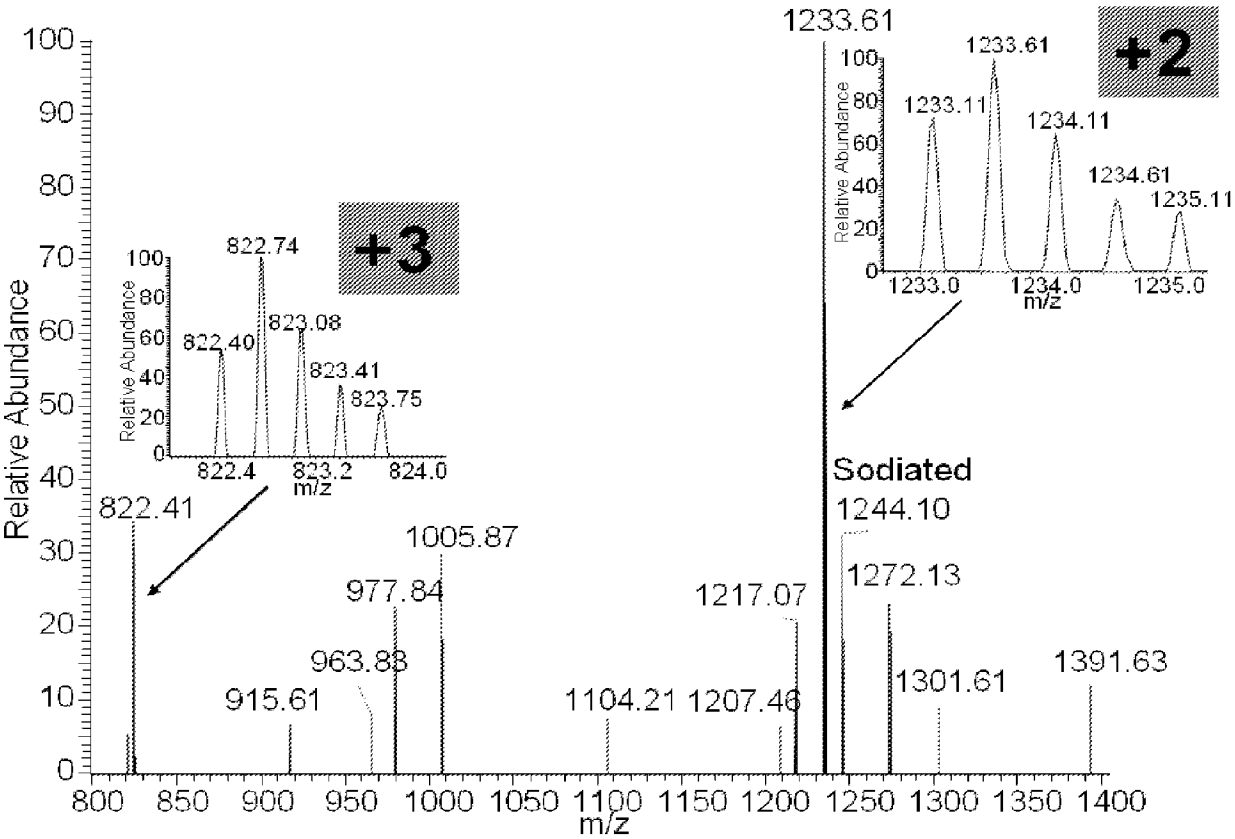
FIG. 64 depicts a spectrum of ACTH showing that LSI produces higher charge states with increasing molecular weight.

FIGS. 64-67 to show additional results obtained using LSI. FIG. 64 shows results for ACTH, with charge states +2 and +3. FIGS. 65-67 show results for amyloid (1-42) with charge states +4, +5 and +6 respectively.

Figure 69:
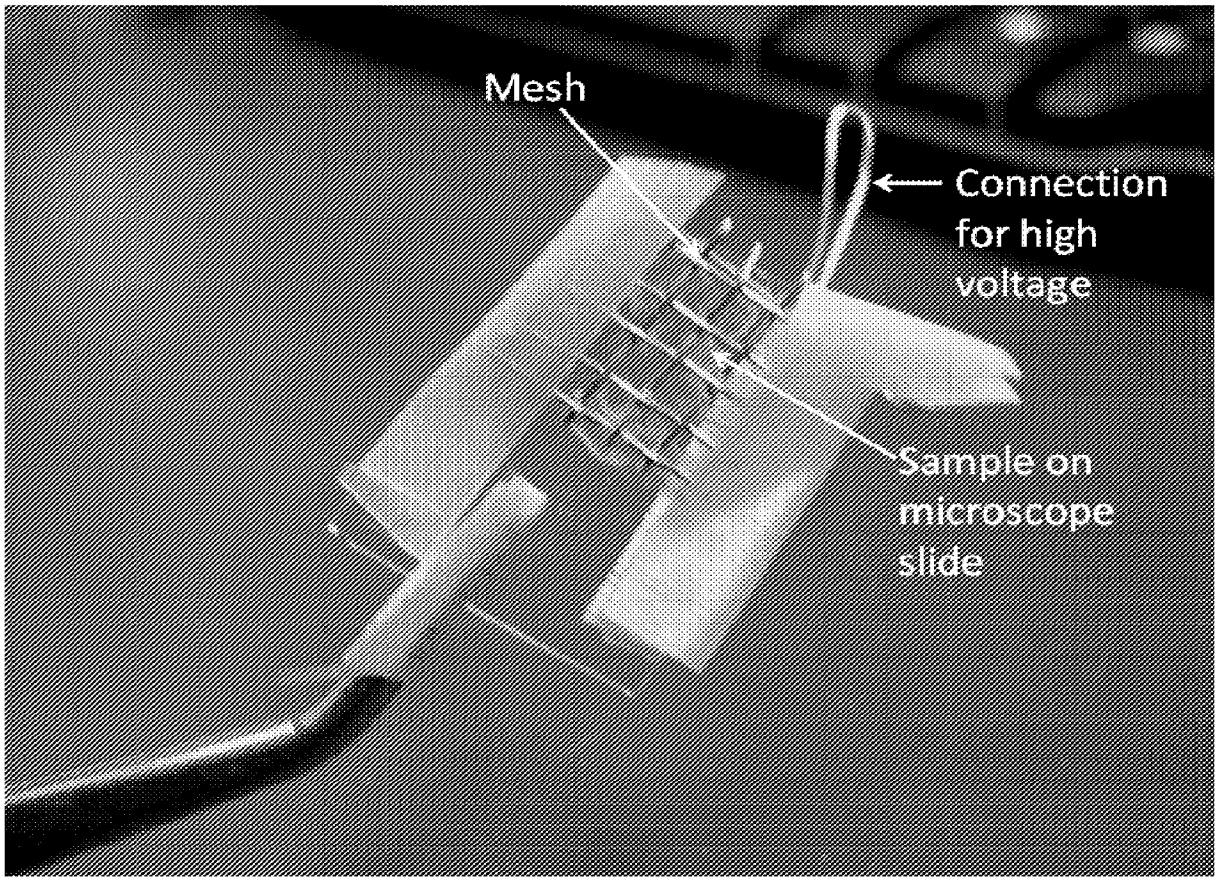
FIG. 69 depicts a wire mesh placed over the matrix/analyte sample preparation on a glass slide.

FIG. 69 provides a photograph of equipment used to perform solvent-free MALDI with voltage. FIG. 70 provides results obtained using AP through-stage MALDI with voltage for Angiotensin 1. The charge states are +1 and +2, compared with FIG. 62 in which charge states +2 and +3 were seen in the absence of voltage.

Figure 71A:
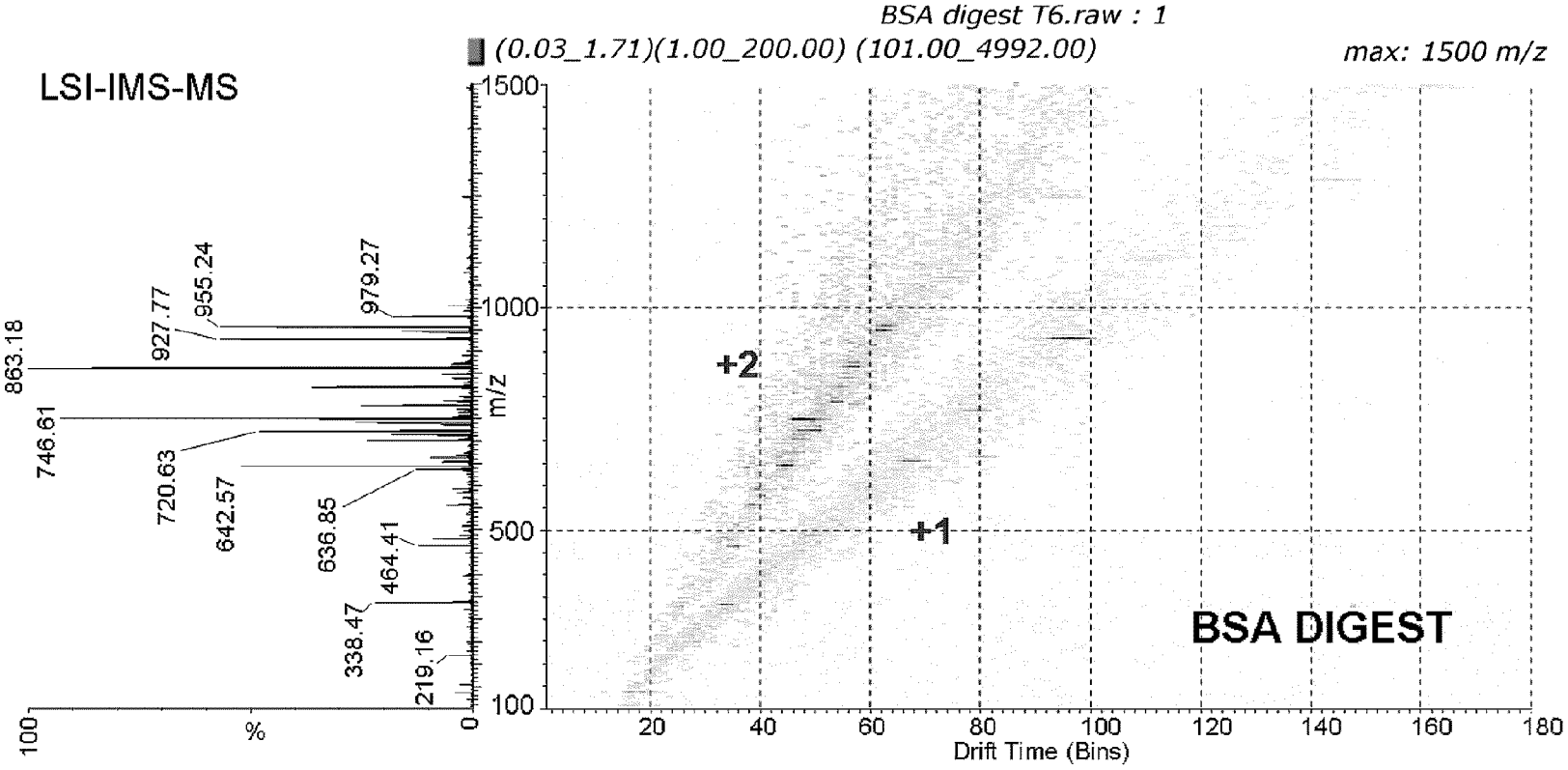
FIG. 71 depicts LSI-ion mobility spectrometry-mass spectrometry (IMS)-MS and MS/MS of a tryptic bovine serum albumin (BSA) protein digest using solvent-based sample preparation conditions and 2,5-DHAP matrix, a cone temperature of 150° C. and the mounted desolvation device (heated only by heat transfer from the cone): 71A IMS-MS, CID fragmentation in the FIG. 71B Trap and FIG. 71C Transfer region of the TriWave section. To the left is displayed the mass spectrum and to the right the 2D plot of drift time separation vs. mass-to-charge ratio (m/z).
Figure 71B:
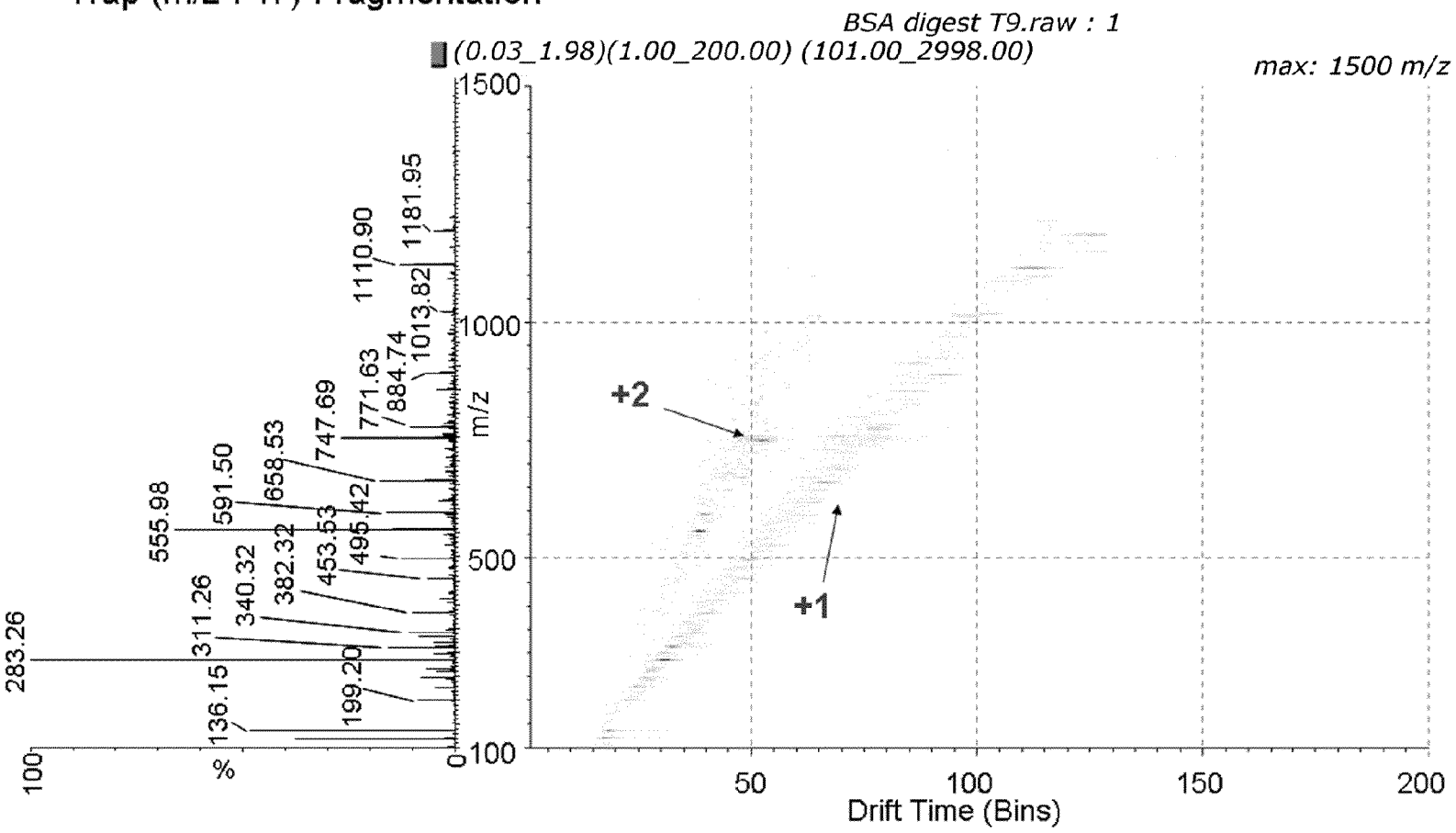
Figure 71C:
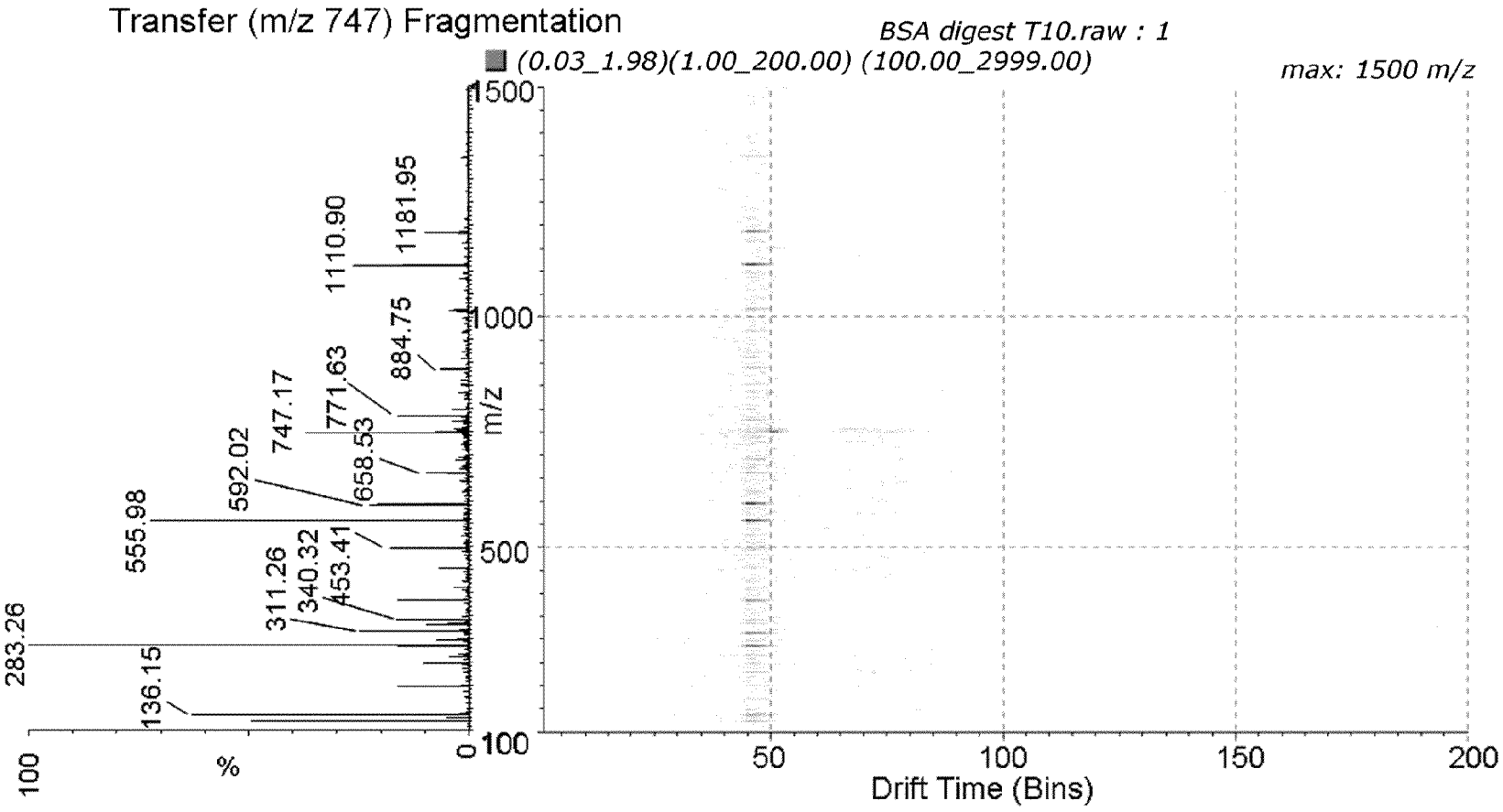
Figure 72:
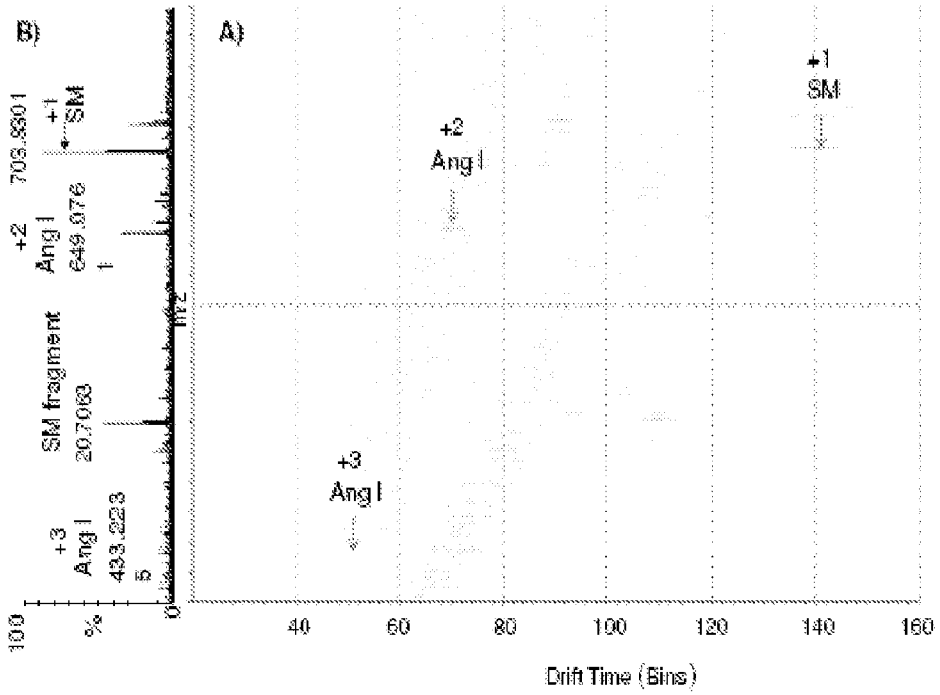
FIG. 72 depicts an example of the benefits of total solvent-free analysis.
Figure 72:
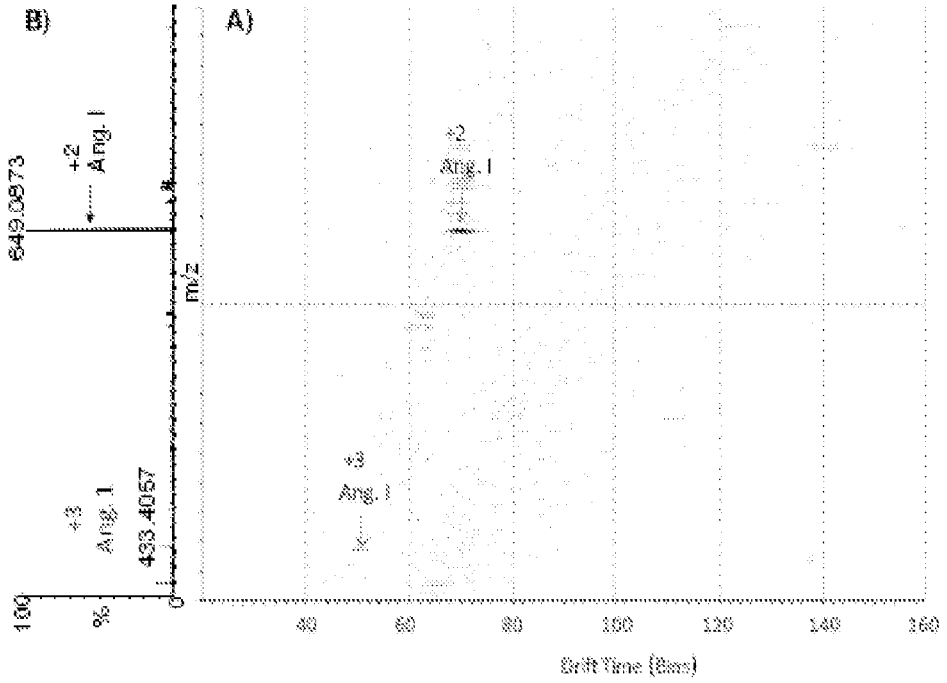

FIGS. 71-80 provide further evidence of the benefits of the methods disclosed herein. As shown in FIGS. 71A-B, the fragment ions provide the necessary sequence information of the tryptic peptides of BSA. Specifically, FIG. 71 depicts LSI-IMS-MS and MS/MS of a tryptic bovine serum albumin (BSA) protein digest using solvent-based sample preparation conditions and 2,5-DHAP matrix, a cone temperature of 150° C. and the mounted desolvation device (not heated): A) IMS-MS, B) CID fragmentation in the FIG. 71B Trap and FIG. 71C Transfer region of the TriWave section. To the left is displayed the mass spectrum and to the right the 2D plot of drift time separation vs. mass-to-charge ratio (m/z).

Figures 73A, 73B:
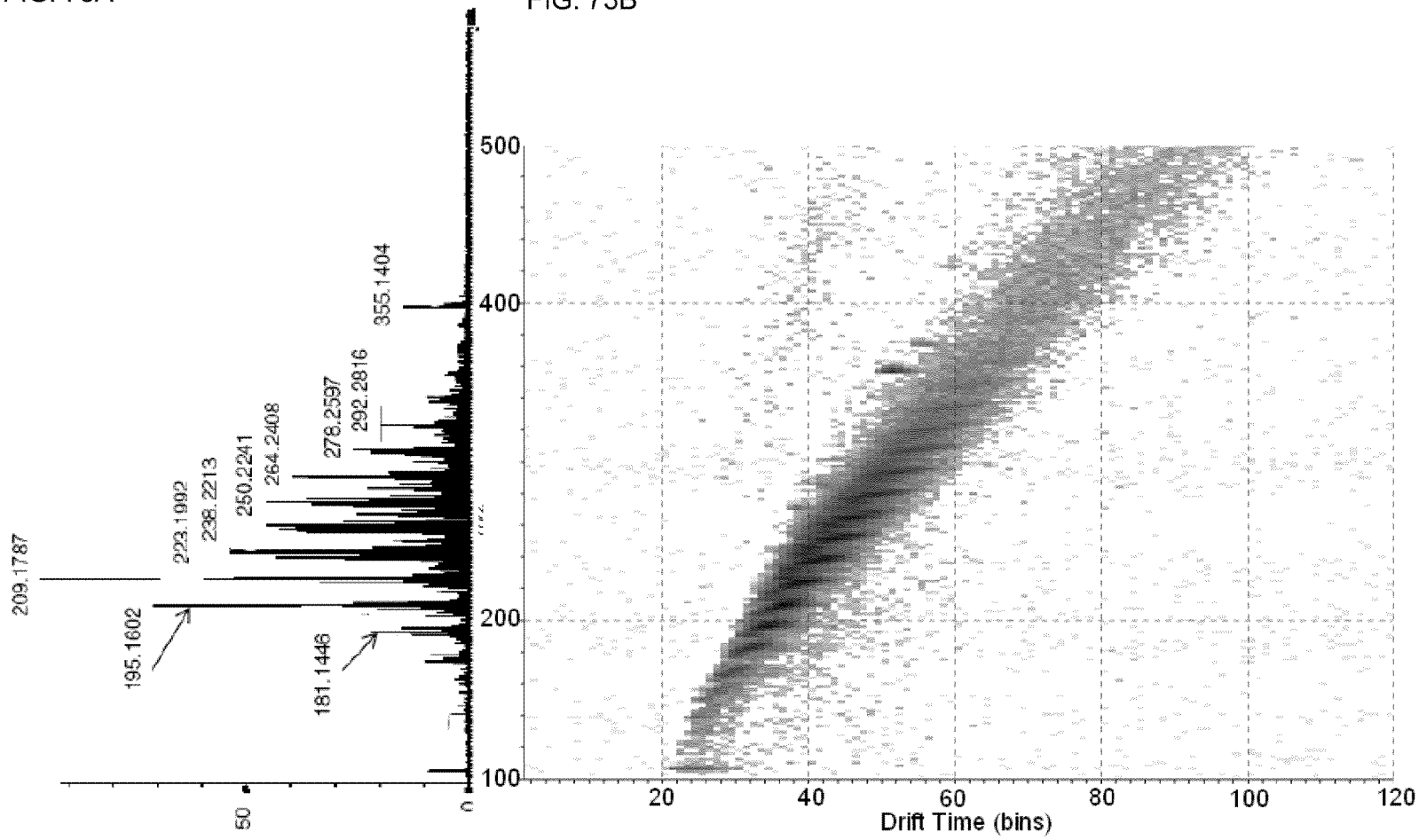
FIGS. 73A-B depicts TSA by solvent-free sample preparation followed by LSI-IMS-MS acquisition of a crude oil sample.

FIGS. 72A-B depict an example of the benefits of total solvent-free analysis. A model mixture was prepared of a peptide and a lipid (50/50 molar ratio) and analyzed by: I) total solvent-free analysis using LSI, II) IMS-MS using the solvent-free sample preparation; only II detects both components. Section (A) depicts 2D IMS-MS plots, and section (B) depicts mass spectra. FIGS. 73A-B depict TSA by solvent-free sample preparation followed by LSI-IMS-MS acquisition of a crude oil sample. FIG. 73(A) depicts mass spectrum and FIG. 73(B) depicts two dimensional plot of drift time (td) vs. m/z of neat crude oil in 2,5-DHB under solvent-free conditions with heat (over 200° C.).

Figure 74A:
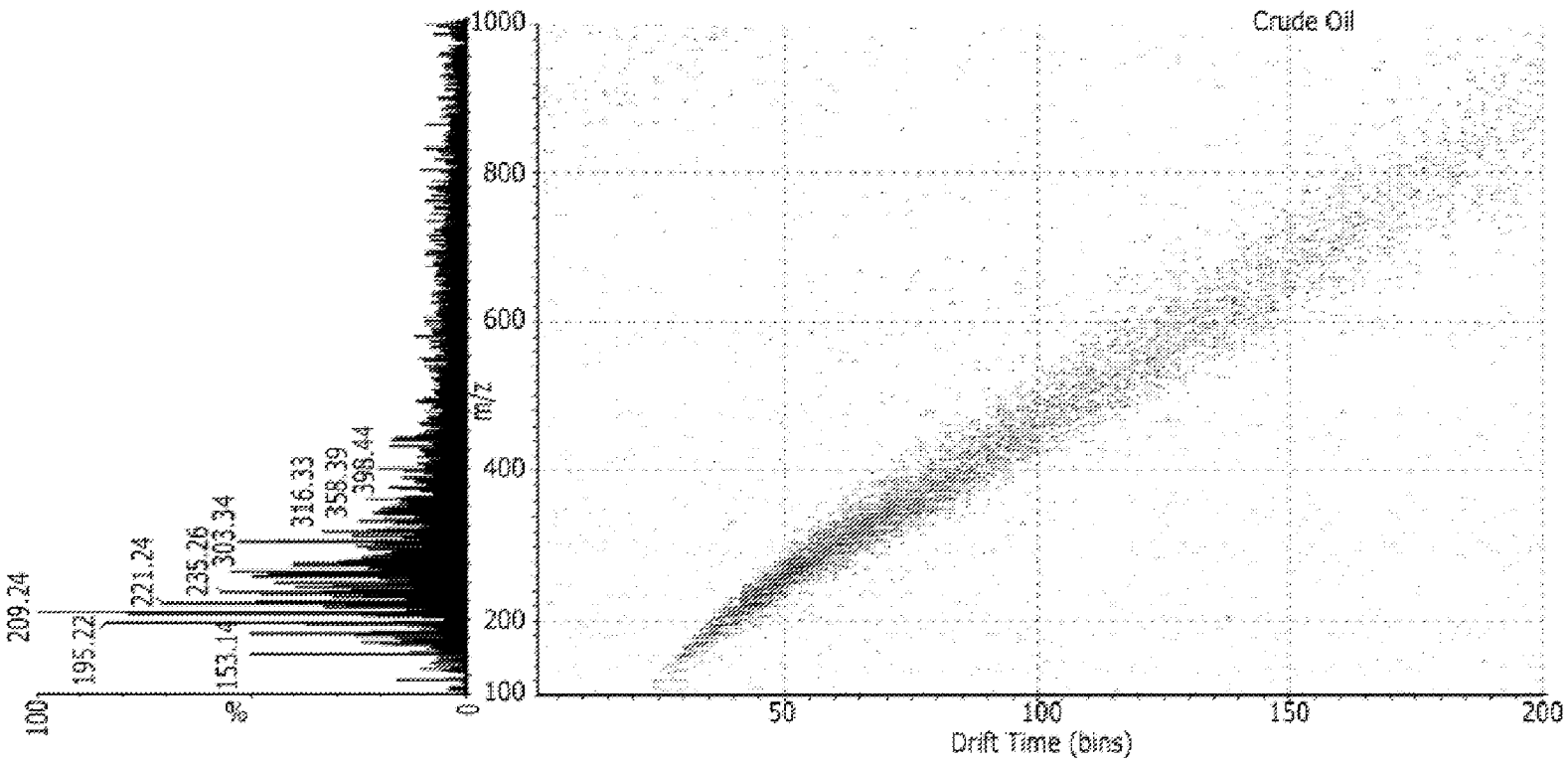
FIGS. 74A-C depicts TSA mass spectra.
Figure 74B:
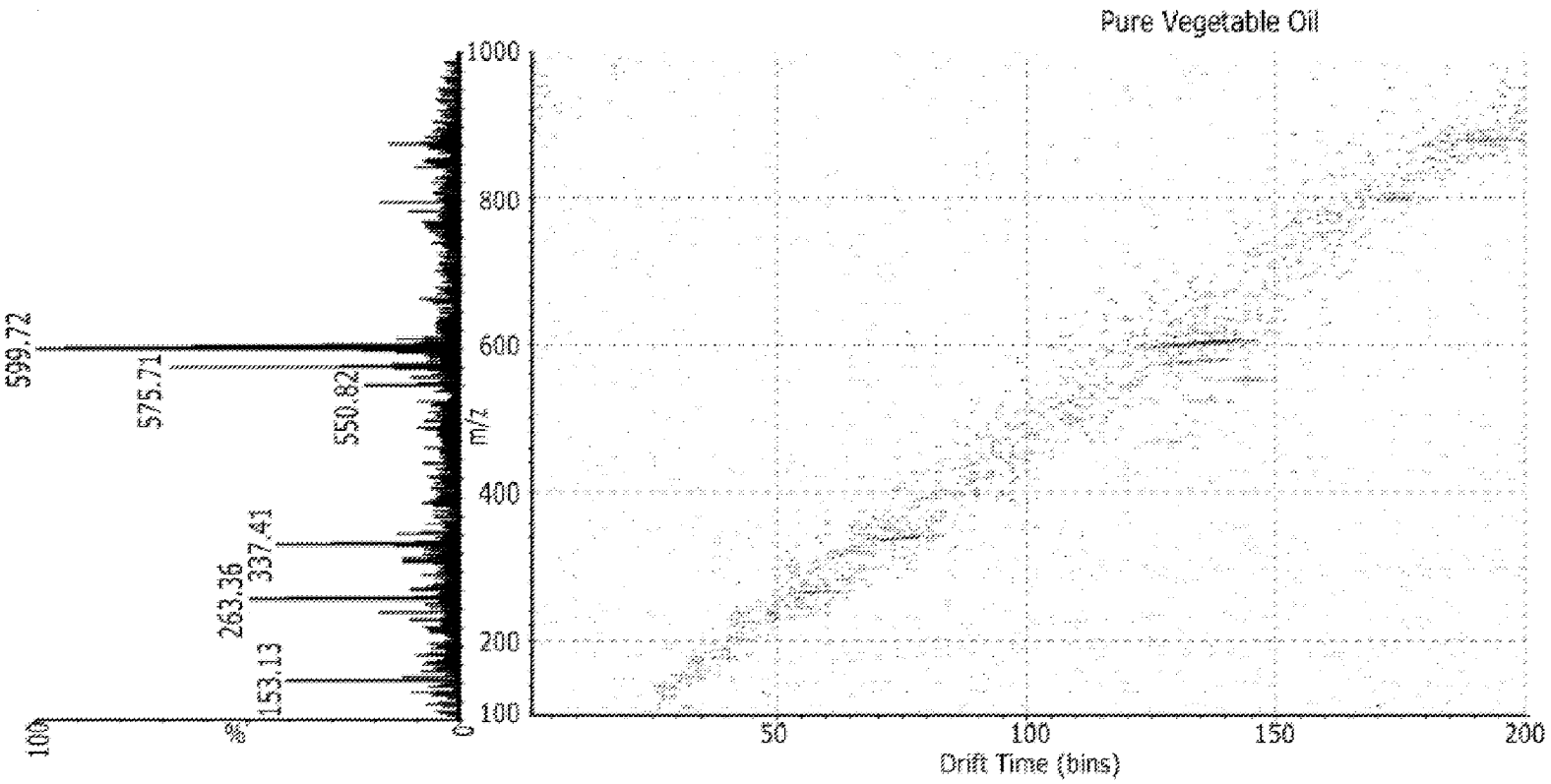
Figure 74C:
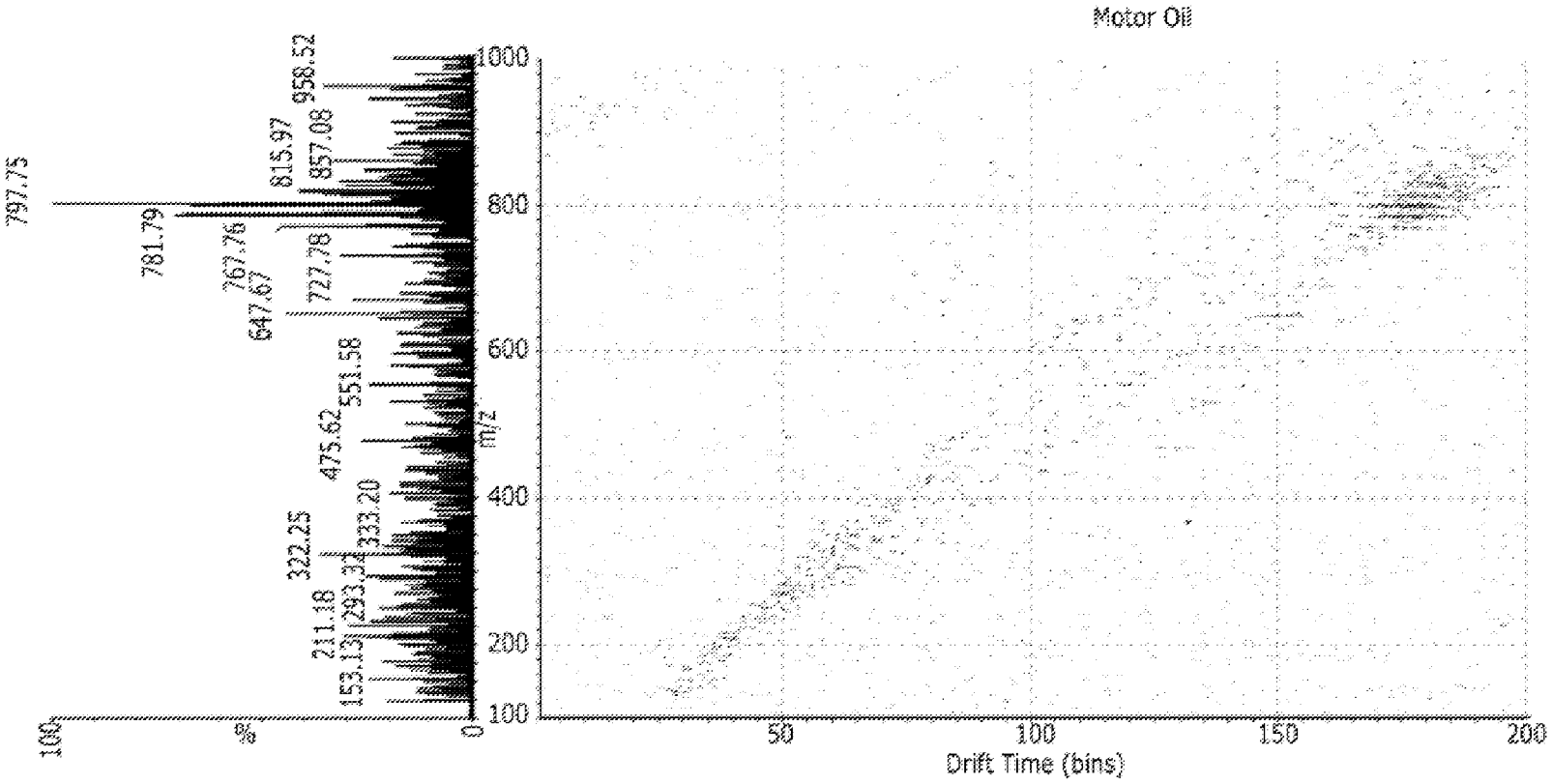

FIGS. 74A-C depicts TSA mass spectra and two dimensional plots of drift time (td) vs. m/z of: FIG. 74A shows crude oil in 2,5-DHAP prepared under solvent-free conditions with a grind pattern of 30 Hz for 5 minutes, additional matrix added and a repeat of grinding at 30 Hz for 5 minutes; FIG. 74B shows pure vegetable oil, prepared identical to FIG. 74A; and FIG. 74C shows motor oil in 2,5-DHAP with a grind pattern of 30 Hz for 5 minutes. For FIGS. 74A-C, 2 μL of analyte was used and prepared under solvent-free conditions. Heat was applied to all three samples and the produced ions are separated according to shape in the ion mobility dimension. This information shows that there are no laser induced aggregates present as are common with traditional MALDI analysis. These LSI results also indicate that the chemical background related to the matrix is not significant. While the pure vegetable oil and the motor oil have more low mass species present, the complexity related to the crude oil sample can be viewed in the 2D plot. Further, the 2D plots indicate to be useful for comparative analysis using a snapshot approach of the pictorial 2D display of drift time vs. m/z.

Figure 75:
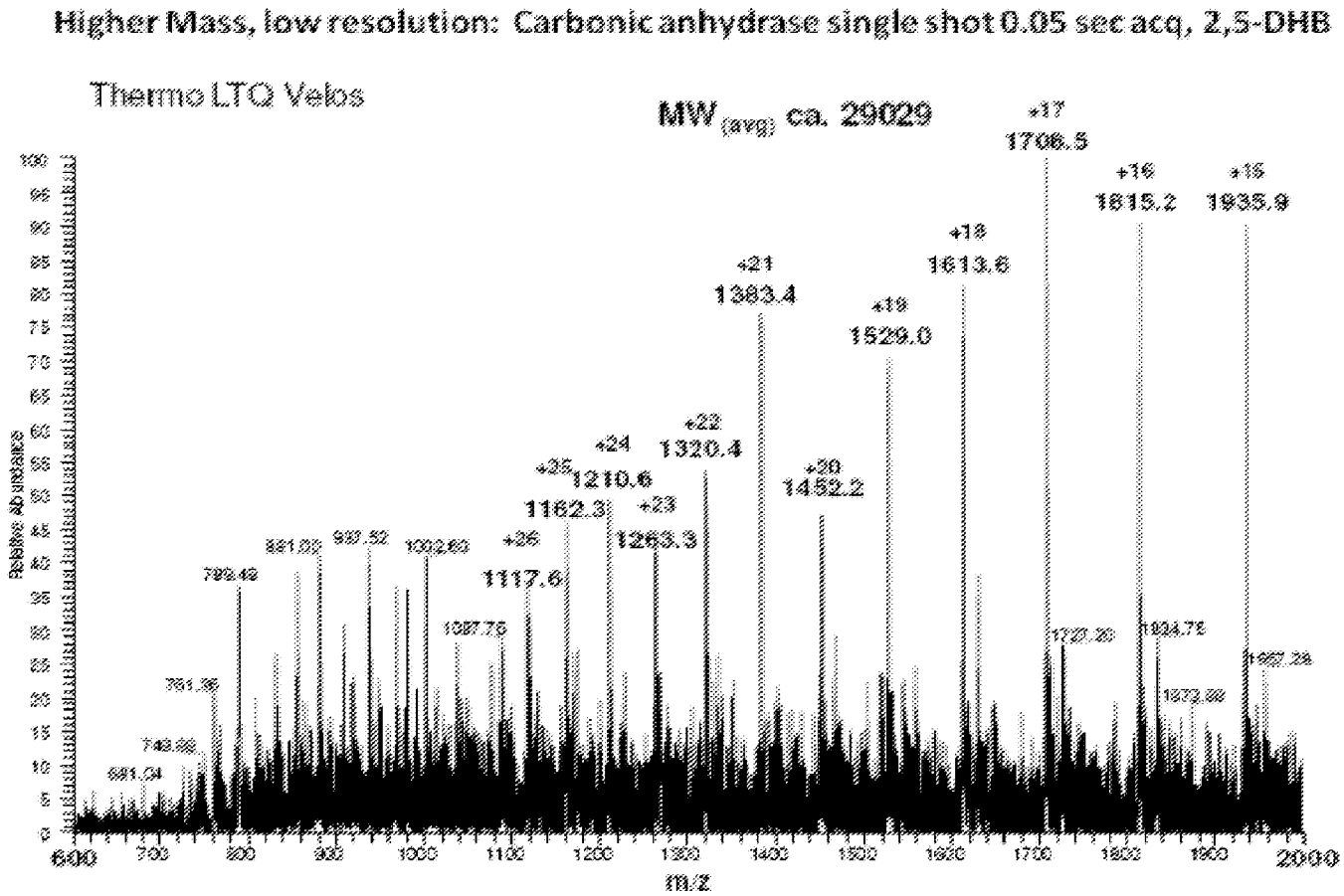
FIG. 75 depicts LSI on a LTQ Velos instrument of Carbonic anydrase (MWavg 29029) protein using the 2,5-DHB and with a heated transfer capillary of 400° C.
Figure 76:
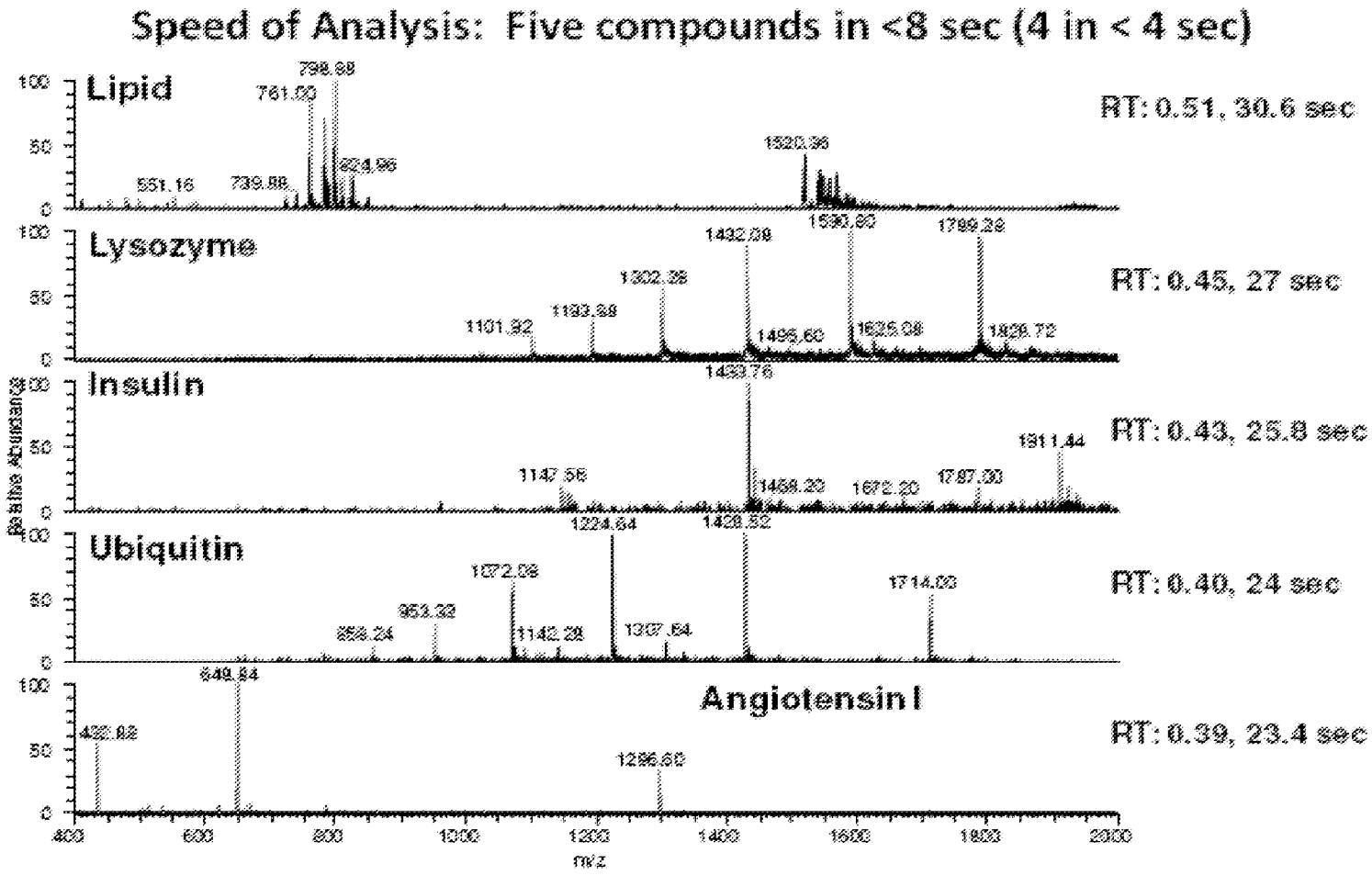
FIG. 76 depicts LSI on a LTQ-ETD Velos instrument.

FIG. 75 depicts LSI on a LTQ Velos instrument of Carbonic anydrase (MWavg 29029) protein using the 2,5-DHB and with a heated transfer capillary of 400° C. FIG. 76 depicts LSI on a LTQ-ETD Velos instrument. Rapid acquisition on multiple samples is carried out with no down time (vacuum interlock) or cross contamination.

Figure 77:
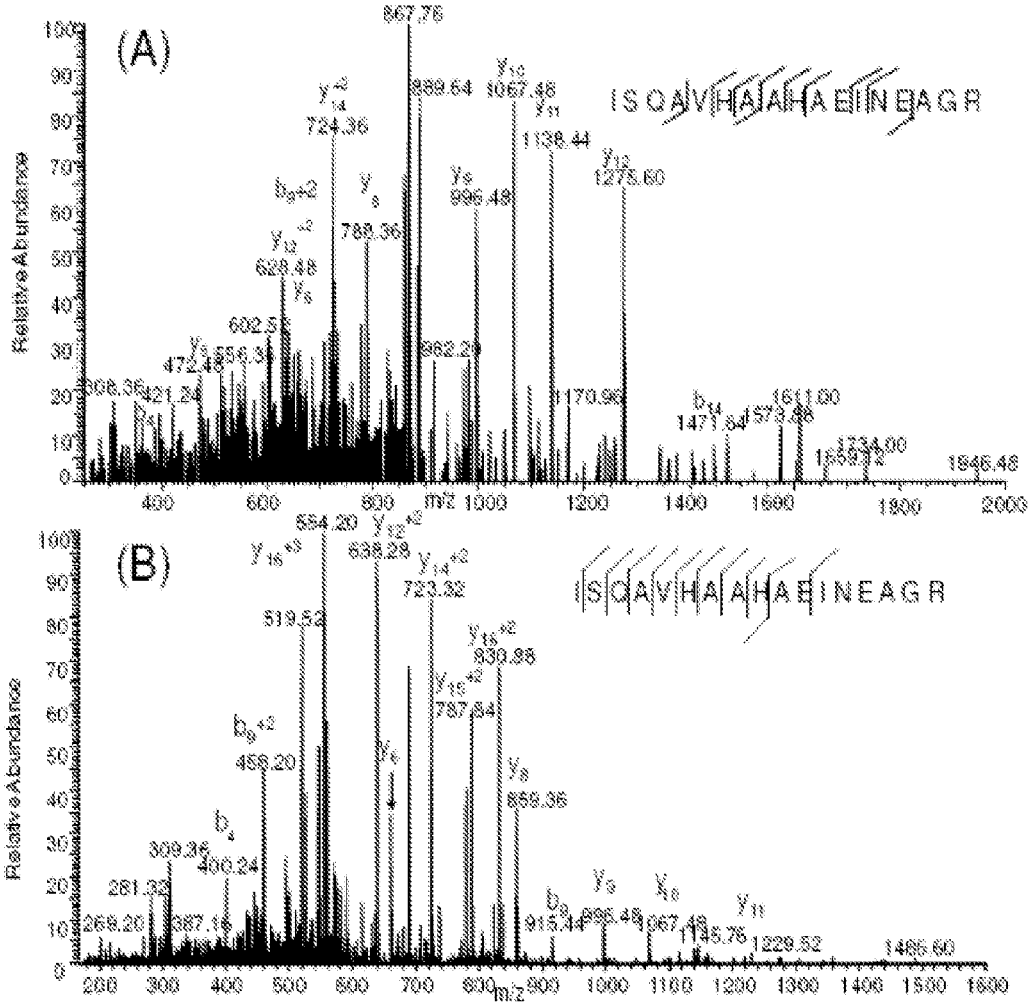
FIG. 77 depicts LSI-CID mass spectra of different charge states of OVA peptide 323-339.

FIGS. 77A-B depicts LSI-CID mass spectra of different charge states of OVA peptide 323-339. FIG. 77 (A) m/z=887; FIG. 77 (B) m/z=444 using DHB matrix.

Figure 78A:
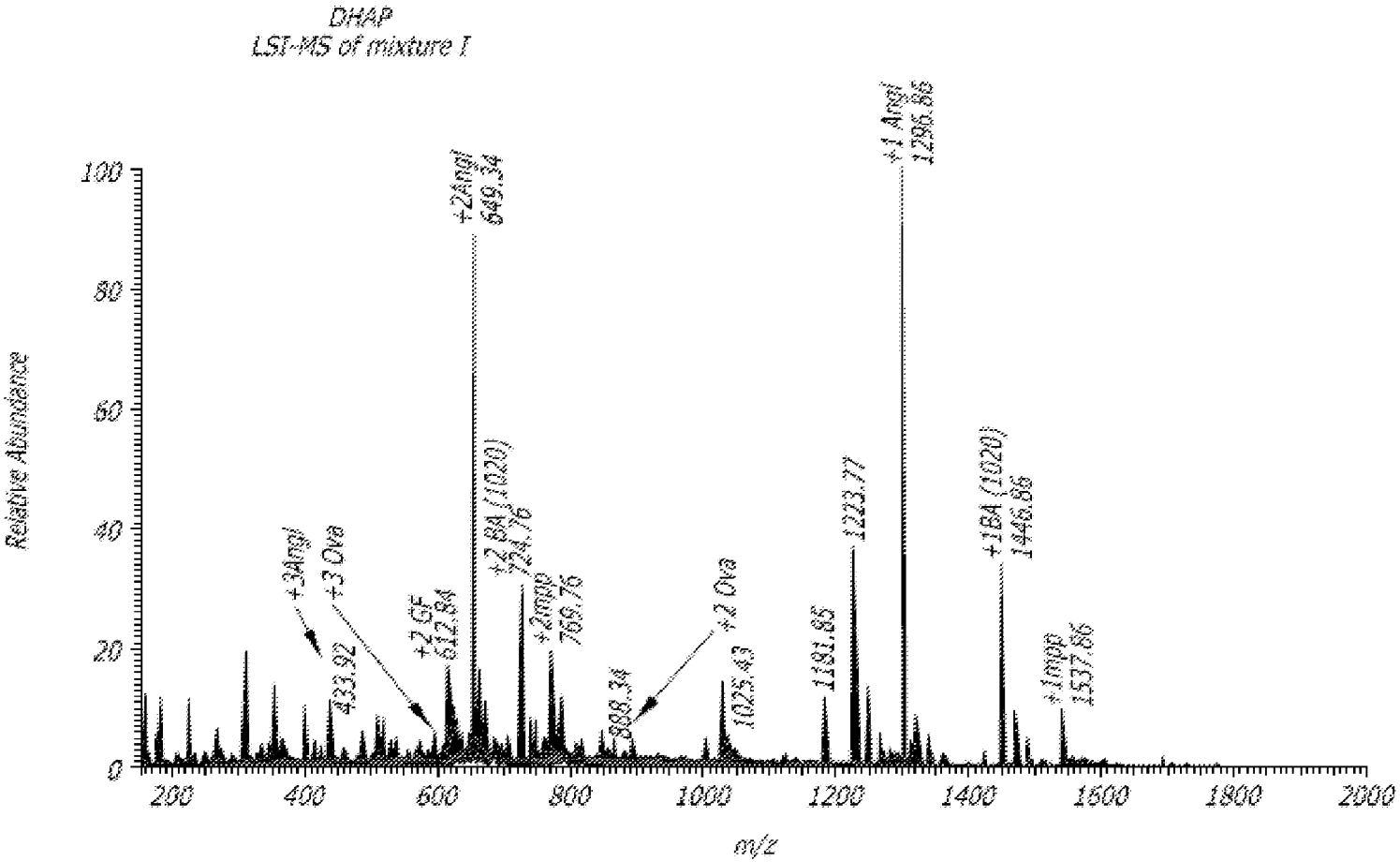
Figure 78B:
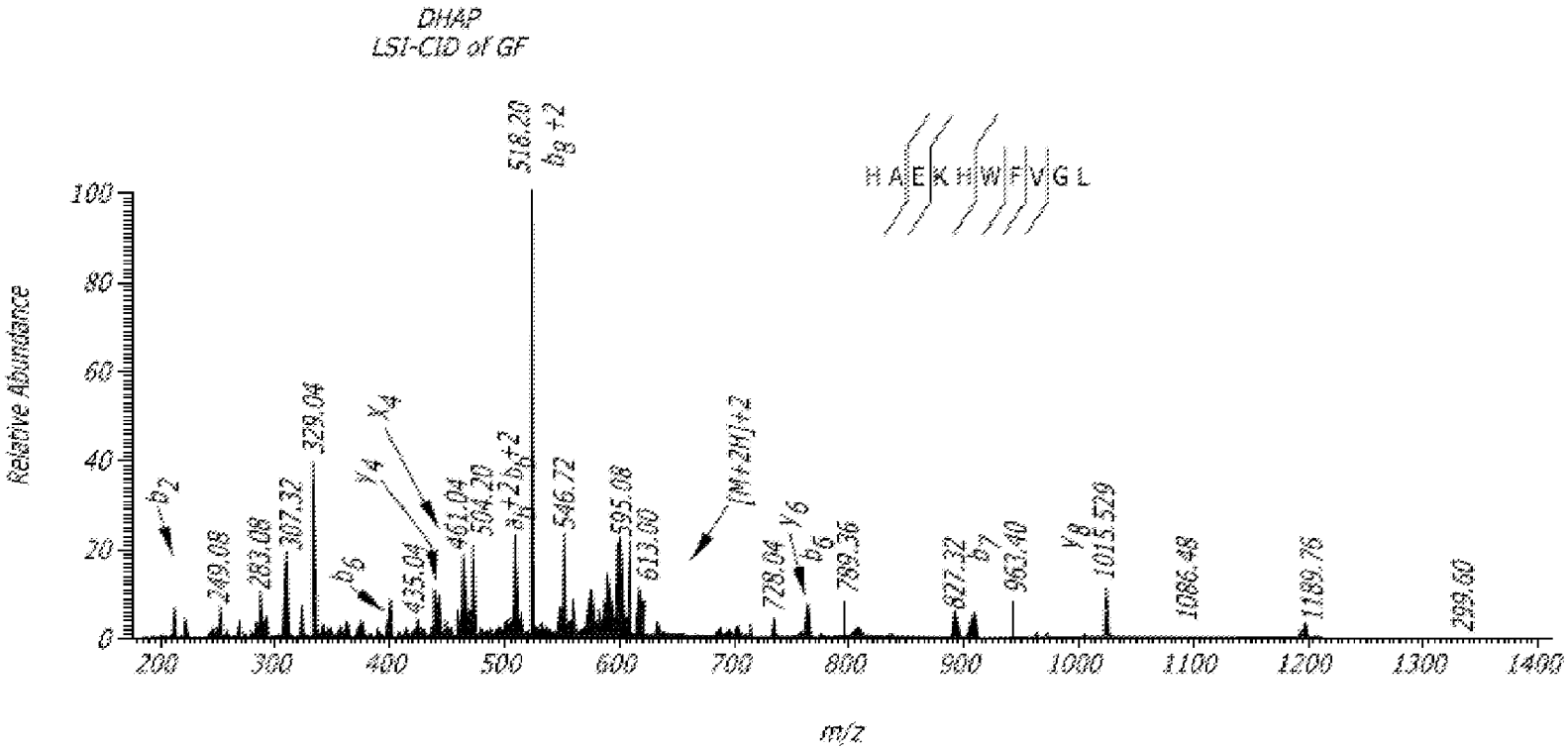
Figure 78C:
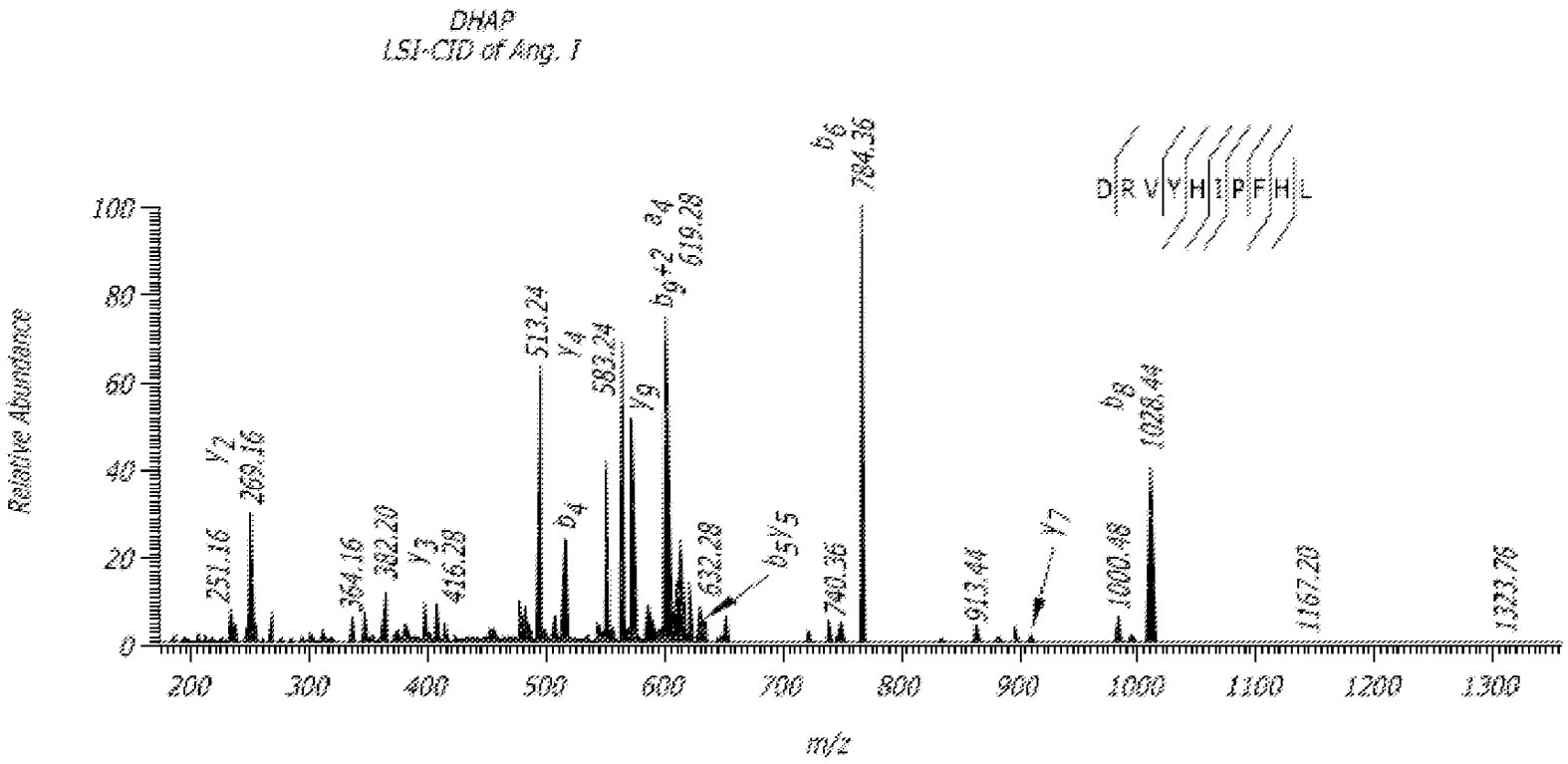
Figure 78D:
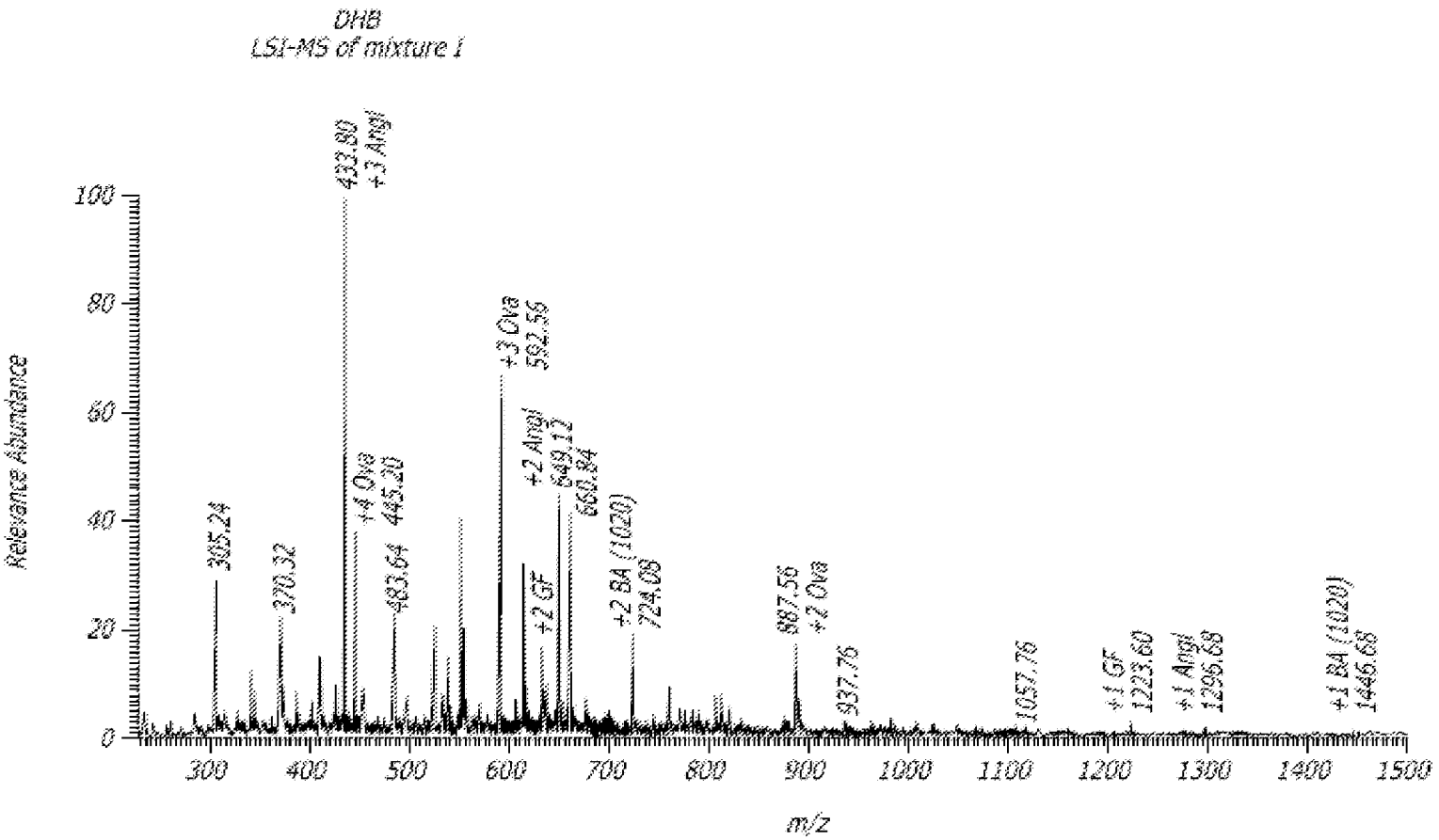
Figure 78E:
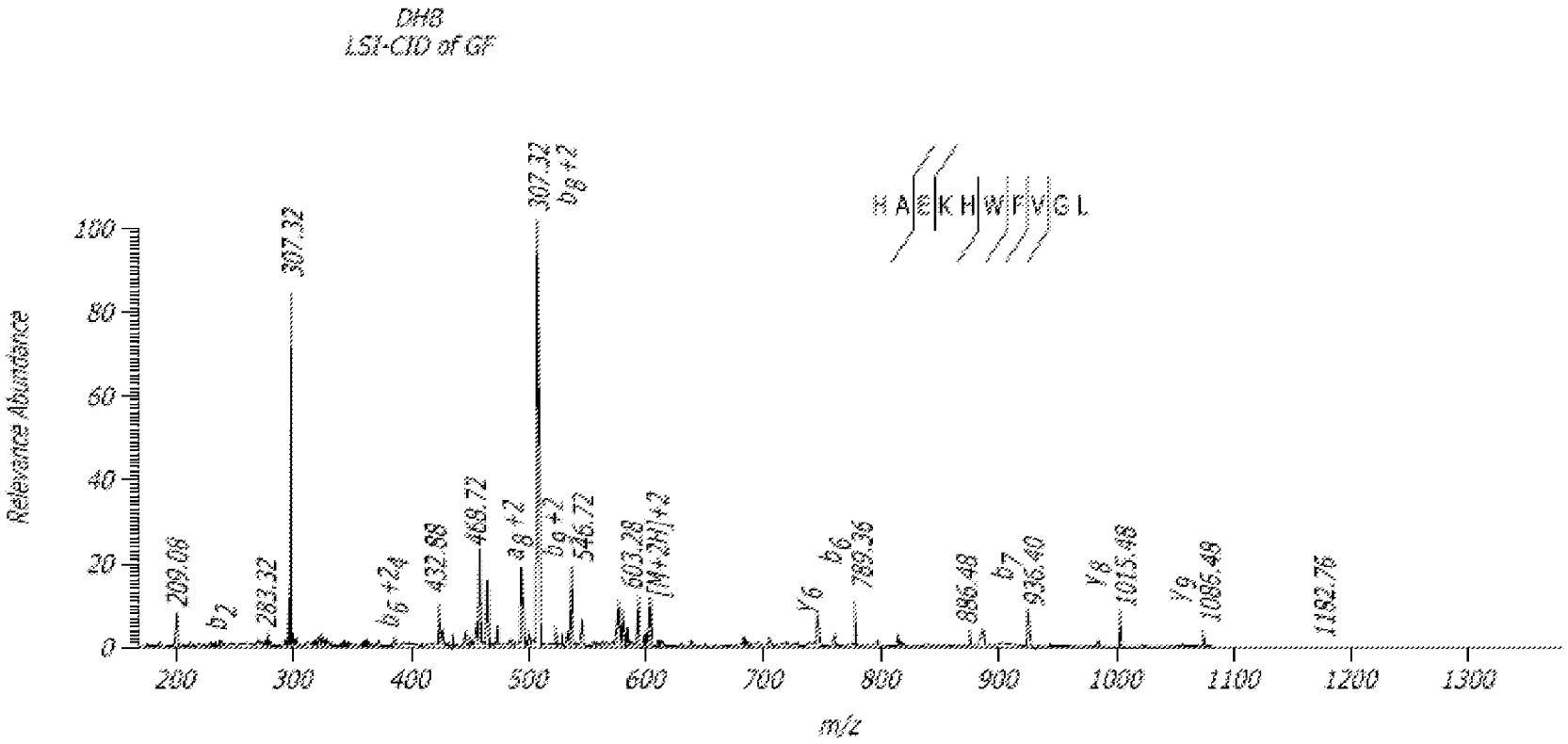
Figure 78F:
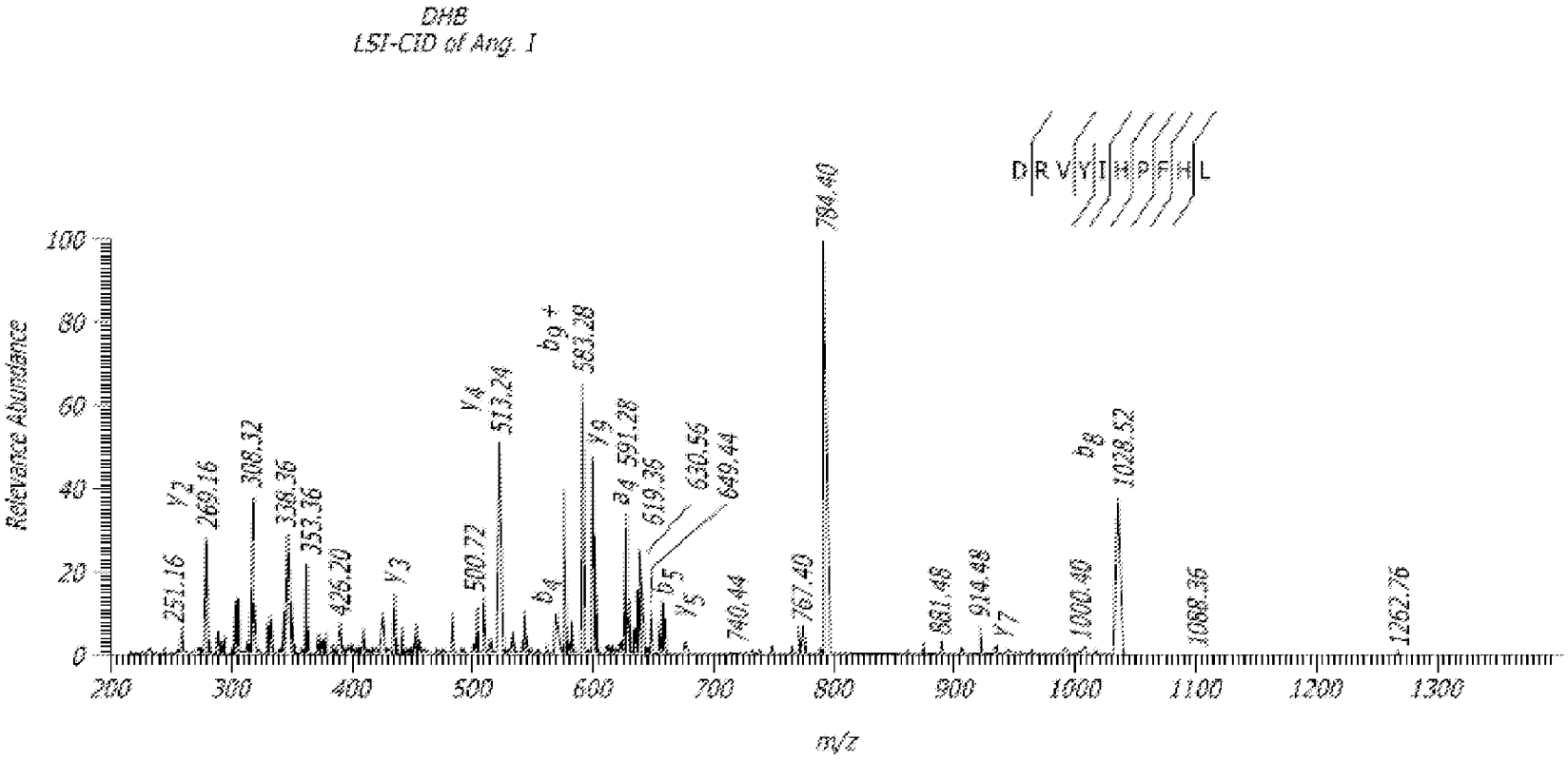
Figure 79:
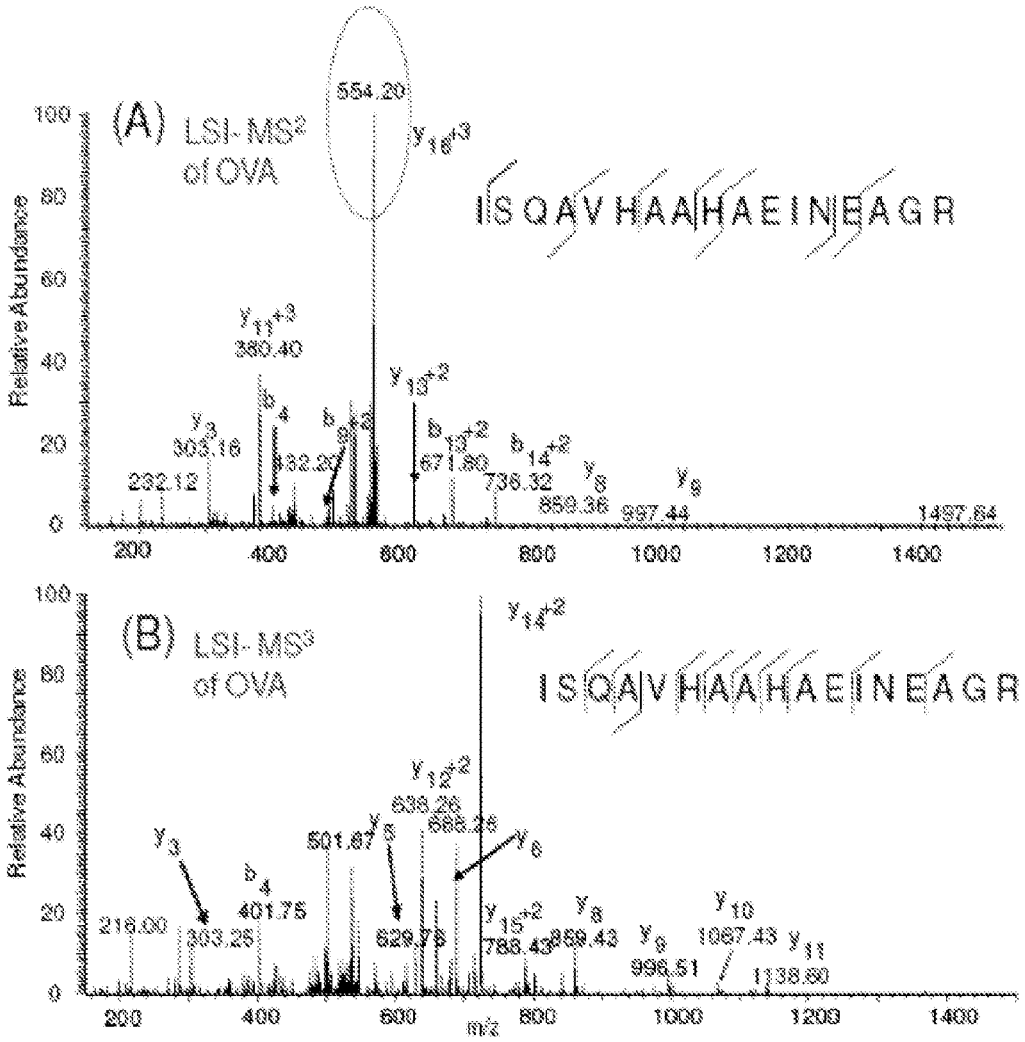
FIGS. 79A-B depict the LSI-MS$^n$ spectra using CID of OVA peptide 323-339 (m/z 444.554).
Figure 80:
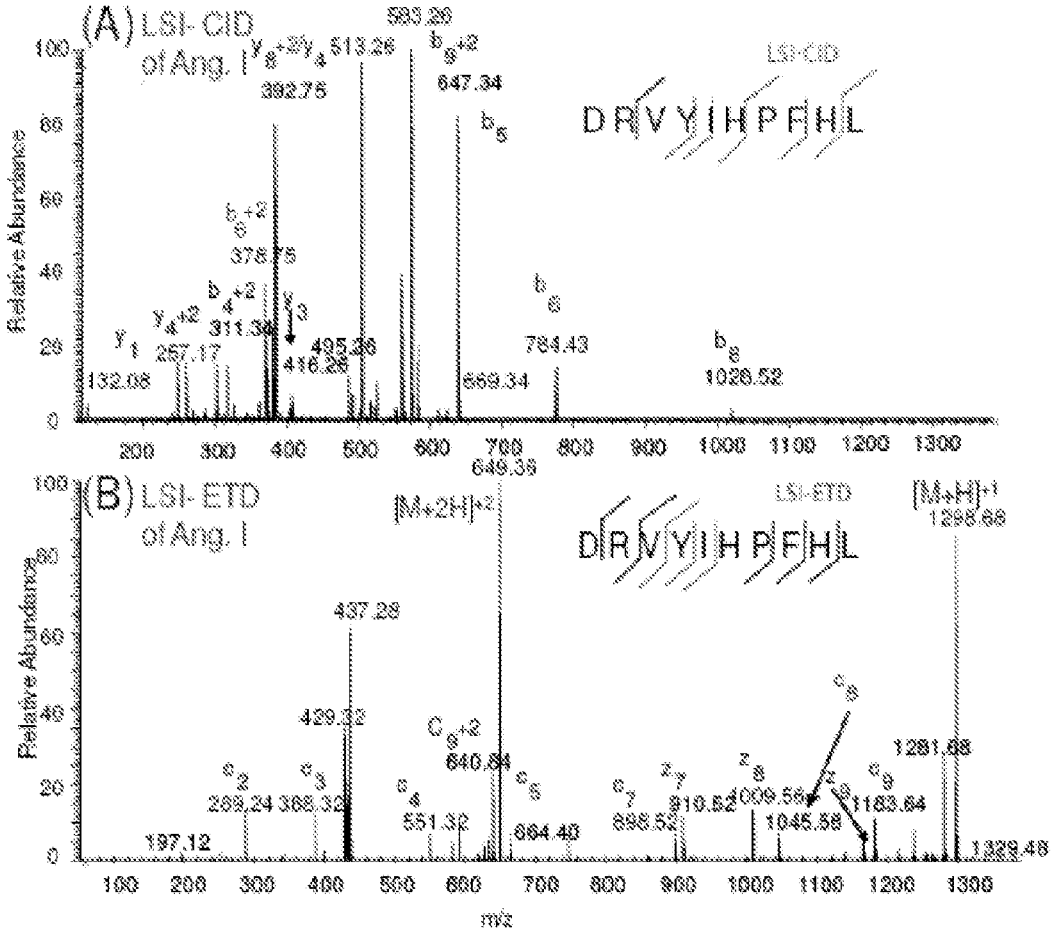
FIGS. 80A-B depicts MS/MS spectra of angiotensin-I.

FIGS. 78A-F depict the comparison of LSI-LTQ-MS analysis of FIG. 78A LSI-MS of mixture I using the DHAP matrix; FIG. 78B LSI-CID of GF (m/z=612.4) using the DHAP matrix. FIG. 78C shows LSI-CID of Ang I (m/z=648.9) using the DHAP matrix. FIG. 78D LSI-MS of Mixture I using the DHB matrix; FIG. 78E LSI-CID of GF using the DHB matrix; and FIG. 78F LSI-CID of angiotensin 1 using the DHB matrix. FIGS. 78A and 78D show that DHB produces higher charge states than DHAP. FIGS. 78B, 78C, 78E, and 78F show that similar sequence information obtained by CID fragmentation is observed for both matrixes.

FIGS. 79A-B depict the LSI-MSn (n=2 and 3) spectra using CID of OVA peptide 323-339 (m/z 444.554). FIG. 79(A) shows LSI-MS2, and FIG. 79(B) shows LSI-MS3 using DHB. FIGS. 80A-B depicts MS/MS spectra of Ang. I (m/z 433) in the mixture containing of Angiotensin 1 (Ang. I), OVA peptide 323-339 (OVA), β-amyloid 10-20 (BA(10-20)), myelin proteolipid protein 139-151 (MPP), and growth factor 102-111 (GF). FIG. 80(A) shows LSI-CID, and FIG. 80(B) shows LSI-ETD using DHB matrix.

Figure 81:
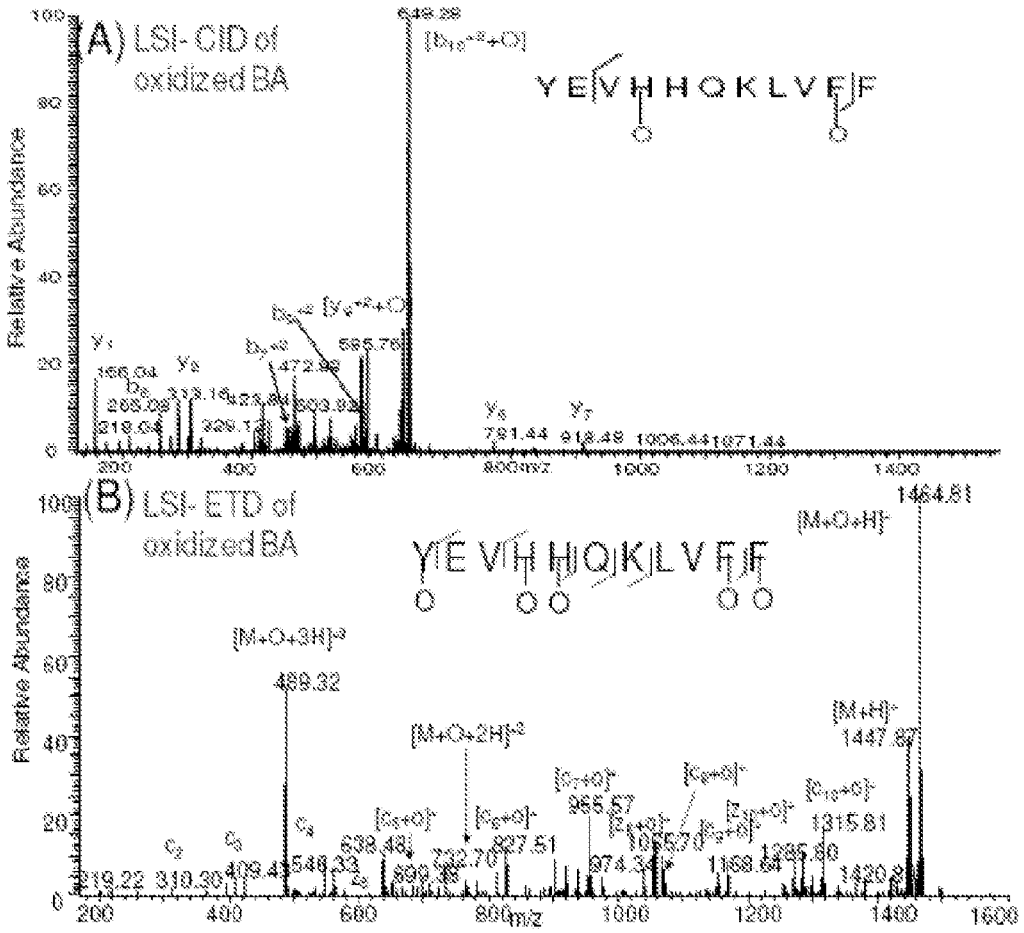
FIGS. 81A-B depict MS/MS spectra of oxidized β-amyloid 10-20, m/z 488: (A) LSI-CID, (B) LSI-ETD using DHB.
Figure 82:
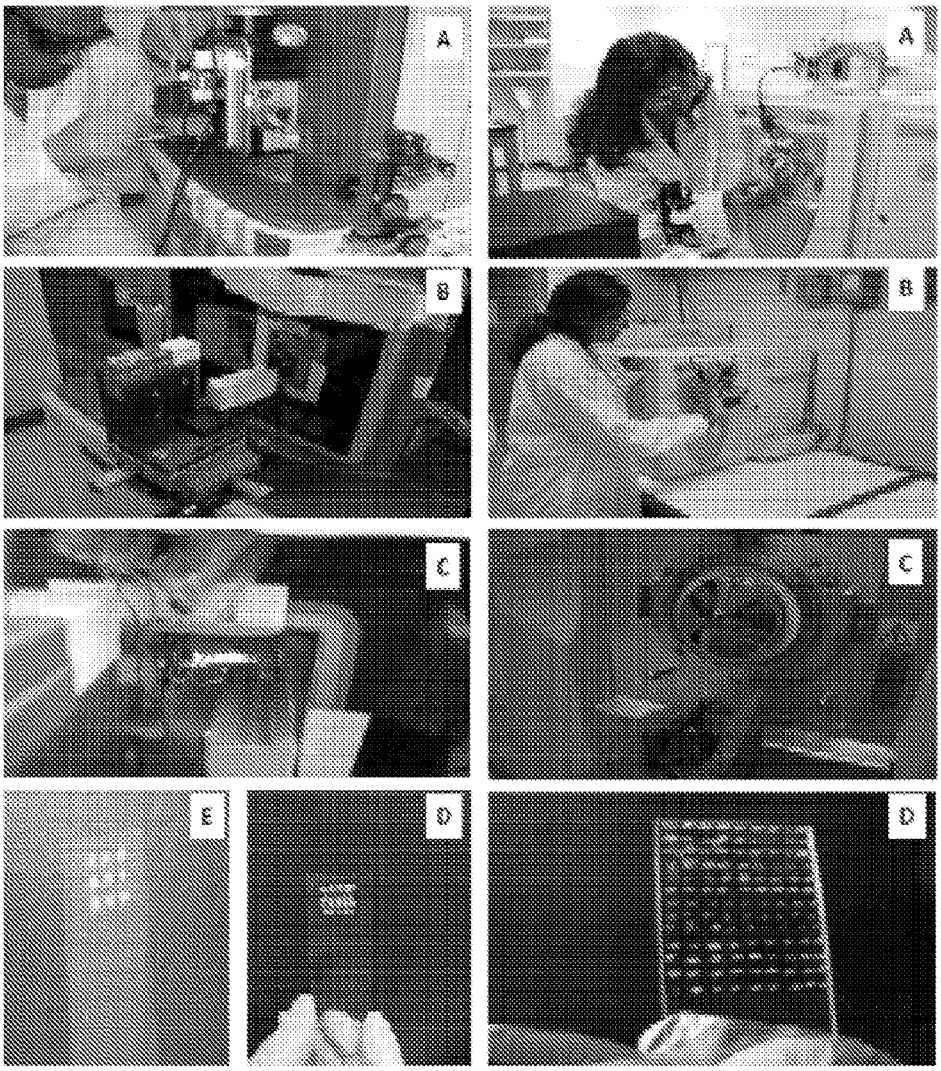
FIGS. 82A-E depict pictures illustrating optimization and benefits of LSI-MS analysis: (I) Acquisition exploiting the precise and continuous ablation using the XYZ-stage of the SYNAPT G2 (left hand column), a manual imaging experimental set-up, (A) to (C); matrix/analyte sample mounted glass slides: (D) Solvent-based to (E) solvent free sample preparation using 2,5-DHAP and angiotensin 1.

FIGS. 81A-B depict MS/MS spectra of oxidized β-amyloid 10-20 (BA), m/z 488: (A) LSI-CID, (B) LSI-ETD using DHB. Improved sequence coverage is observed using LSI-ETD as compared to LSI-CID.

FIGS. 82A-E illustrate optimization and benefits of LSI-MS analysis: (I) Acquisition exploiting the precise and continuous ablation using the XYZ-stage of the SYNAPTG2 (left hand column), a manual imaging experimental set-up, (A) to (C); matrix/analyte sample mounted glass slides: (D) Solvent-based to (E) solvent free sample preparation using 2,5-DHAP and angiotensin 1.

Figure 83:
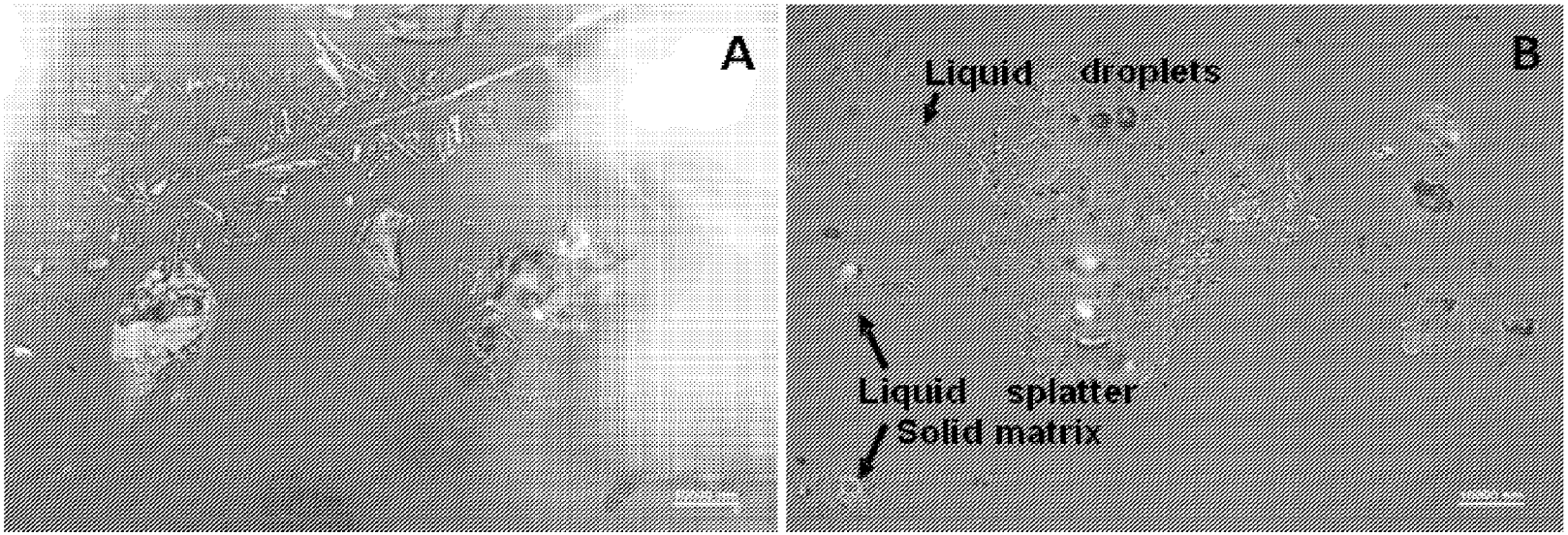
FIGS. 83A-B depict microscopy of solvent-based deposited 2,5-DHB and ablated by a $N_2$ laser in a transmission geometry LSI type setup.

FIGS. 83A-B depict microscopy of solvent-based deposited 2,5-DHB and ablated by a N2 laser in a transmission geometry LSI type setup; instead of the mass spectrometer entrance orifice, a second microscopy glass slide was placed at a distance of about 2 mm to collect the ablated plume: To the left (a) is displayed the ablated area on the parent slide and to the right (b) the collected plume. Experimental observations show "cluster" or "droplet" formation in the laser ablation process.

Figure 101:
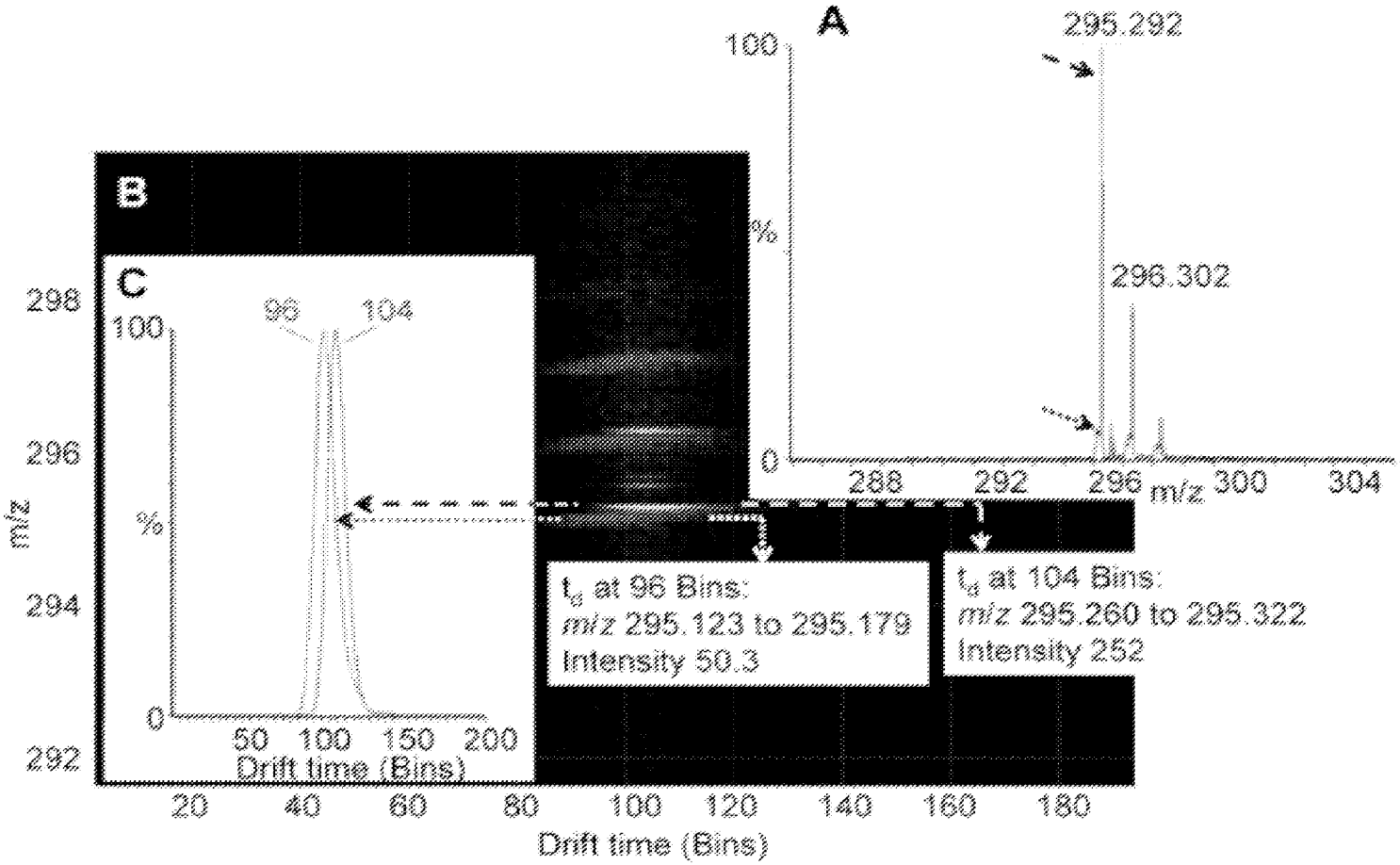
FIGS. 101A-C depicts fatty acid analysis by charge remote fragmentation.

FIGS. 101A-C depict fatty acid analysis by charge remote fragmentation. The figures show TSA of oleic acid acquired on a SYNAPT HD mass spectrometer using vacuum MALDI. FIG. 101A depicts the mass spectrum, FIG. 101B depicts the two dimensional drift time vs. m/z, and FIG. 101C depicts extracted drift times for two isobars m/z 295.123 to 295.179 and m/z 295.260 to 295.322.

Figure 102:
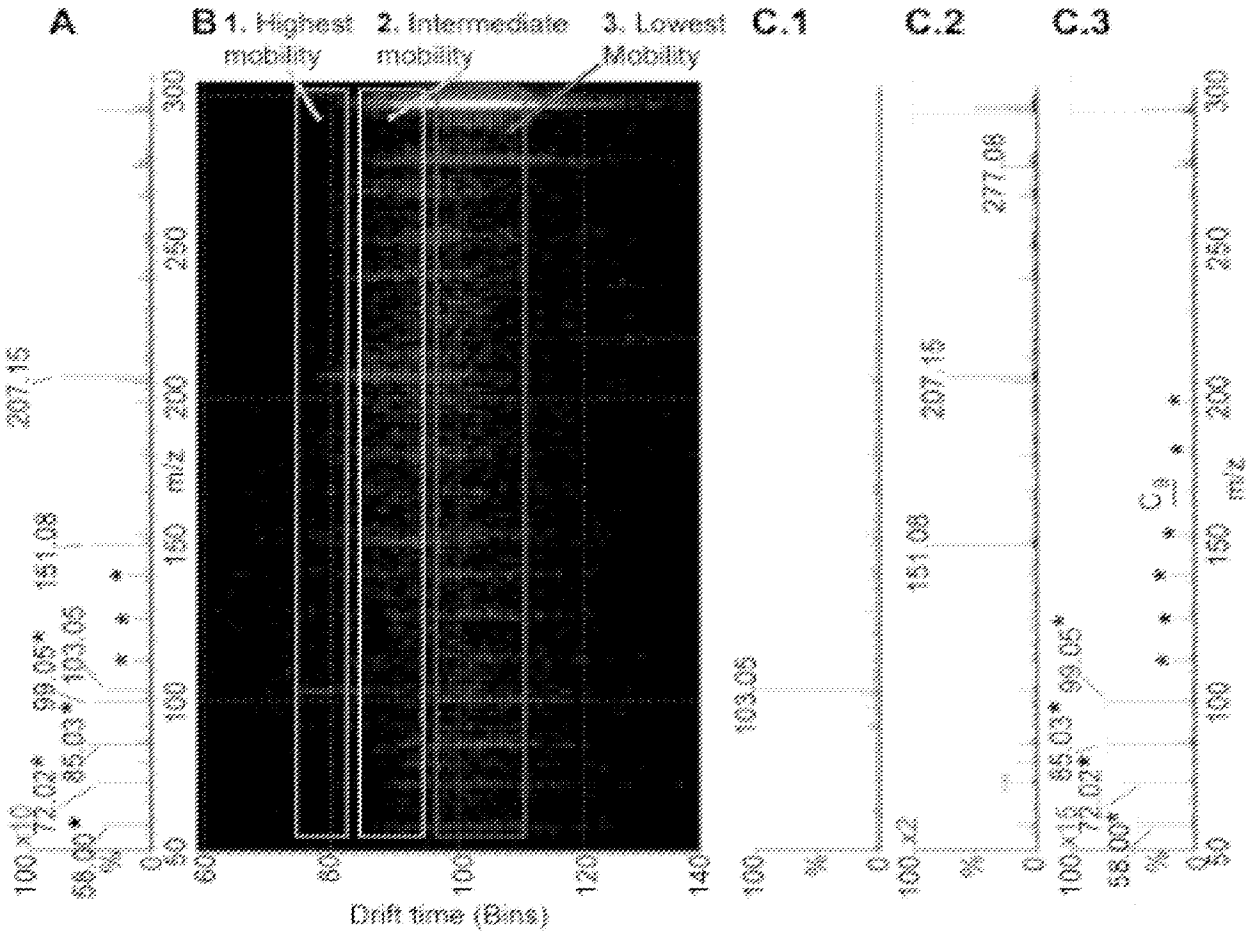
FIG. 102 depicts fatty acid analysis by charge remote fragmentation.

FIG. 102 depicts fatty acid analysis by charge remote fragmentation. MS/MS from FIGS. 101A-C of oleic acid: Section (A) shows total MS and section (B) shows that three mobilities are observed. The lowest mobility shows charge remote fragmentation and therefore provides structural information (C-9 double bond position) as seen in section (C.3).

Figure 103:
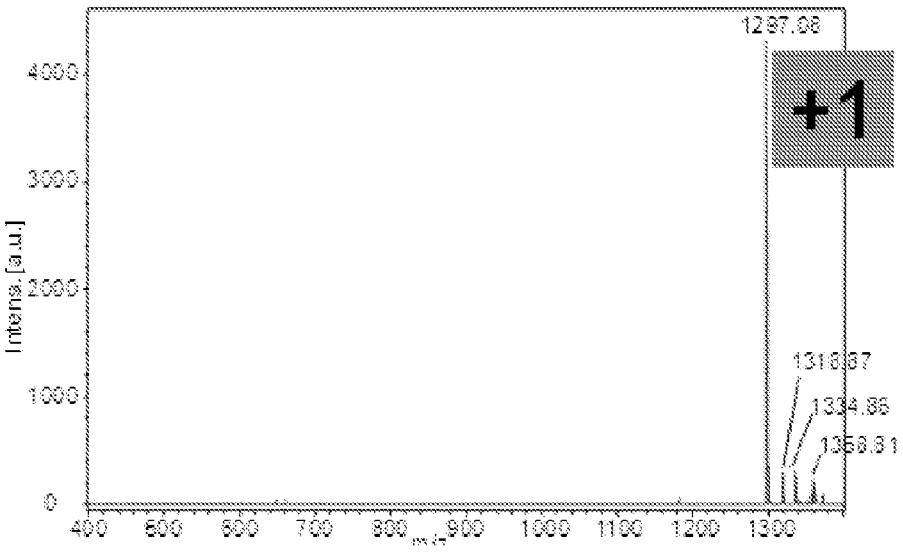
FIG. 103 depicts a summary of traditional ionization methods for angiotensin 1.
Figure 103:
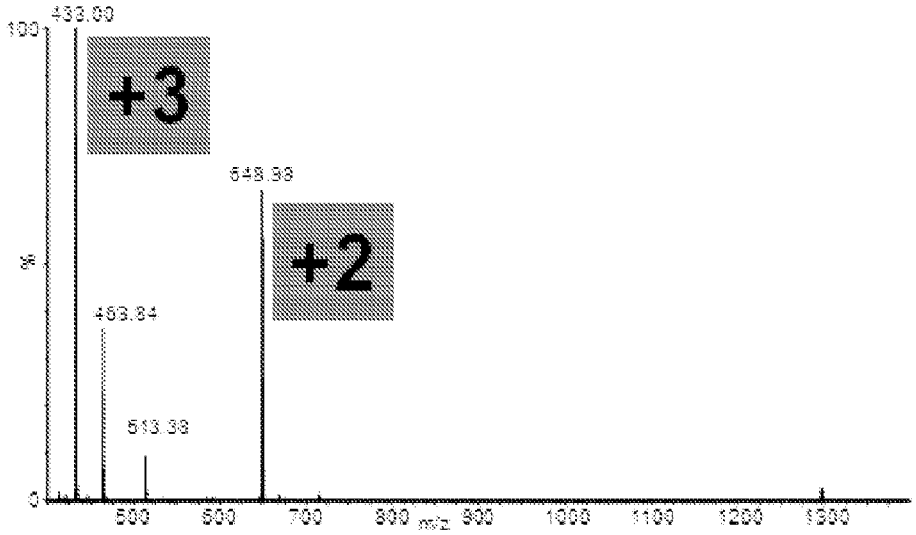

FIG. 103 depicts a summary of traditional ionization methods for Angiotensin 1 (a peptide). The left panel shows results from vacuum MALDI and right the panel shows AP ESI.

Figure 104:
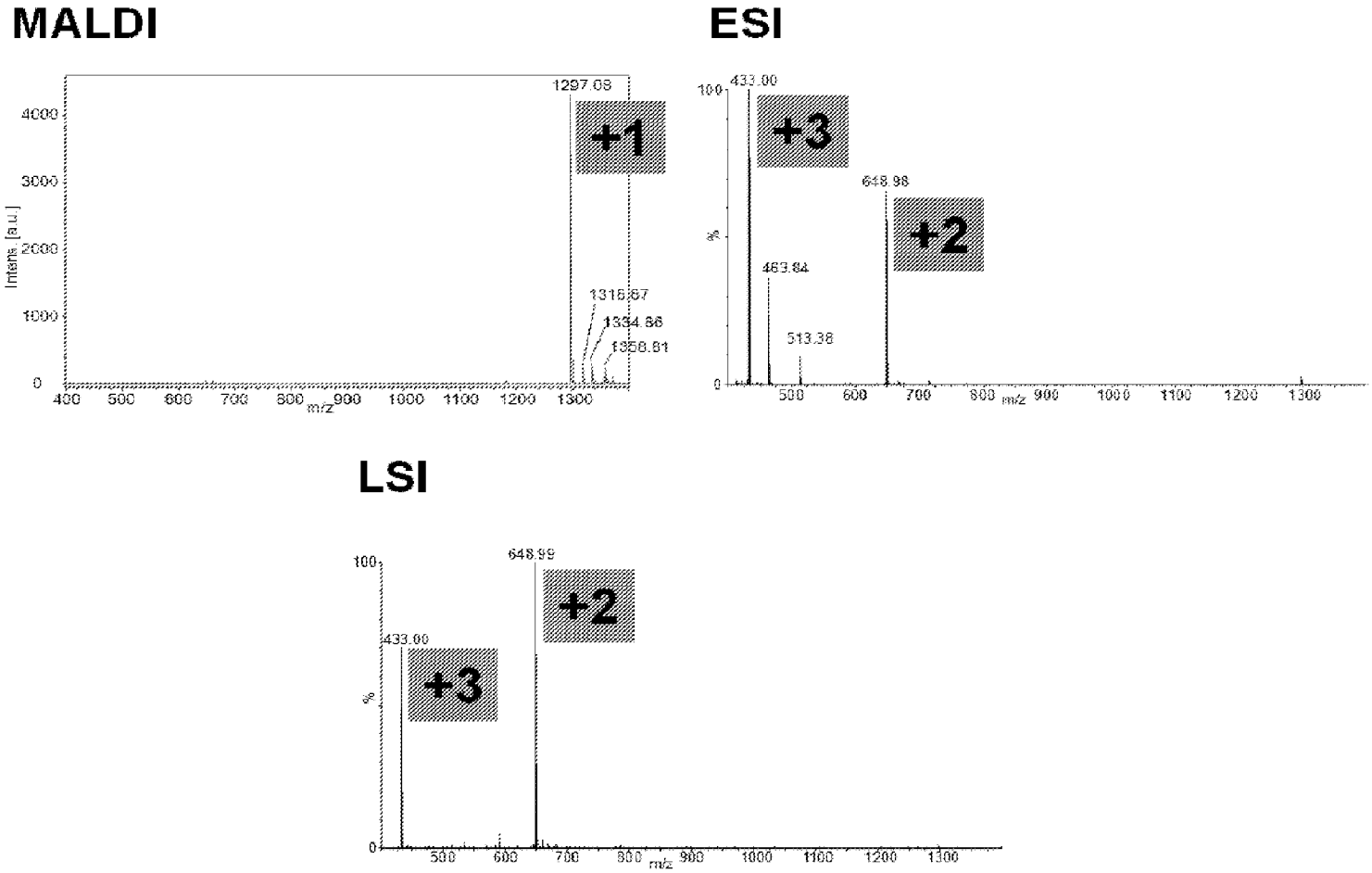
FIG. 104 depicts the summary of traditional ionization methods for angiotensin 1 shown in FIG. 103 with the addition of LSI.

FIG. 104 depicts the summary of traditional ionization methods for Angiotensin 1 (a peptide) shown in FIG. 103 with the addition of LSI (bottom). The LSI shows ESI like multiply charged ion mass spectrum using laser ablation of a solid matrix (2,5-dihydroxybenzoic acid [2,5-DHB]) containing trace quantities of the peptide.

Figure 105:
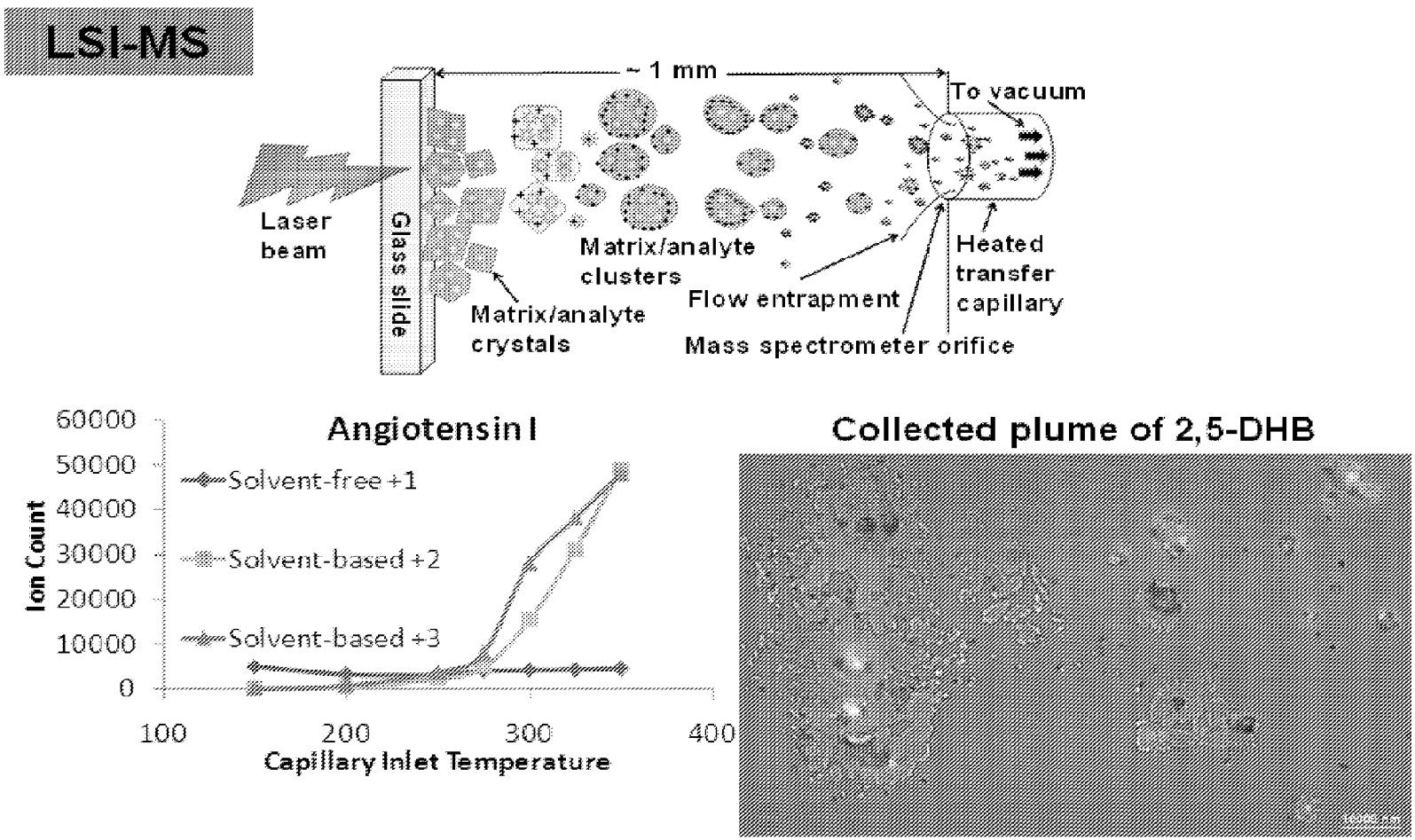
FIG. 105 depicts LSI-MS schematics and results.

FIG. 105 depicts LSI-MS schematics and results. The top section shows a schematic of the LSI process showing laser ablation producing multiply-charged clusters or liquid droplets that enter a desolvation region for evaporation of the matrix to release multiply charged ions. The bottom left section shows the response of the multiply charged ions to increasing temperature of the desolvation region (shown top right) relative to singly charged ions apparently being produced by the conventional MALDI mechanism (APCI process). The bottom right section shows laser ablated liquid droplets collected on a microscope slide held 3 mm distance from a parent glass microscopic slide containing the matrix 2,5-DHB. The conditions were similar to LSI laser ablation conditions and shows that liquid droplets are produced from the solid matrix by laser ablation at AP.

Figure 106:
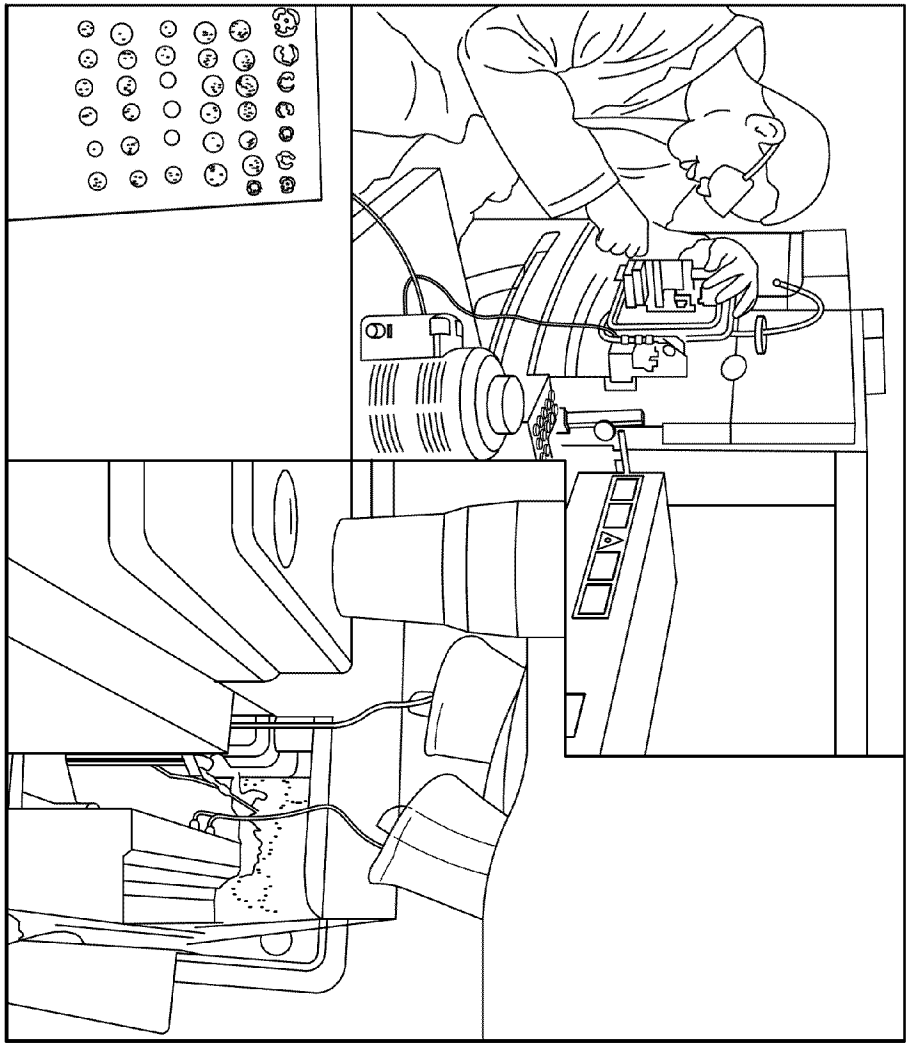
FIG. 106 shows pictures of the LSI instrumentation.

FIG. 106 shows pictures of the LSI instrumentation. The top section shows the IMS-MS SYNAPT G2. The motor of the lockspray has been removed to provide the ability to align the laser (top right) directly with the orifice of the mass spectrometer. A focusing lens between laser and orifice permits focusing the laser beam directly on the matrix/analyte sample placed on the glass slide and mounted 1 to 3 mm in front of the orifice. The bottom right section shows the inside view of the source modifications. The sample faces the thermal device (white), the laser hits from the back (here, the right side); the xyz-stage of the nano-electrospray source is used to move (raster) the matrix/analyte sample through the focused laser beam. The wires in the front can be hooked up to for example a Variac device to also provide heat depending on the matrix used. The bottom left section shows a microscopy glass slide loaded with about 3 dozen LSI samples.

Figure 107:
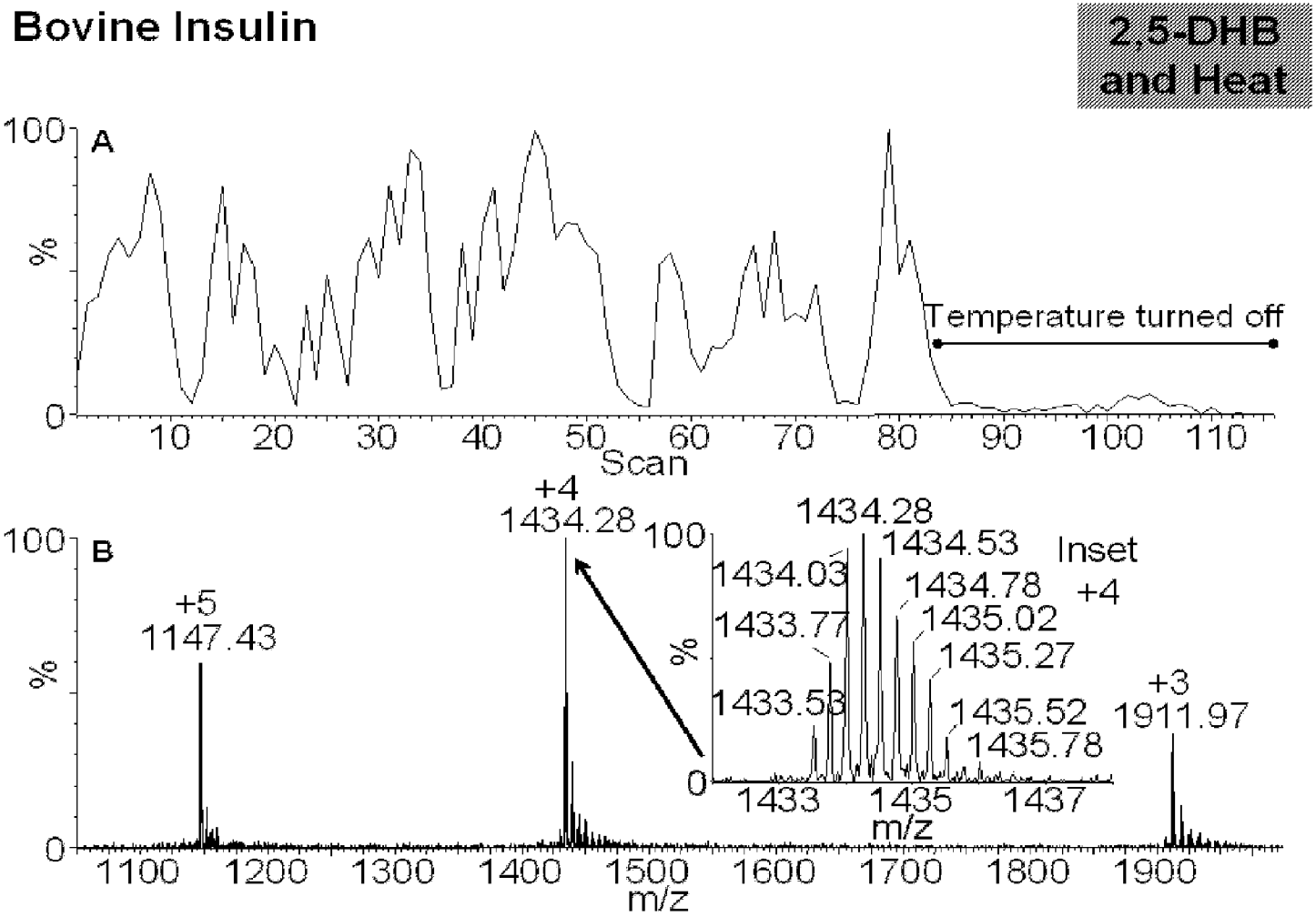
FIGS. 107A-B depicts LSI-IMS-MS of bovine insulin using 2,5-DHB as the matrix.

FIGS. 107A-B depicts LSI-IMS-MS of bovine insulin using 2,5-DHB as the matrix. FIG. 107A depicts that the total ion current provides indication of the efficient ion production when heat is applied and the sample is moved through the focused laser beam. After about 80 seconds of acquisition the temperature was turned off, a significant drop of ion current is observed. FIG. 107B depicts the mass spectrum of multiple acquisitions from the total ion current. Abundant signals and charge states typically observed with ESI are shown with high resolution as shown with the Inset spectrum for charge state +4.

Figure 108:
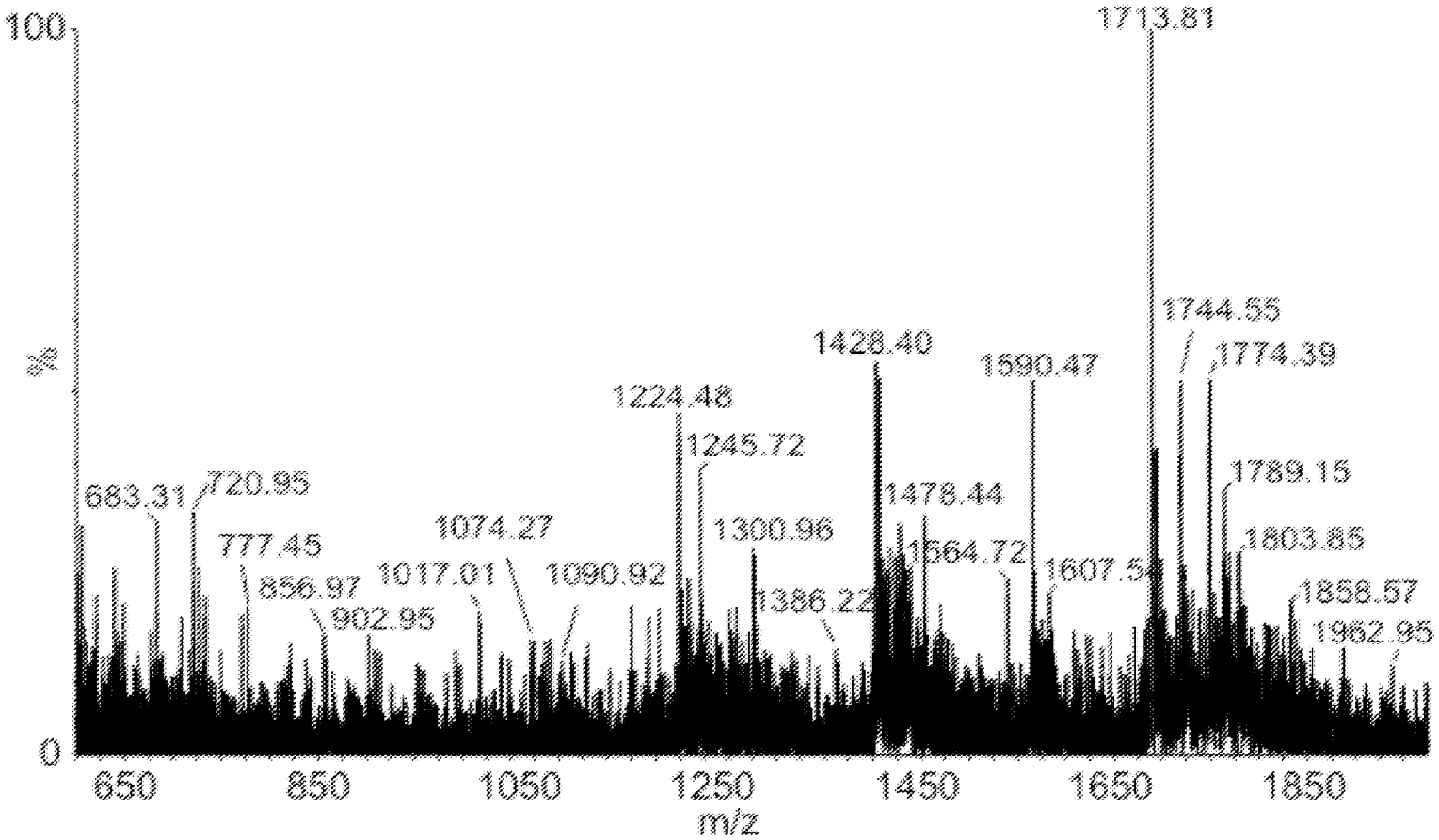
FIG. 108 depicts LSI-IMS-MS of a lower abundance protein of lysozyme and ubiquitin using 2,5-DHB as matrix as well as a heated thermal device (here, about 5 Volts applied to heater wire).

FIG. 108 depicts LSI-IMS-MS of a lower abundance protein mixture of lysozyme and ubiquitin using 2,5-DHB as matrix as well as a heated thermal device (here, about 5 V). A crowded total mass spectrum is observed because of charge state convolution of the two proteins.

Figure 109:
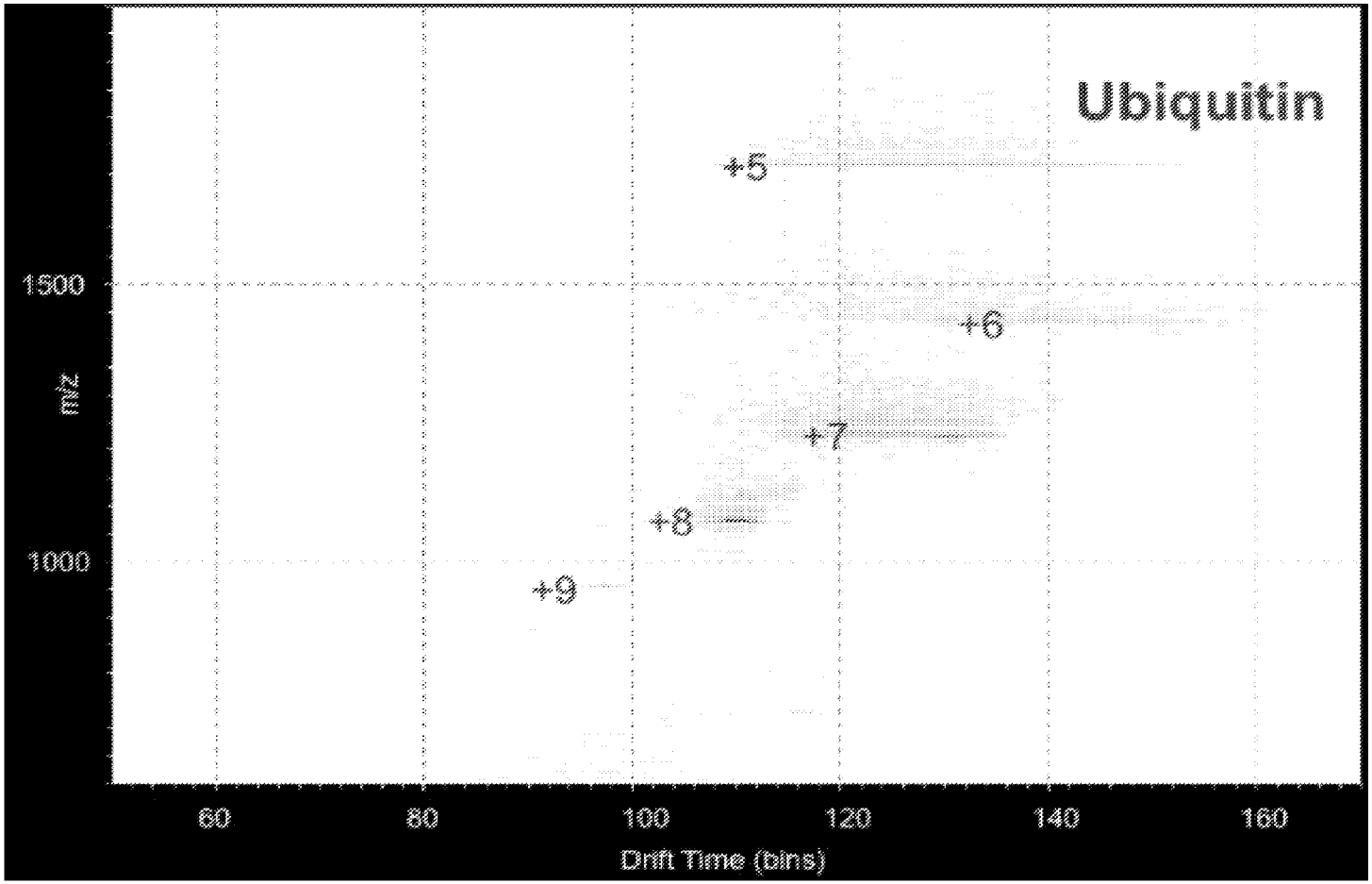
FIG. 109 depicts the two dimensional drift time vs. m/z of ubiquitin in similar concentrations as FIG. 108 using 2,5-DHB as matrix as well as a heated thermal device (here, about 5 Volts applied to nichrome heater wire).

FIG. 109 depicts the two dimensional drift time vs. m/z of ubiquitin in similar concentrations as FIG. 108 using 2,5-DHB as matrix as well as a heated thermal device (here, about 5 V). The LSI ions are separated according to number of charges and cross-section (size and shape) as is the case with ESI ions.

Figure 110:
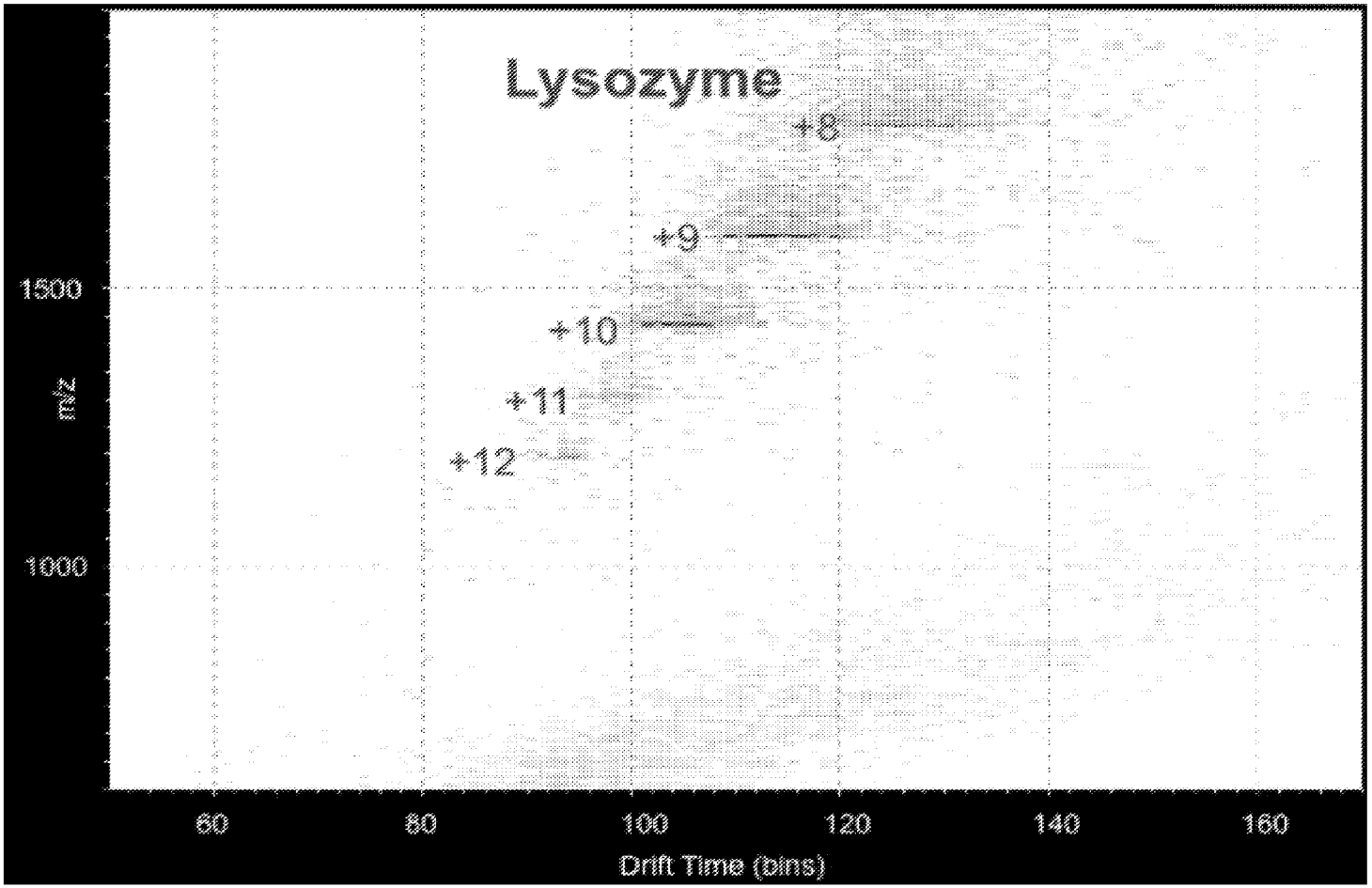
FIG. 110 depicts two dimensional drift time vs. m/z of lysozyme in similar concentrations as FIG. 108 using 2,5-DHB as matrix as well as a heated thermal device (here, about 5 V).

FIG. 110 depicts two dimensional drift time vs. m/z of lysozyme in similar concentrations as FIG. 108 using 2,5-DHB as matrix as well as a heated thermal device (here, about 5 V). The LSI ions are separated according to number of charges and cross-section (size and shape) as is the case with ESI ions.

Figure 111:
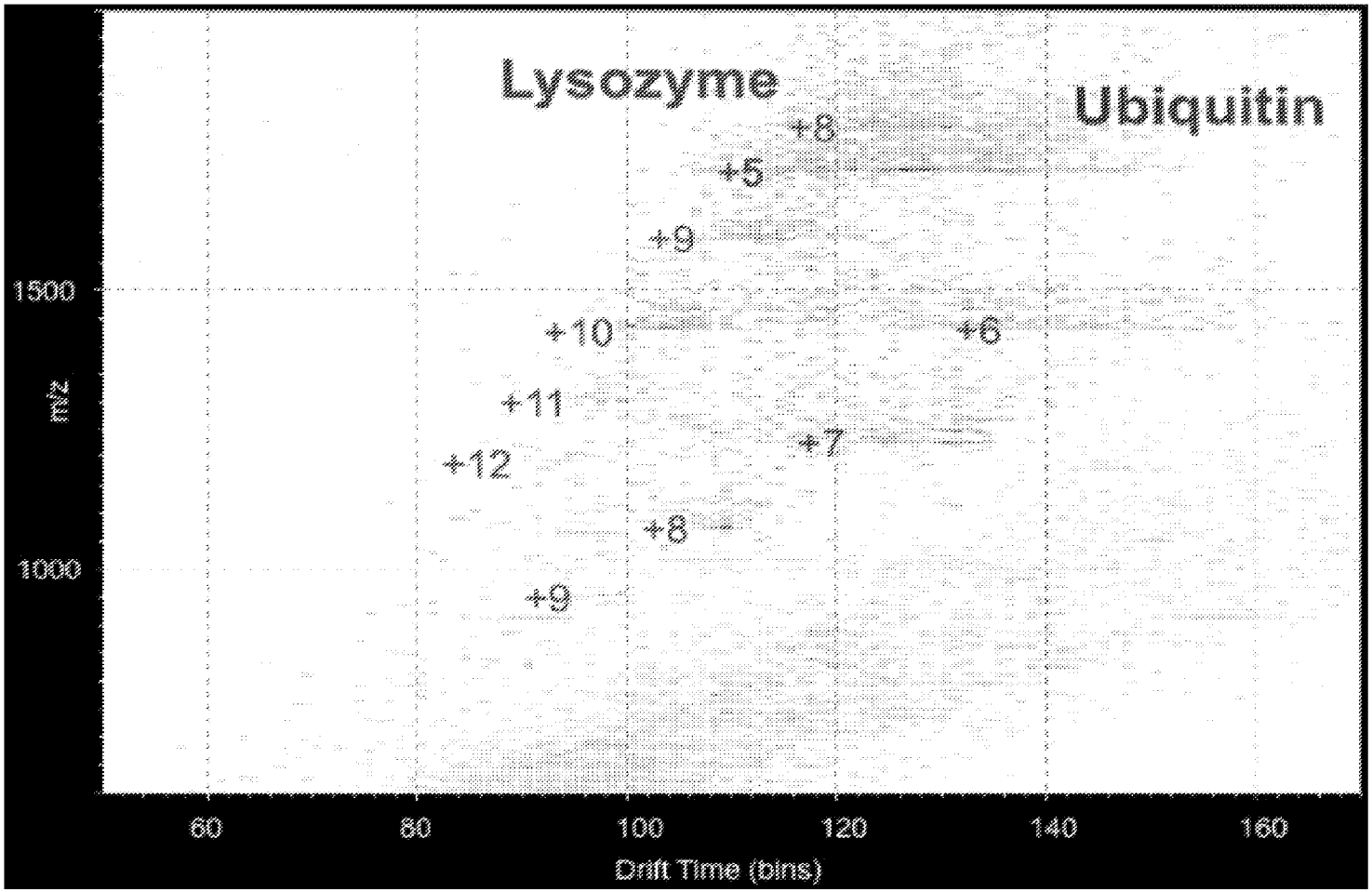
FIG. 111 depicts the two dimensional drift time vs. m/z of ubiquitin and lysozyme with identical concentrations as FIG. 108 using 2,5-DHB as matrix as well as a heated thermal device (here, about 5 V).

FIG. 111 depicts the two dimensional drift time vs. m/z of ubiquitin and lysozyme with identical concentrations as FIG. 108 using 2,5-DHB as matrix as well as a heated thermal device (here, about 5 V). The LSI ions of both proteins are separated according to number of charges and cross-section (size and shape) as is the case with ESI ions. The two-dimensionality of the data and the pictorial of the display permits the identity of each feature to both proteins and charge state to be assigned. The mass spectrum for each protein can be cleanly extracted as is shown for lysozyme in FIG. 112.

Figure 112A:
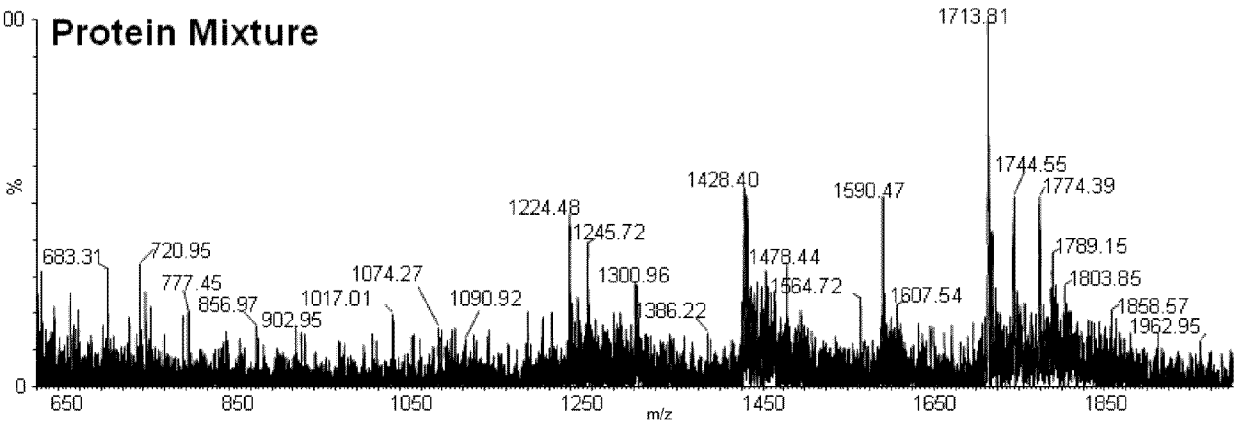
FIGS. 112A-B depict MS of A) ubiquitin and B) lysozyme.
Figure 112B:
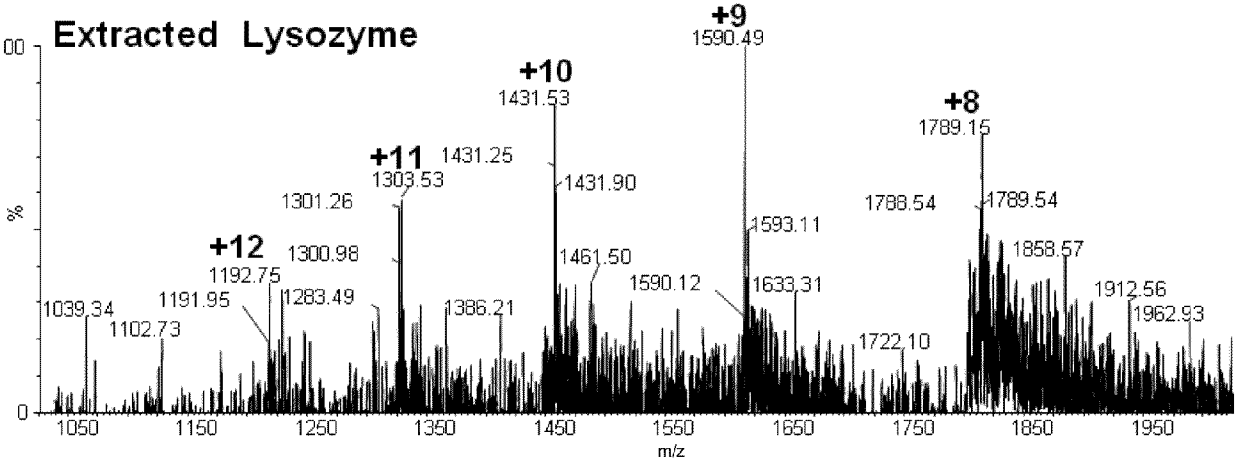

FIGS. 112A-B depict MS of ubiquitin and lysozyme. FIG. 112A depicts the total MS of ubiquitin and lysozyme as shown in FIG. 108. FIG. 112B depicts the extracted mass spectrum of lysozyme from the 2-dimensional drift time vs. m/z plot displayed in FIG. 111.

Figure 113:
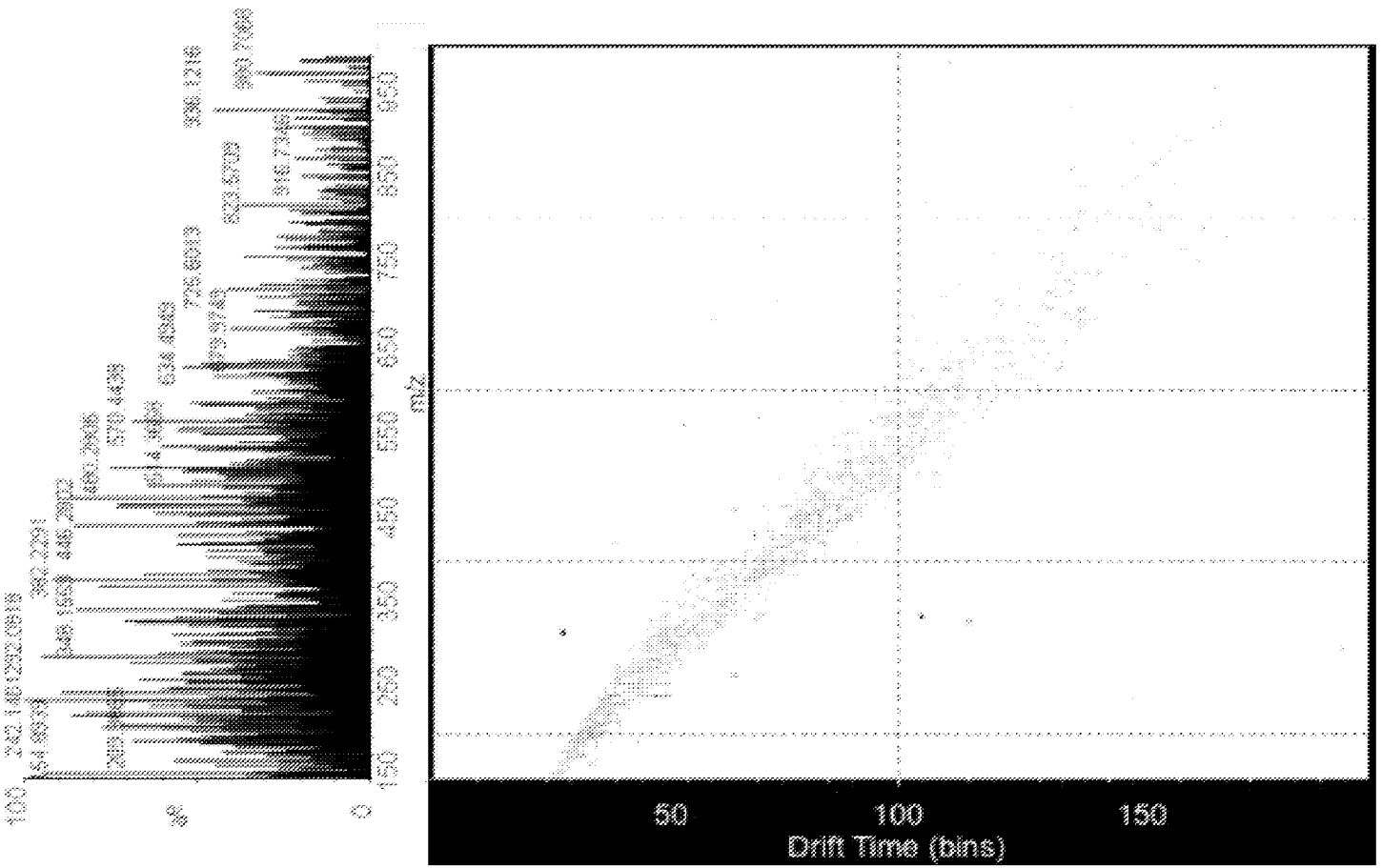
FIG. 113 depicts LSI-IMS-MS analysis of crude oil using 2,5-DHB with no heat applied.

FIG. 113 depicts LSI-IMS-MS analysis of crude oil using 2,5-DHB with no heat applied.

Figure 114:
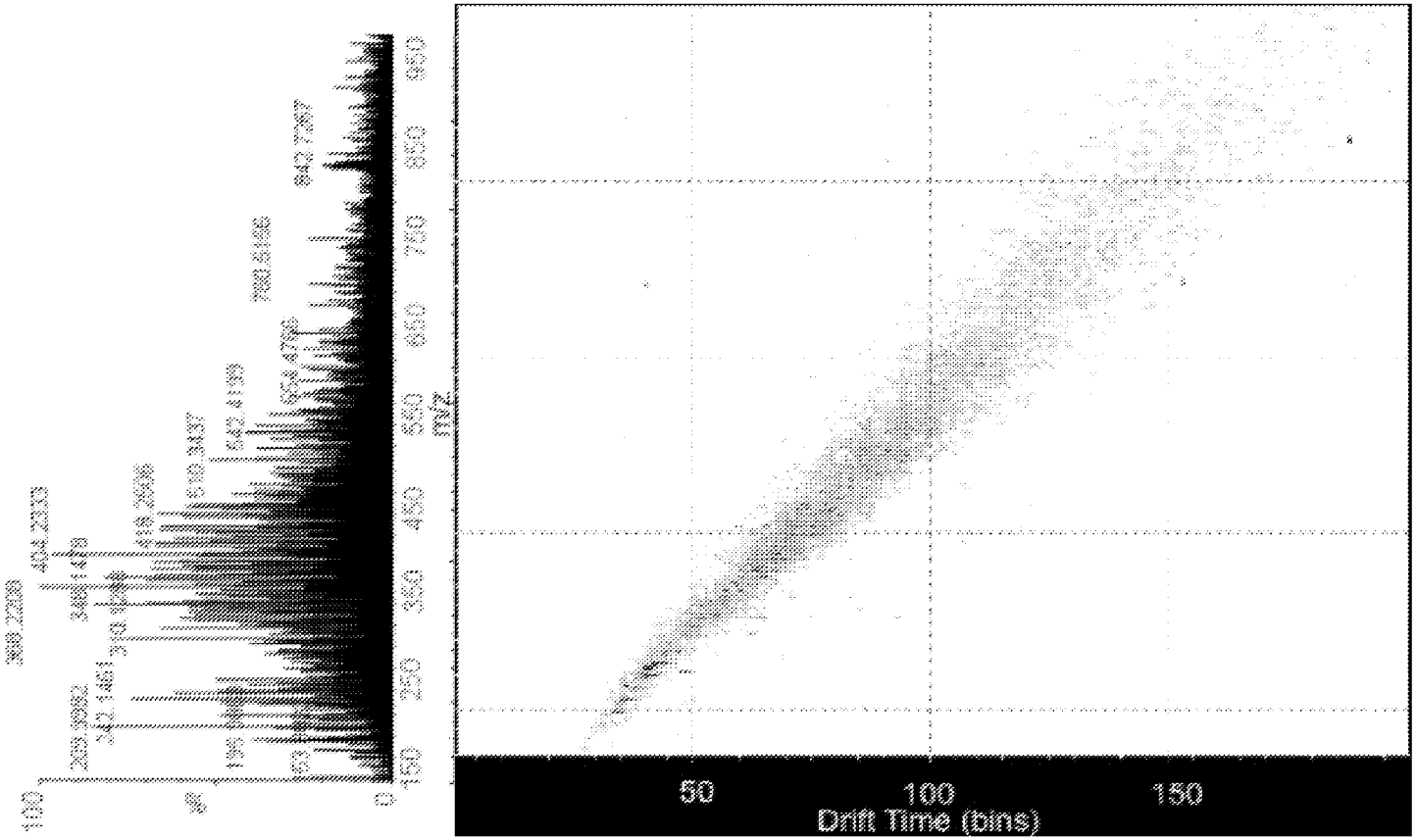
FIG. 114 depicts LSI-IMS-MS analysis of crude oil using 2,5-DHB with heat applied.

FIG. 114 depicts LSI-IMS-MS analysis of crude oil using 2,5-DHB with heat applied. When 'no heat' is said to be applied to the desolvation device, it is still connected to the ion source skimmer which is at 150° C. Thus, the metal desolvation device is near 150° C. When heat is applied to the desolvation device, it is heated beyond 150° C. More abundant and higher molecular weight ions are observed when heat is applied. The ions are separated in the gas-phase. Aggregation due to high laser power, frequently observed with laser desorption/ionization or higher concentrations with ESI are not observed. The pictorial snapshots of these complex systems can be sufficiently distinctive to be differentiated quickly as long as identical sample and acquisition protocols are used.

Figure 115A:
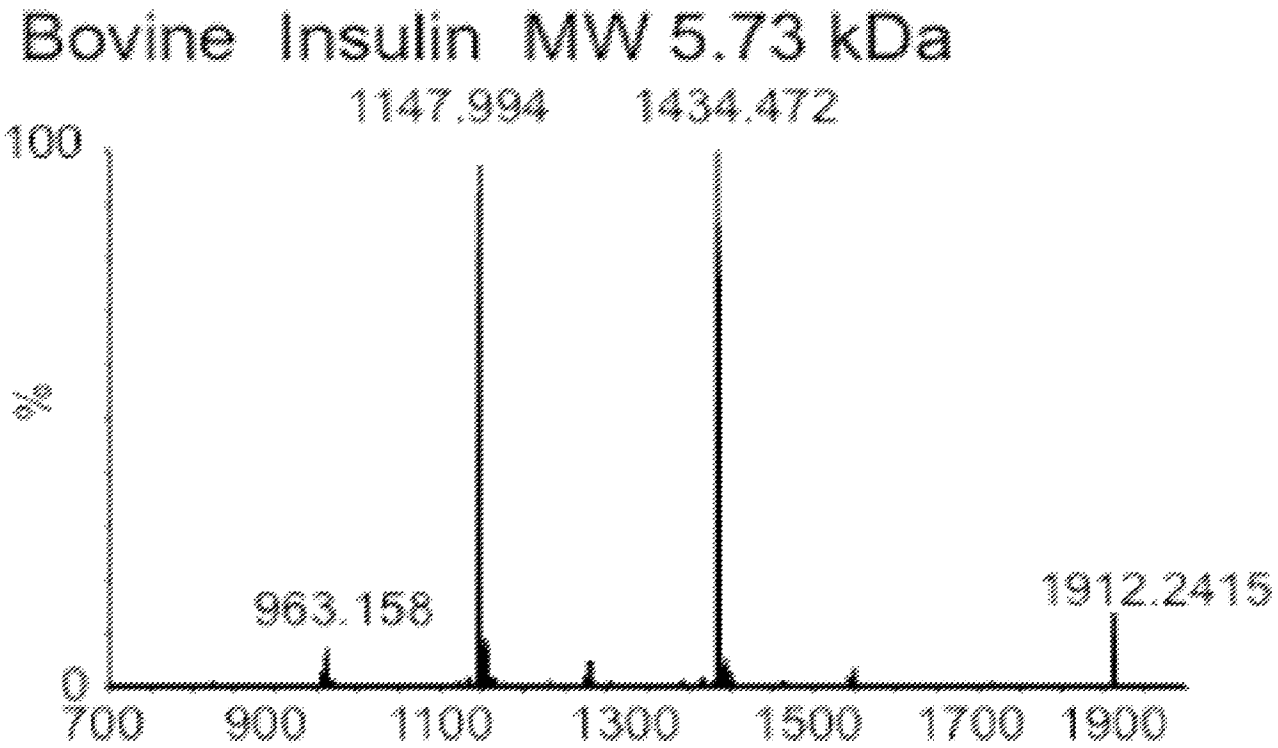
FIGS. 115A-D depict LSI-IMS-MS for proteins with increasing molecular weights using 2,5-DHAP and the desolvation device with no heat applied.
Figure 115B:
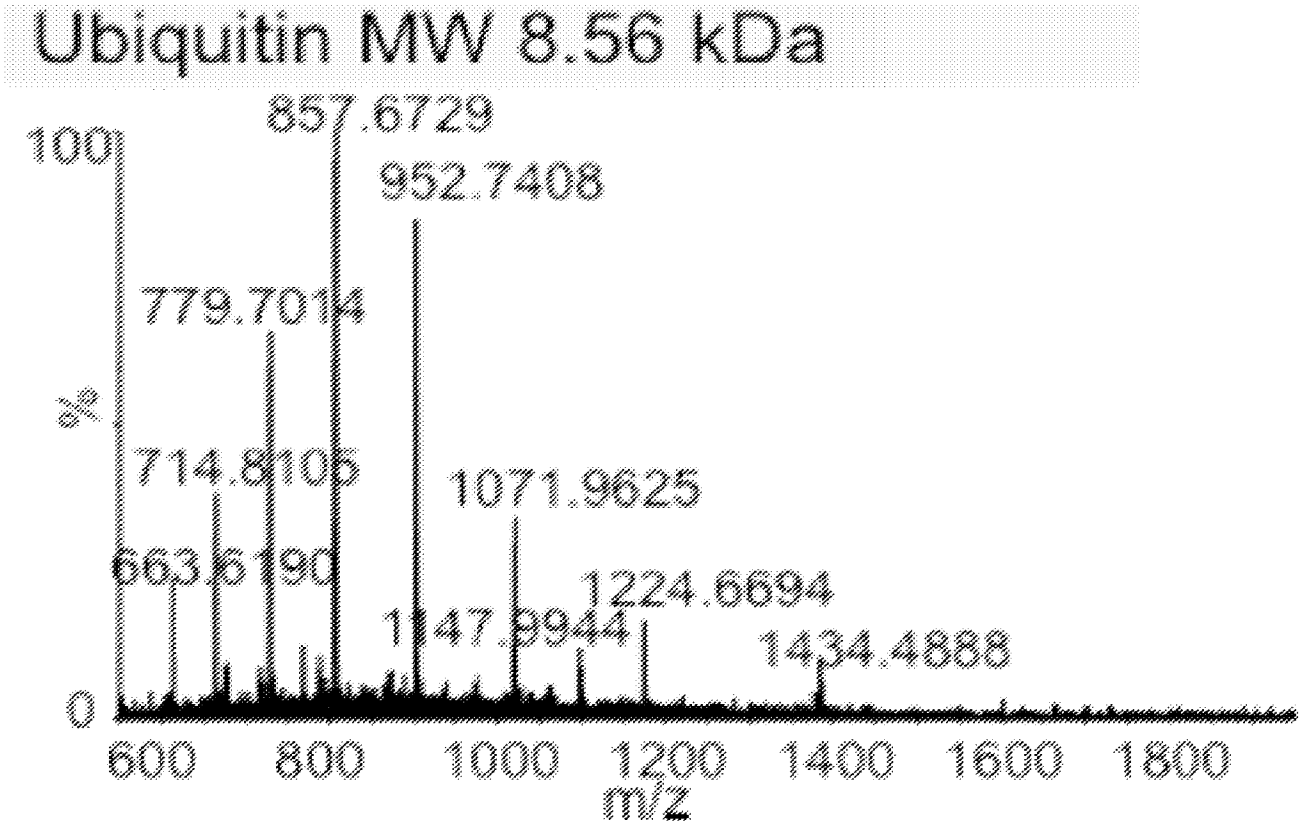
Figure 115C:
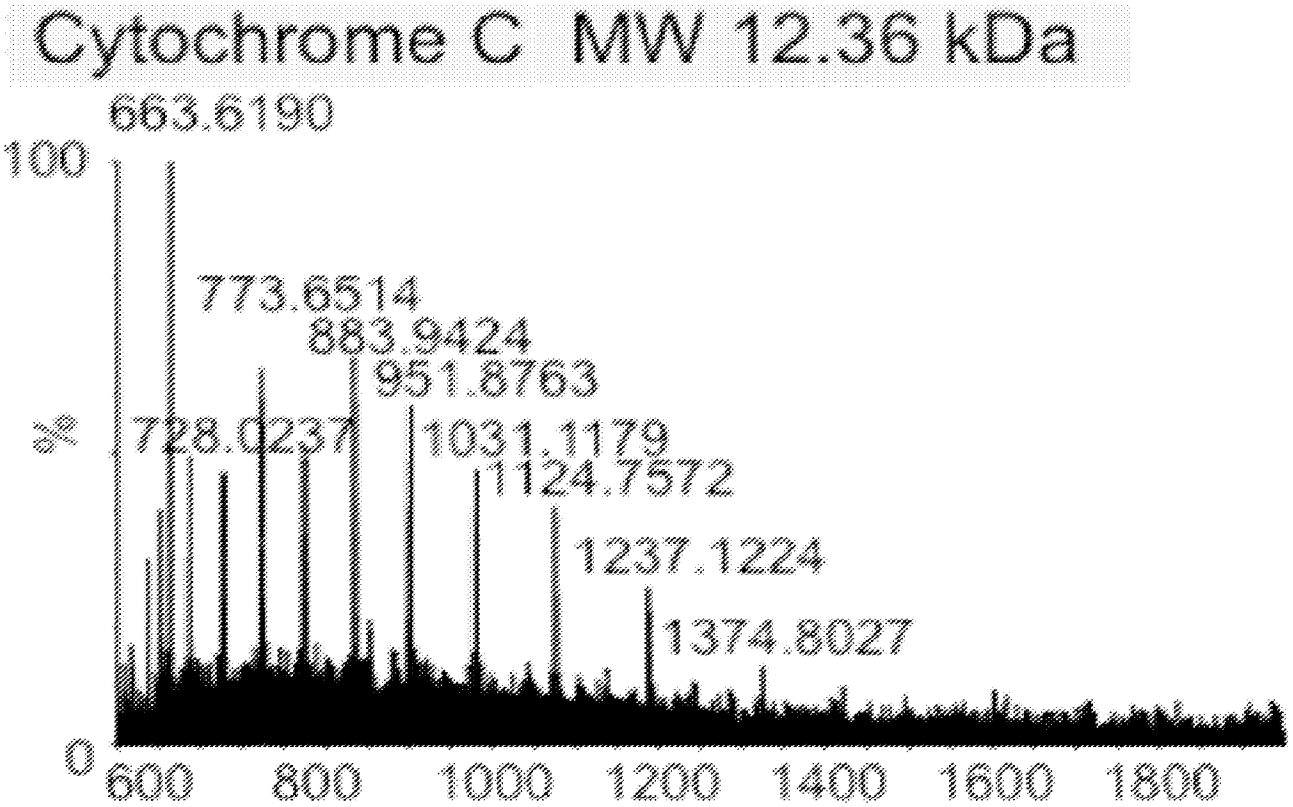
Figure 115D:
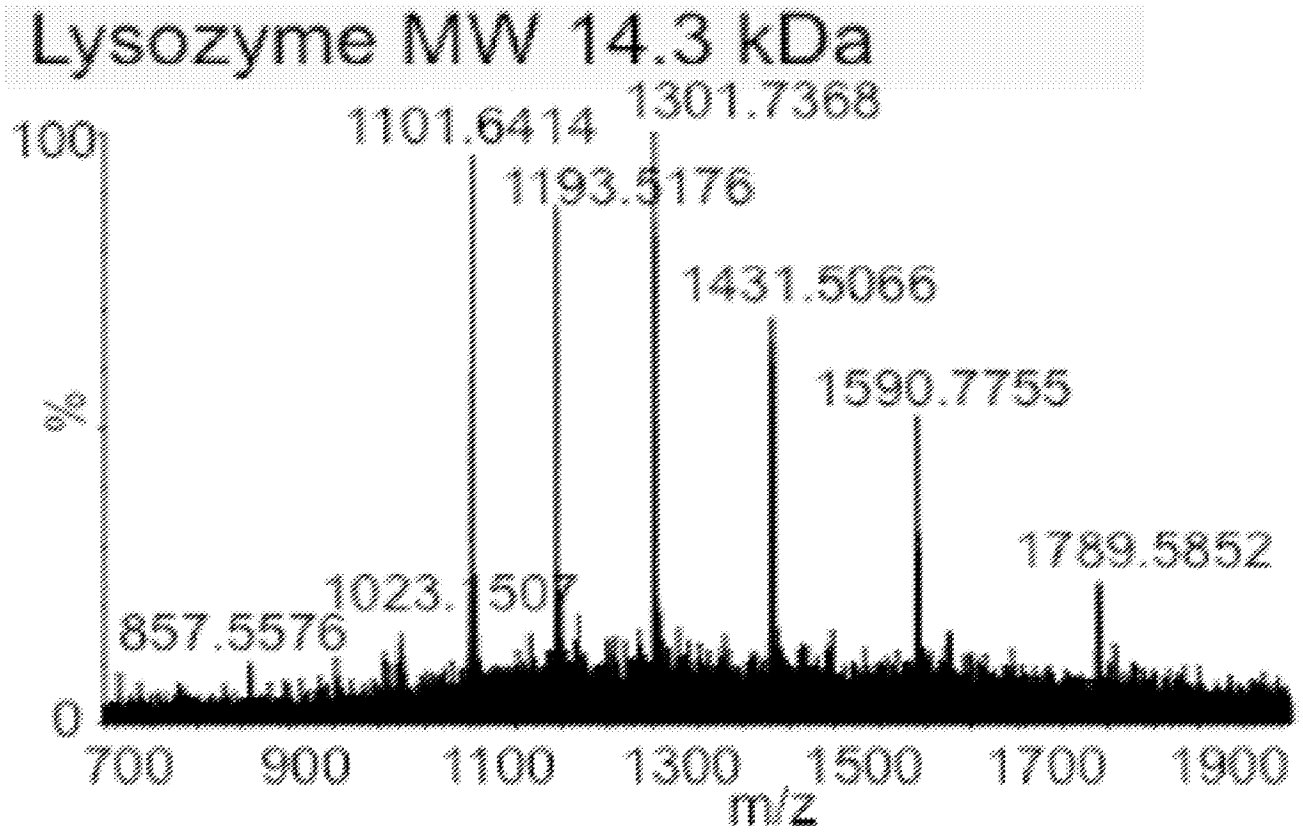

FIGS. 115A-D depict LSI-IMS-MS for proteins with increasing molecular weights using 2,5-DHAP and the desolvation device with no heat applied. FIG. 115A shows results for bovine insulin, FIG. 115B shows results for ubiquitin, FIG. 115C shows results for cytochrome C, and FIG. 115D shows results for lysozyme.

Figure 116:
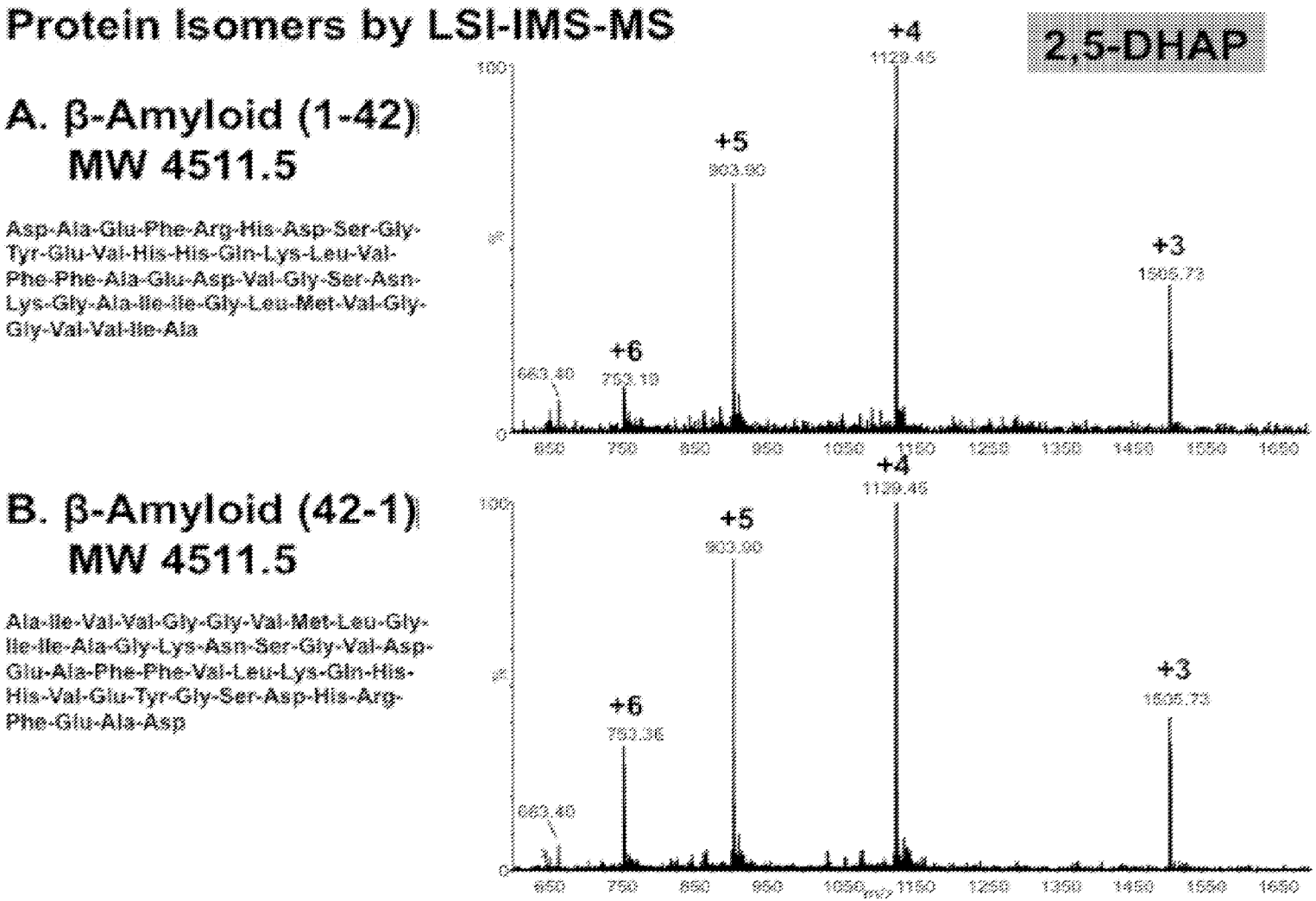
FIG. 116 depicts LSI-IMS-MS for the analysis of isomeric proteins that have not been differentiated by mass spectrometry alone because of identical m/z and, as shown here, very similar charge state distributions.

FIG. 116 depicts LSI-IMS-MS for the analysis of isomeric protein mixtures that are impossible to be differentiated by mass spectrometry alone because of identical m/z and, as shown here, very similar charge state distributions. The total mass spectra of beta amyloid (1-42) in shown in section (A) and amyloid (42-1) is shown in section (B). The analysis was conducted using 2,5-DHAP as the matrix and no heat was applied to the desolvation device.

Figure 117:
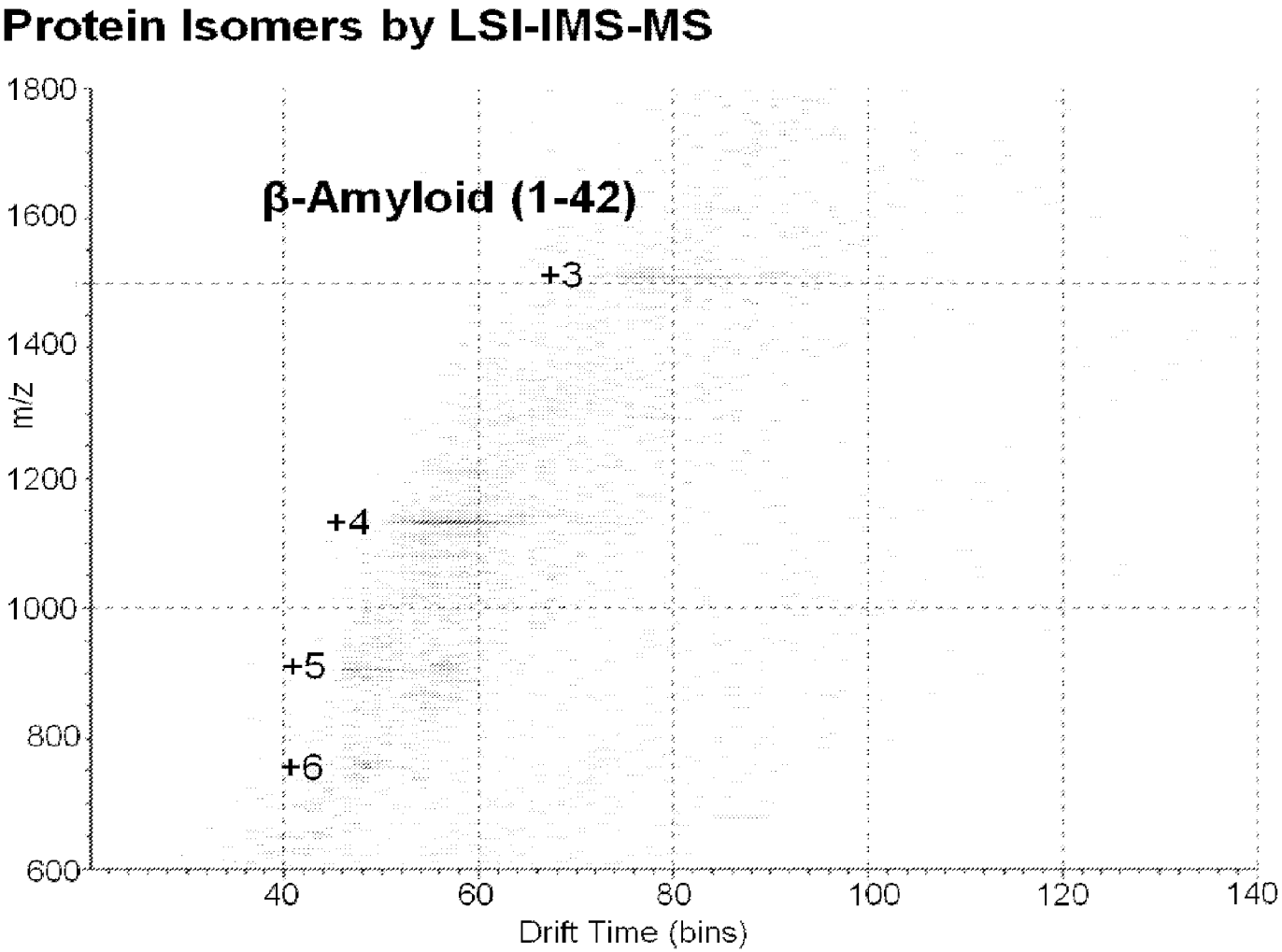
FIG. 117 depicts the two dimensional drift time vs. m/z of β-amyloid (1-42).

FIG. 117 depicts the two dimensional drift time vs. m/z of beta amyloid (1-42). The two dimensional drift time vs. m/z shows separation according to number of charges and cross-section. The analysis was conducted using 2,5-DHAP as the matrix and no heat was applied to the thermal device.

Figure 118:
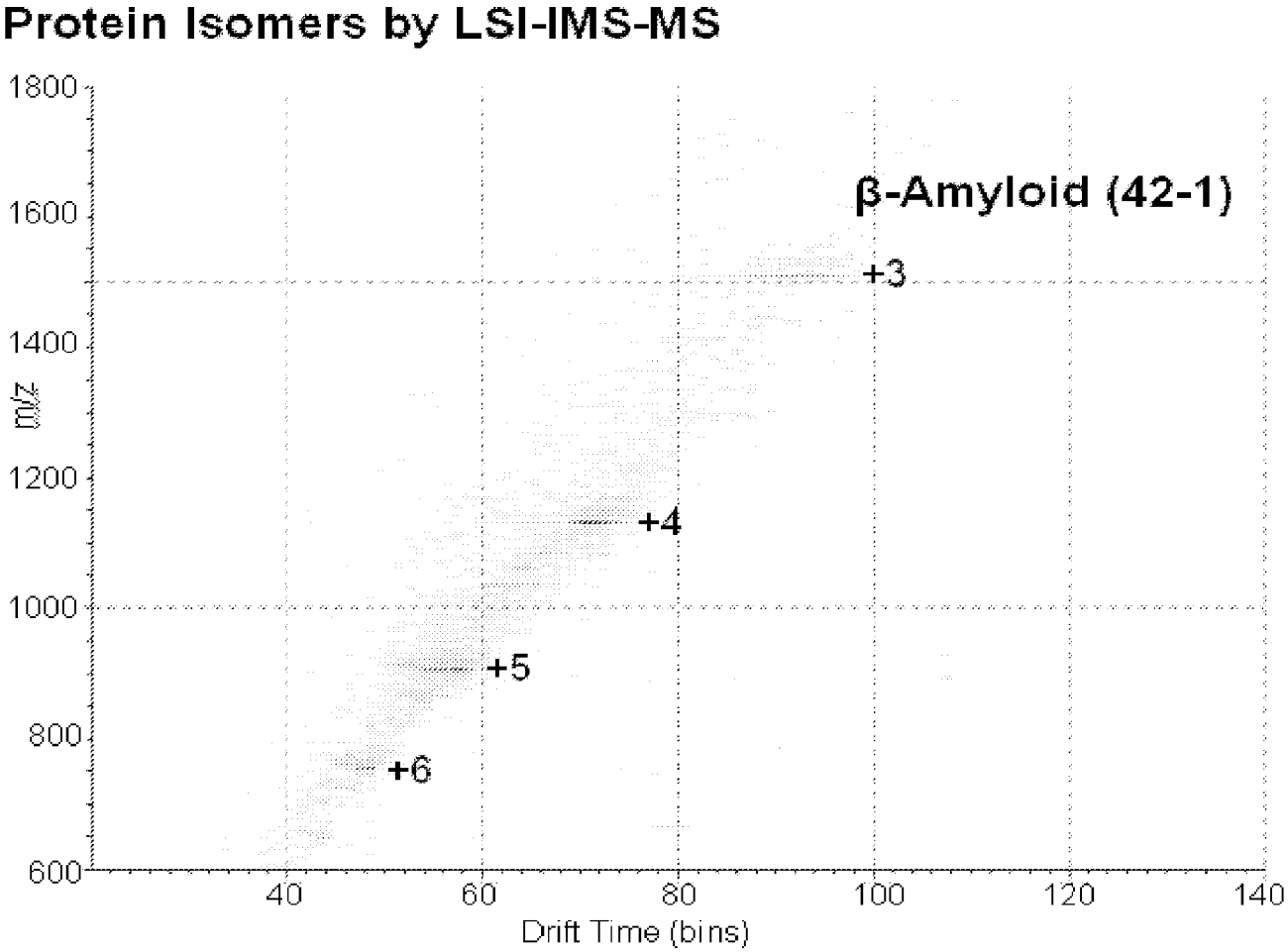
FIG. 118 depicts the two dimensional drift time vs. m/z of β-amyloid (42-1).

FIG. 118 depicts the two dimensional drift time vs. m/z of amyloid (42-1). The two dimensional drift time vs. m/z shows separation according to number of charges and cross-section. The analysis was conducted using 2,5-DHAP as the matrix and no heat was applied to the thermal device.

The methods disclosed herein show that desolvation of analyte/matrix clusters can be achieved by increasing the temperature (2,5-DBH at ~400° C.) and by lowering the thermal requirements of the matrix (2,5-DHB at ~300° C.). The methods disclosed herein also show that charge state families of isomeric protein mixtures are baseline separated in the IMS dimension.

Figure 119:
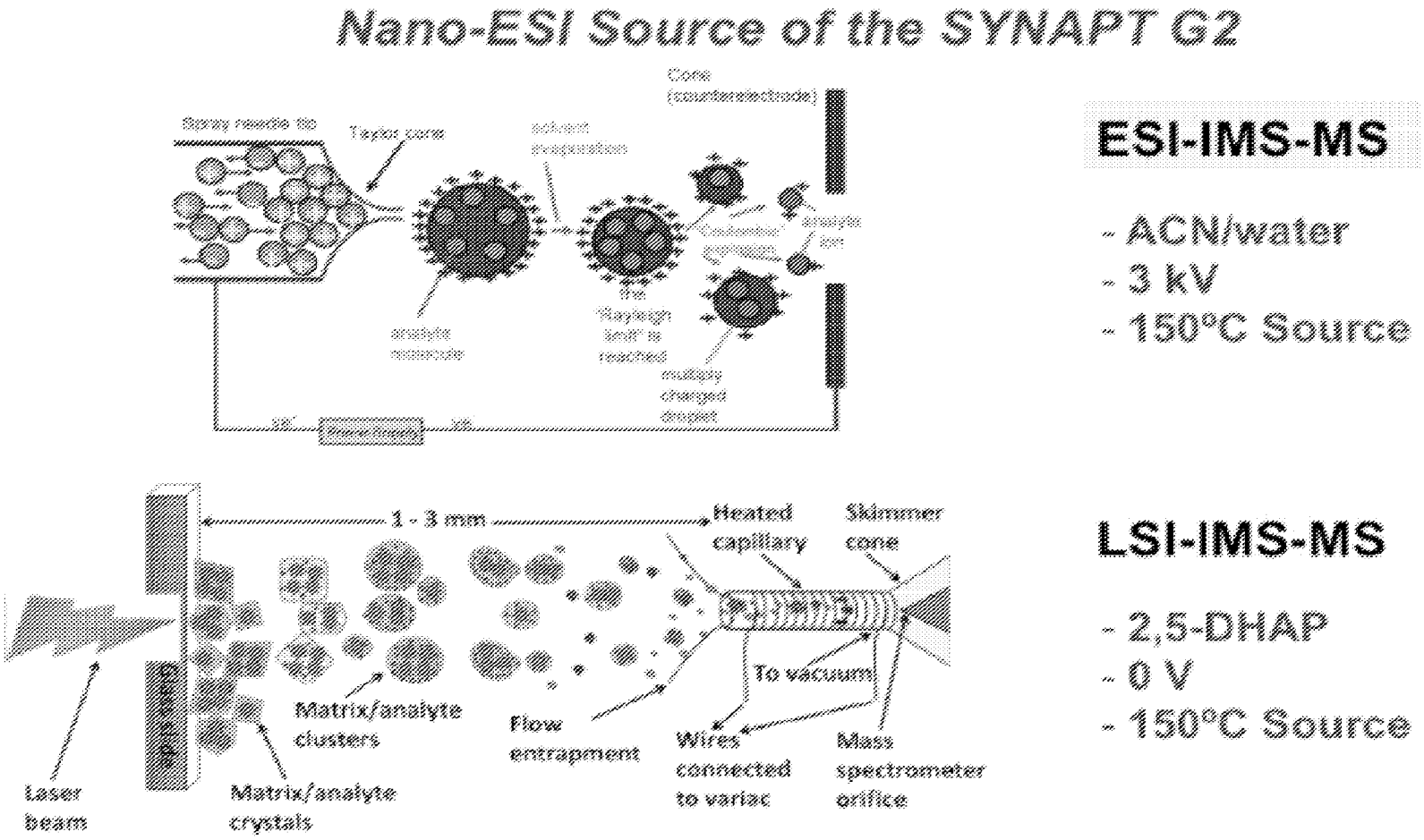
FIG. 119 depicts the conditions used for an ESI-IMS-MS comparison to LSI-IMS-MS using ubiquitin.
Figure 120:
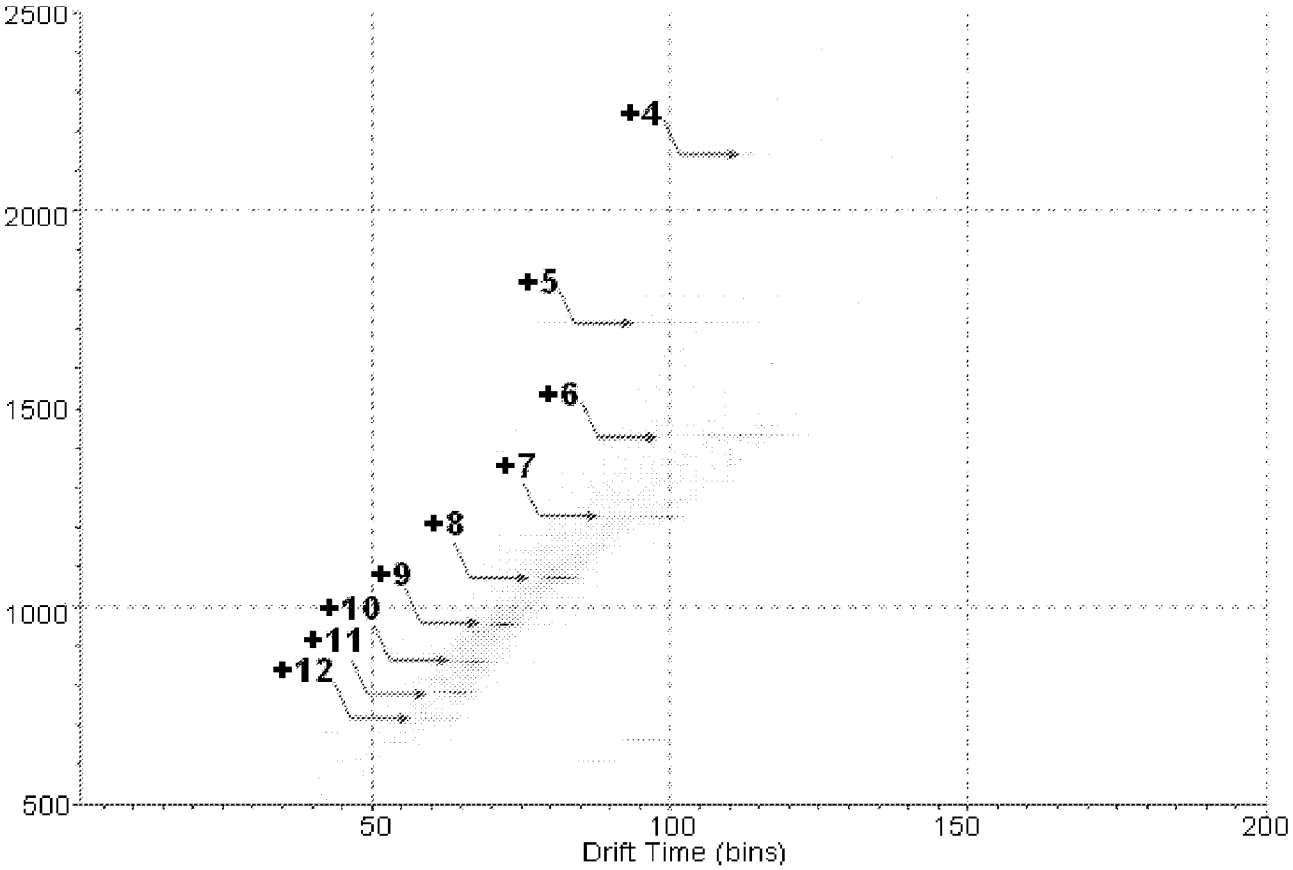
Figure 121:
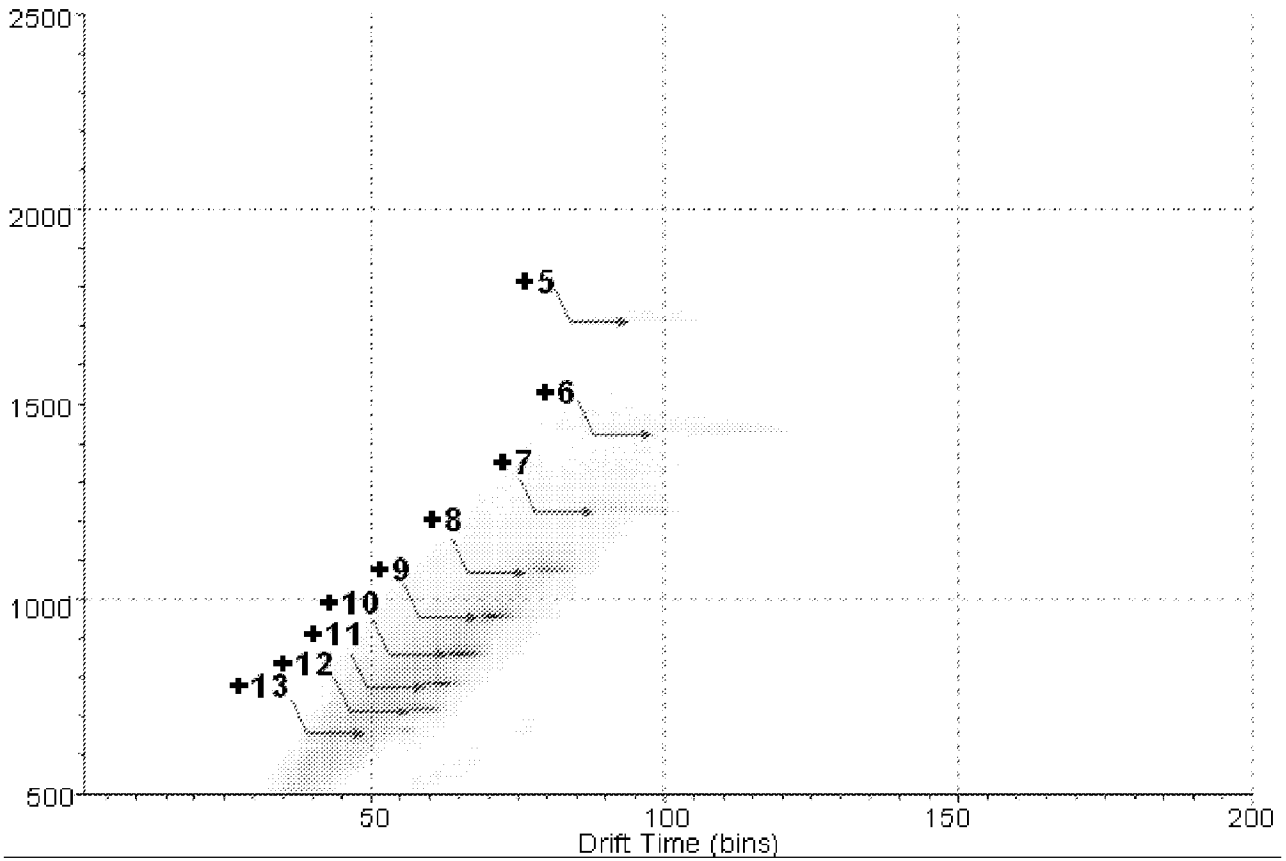
Figure 122:
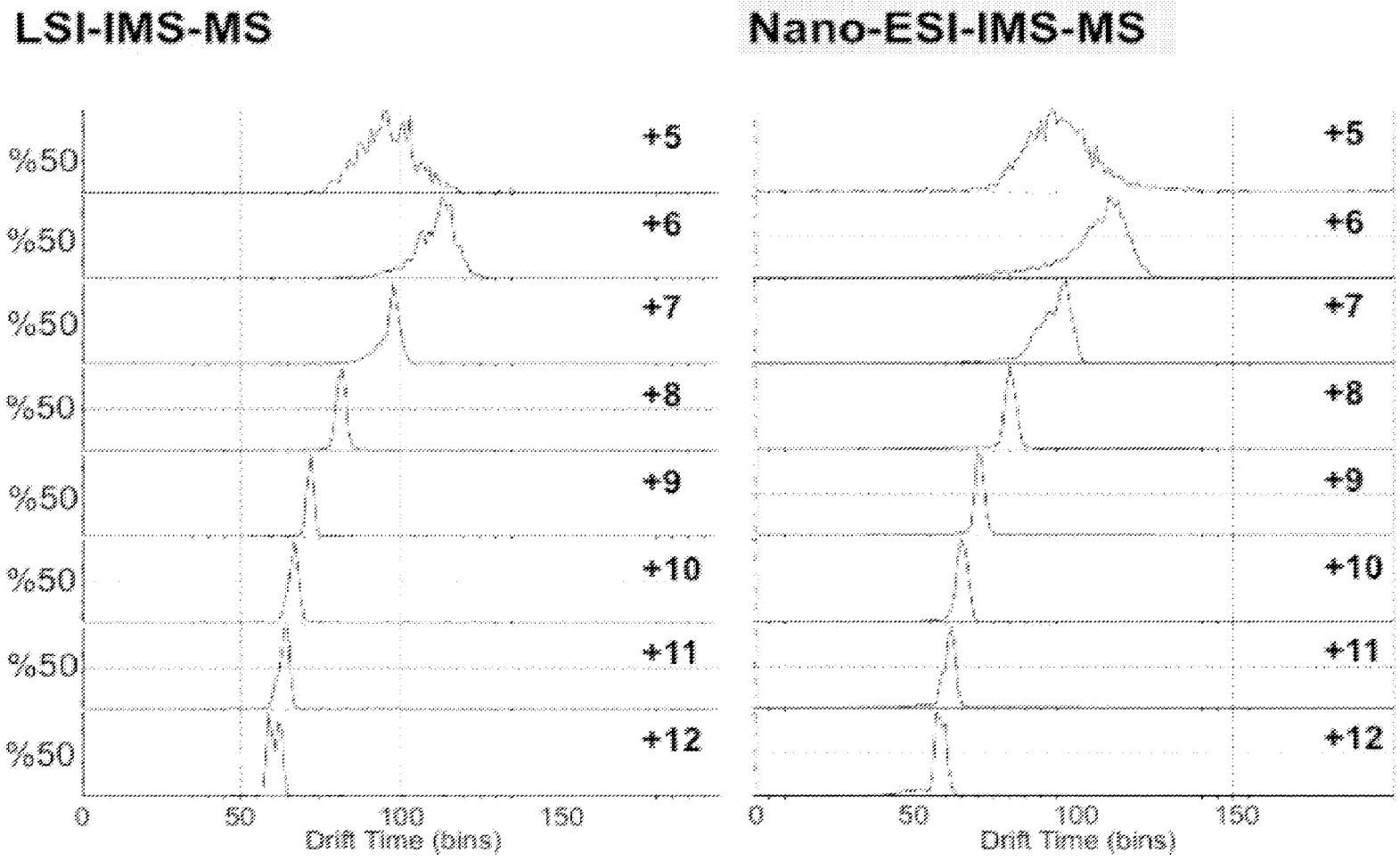

FIGS. 119-122 depict the structures of ubiquitin based on drift time results obtained by LSI in comparison to those obtained by ESI using the same nano-electrospray ionization source on the SYNAPT G2. FIG. 119 depicts the conditions used for an ESI-IMS-MS comparison to LSI-IMS-MS using ubiquitin. FIG. 120 depicts the results for LSI-IMS-MS of ubiquitin displayed in a 2-dimensional drift time vs. m/z plot. FIG. 121 depicts the results for ESI-IMS-MS of ubiquitin displayed in a 2-dimensional drift time vs. m/z plot. The charge states are very similar for LSI and ESI, the ion abundance is higher for the ESI ions. FIG. 122 depicts the extracted drift time distributions for all charges states of FIGS. 120 and 121. To the left are displayed the LSI ions and to the right the ESI ions. LSI and ESI ions show essentially identical drift times. Independent of the charge states, the LSI ions have narrower drift times than the respective ESI ions. Further, the LSI ion with charge state +12 shows a more resolved drift time distribution than the ESI ion +12. LSI therefore provides a soft ionization of large molecules and retains structural information.

Figure 123:
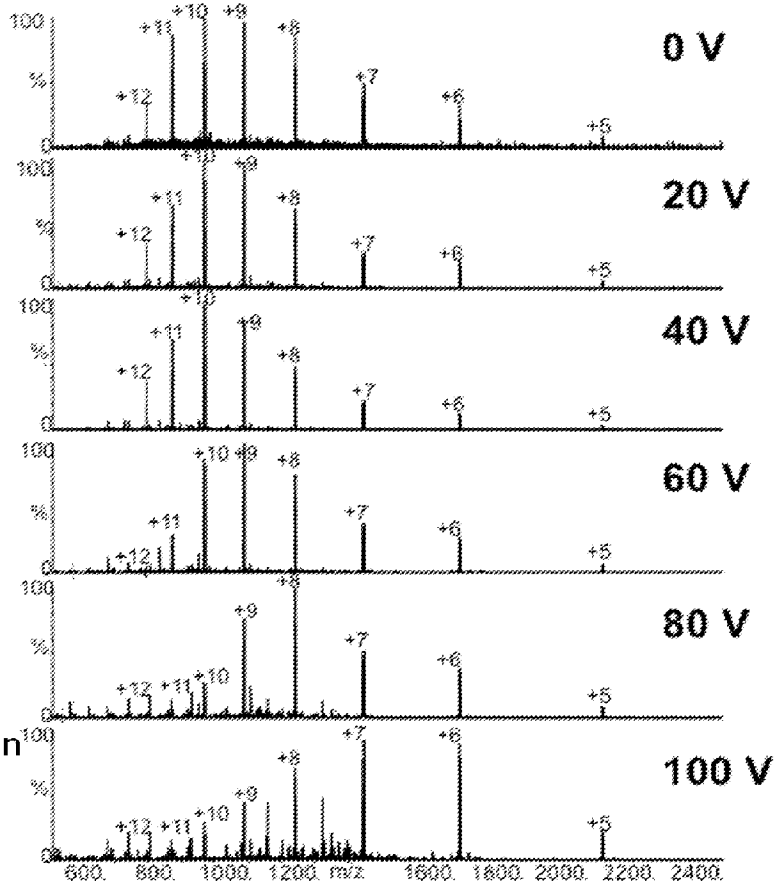
Figure 124:
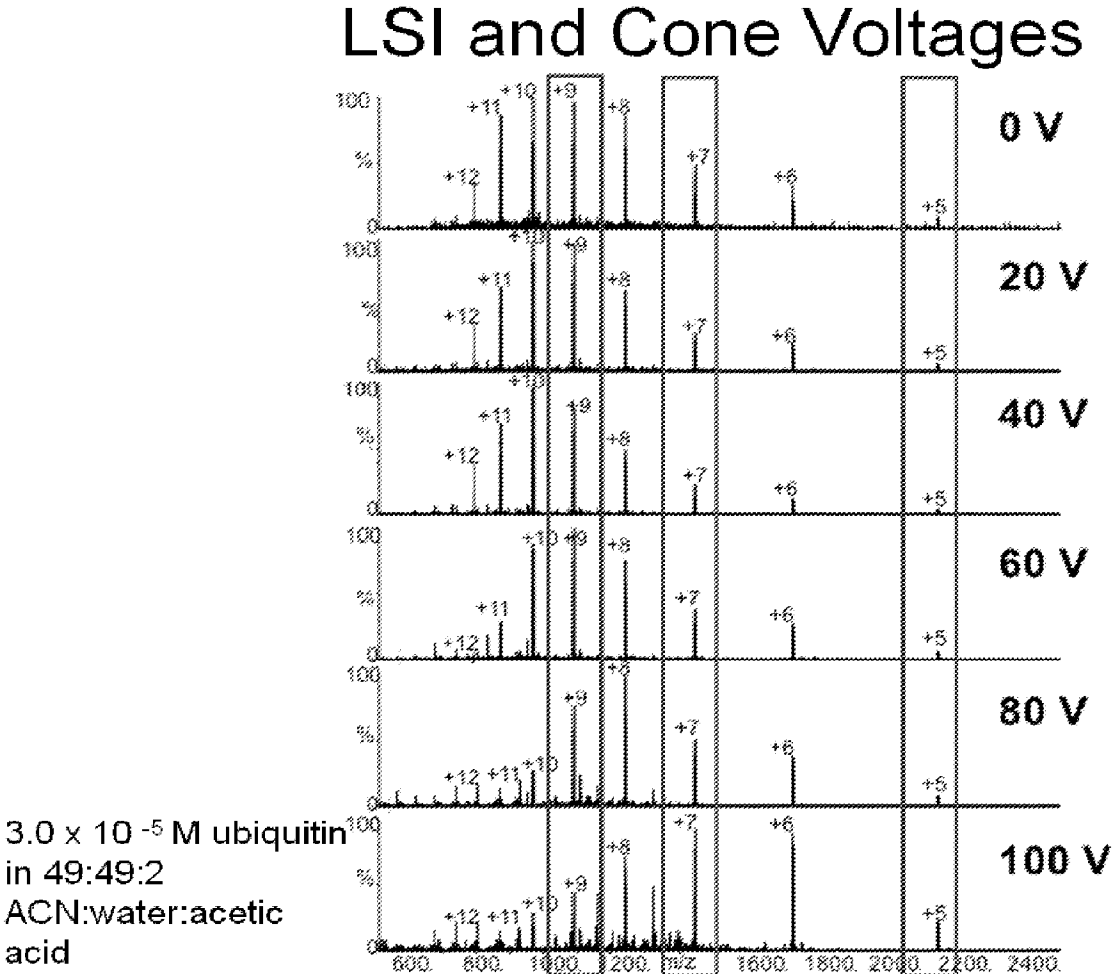
Figure 125:
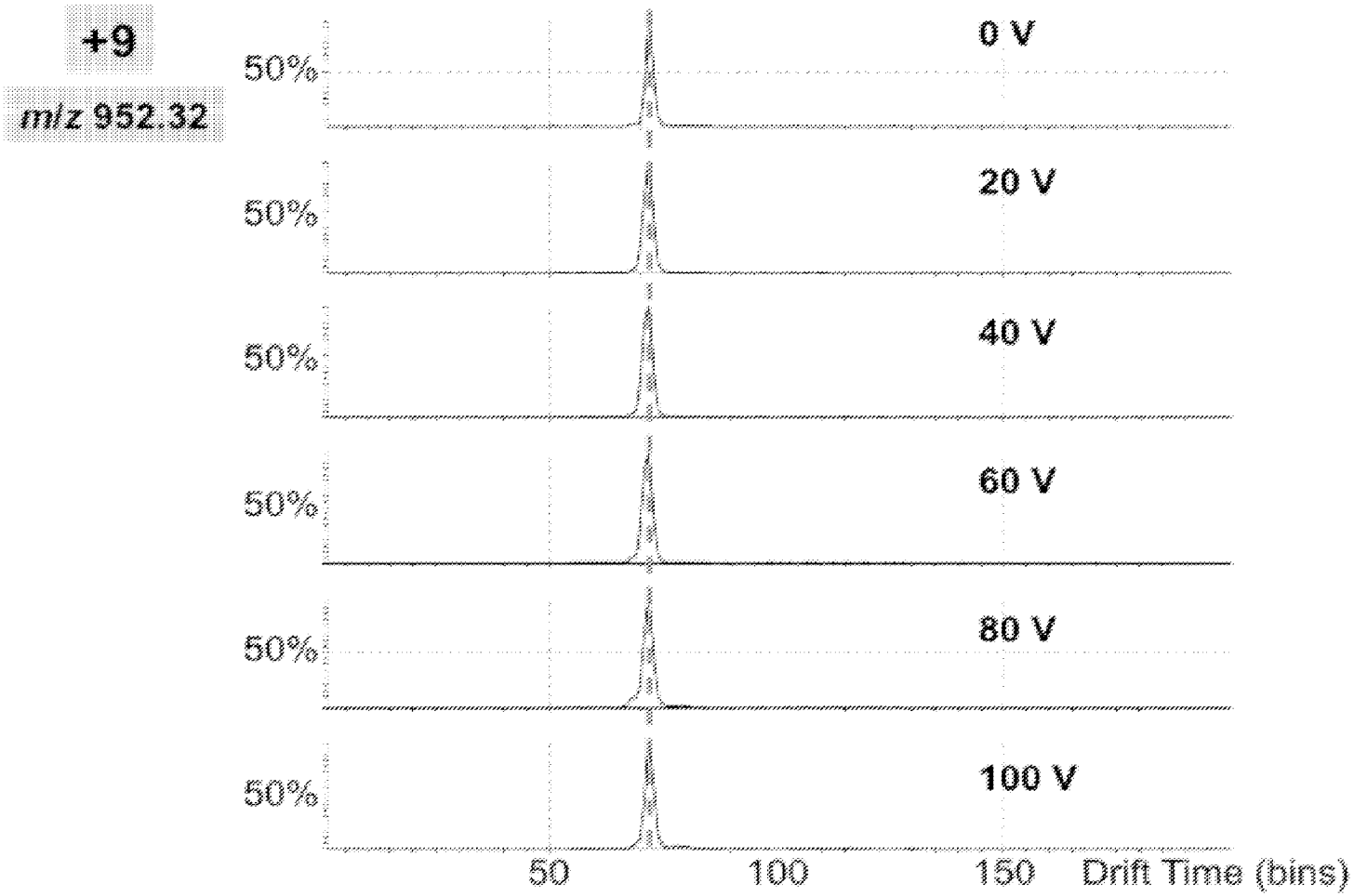
Figure 126:
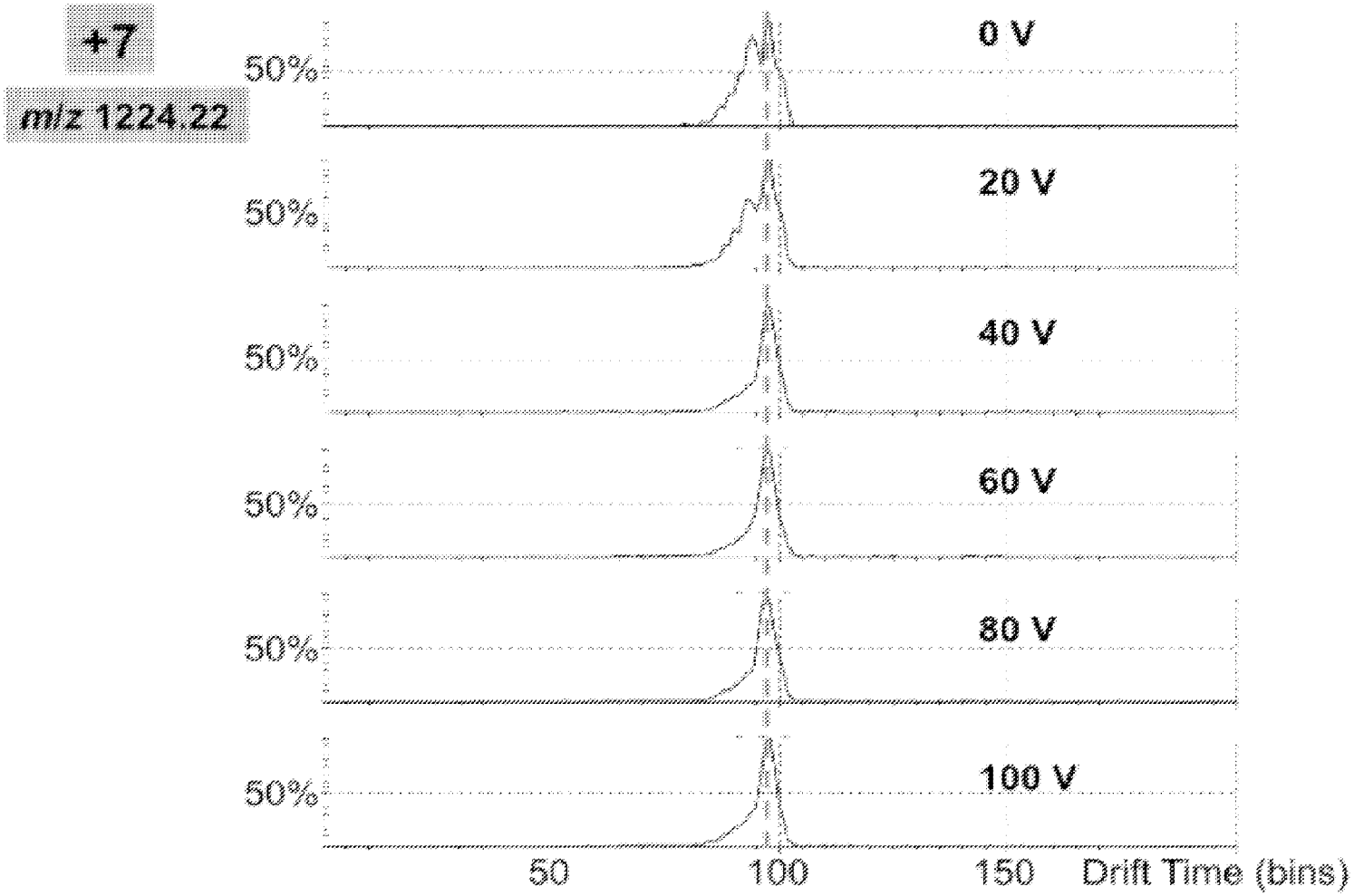
Figure 127:
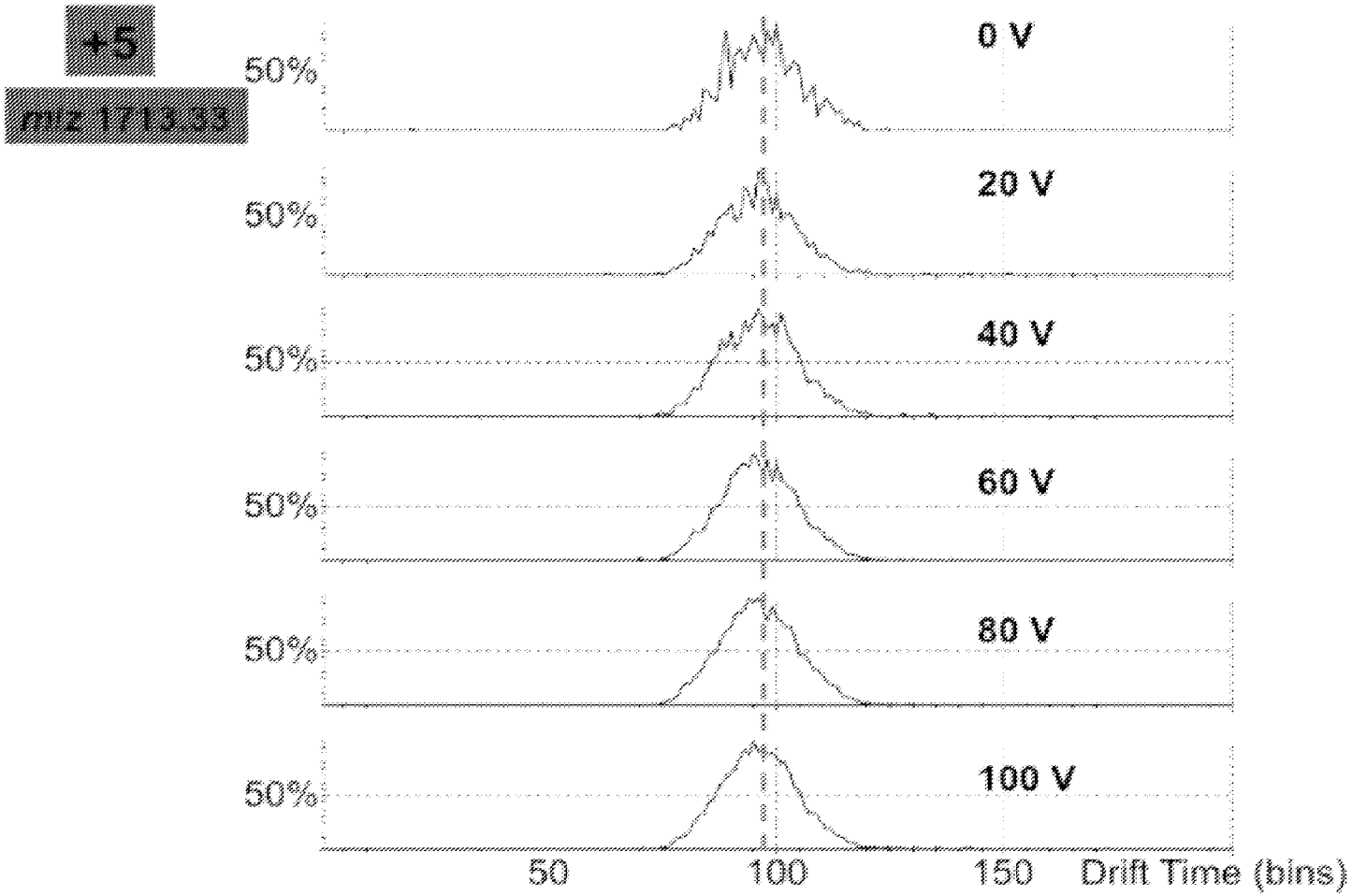

FIG. 123-127 depict the structures of ubiquitin based on drift time results obtained by LSI. FIG. 123 depicts the conditions used for the results displayed in FIGS. 124-127. The LSI conditions are identical to those in FIG. 199, however, the cone voltage was systematically changed from 0 V (traditional LSI conditions) to 100 V (typical ESI values). FIG. 124 depicts the MS obtained with increasing cone voltage showing an increase in ion abundance and lower charge states (charge stripping). Drift time distributions were extracted for charge states +9, +7, +5. FIG. 125 depicts the drift time for charge state +9 extracted from FIG. 124. The charge state +9 show narrow drift time distributions. At 100 V cone voltage, a longer drift time (roughly at 80 drift time bins) is also observed indicating that some protein ions lost their structure by opening up to a more elongated structure. FIG. 126 depicts the drift time for charge state +7 extracted from FIG. 124. The charge state +7 shows a number of drift times (roughly <95 bins) indicating a number of compact structures at 0 V at the cone. With increasing voltage these drift times disappear and only one abundant drift time is observed. FIG. 127 depicts the drift time for charge state +5 extracted from FIG. 124. The charge state +5 shows a broad drift time distribution. With increasing voltage the abundance of the distribution becomes more intense. These results show that at 0 V on the cone a number of structures that are lost with increasing voltage are applied. LSI is therefore a soft ionization method that keeps the structural integrity of the ubiquitin.

Figure 128:
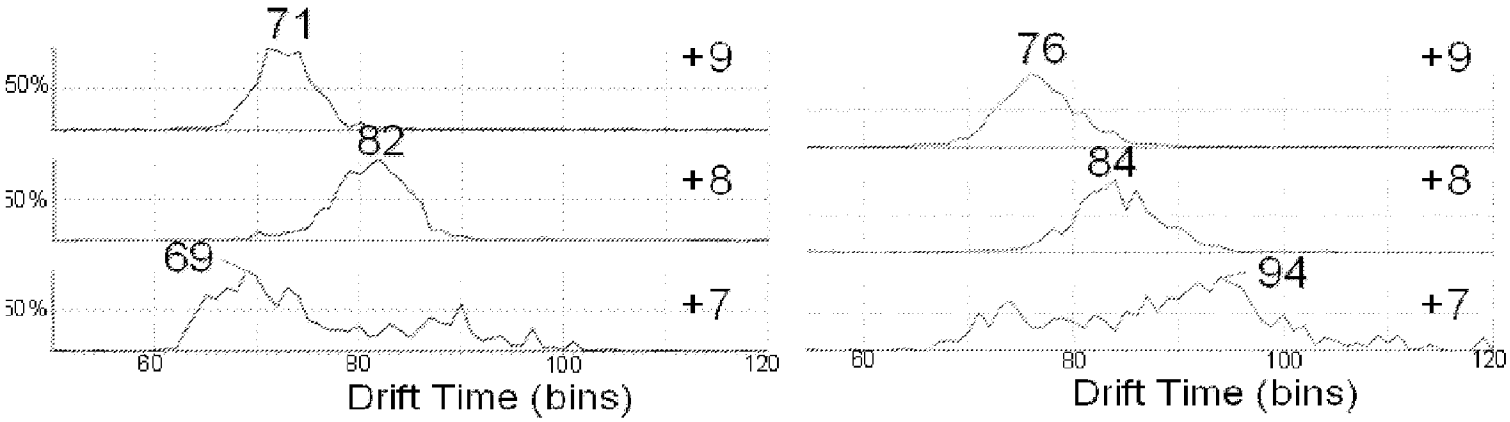

FIG. 128 depicts LSI-IMS-MS drift time distributions of protein complexes (right panel) compared to the protein (left panel). For all charge states longer drift times are observed, most notable is charge state +7. This observation is in line with a larger cross-section of the protein-ligand complex.

Methods disclosed herein show that using the same nano-ESI-IMS-MS instrument, both LSI and ESI show similar drift times for all charge states with the LSI showing fewer conformations. Methods disclosed herein also show for LSI and cone voltages that voltage increases the abundance of lower charge state ions (charge stripping), that voltage introduces background and that fewer conformations are observed with increasing voltage.

Figure 129:
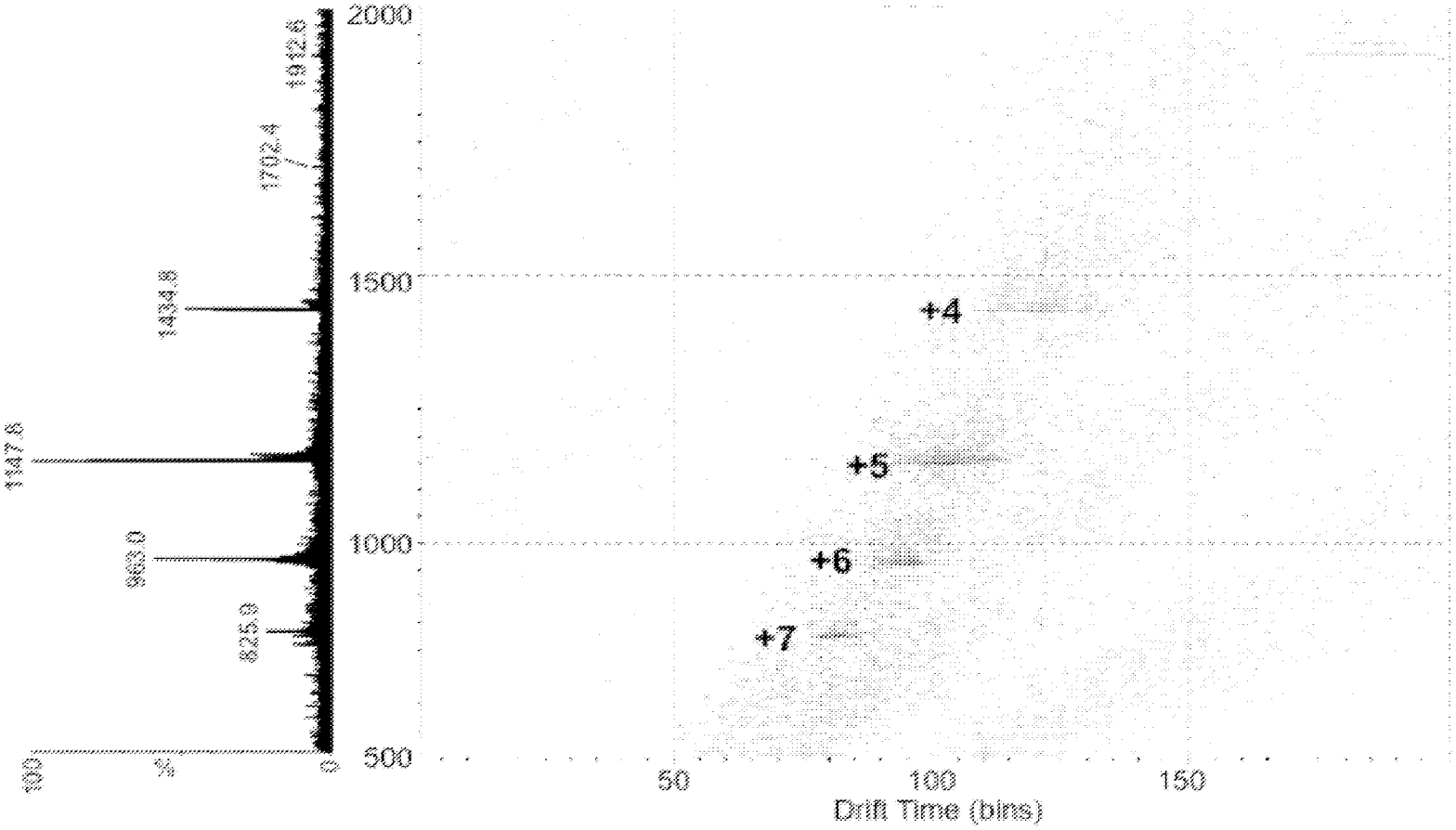

FIG. 129 depicts TSA of bovine insulin. The analysis was conducted using a TissueLyzer homogenization/transfer of the 2,5-DHAP matrix/bovine insulin and a desolvation device without the application of heat. Multiply charged ions are formed and separated in the gas-phase as is observed in the 2-dimensional drift time vs. m/z plot.

Figure 130:
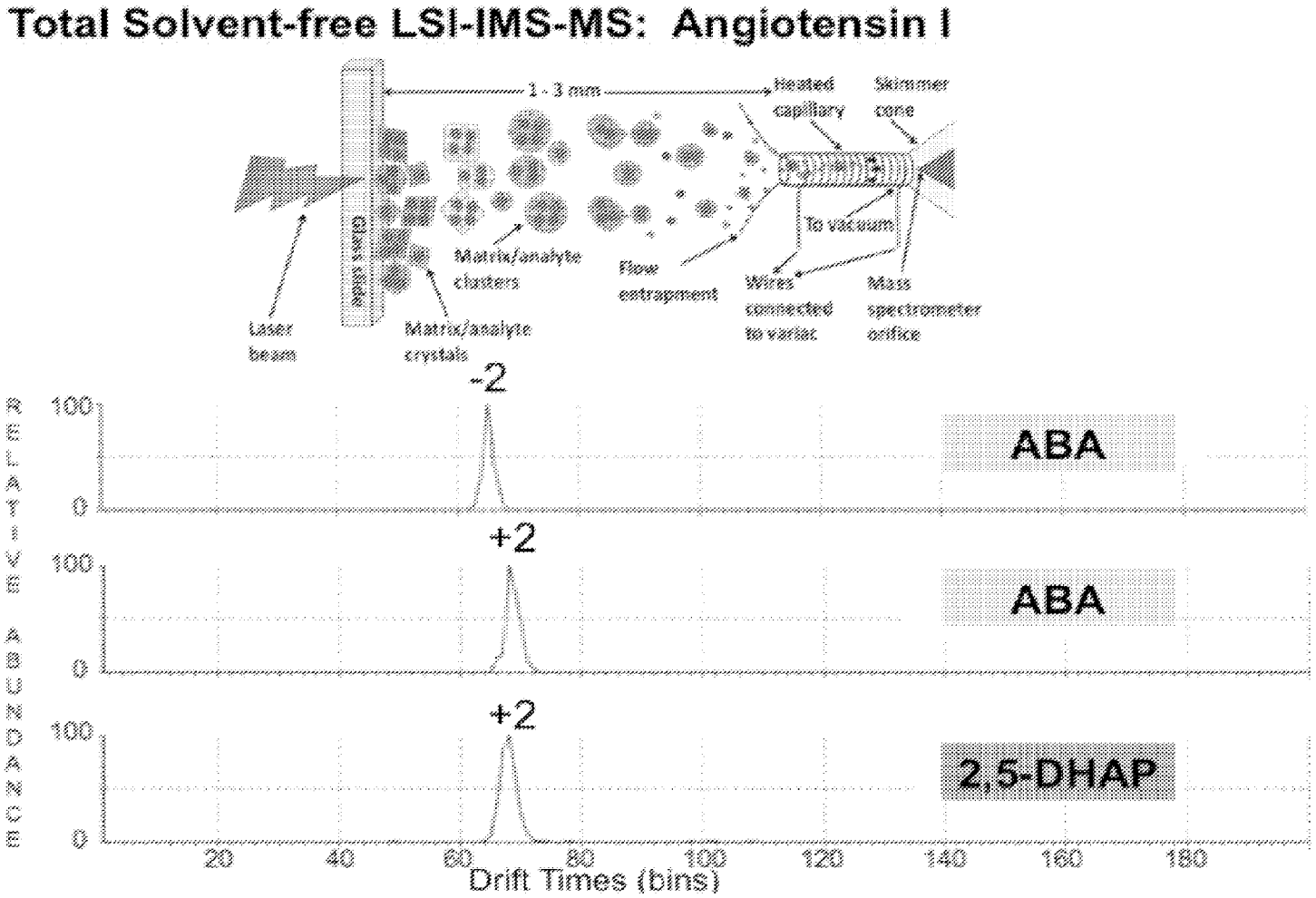

FIG. 130 depicts TSA of Angiotensin 1. The analysis was conducted using a TissueLyzer homogenization/transfer of different matrixes/Angiotensin 1 desolvation and a desolvation device without the application of heat. Multiply charged ions are formed and separated in the gas-phase as is shown in the extracted drift time distribution. The top displayed drift time shows 2-Amino benzyl alcohol measured in the negative ion mode, the middle displayed drift time shows 2-Amino benzyl alcohol measured in the positive ion mode and the bottom displayed drift time shows 2,5-DHAP measured in the positive ion mode. The results show that a variety of different matrixes can be employed for TSA in both the negative and positive ion mode. The negative ions of the same charge state (doubly) have a faster drift time than those ions that are protonated. The positive doubly charged ions produced by two different matrixes have essentially identical drift times indicating that the matrix has little influence on the drift time (thus structure) of the ions. Note, solvent-based sample preparation of ABA did not permit the production of the negative, doubly charged ion; when using a Nd/YAG laser (355 nm) negative, doubly charged ions were observed.

Figure 131:
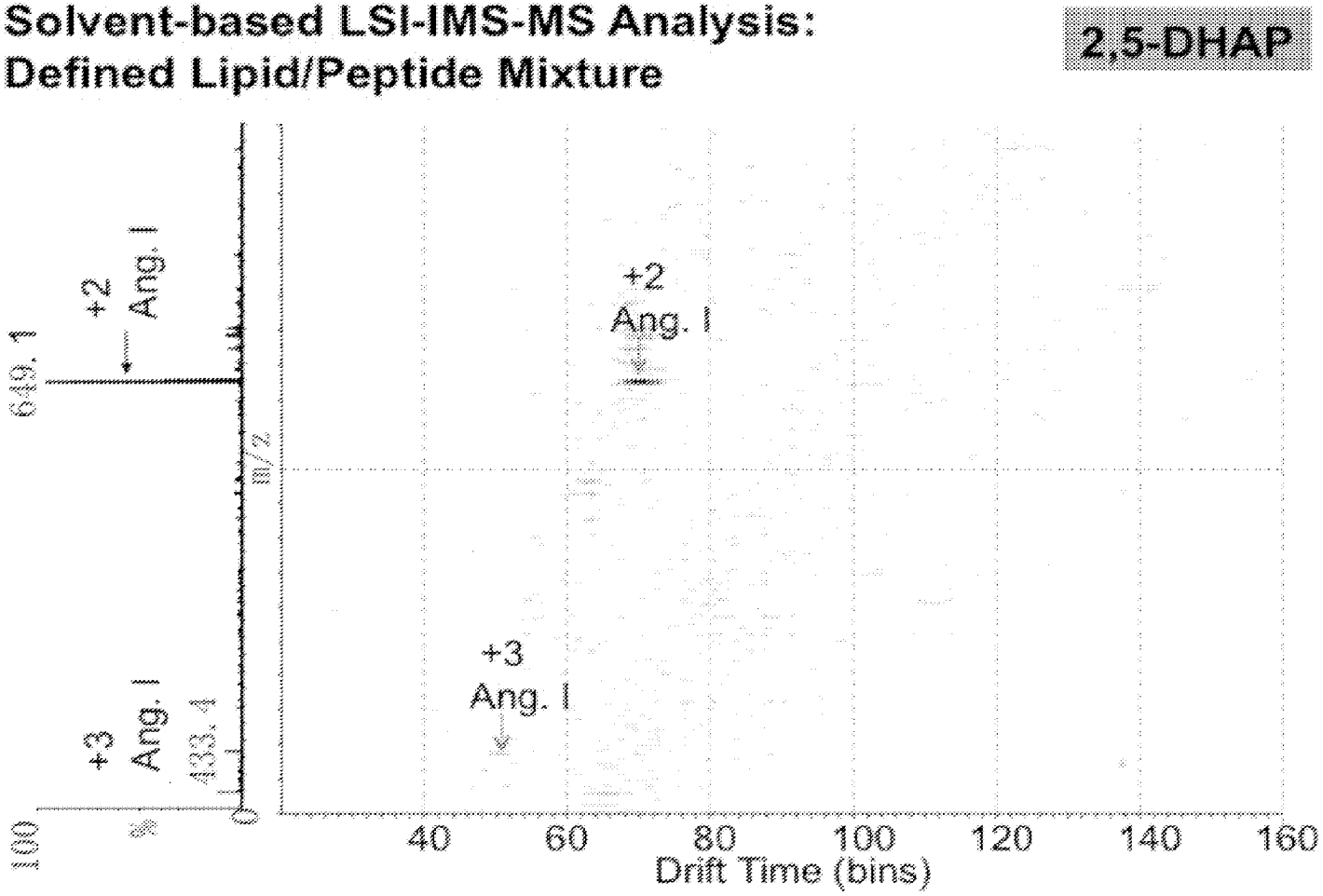

FIGS. 131-132 show the analysis of a defined mixture of lipid (sphingomyelin, SM) and a peptide (Angiotensin 1, Ang. I) in a molar ratio of 1:1. FIG. 131 depicts solvent-based analysis of a defined mixture of lipid (sphingomyelin, SM) and a peptide (Angiotensin 1, Ang. I) in a molar ratio of 1:1.

FIG. 132 depicts TSA analysis of a defined mixture of lipid (sphingomyelin, SM) and a peptide (Angiotensin 1, Ang. I) in a molar ratio of 1:1. FIG. 131 only observes the peptide whereas FIG. 132 observes both components of the mixture, SM and Ang. I. These results show qualitative and relative quantitative improvements in analysis. The analysis was conducted using a TissueLyzer homogenization/transfer of the 2,5-DHAP matrix/analyte mixture a desolvation device without the application of heat. Multiply charged ions are formed and separated in the gas-phase as is observed in the 2-dimensional drift time vs. m/z plot.

Unless otherwise indicated, all numbers expressing quantities of ingredients, properties such as molecular weight, reaction conditions, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

The terms "a," "an," "the" and similar referents used in the context of describing the invention (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments of this invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the invention to be practiced otherwise than specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

Specific embodiments disclosed herein may be further limited in the claims using consisting of or and consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of the invention so claimed are inherently or expressly described and enabled herein.

In closing, it is to be understood that the embodiments of the invention disclosed herein are illustrative of the principles of the present invention. Other modifications that may be employed are within the scope of the invention. Thus, by way of example, but not of limitation, alternative configurations of the present invention may be utilized in accordance with the teachings herein. Accordingly, the present invention is not limited to that precisely as shown and described.

What is claimed is:

1. A method for producing predominantly multiply-charged ions for analysis of a material consisting of, applying the material and a matrix to a surface as a material/matrix analyte;

ablating the material/matrix analyte at or near atmospheric pressure with a laser; and passing the laser-ablated material/matrix analyte through a heated region before the material/matrix analyte enters the high vacuum area of a mass spectrometer thereby producing predominantly multiply-charged ions.

2. The method of claim 1, wherein the matrix is composed of small molecules that absorb energy at the laser's wavelength.

3. The method of claim 2, wherein the small molecules are selected from the group consisting of a dihydroxybenzoic acid, 2,5-dihydroxybenzoic acid (2,5-DHB); a dihydroxyacetophenones, 2,5-dihydroxyacetophenone (2,5-DHAP), 2,6-dihydroxyacetophenone (2,6-DHAP), 2-aminobenzyl alcohol (2-ABA) and combinations thereof.

4. The method of claim 1, wherein the laser has an output in the ultraviolet region.

5. The method of claim 1, wherein the laser is a nitrogen laser (337 nm) or a frequency tripled Nd/YAG laser (355 nm).

6. The method of claim 1, wherein the heated region is a heated tube.

7. The method of claim 6, wherein the tube is constructed of heat-tolerant material that does not emit vapors detrimental to the mass spectrometer vacuum system.

8. The method of claim 7, wherein the tube is constructed of metal or quartz.

9. The method of claim 6, wherein the tube is heated to a temperature between 50-600° C.

10. The method of claim 6, wherein the tube is heated to a temperature between 150-450° C.

11. The method of claim 1, wherein an electric field in an ion source region defined by the point of laser ablation of the material/matrix analyte and the ion entrance to the vacuum of the mass spectrometer is less than 800 V.

12. The method of claim 11, wherein the electric field in the ion source region is less than 100 V.

13. The method of claim 11, wherein the electric field in the ion source region is 0 V.

14. The method of claim 1, wherein the material is a biological material or a non-biological material.

15. The method of claim 14 wherein the material is a biological material selected from the group consisting of a protein, a peptide, a carbohydrate, and a lipid.

16. The method of claim 14 wherein the material is a non-biological material selected from the group consisting of a polymer and an oil.

17. A system for carrying out the methods of claim 1.

18. The method of claim 1 wherein the laser is aligned in transmission geometry or reflection geometry.

19. The method of claim 1 wherein no electric field is required to produce the predominantly multiply-charged ions.

20. A method for producing predominantly multiply-charged ions for analysis of a material comprising, applying the material and a matrix to a surface as a material/matrix analyte;

ablating the material/matrix analyte at or near atmospheric pressure with a laser; and passing the laser-ablated material/matrix analyte through a heated region before the material/matrix analyte enters the high vacuum area of a mass spectrometer thereby producing predominantly multiply-charged ions wherein no electric field is required to produce the predominantly multiply-charged ions.

21. The method of claim 20 further comprising analyzing the material/matrix analyte using solvent-free material/matrix analyte preparation methods.

22. The method of claim 21 wherein the analyzing includes surface imaging and/or MS/MS fragmentation for structural characterization.

23. The method of claim 20 further comprising separating and analyzing the predominantly multiply-charged ions using ion mobility spectrometry.

24. The method of claim 20 further comprising fragmenting and characterizing the predominantly multiply-charged ions using MS/MS fragmentation selected from collision induced dissociation fragmentation, charge remote fragmentation, electron transfer dissociation fragmentation or electron capture dissociation fragmentation.

25. The method of claim 22 wherein the laser is aligned in transmission geometry or reflection geometry.

26. The method of claim 23 wherein the separating and analyzing includes surface imaging.

27. The method of claim 20 wherein no electric field is used to produce the predominantly multiply-charged ions.

28. The method of claim 20 wherein the electric field in an ion source region defined by the point of laser ablation of the material/matrix analyte and the ion entrance to the vacuum of the mass spectrometer is 0 V.

* * * * *